US007717141B1

(12) United States Patent
Quigley

(10) Patent No.: US 7,717,141 B1
(45) Date of Patent: May 18, 2010

(54) FORMING FABRIC WITH DUAL COMBINATION BINDER WEFT YARNS

(75) Inventor: Scott D. Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 12/367,309

(22) Filed: Feb. 6, 2009

(51) Int. Cl.
*D21F 1/10* (2006.01)
*D21F 7/08* (2006.01)
*D03D 3/04* (2006.01)
*D03D 25/00* (2006.01)

(52) U.S. Cl. ..... 139/383 A; 139/383 R; 162/358.2

(58) Field of Classification Search ..... 139/383 R, 139/383 A, 383 AA, 408, 411, 412, 413, 139/414; 162/348, 358.1, 358.2, 900, 902, 162/903, 904
See application file for complete search history.

(56) References Cited

U.S. PATENT DOCUMENTS 4,041,989 A * 8/1977 Johansson et al. ..... 139/425 A
5,114,777 A * 5/1992 Gaisser ..... 428/137
5,555,917 A * 9/1996 Quigley ..... 139/383 A
5,709,250 A 1/1998 Ward et al.
5,826,627 A * 10/1998 Seabrook et al. ..... 139/383 A
5,899,240 A 5/1999 Wilson
6,227,256 B1 * 5/2001 Quigley ..... 139/383 A
6,334,467 B1 * 1/2002 Barrett et al. ..... 139/383 A
6,810,917 B2 * 11/2004 Stone ..... 139/383 A
6,854,488 B2 * 2/2005 Hay et al. ..... 139/383 A
6,904,942 B2 * 6/2005 Odenthal ..... 139/383 A
6,978,809 B2 * 12/2005 Quigley ..... 139/383 A
7,007,722 B2 * 3/2006 Quigley et al. ..... 139/383 A
7,059,361 B1 * 6/2006 Hansson ..... 139/383 A
7,415,993 B2 * 8/2008 Hay et al. ..... 139/383 A
7,445,032 B2 * 11/2008 Barrett et al. ..... 139/383 A
7,464,731 B2 * 12/2008 Fujisawa ..... 139/383 A
7,506,670 B2 * 3/2009 Hay ..... 139/383 A
7,571,746 B2 * 8/2009 Hay et al. ..... 139/383 A
7,604,025 B2 * 10/2009 Quigley ..... 139/383 A (Continued)

*Primary Examiner*—Bobby H Muromoto, Jr.
(74) *Attorney, Agent, or Firm*—Quarles & Brady LLP

(57) ABSTRACT

A forming fabric for a papermaking machine that includes a machine-side layer and a paper-side layer. The machine-side layer includes bottom warp yarns and bottom weft yarns that weave with at least some of the bottom warp yarns. The paper-side layer includes top warp yarns and top weft yarns that weave with at least some of the top warp yarns to create a weave pattern in a repeating pattern area, and at least one of the top weft yarns includes a paper-side float in the repeating pattern area that passes over a number of consecutive top warp yarns. The forming fabric further includes a set of dual combination binder weft yarns disposed adjacent a top weft yarn. At least one dual combination binder weft yarn of the set weaves with some of the bottom warp yarns and some of the top warp yarns. Each dual combination binder weft yarn of the set includes at least one segment in the repeating pattern area that passes over at least one top warp yarn. The at least one segment is disposed adjacent to a segment of another dual combination binder weft yarn of the set. The at least one segment and the adjacent segment combine to form a long weft float that passes over the number of consecutive top warp yarns passed over by the paper-side float to match the weave pattern of the top weft yarns. The long weft float occurs at least once in each repeat of the dual combination binder weft yarns.

20 Claims, 150 Drawing Sheets

U.S. PATENT DOCUMENTS

2005/0103397 A1* 5/2005 Quigley et al. ..... 139/383 A
2006/0048840 A1* 3/2006 Quigley ..... 139/408
2006/0219312 A1* 10/2006 Hay et al. ..... 139/383 A
2008/0105323 A1* 5/2008 Hay et al. ..... 139/383 A
2008/0149213 A1* 6/2008 Quigley ..... 139/408
2008/0149214 A1* 6/2008 Quigley ..... 139/410

* cited by examiner

WEFT 41
24 22 20 18 16 14 12 10 8 6 4 2
23 21 19 17 15 13 11 9 7 5 3 1

WEFT 42
24 22 20 18 16 14 12 10 8 6 4 2
23 21 19 17 15 13 11 9 7 5 3 1

WEFT 43
24 22 20 18 16 14 12 10 8 6 4 2
23 21 19 17 15 13 11 9 7 5 3 1

WEFT 44
24 22 20 18 16 14 12 10 8 6 4 2
23 21 19 17 15 13 11 9 7 5 3 1

WEFT 45
24 22 20 18 16 14 12 10 8 6 4 2
23 21 19 17 15 13 11 9 7 5 3 1

WEFT 46
24 22 20 18 16 14 12 10 8 6 4 2
23 21 19 17 15 13 11 9 7 5 3 1

WEFT 47
24 22 20 18 16 14 12 10 8 6 4 2
23 21 19 17 15 13 11 9 7 5 3 1

WEFT 48
24 22 20 18 16 14 12 10 8 6 4 2
23 21 19 17 15 13 11 9 7 5 3 1

WEFT 49
24 22 20 18 16 14 12 10 8 6 4 2
23 21 19 17 15 13 11 9 7 5 3 1

WEFT 50
24 22 20 18 16 14 12 10 8 6 4 2
23 21 19 17 15 13 11 9 7 5 3 1

WEFT 51
24 22 20 18 16 14 12 10 8 6 4 2
23 21 19 17 15 13 11 9 7 5 3 1

WEFT 52
24 22 20 18 16 14 12 10 8 6 4 2
23 21 19 17 15 13 11 9 7 5 3 1

WEFT 53
24 22 20 18 16 14 12 10 8 6 4 2
23 21 19 17 15 13 11 9 7 5 3 1

WEFT 54
24 22 20 18 16 14 12 10 8 6 4 2
23 21 19 17 15 13 11 9 7 5 3 1

WEFT 55
24 22 20 18 16 14 12 10 8 6 4 2
23 21 19 17 15 13 11 9 7 5 3 1

WEFT 56
24 22 20 18 16 14 12 10 8 6 4 2
23 21 19 17 15 13 11 9 7 5 3 1

WEFT 57
24 22 20 18 16 14 12 10 8 6 4 2
23 21 19 17 15 13 11 9 7 5 3 1

WEFT 58
24 22 20 18 16 14 12 10 8 6 4 2
23 21 19 17 15 13 11 9 7 5 3 1

WEFT 59
24 22 20 18 16 14 12 10 8 6 4 2
23 21 19 17 15 13 11 9 7 5 3 1

WEFT 60
24 22 20 18 16 14 12 10 8 6 4 2
23 21 19 17 15 13 11 9 7 5 3 1

FIG. 78

WEFT 61
24 22 20 18 16 14 12 10 8 6 4 2
23 21 19 17 15 13 11 9 7 5 3 1

WEFT 62
24 22 20 18 16 14 12 10 8 6 4 2
23 21 19 17 15 13 11 9 7 5 3 1

WEFT 63
24 22 20 18 16 14 12 10 8 6 4 2
23 21 19 17 15 13 11 9 7 5 3 1

WEFT 64
24 22 20 18 16 14 12 10 8 6 4 2
23 21 19 17 15 13 11 9 7 5 3 1

WEFT 65
24 22 20 18 16 14 12 10 8 6 4 2
23 21 19 17 15 13 11 9 7 5 3 1

WEFT 66
24 22 20 18 16 14 12 10 8 6 4 2
23 21 19 17 15 13 11 9 7 5 3 1

WEFT 67
24 22 20 18 16 14 12 10 8 6 4 2
23 21 19 17 15 13 11 9 7 5 3 1

WEFT 68
24 22 20 18 16 14 12 10 8 6 4 2
23 21 19 17 15 13 11 9 7 5 3 1

WEFT 69
24 22 20 18 16 14 12 10 8 6 4 2
23 21 19 17 15 13 11 9 7 5 3 1

WEFT 70
24 22 20 18 16 14 12 10 8 6 4 2
23 21 19 17 15 13 11 9 7 5 3 1

WEFT 71
24 22 20 18 16 14 12 10 8 6 4 2
23 21 19 17 15 13 11 9 7 5 3 1

WEFT 72
24 22 20 18 16 14 12 10 8 6 4 2
23 21 19 17 15 13 11 9 7 5 3 1

WEFT 73
24 22 20 18 16 14 12 10 8 6 4 2
23 21 19 17 15 13 11 9 7 5 3 1

WEFT 74
24 22 20 18 16 14 12 10 8 6 4 2
23 21 19 17 15 13 11 9 7 5 3 1

WEFT 75
24 22 20 18 16 14 12 10 8 6 4 2
23 21 19 17 15 13 11 9 7 5 3 1

WEFT 76
24 22 20 18 16 14 12 10 8 6 4 2
23 21 19 17 15 13 11 9 7 5 3 1

WEFT 77
24 22 20 18 16 14 12 10 8 6 4 2
23 21 19 17 15 13 11 9 7 5 3 1

WEFT 78
24 22 20 18 16 14 12 10 8 6 4 2
23 21 19 17 15 13 11 9 7 5 3 1

WEFT 79
24 22 20 18 16 14 12 10 8 6 4 2
23 21 19 17 15 13 11 9 7 5 3 1

WEFT 80
24 22 20 18 16 14 12 10 8 6 4 2
23 21 19 17 15 13 11 9 7 5 3 1

FIG. 79

WEFT 1
24 21 20 17 16 13 12 9 8 5 4 1
23 22 19 18 15 14 11 10 7 6 3 2

WEFT 2
24 21 20 17 16 13 12 9 8 5 4 1
23 22 19 18 15 14 11 10 7 6 3 2

WEFT 3
24 21 20 17 16 13 12 9 8 5 4 1
23 22 19 18 15 14 11 10 7 6 3 2

WEFT 4
24 21 20 17 16 13 12 9 8 5 4 1
23 22 19 18 15 14 11 10 7 6 3 2

WEFT 5
24 21 20 17 16 13 12 9 8 5 4 1
23 22 19 18 15 14 11 10 7 6 3 2

WEFT 6
24 21 20 17 16 13 12 9 8 5 4 1
23 22 19 18 15 14 11 10 7 6 3 2

WEFT 7
24 21 20 17 16 13 12 9 8 5 4 1
23 22 19 18 15 14 11 10 7 6 3 2

WEFT 8
24 21 20 17 16 13 12 9 8 5 4 1
23 22 19 18 15 14 11 10 7 6 3 2

WEFT 9
24 21 20 17 16 13 12 9 8 5 4 1
23 22 19 18 15 14 11 10 7 6 3 2

WEFT 10
24 21 20 17 16 13 12 9 8 5 4 1
23 22 19 18 15 14 11 10 7 6 3 2

WEFT 11
24 21 20 17 16 13 12 9 8 5 4 1
23 22 19 18 15 14 11 10 7 6 3 2

WEFT 12
24 21 20 17 16 13 12 9 8 5 4 1
23 22 19 18 15 14 11 10 7 6 3 2

WEFT 13
24 21 20 17 16 13 12 9 8 5 4 1
23 22 19 18 15 14 11 10 7 6 3 2

WEFT 14
24 21 20 17 16 13 12 9 8 5 4 1
23 22 19 18 15 14 11 10 7 6 3 2

WEFT 15
24 21 20 17 16 13 12 9 8 5 4 1
23 22 19 18 15 14 11 10 7 6 3 2

WEFT 16
24 21 20 17 16 13 12 9 8 5 4 1
23 22 19 18 15 14 11 10 7 6 3 2

WEFT 17
24 21 20 17 16 13 12 9 8 5 4 1
23 22 19 18 15 14 11 10 7 6 3 2

WEFT 18
24 21 20 17 16 13 12 9 8 5 4 1
23 22 19 18 15 14 11 10 7 6 3 2

WEFT 19
24 21 20 17 16 13 12 9 8 5 4 1
23 22 19 18 15 14 11 10 7 6 3 2

WEFT 20
24 21 20 17 16 13 12 9 8 5 4 1
23 22 19 18 15 14 11 10 7 6 3 2

FIG. 102

| | | | | | | | | | | | | | |
|---|---|---|---|---|---|---|---|---|---|---|---|---|---|
| | | X | | | X | | | X | | | X | 47 | 48 |
| | X | | | X | | | X | | | X | | 45 | 46 |
| X | | | X | | | X | | | X | | | 43 | 44 |
| | | X | | | X | | | X | | | X | 41 | 42 |
| | X | | | X | | | X | | | X | | 39 | 40 |
| X | | | X | | | X | | | X | | | 37 | 38 |
| | | X | | | X | | | X | | | X | 35 | 36 |
| | X | | | X | | | X | | | X | | 33 | 34 |
| X | | | X | | | X | | | X | | | 31 | 32 |
| | | X | | | X | | | X | | | X | 29 | 30 |
| | X | | | X | | | X | | | X | | 27 | 28 |
| X | | | X | | | X | | | X | | | 25 | 26 |
| | | X | | | X | | | X | | | X | 23 | 24 |
| | X | | | X | | | X | | | X | | 21 | 22 |
| X | | | X | | | X | | | X | | | 19 | 20 |
| | | X | | | X | | | X | | | X | 17 | 18 |
| | X | | | X | | | X | | | X | | 15 | 16 |
| X | | | X | | | X | | | X | | | 13 | 14 |
| | | X | | | X | | | X | | | X | 11 | 12 |
| | X | | | X | | | X | | | X | | 9 | 10 |
| X | | | X | | | X | | | X | | | 7 | 8 |
| | | X | | | X | | | X | | | X | 5 | 6 |
| | X | | | X | | | X | | | X | | 3 | 4 |
| X | | | X | | | X | | | X | | | 1 | 2 |
| 24 | 21 | 20 | 17 | 16 | 13 | 12 | 9 | 8 | 5 | 4 | 1 | | |
| 23 | 22 | 19 | 18 | 15 | 14 | 11 | 10 | 7 | 6 | 3 | 2 | | |

WEFT YARNS

WARP YARNS

FIG. 166

FORMING FABRIC WITH DUAL COMBINATION BINDER WEFT YARNS

CROSS-REFERENCE TO RELATED APPLICATION

Not applicable.

STATEMENT CONCERNING FEDERALLY SPONSORED RESEARCH OR DEVELOPMENT

Not applicable.

FIELD OF THE INVENTION

The present invention relates generally to papermaking, and relates more specifically to a forming fabric employed in papermaking.

BACKGROUND OF THE INVENTION

In the conventional Fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

Typically, papermakers' fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto joining machines are available, which for certain fabrics may be used to automate at least part of the joining process. In a flat woven papermakers' fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and the like) the papermaking surface comprises a very finely woven or fine wire mesh structure.

Specifically regarding forming fabrics, these fabrics typically include two layers. The first layer is a top or paper-side layer that includes top warp yarns and top weft yarns that weave with the top warp yarns. The paper-side layer contacts the paper web as the paper web is formed during the papermaking process. The second layer is a bottom or machine-side layer that includes bottom warp yarns and bottom weft yarns that weave with the bottom warp yarns. The machine-side layer contacts various components of the papermaking machine, such as rolls that support the forming fabric, during the papermaking process. In addition, forming fabrics also include binder wefts that weave with both the top and bottom warp yarns to connect the paper-side and the machine-side layers. The binder weft yarns and the top weft yarns typically include long weft floats over the top warp yarns to provide a generally continuous paper-side surface on which the paper web is formed. However, the long weft floats prevent the binder weft yarns from effectively interweaving with the top and bottom warp yarns, and therefore, the stability of forming fabrics is relatively low.

Considering the limitations of previous designs, it would be desirable to have a forming fabric with increased stability and a generally continuous paper-side surface on which a paper web is formed.

SUMMARY OF THE INVENTION

In one aspect, the invention provides a forming fabric for a papermaking machine that comprises a machine-side layer and a paper-side layer. The machine-side layer includes bottom warp yarns and bottom weft yarns that weave with at least some of the bottom warp yarns. The paper-side layer includes top warp yarns and top weft yarns that weave with at least some of the top warp yarns to create a weave pattern in a repeating pattern area, and at least one of the top weft yarns includes a paper-side float in the repeating pattern area that passes over a number of consecutive top warp yarns. The forming fabric further comprises a set of dual combination binder weft yarns disposed adjacent to a top weft yarn. At least one dual combination binder weft yarn of the set weaves with some of the bottom warp yarns and some of the top warp yarns. Each dual combination binder weft yarn of the set includes at least one segment in the repeating pattern area that passes over at least one top warp yarn. The at least one segment is disposed adjacent to a segment of another dual combination binder weft yarn of the set. The at least one segment and the adjacent segment combine to form a long weft float that passes over the number of consecutive top warp yarns passed over by the paper-side float to match the weave pattern of the top weft yarns. The long weft float occurs at least once in each repeat of the dual combination binder weft yarns.

In another aspect, the invention provides a forming fabric for a papermaking machine that comprises a machine-side layer and a paper-side layer. The machine-side layer includes bottom warp yarns and bottom weft yarns that weave with at least some of the bottom warp yarns. The paper-side layer includes top warp yarns and top weft yarns that weave with at least some of the top warp yarns. The forming fabric further includes sets of dual combination binder weft yarns, and each set is disposed adjacent to a top weft yarn. The top warp yarns, the top weft yarns and dual combination binder weft yarns form a weave pattern in a repeating pattern area. Each of the top weft yarns weaves with the top warp yarns in an identical pattern in the repeating pattern area and each of the top weft yarns includes at least one paper-side float in the repeating pattern area that passes over a number of consecutive top warp yarns. Each dual combination binder weft yarn of the sets weaves with the top warp yarns and the bottom warp yarns in an identical pattern in the repeating pattern area and each dual combination binder weft yarn of the sets includes at least one segment in the repeating pattern area that passes over at least one top warp yarn. The at least one segment is disposed adjacent to a segment of another dual combination binder weft yarn, and the at least one segment and the adjacent segment of each set of dual combination binder weft yarns combine to form a long weft float. The long weft floats pass over the number of consecutive top warp yarns passed over by the paper-side floats of the top weft yarns to match the weave pattern of the top weft yarns. The long weft float occurs at least once in each repeat of the dual combination binder weft yarns.

The foregoing and other objects and advantages of the invention will be apparent in the detailed description and drawings which follow. In the description, reference is made to the accompanying drawings which illustrate a preferred embodiment of the invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings. Referring to the drawings, the pattern areas shown therein include various symbols to indicate how the warp yarns and weft yarns are positioned relative to one another in the weave. These symbols will be described in further detail below.

FIG. 78 shows an additional schematic representation of the weave pattern of individual weft yarns of FIG. 75 with the top and bottom warp yarns;

FIG. 79 shows an additional schematic representation of the weave pattern of individual weft yarns of FIG. 75 with the top and bottom warp yarns;

FIG. 102 shows a schematic representation of the weave pattern of individual weft yarns of FIG. 101 with the top and bottom warp yarns;

FIG. 117 shows a photograph of an impression of the upper surface of the forming fabric of FIG. 113;

FIG. 118 shows a repeating pattern area of a thirty seventh embodiment of a forming fabric according to the invention;

FIG. 119 shows a schematic representation of the weave pattern of individual weft yarns of FIG. 118 with the top and bottom warp yarns;

FIG. 120 shows an additional schematic representation of the weave pattern of individual weft yarns of FIG. 118 with the top and bottom warp yarns;

FIG. 121 shows a photograph of the upper surface or paper-facing surface of the forming fabric of FIG. 118;

FIG. 122 shows a photograph of a bottom layer of the forming fabric of FIG. 118;

FIG. 123 shows a photograph of an impression of the upper surface of the forming fabric of FIG. 118;

FIG. 124 shows a repeating pattern area of a thirty eighth embodiment of a forming fabric according to the invention;

FIG. 125 shows a schematic representation of the weave pattern of individual weft yarns of FIG. 124 with the top and bottom warp yarns;

FIG. 126 shows an additional schematic representation of the weave pattern of individual weft yarns of FIG. 124 with the top and bottom warp yarns;

FIG. 127 shows a photograph of the upper surface or paper-facing surface of the forming fabric of FIG. 124;

FIG. 128 shows a photograph of a bottom layer of the forming fabric of FIG. 124;

Figure 124:
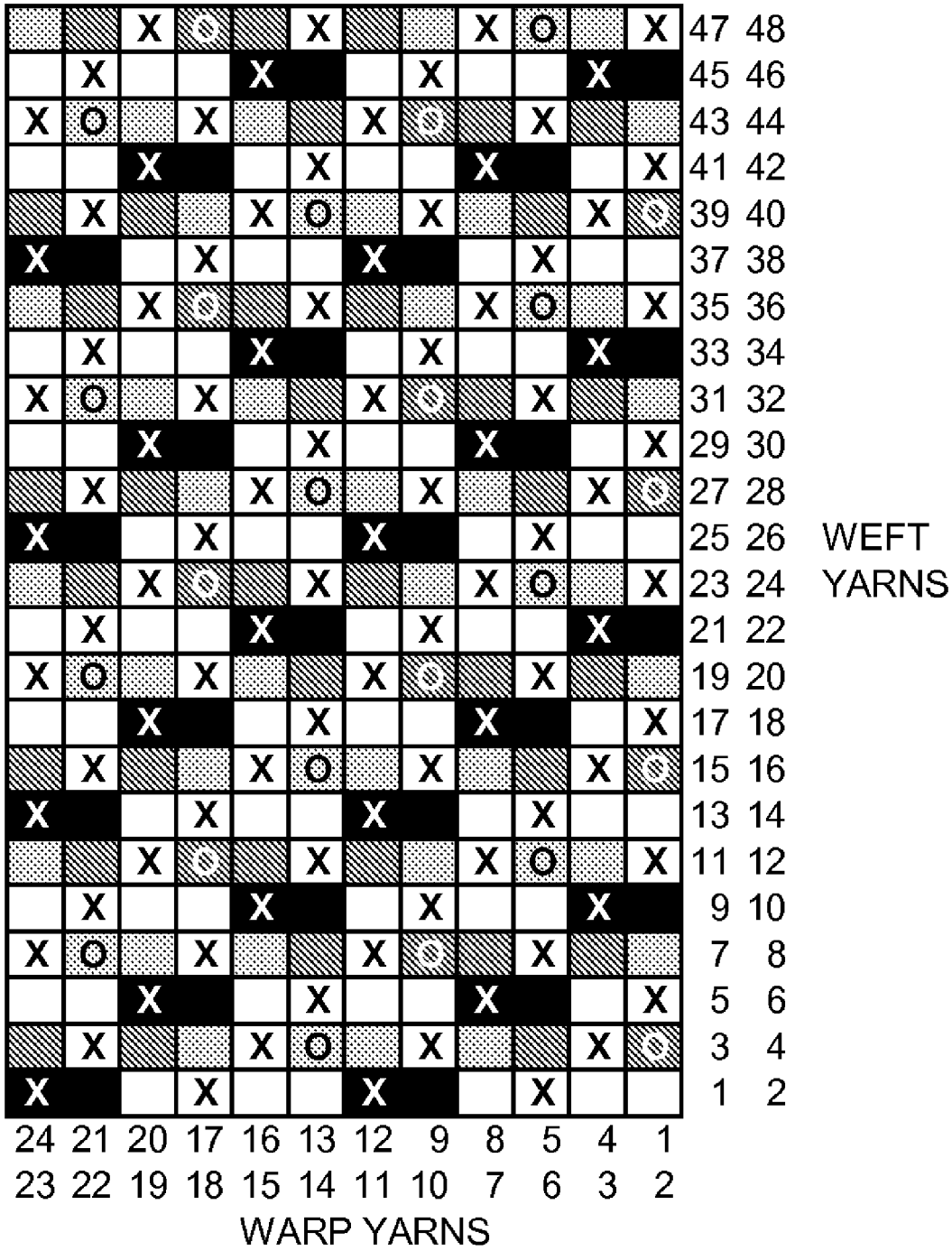
Figure 125:
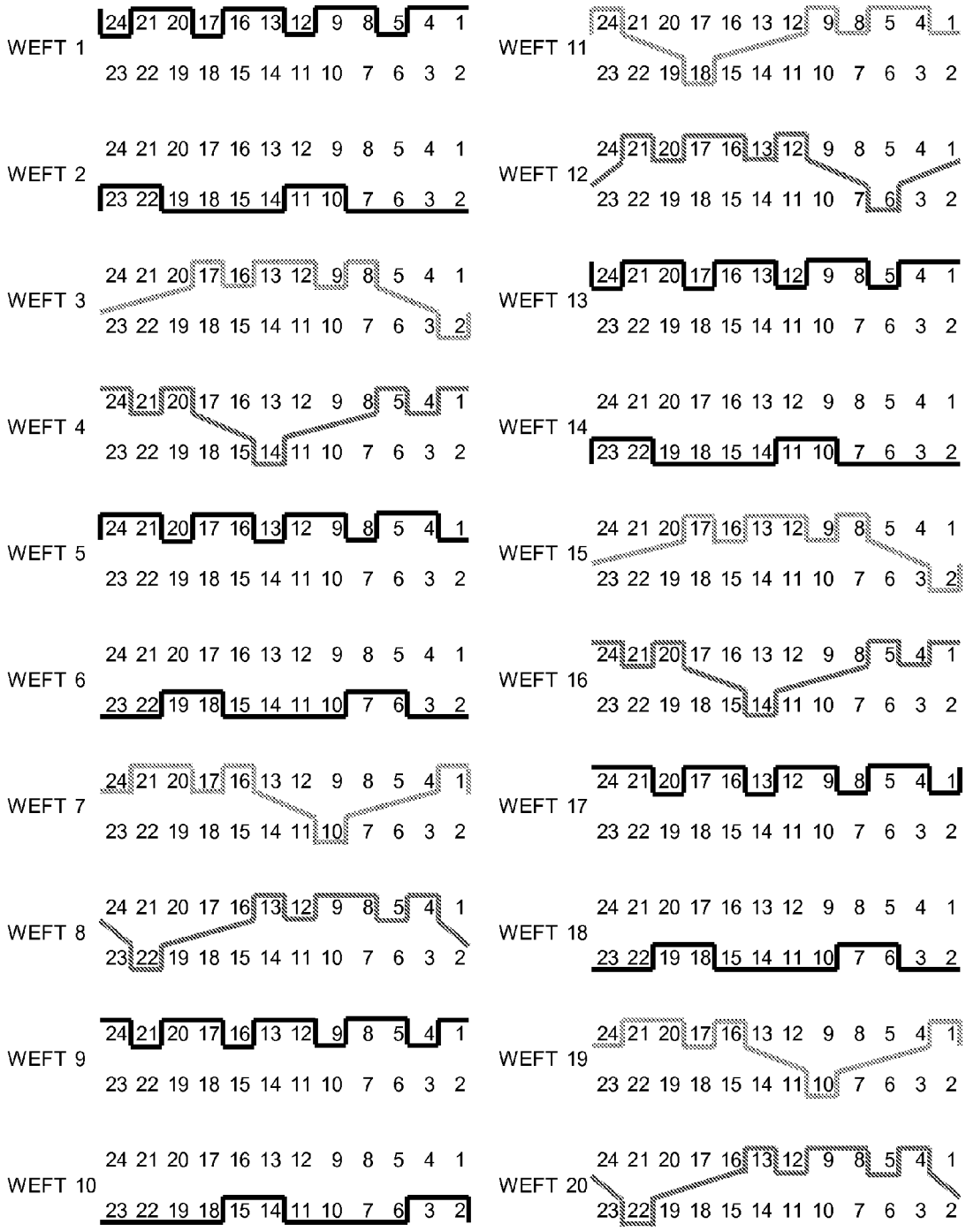
Figure 126:
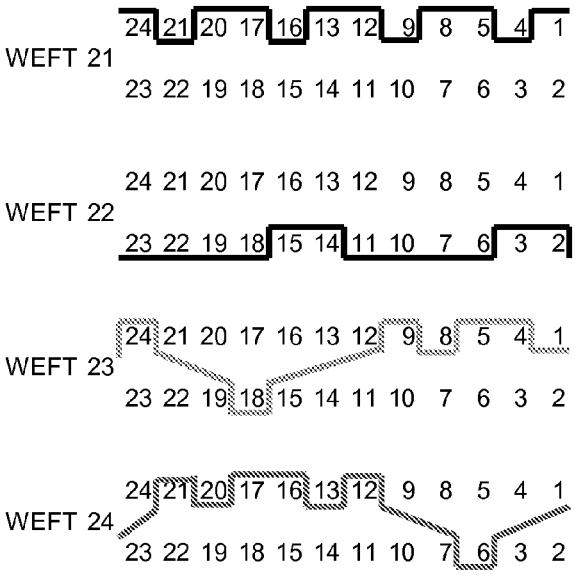
Figure 127:
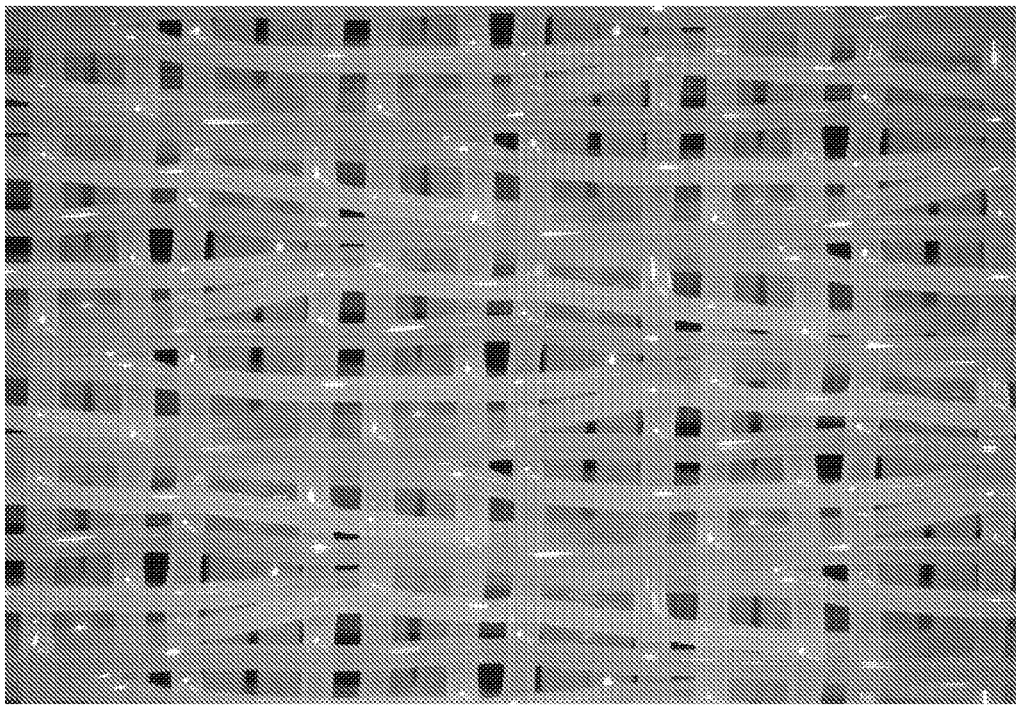
Figure 128:
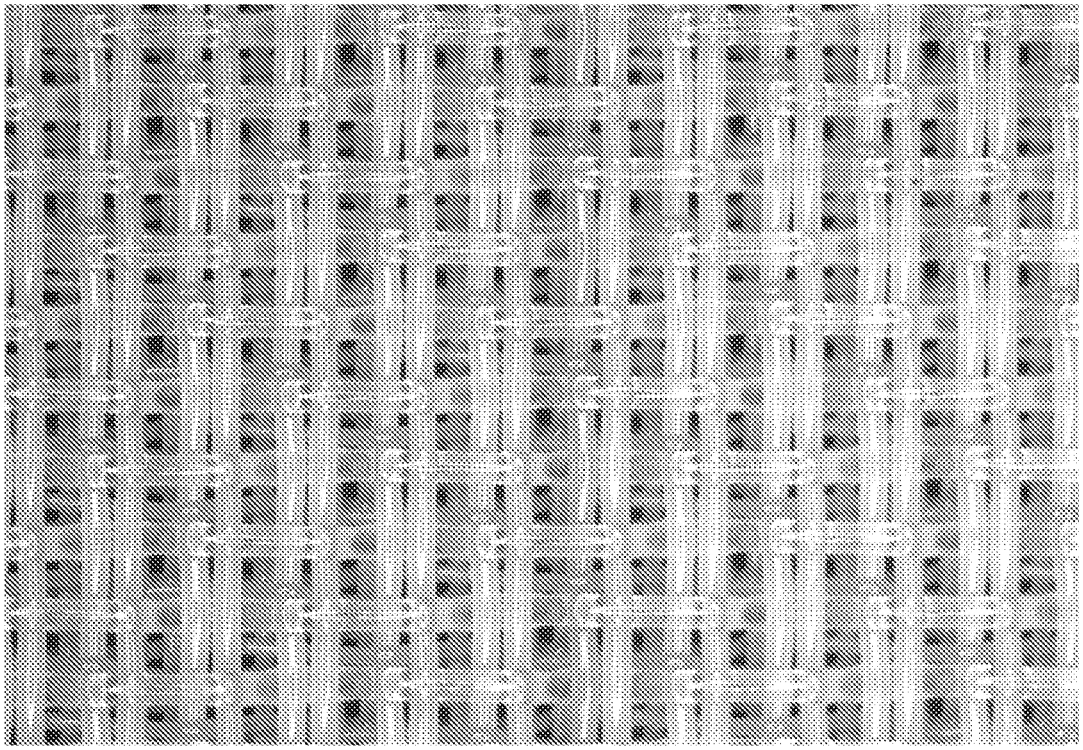
Figure 129:
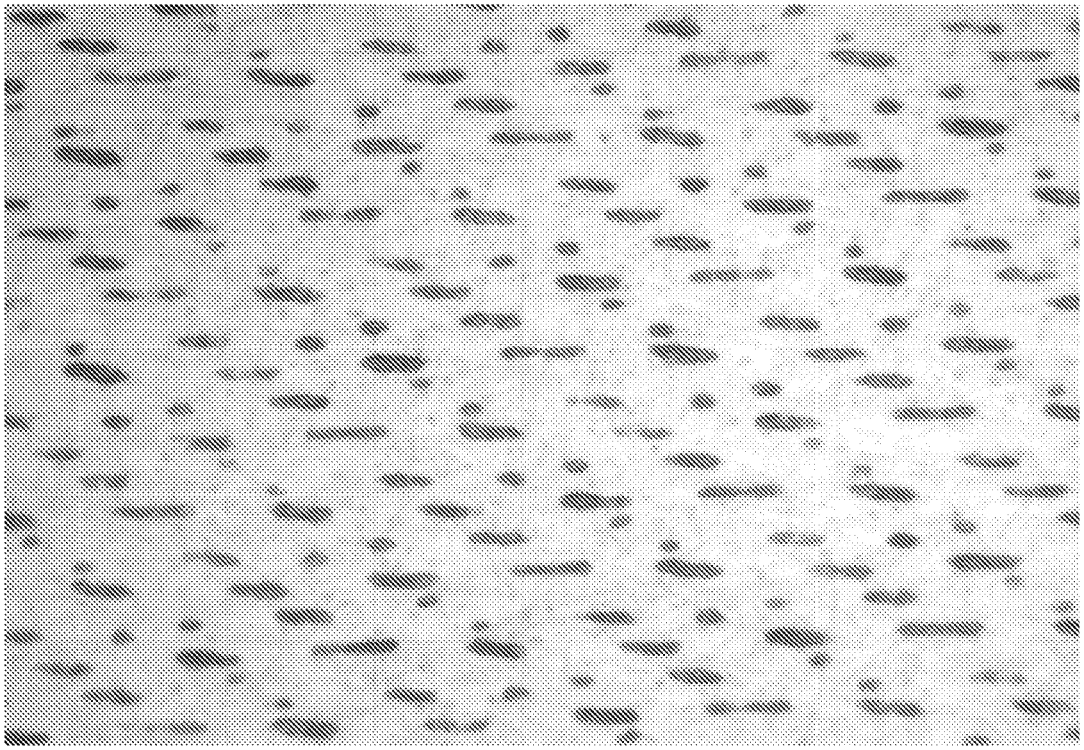
Figure 130:
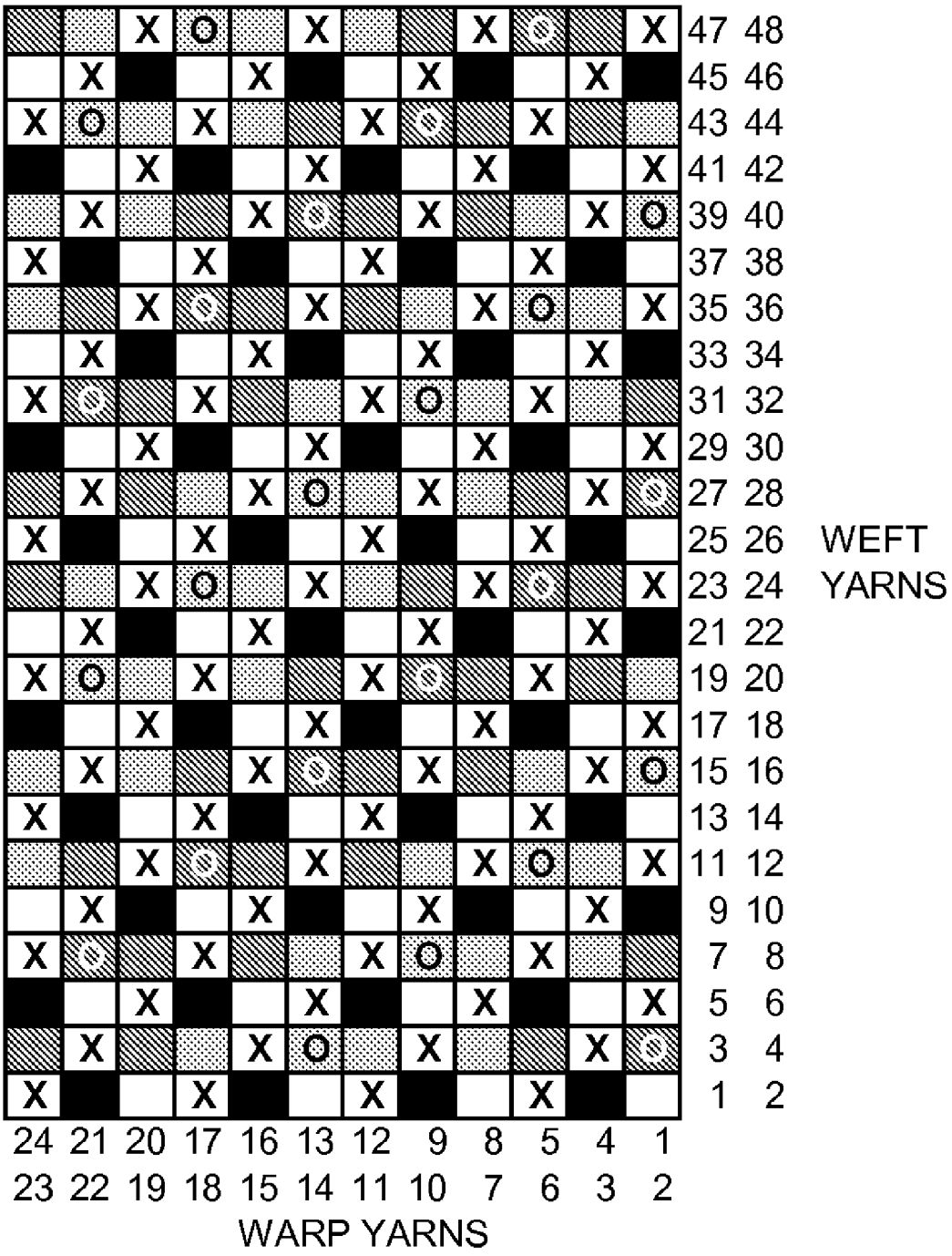
Figure 131:
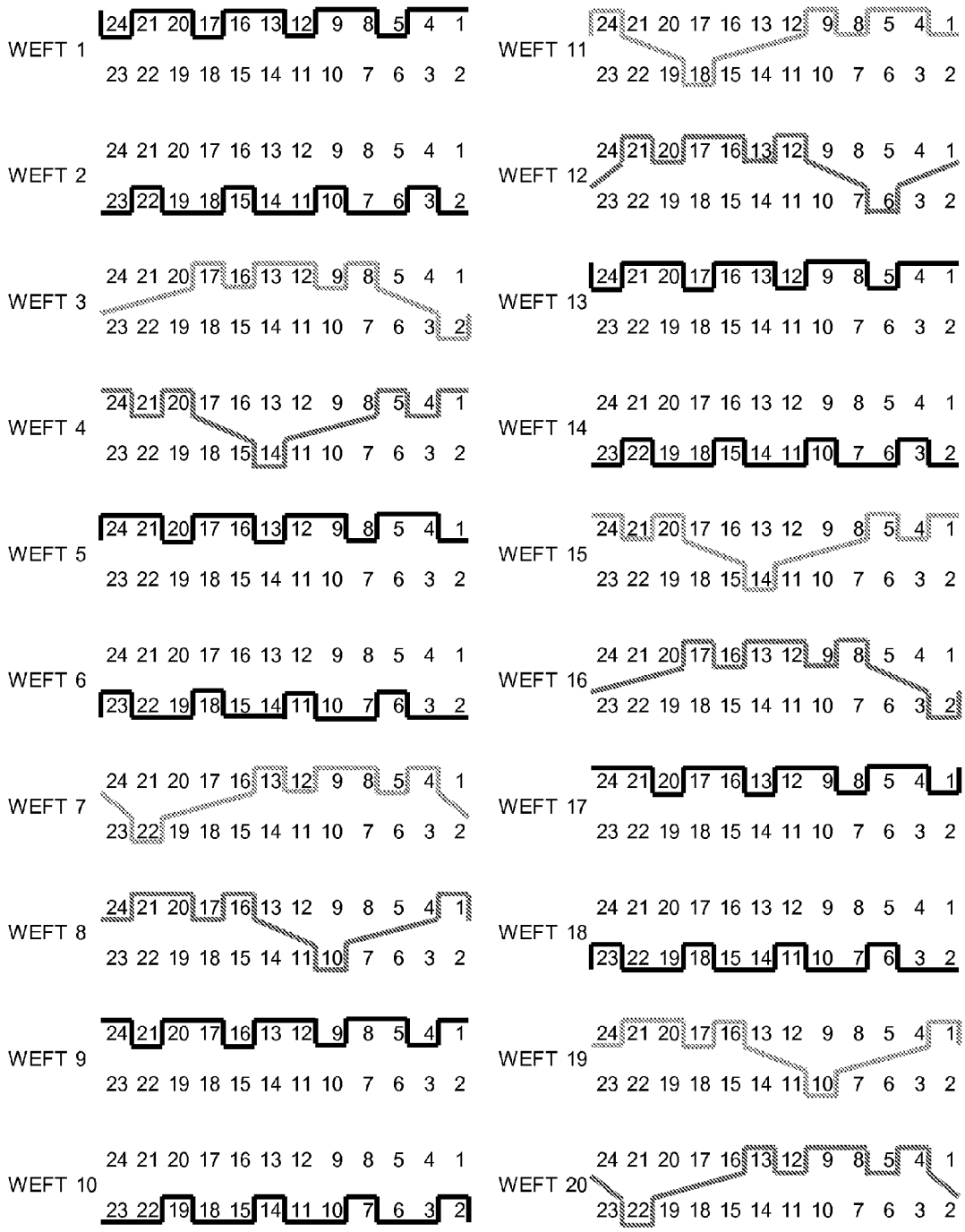
Figure 132:
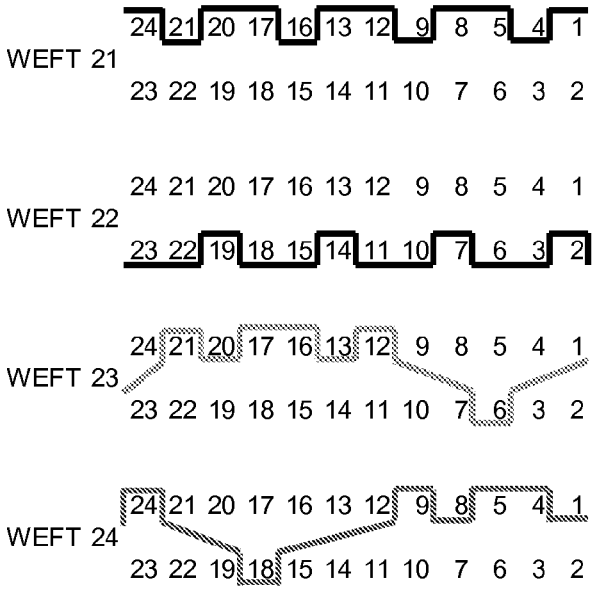
Figure 133:
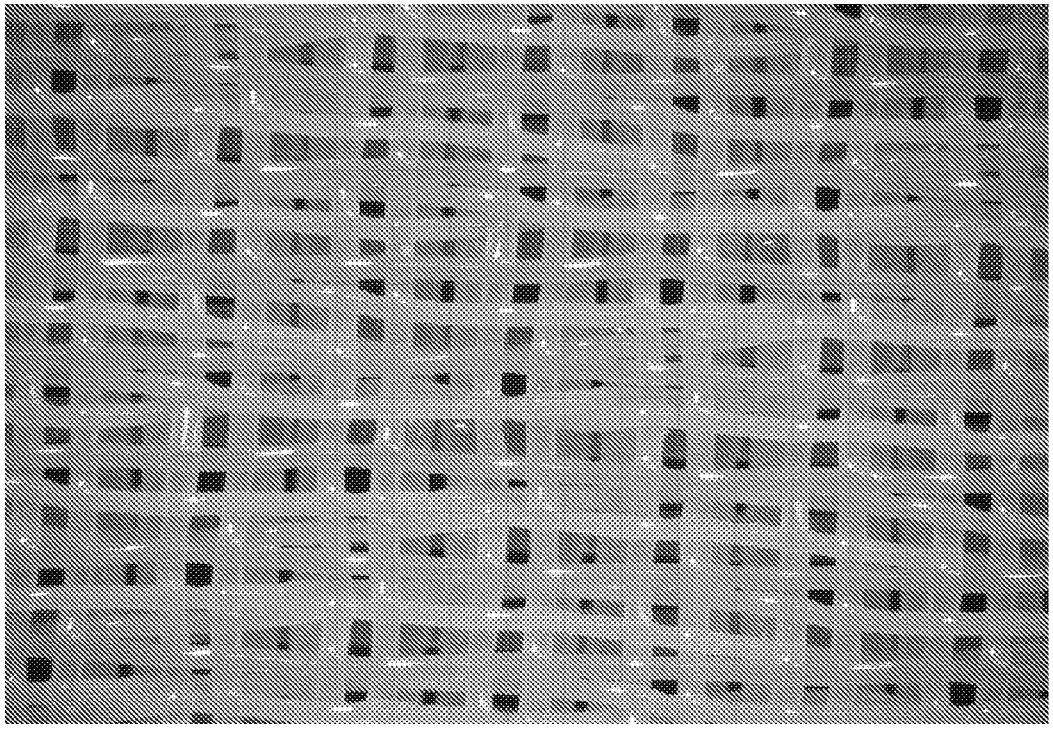
Figure 134:
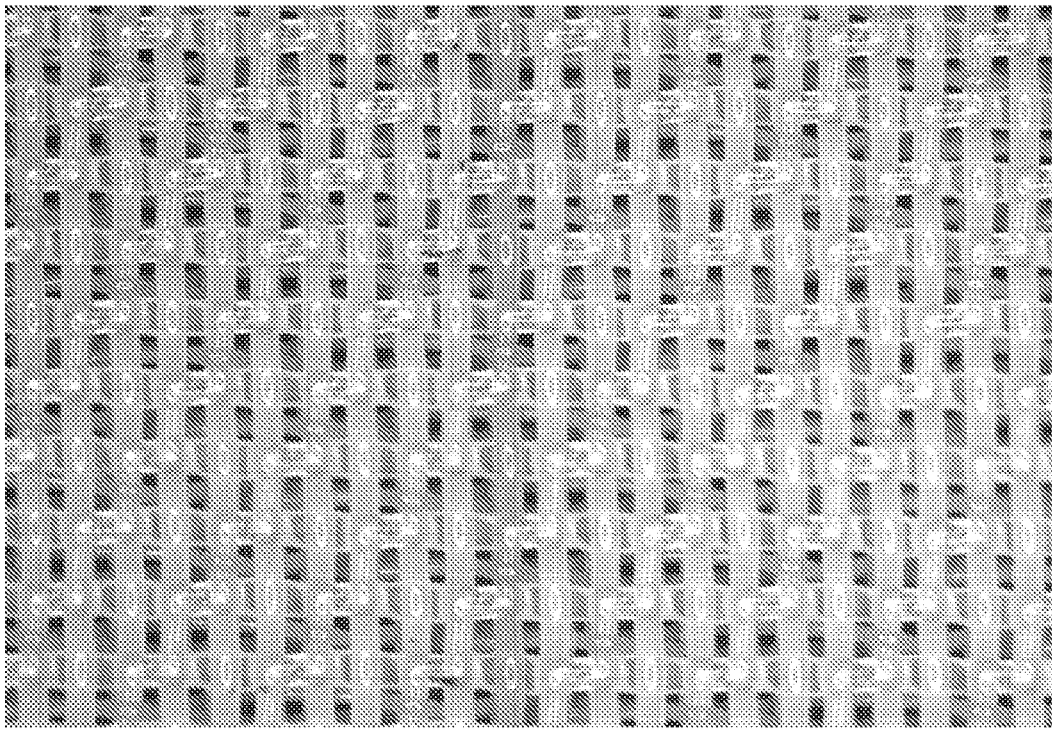
Figure 135:
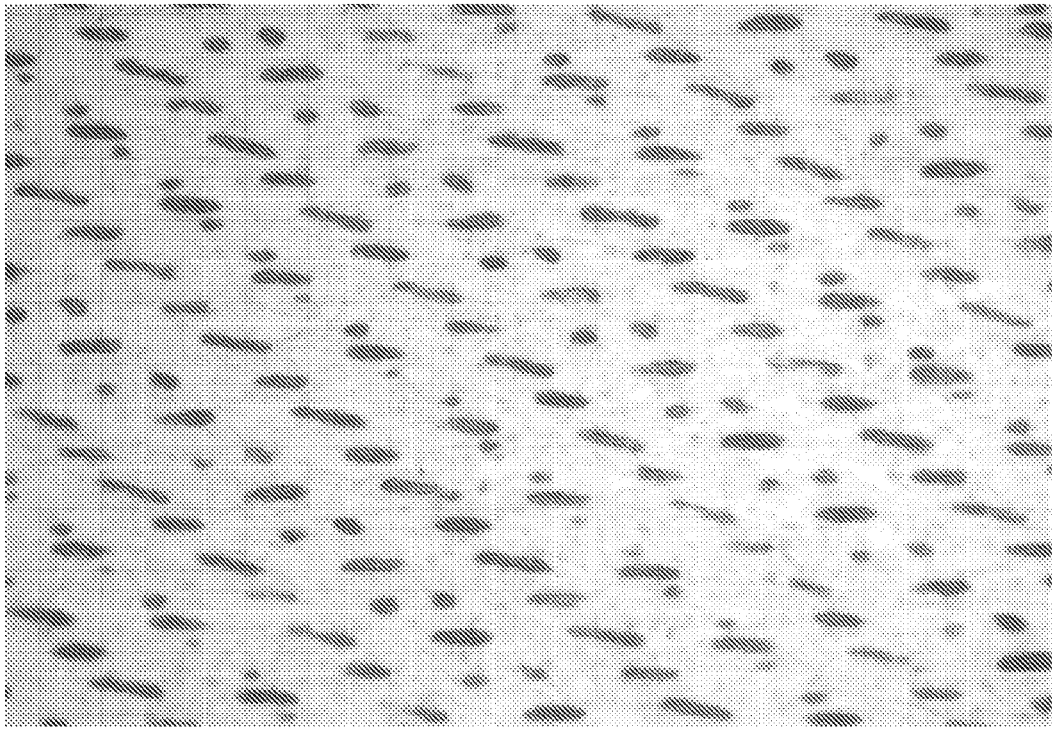
Figure 136:
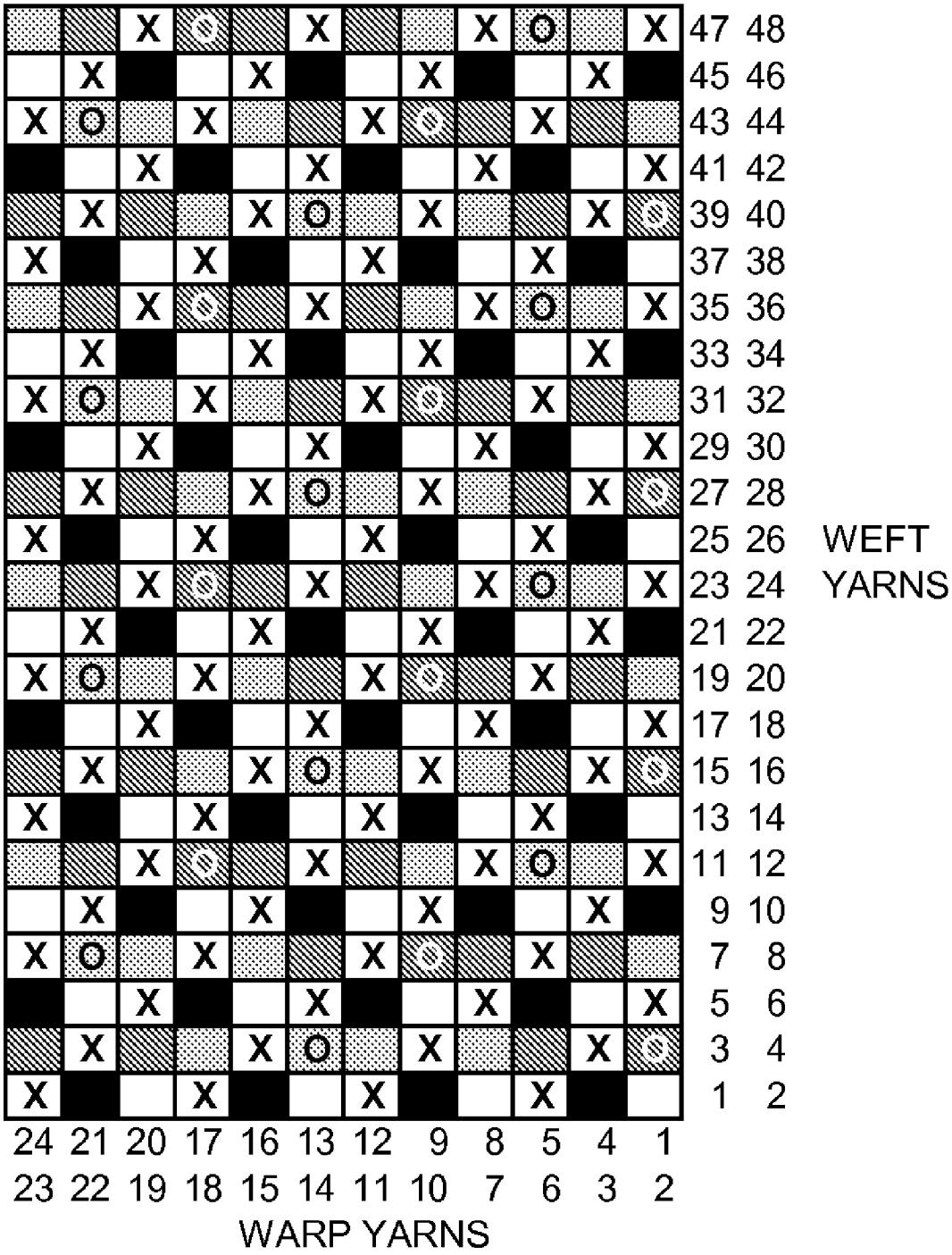
Figure 137:
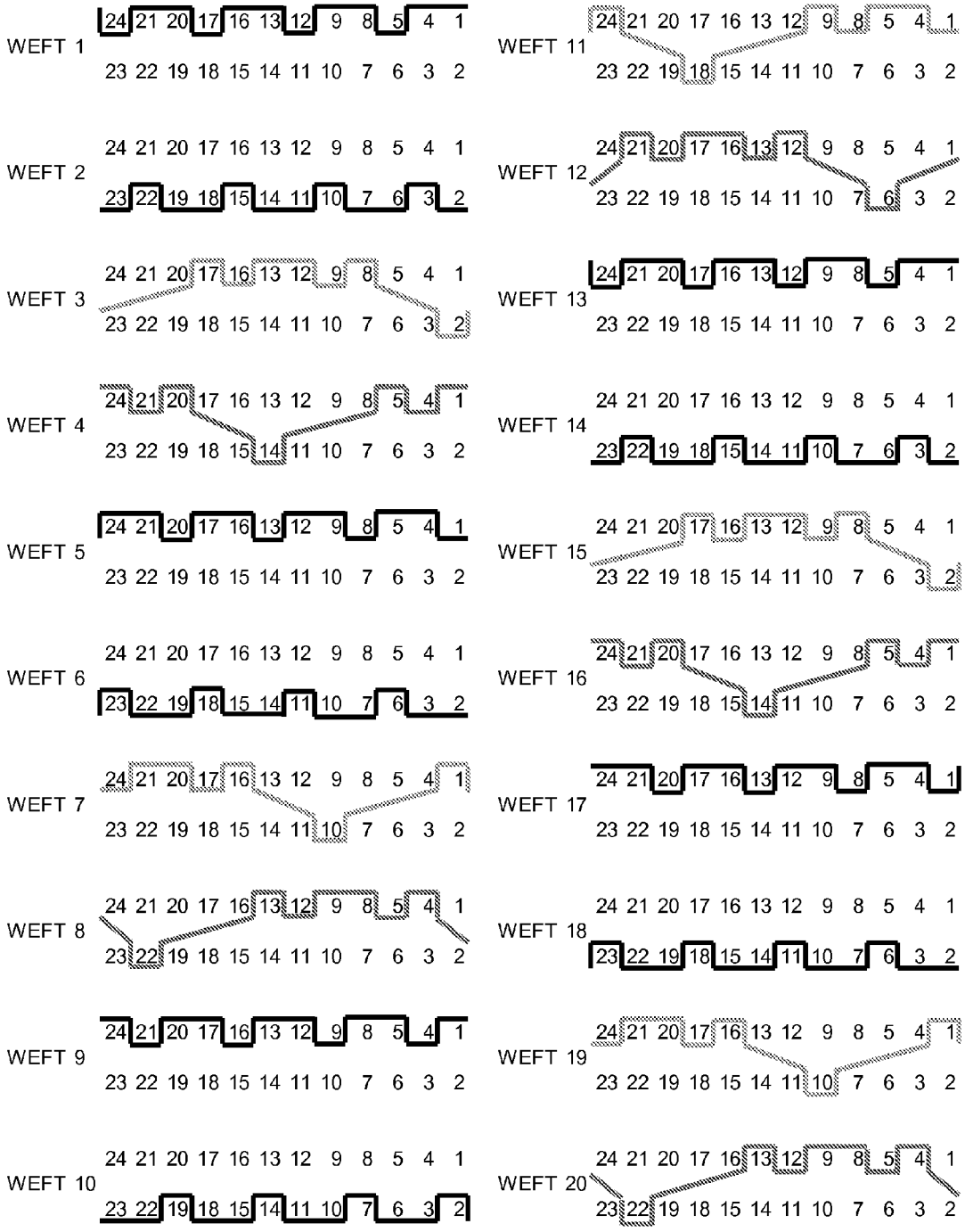
Figure 138:
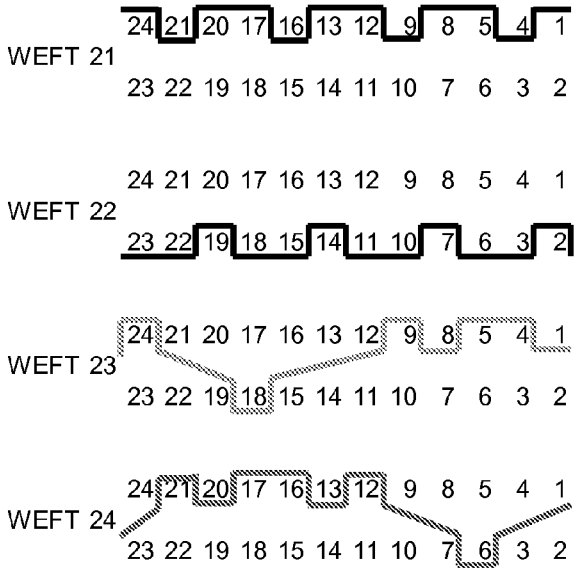
Figure 139:
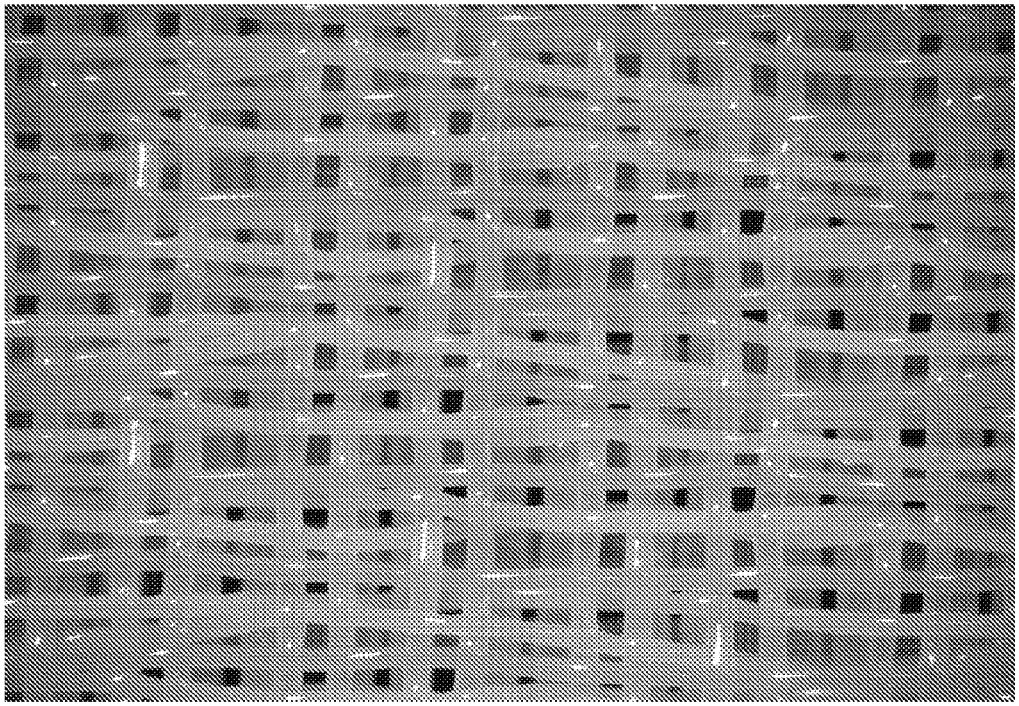
Figure 140:
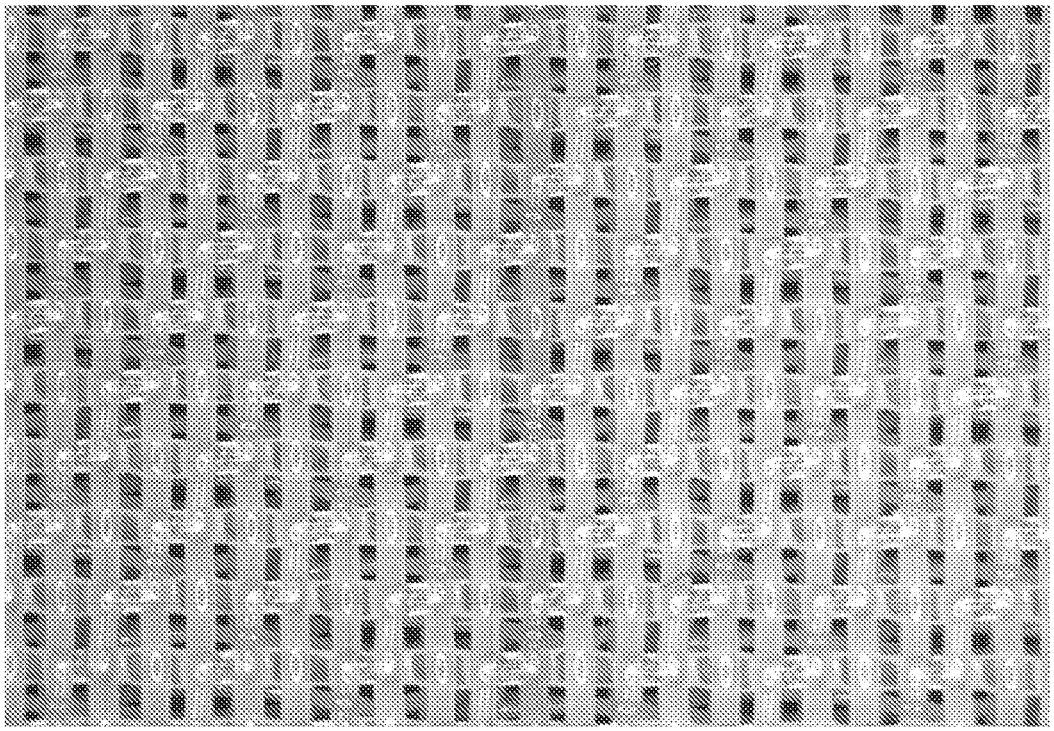
Figure 141:
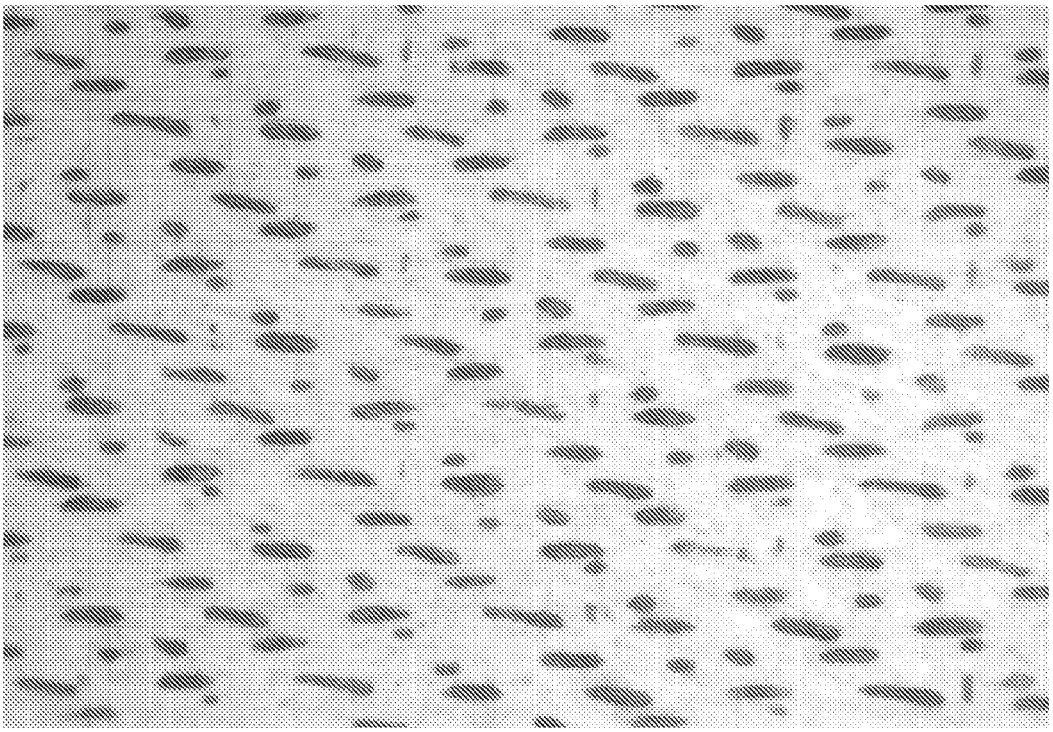
Figure 142:
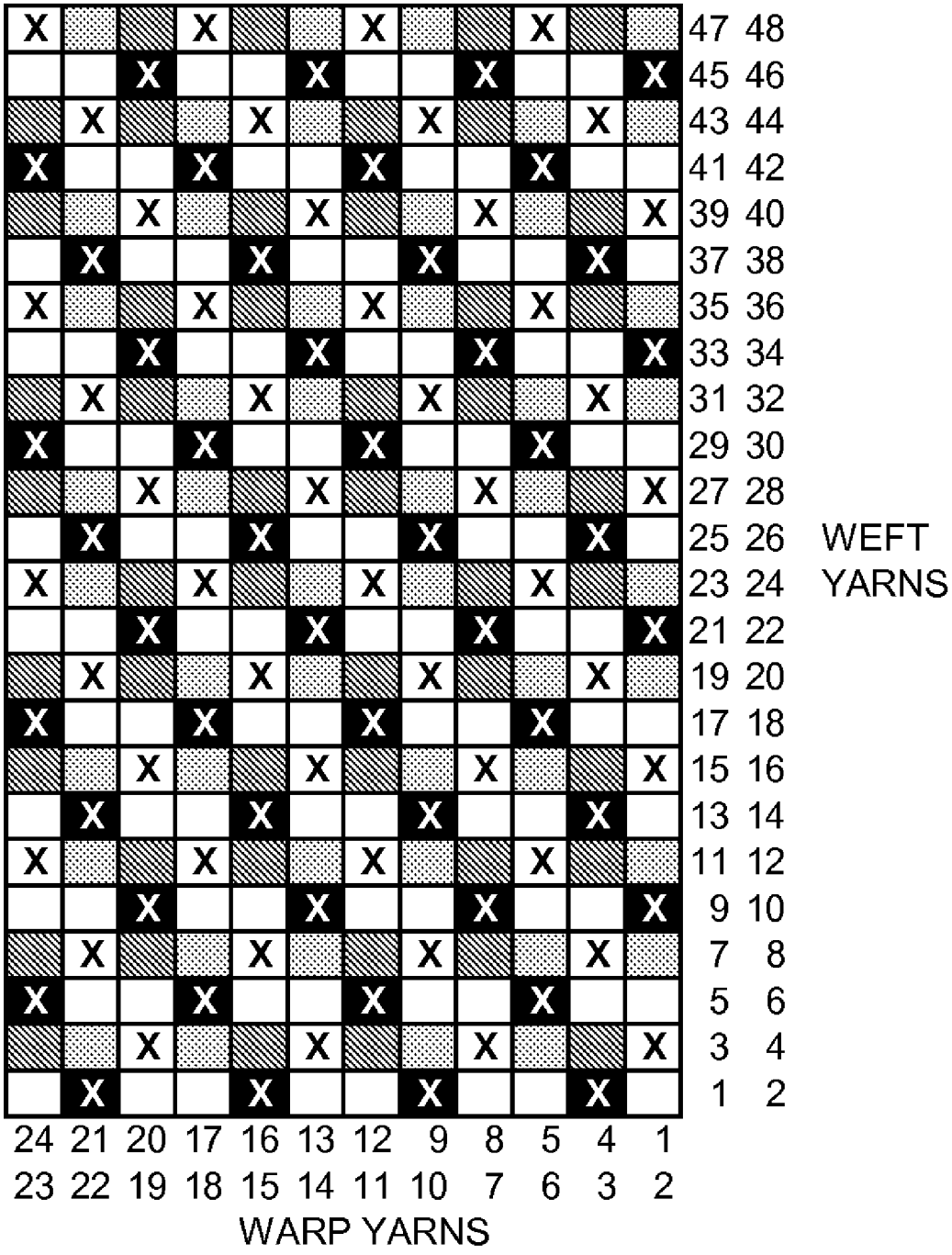
Figure 143:
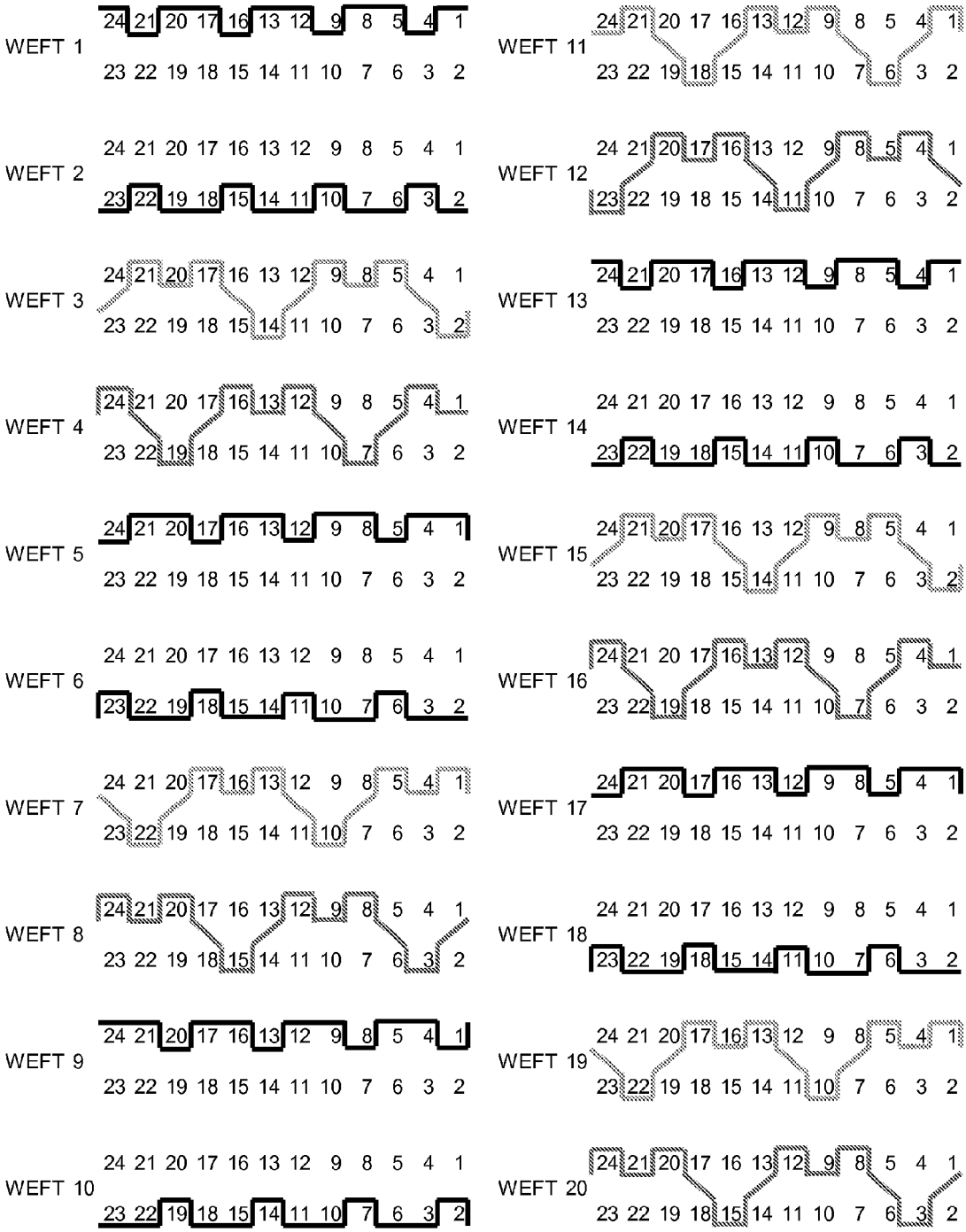
Figure 144:
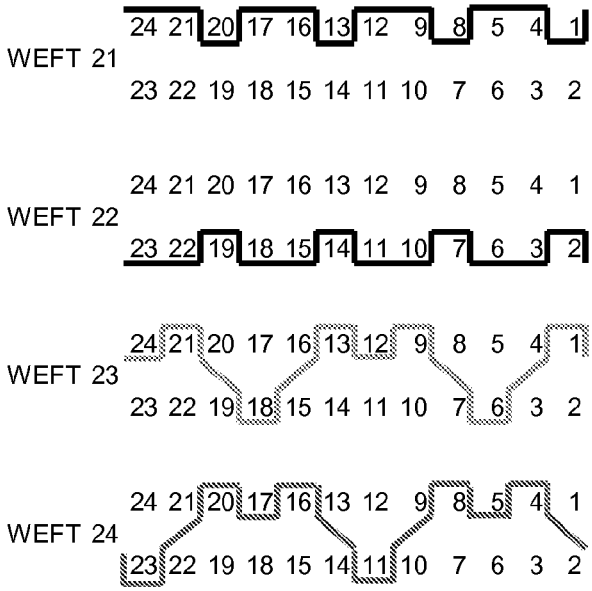
Figure 145:
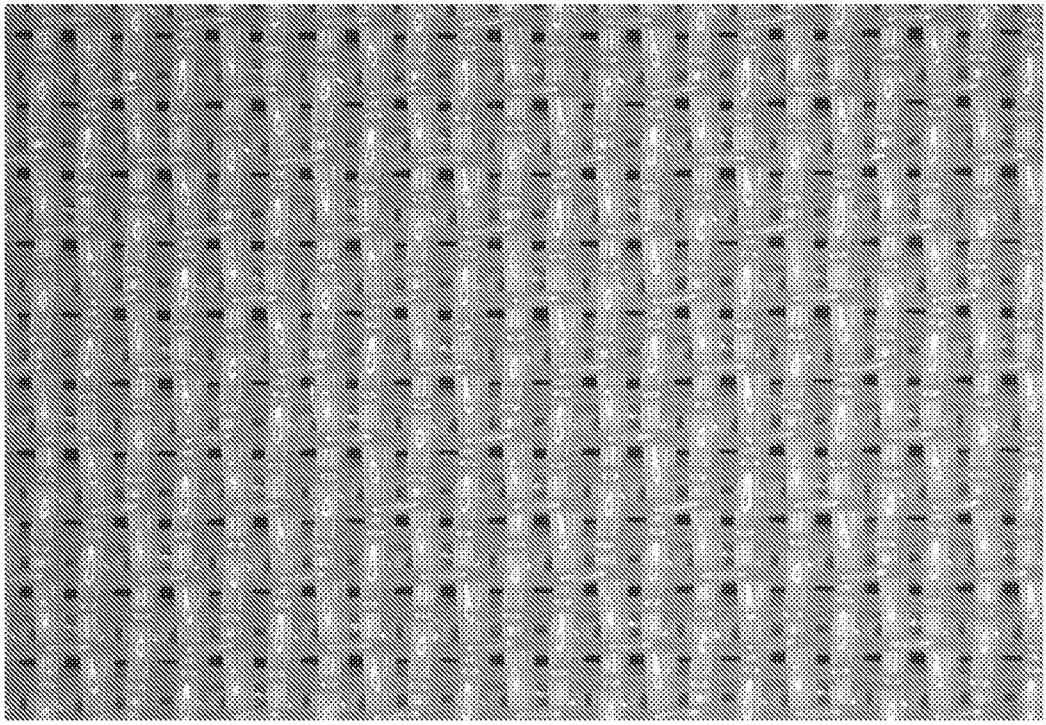
Figure 146:
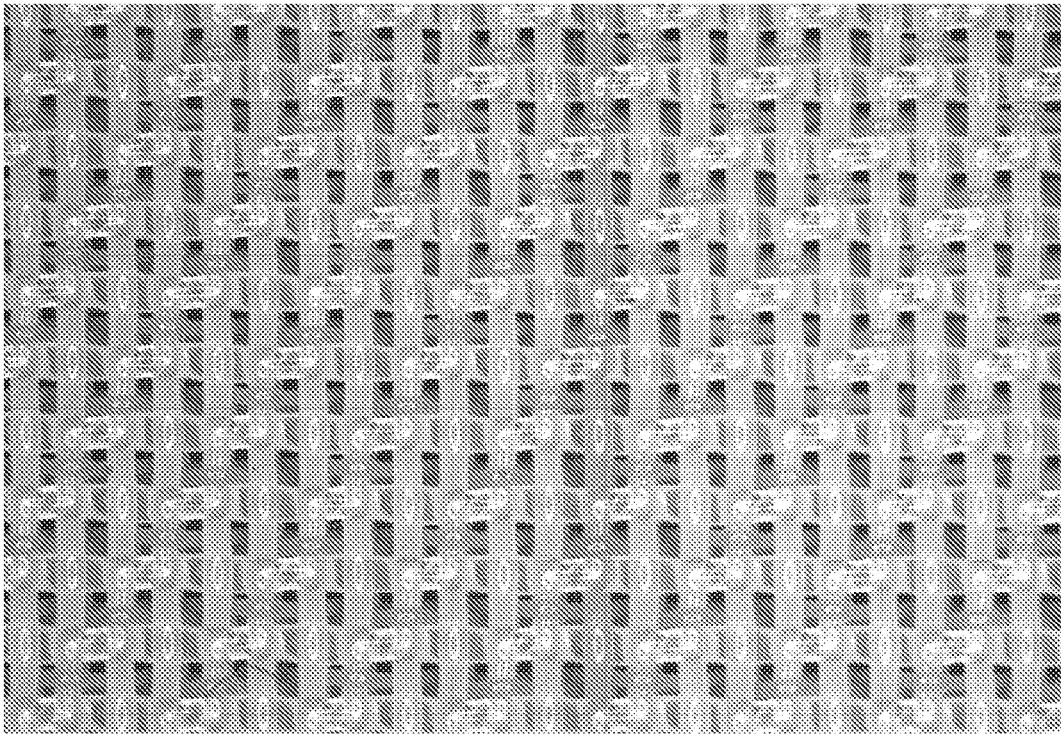
Figure 147:
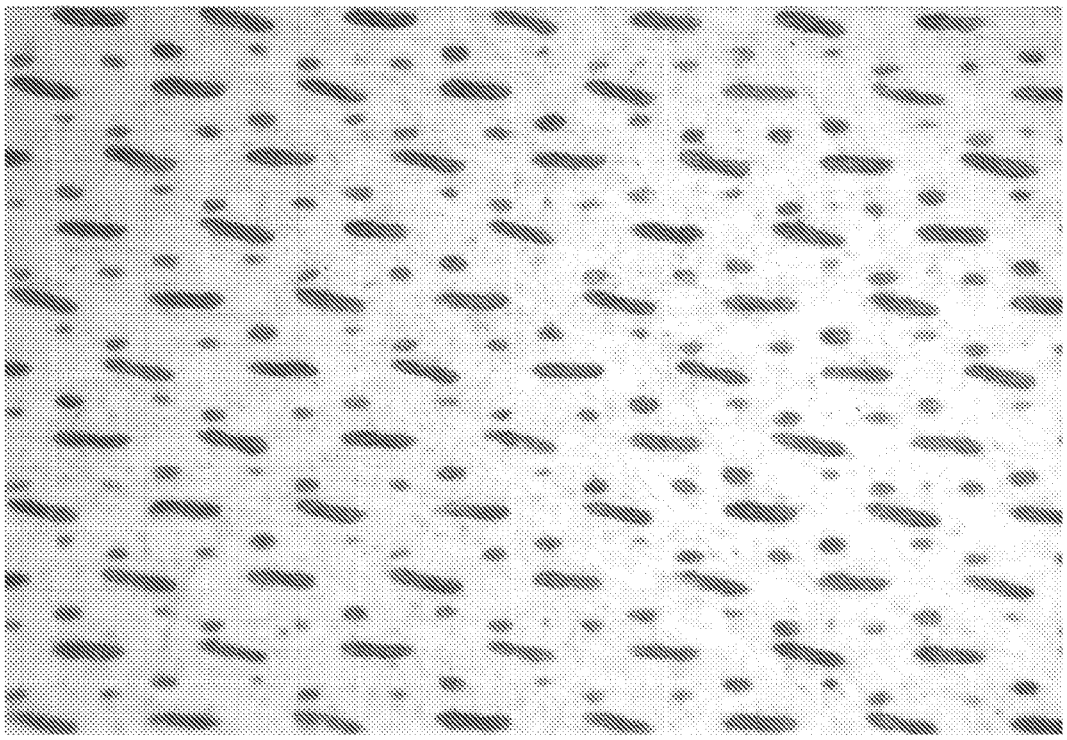
Figure 148:
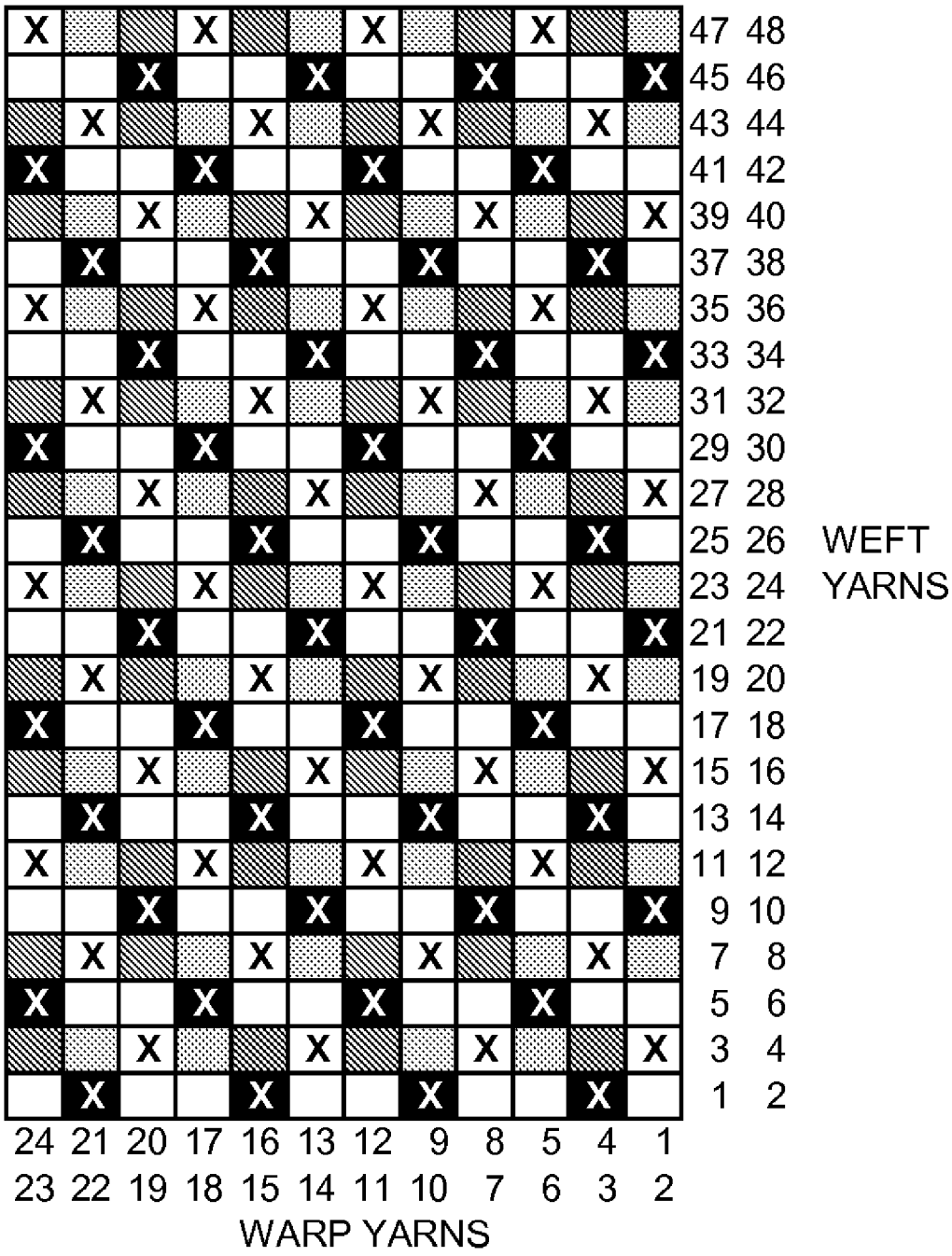
Figure 149:
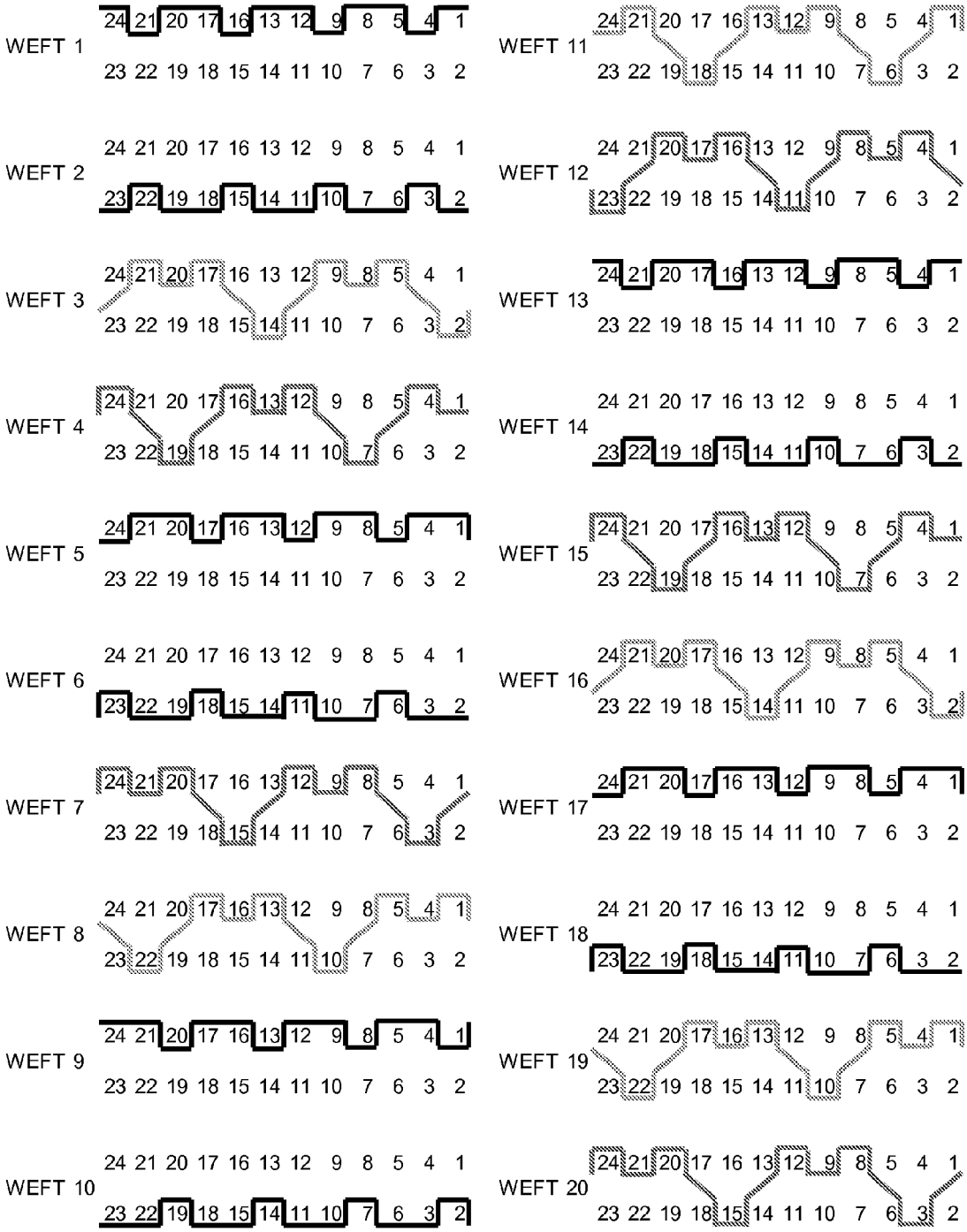
Figure 150:
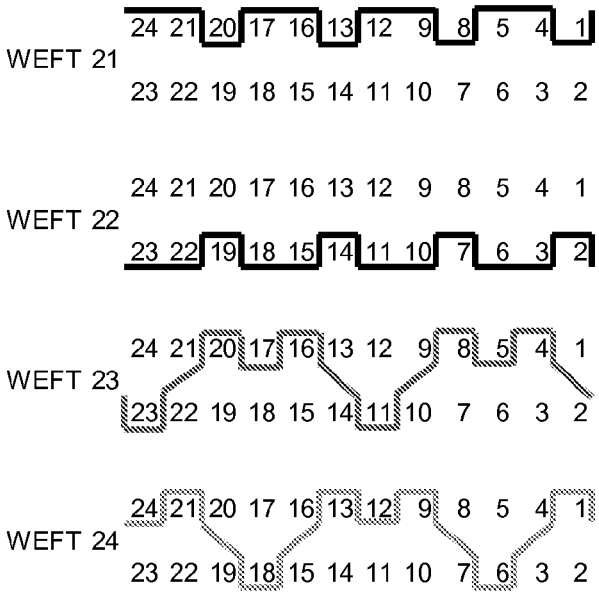
Figure 151:
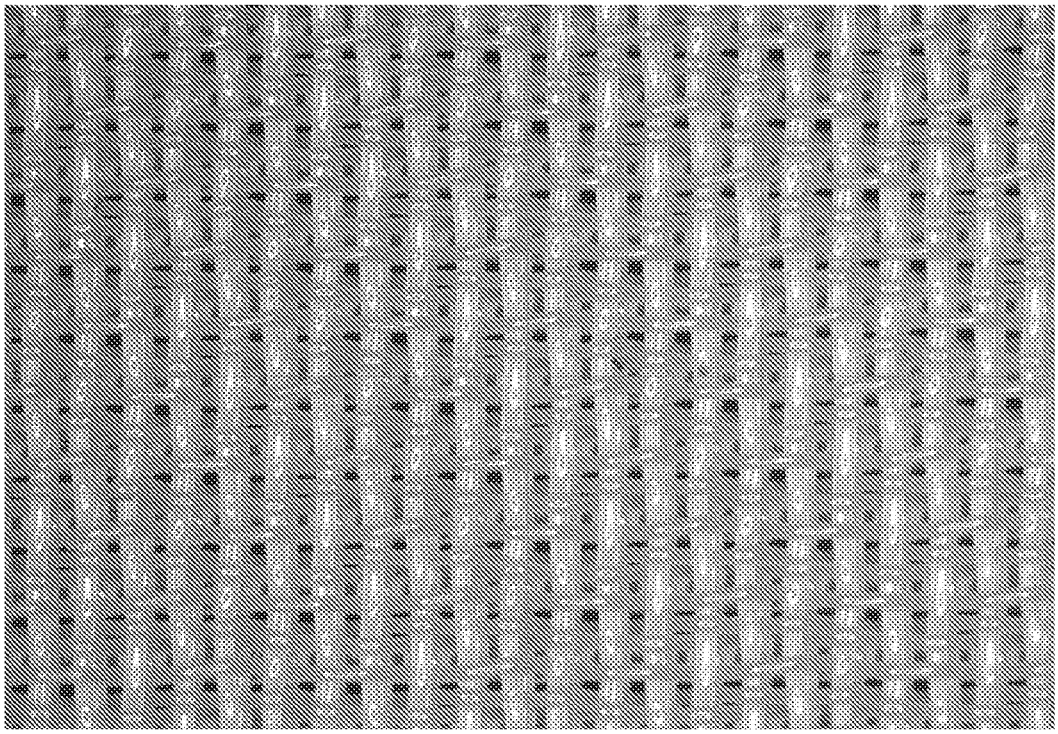
Figure 152:
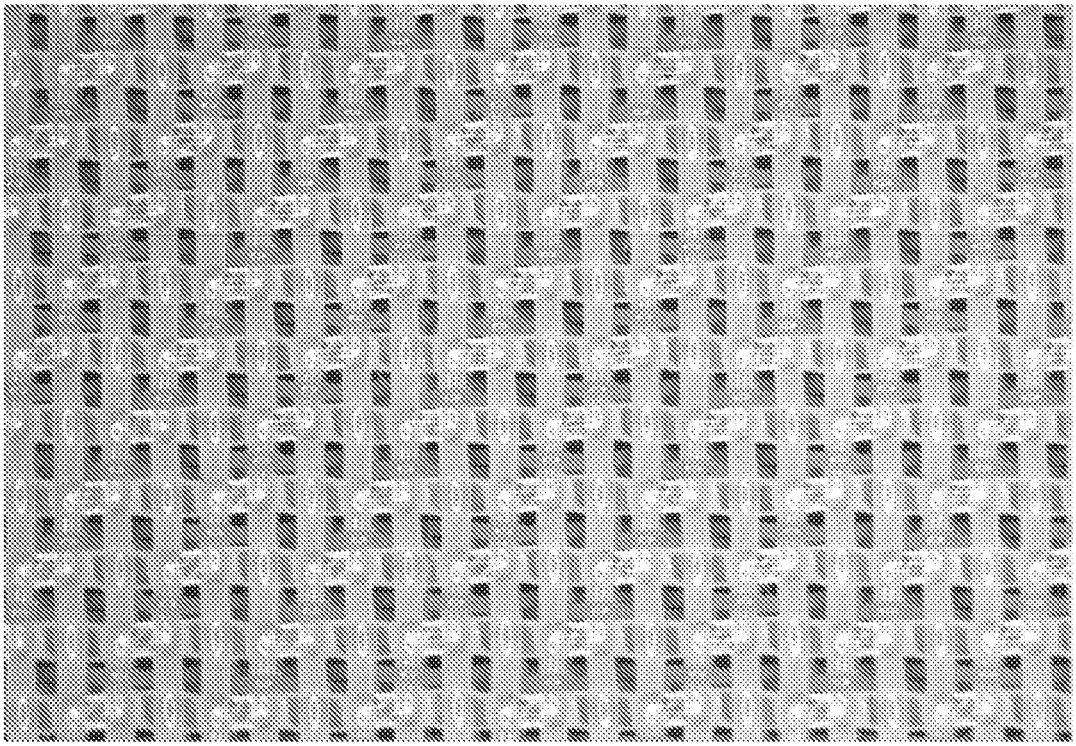
Figure 153:
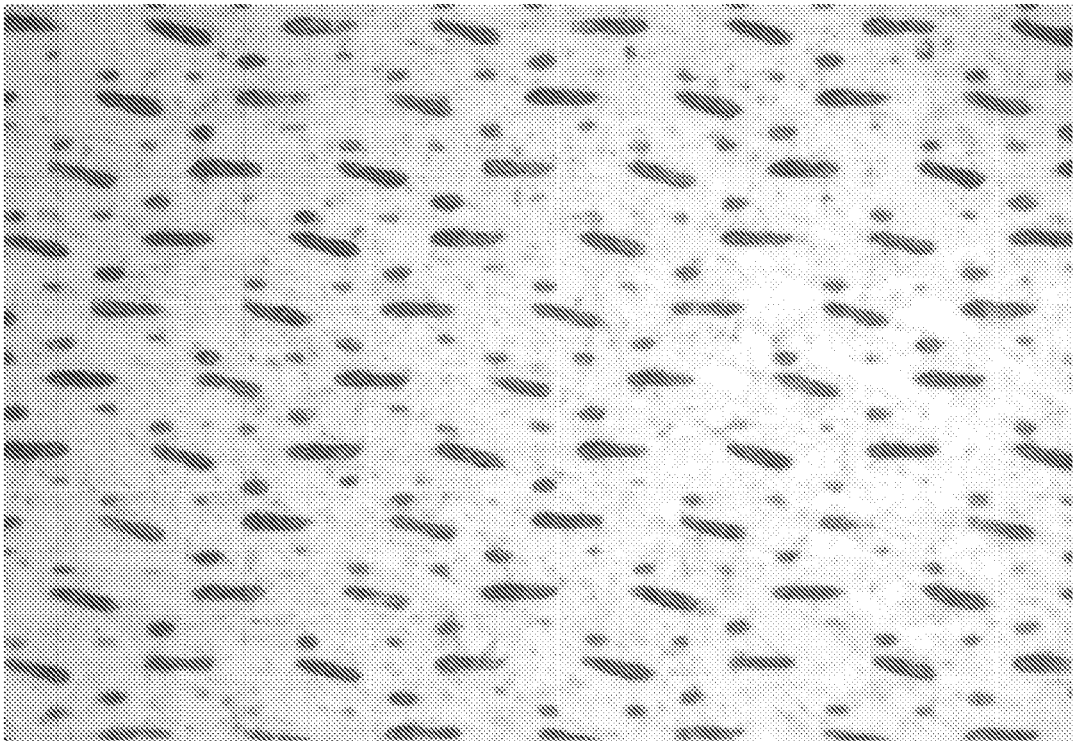
Figure 154:
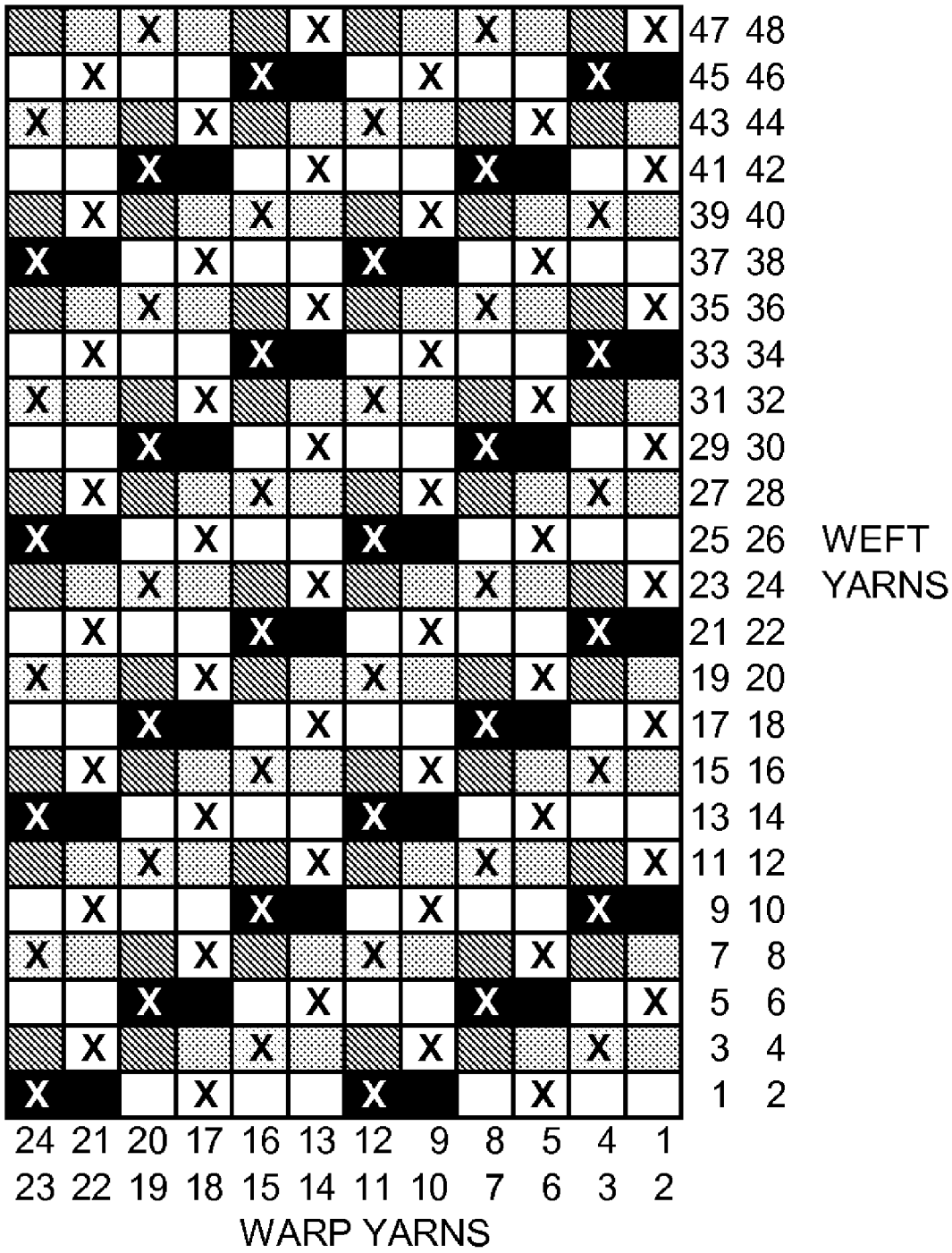
Figure 155:
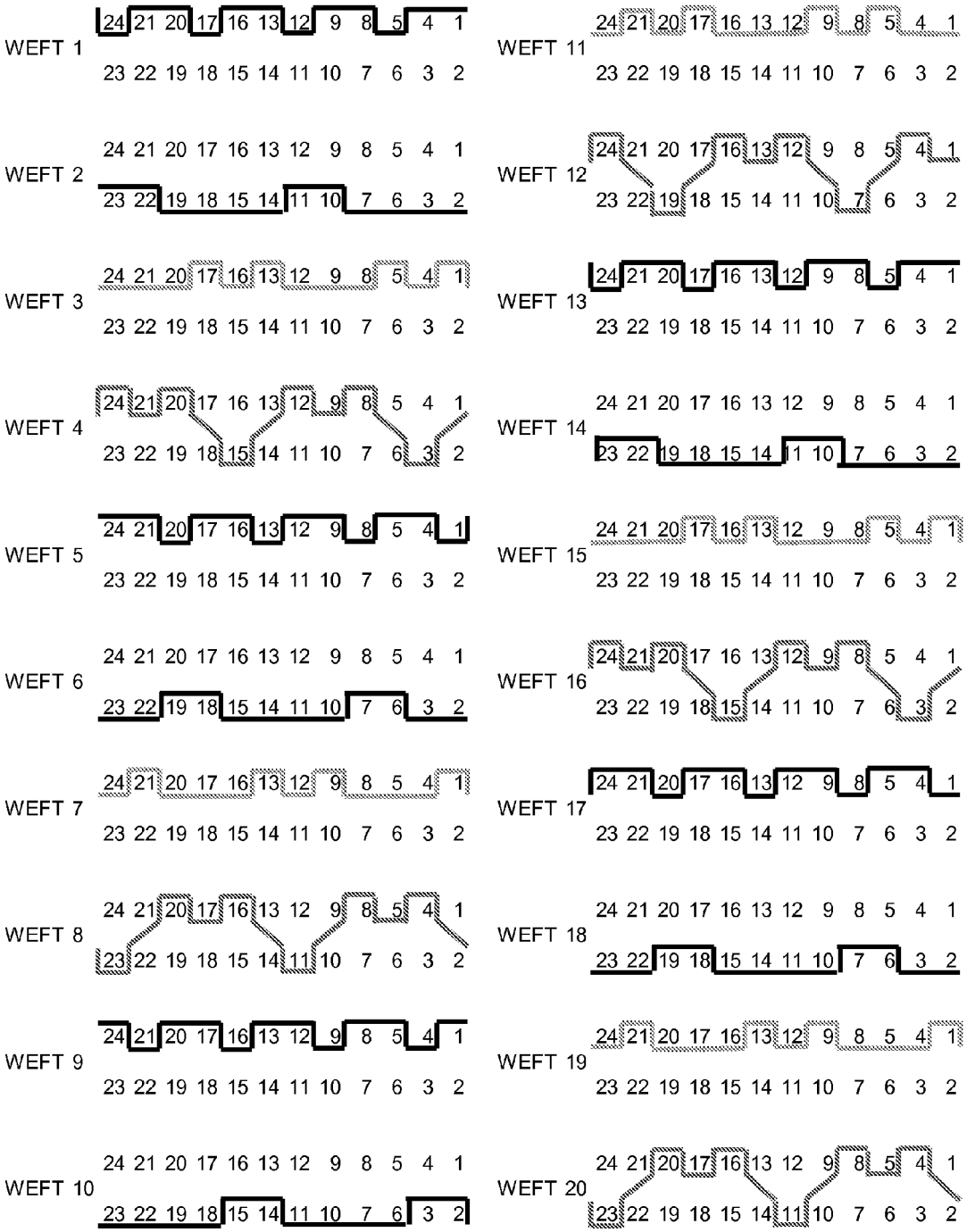
Figure 156:
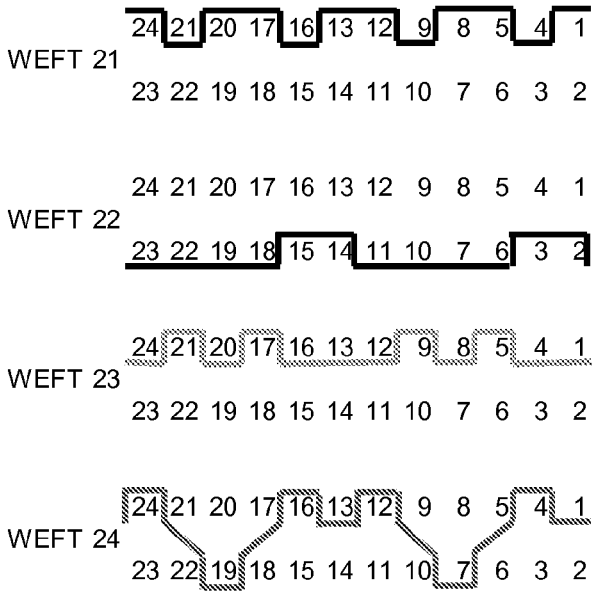
Figure 157:
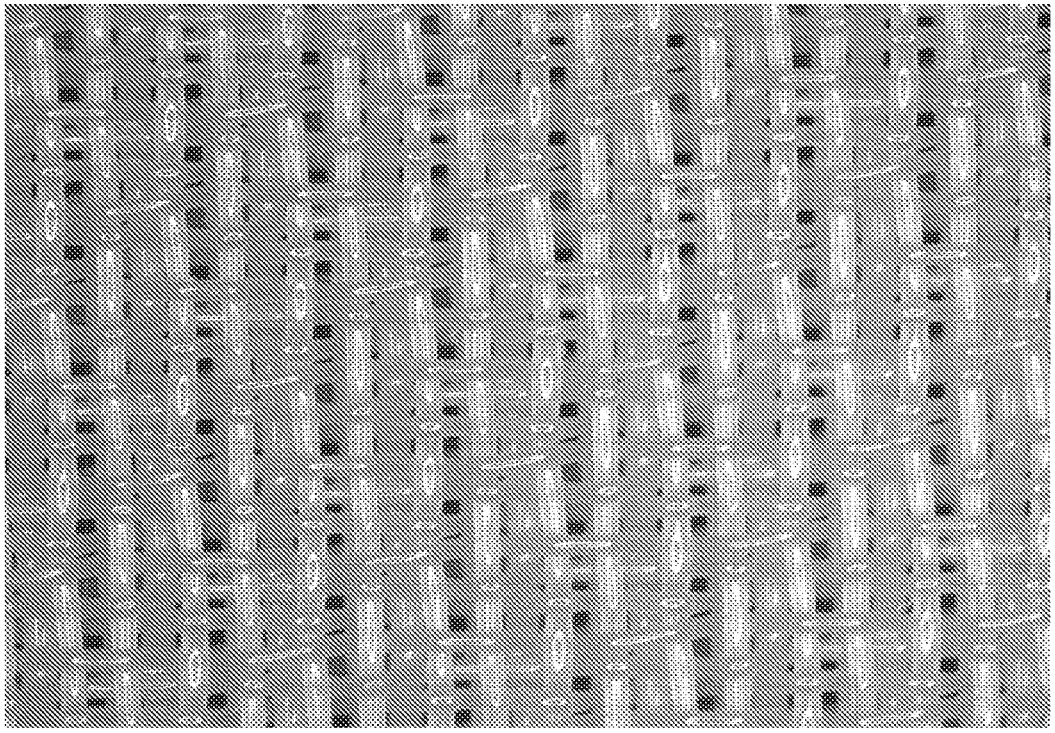
Figure 158:
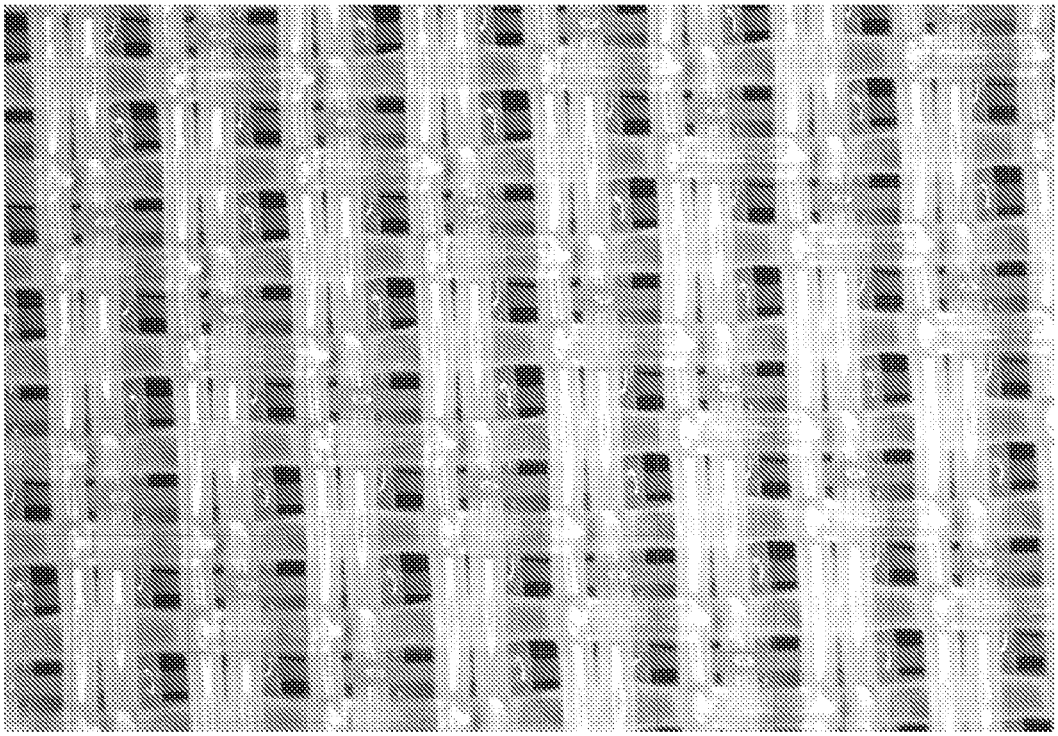
Figure 159:
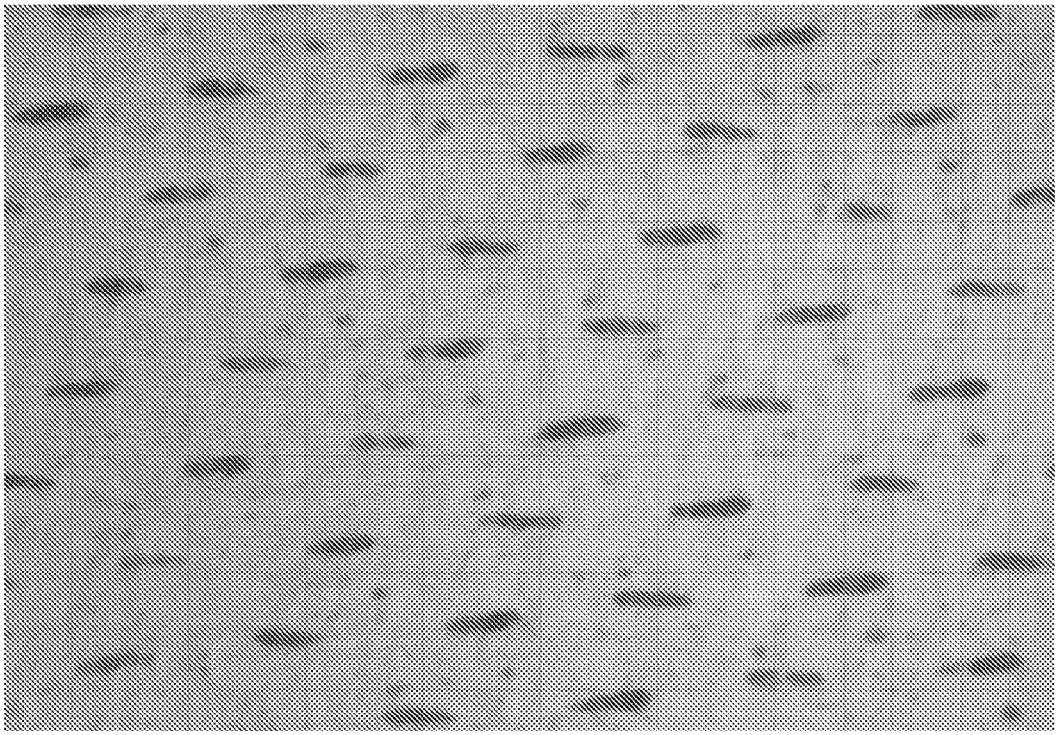
Figure 160:
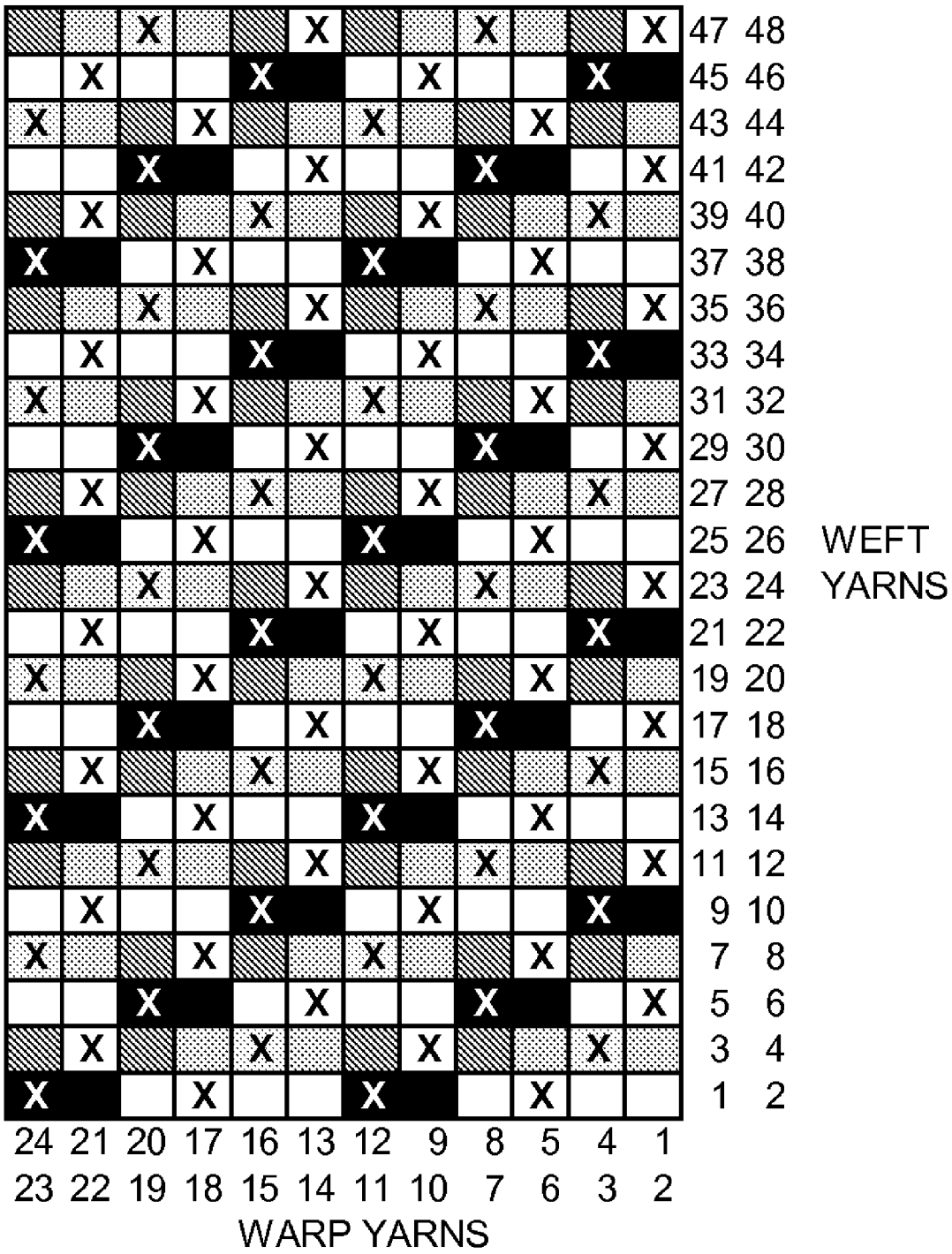
Figure 161:
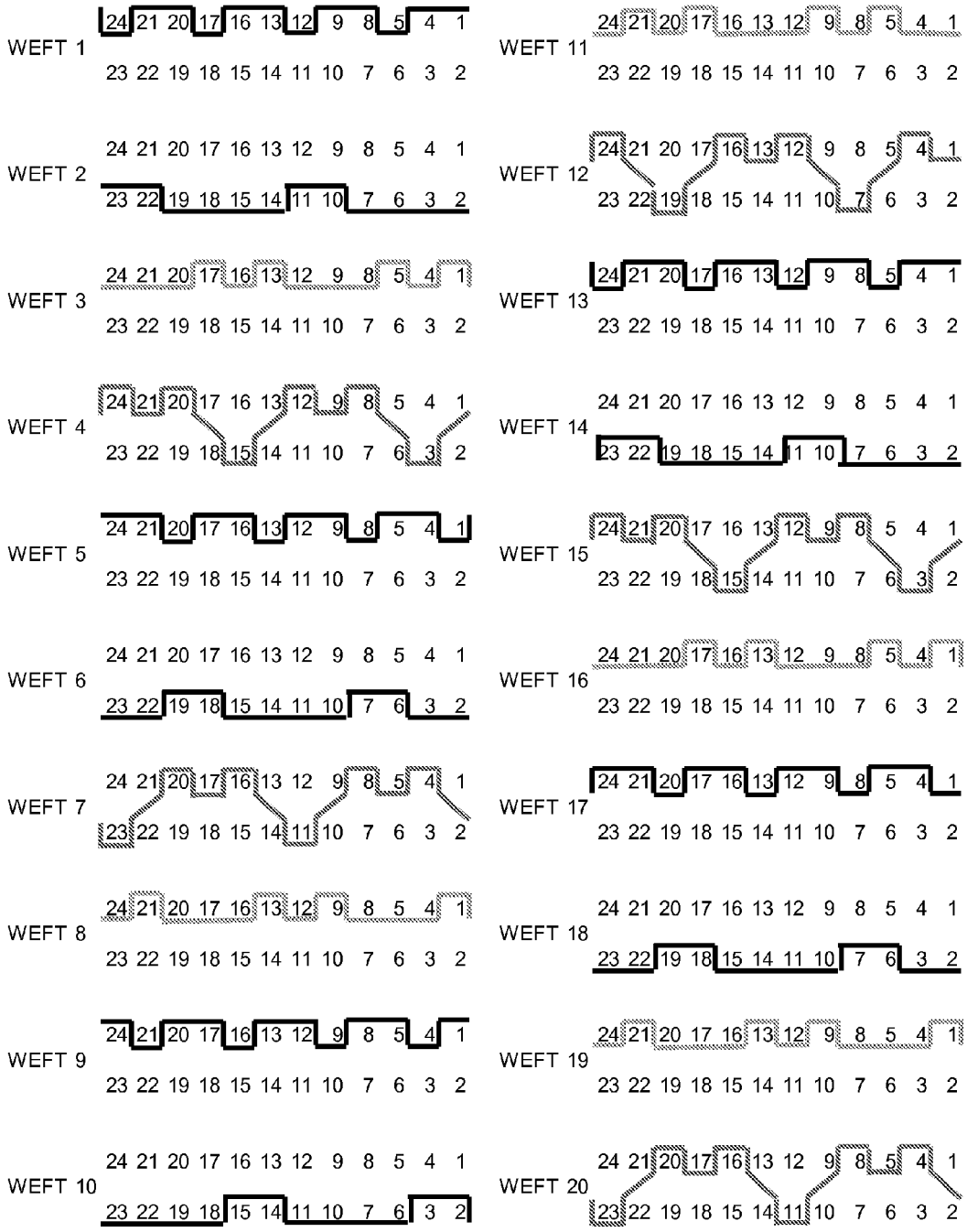
Figure 162:
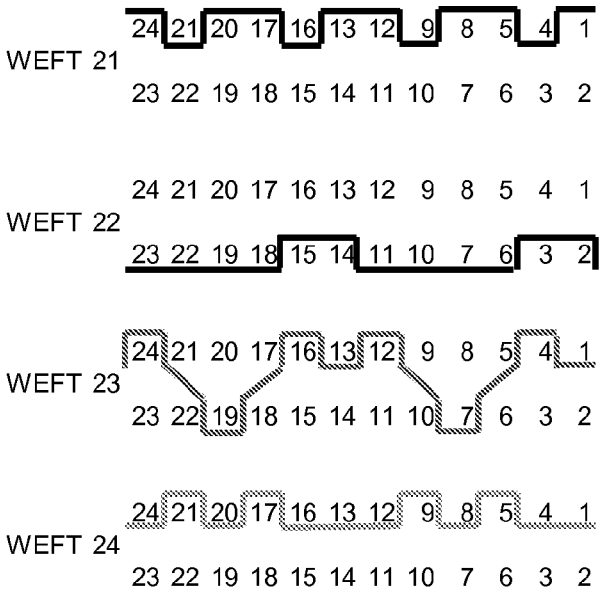
Figure 163:
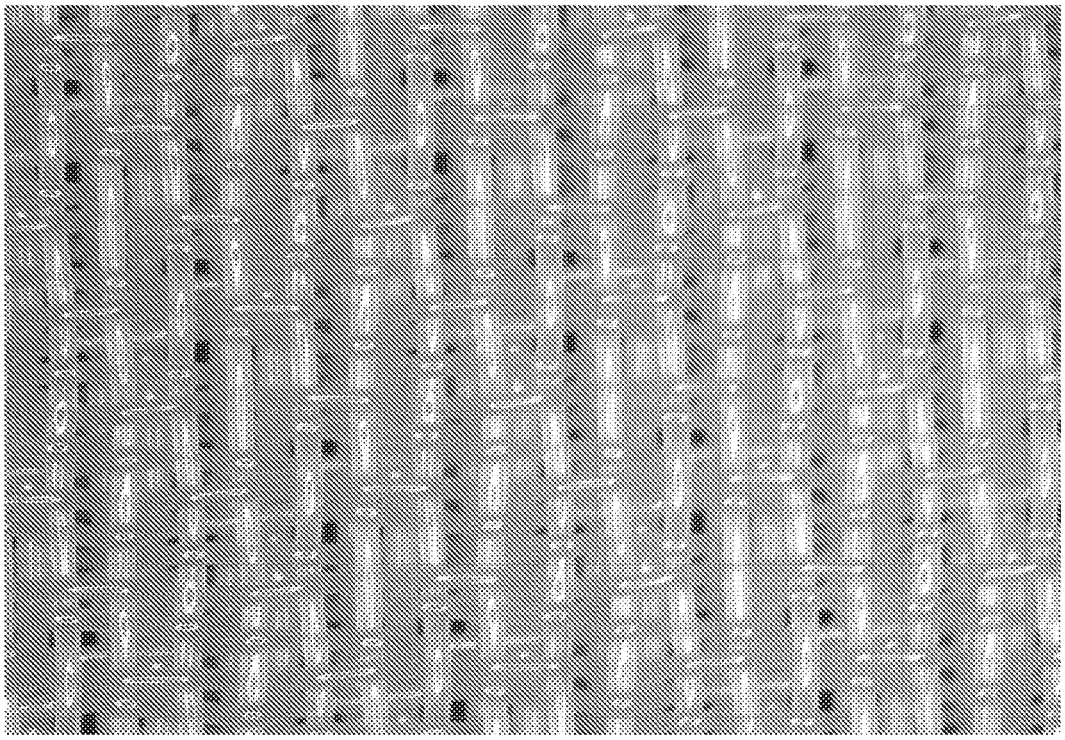
Figure 164:
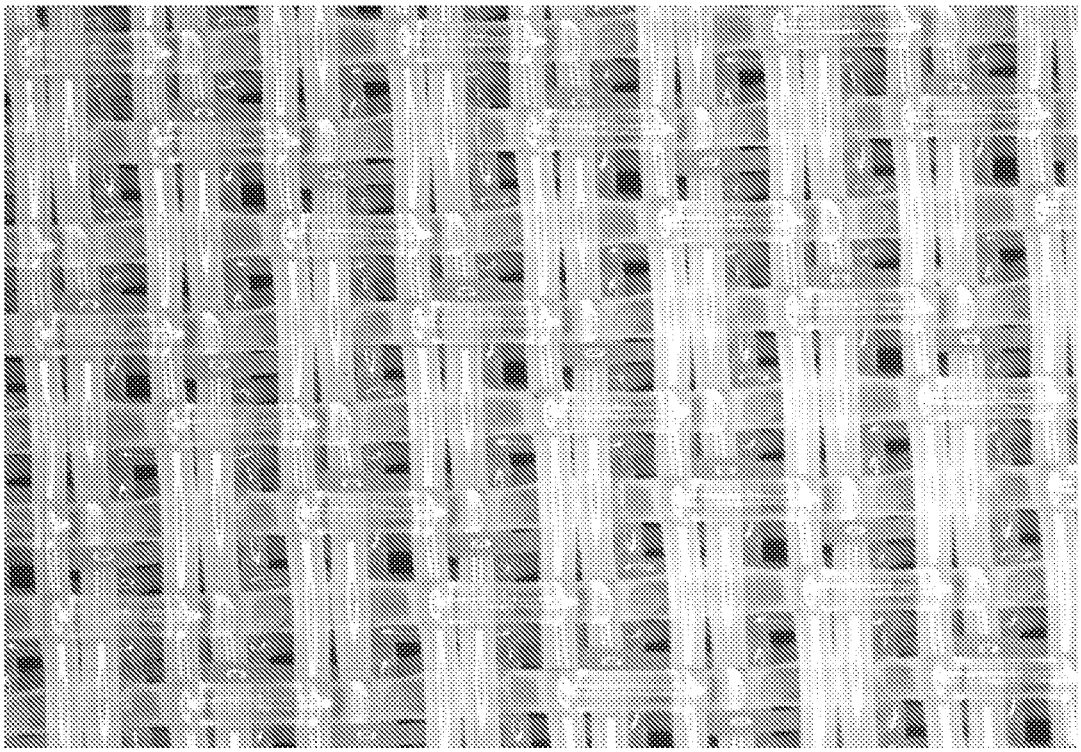
Figure 165:
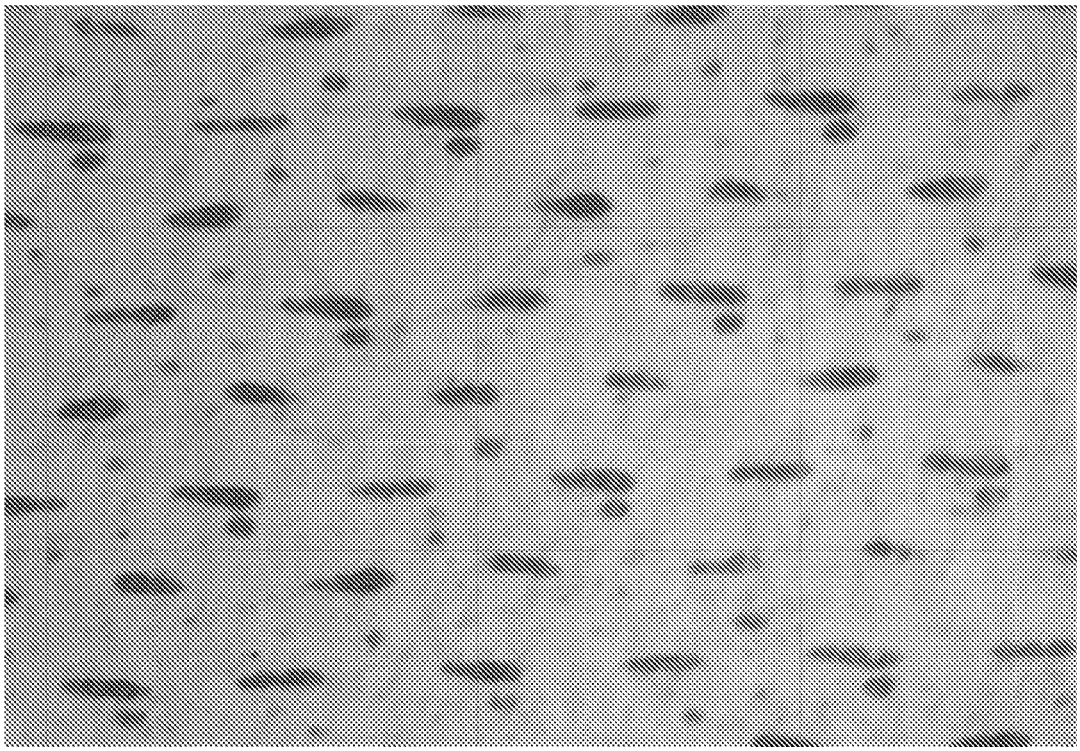
Figure 167:
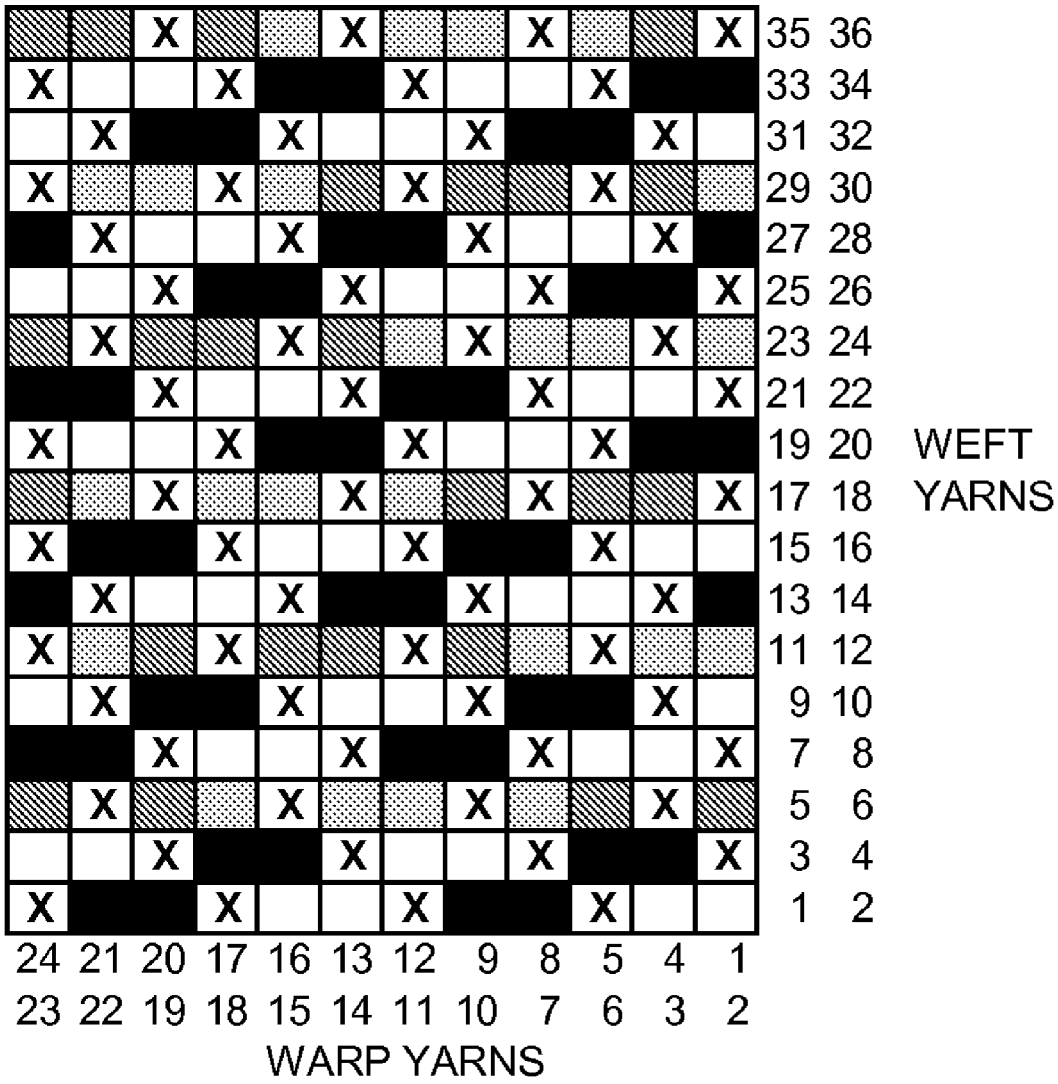
Figure 168:
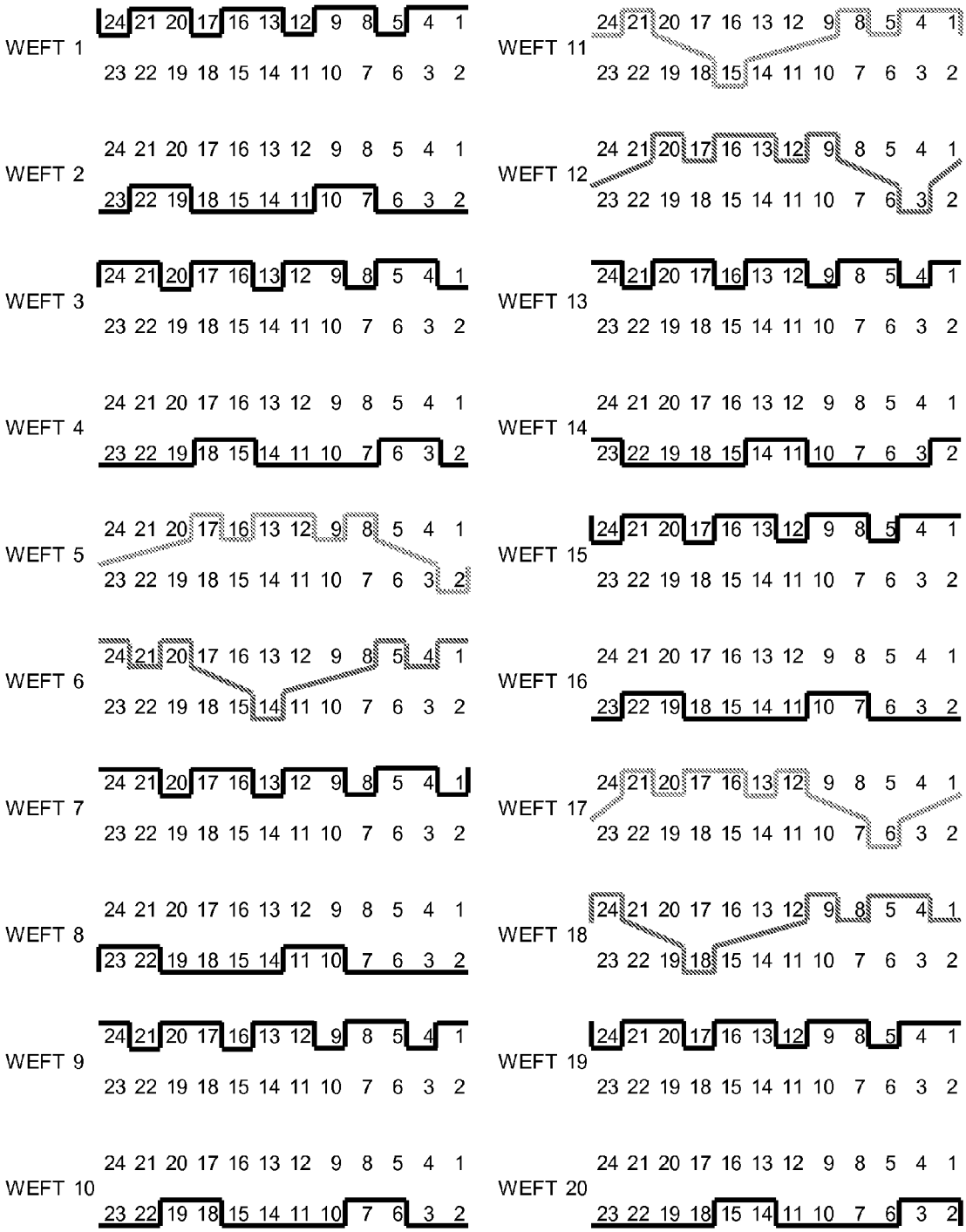
Figure 169:
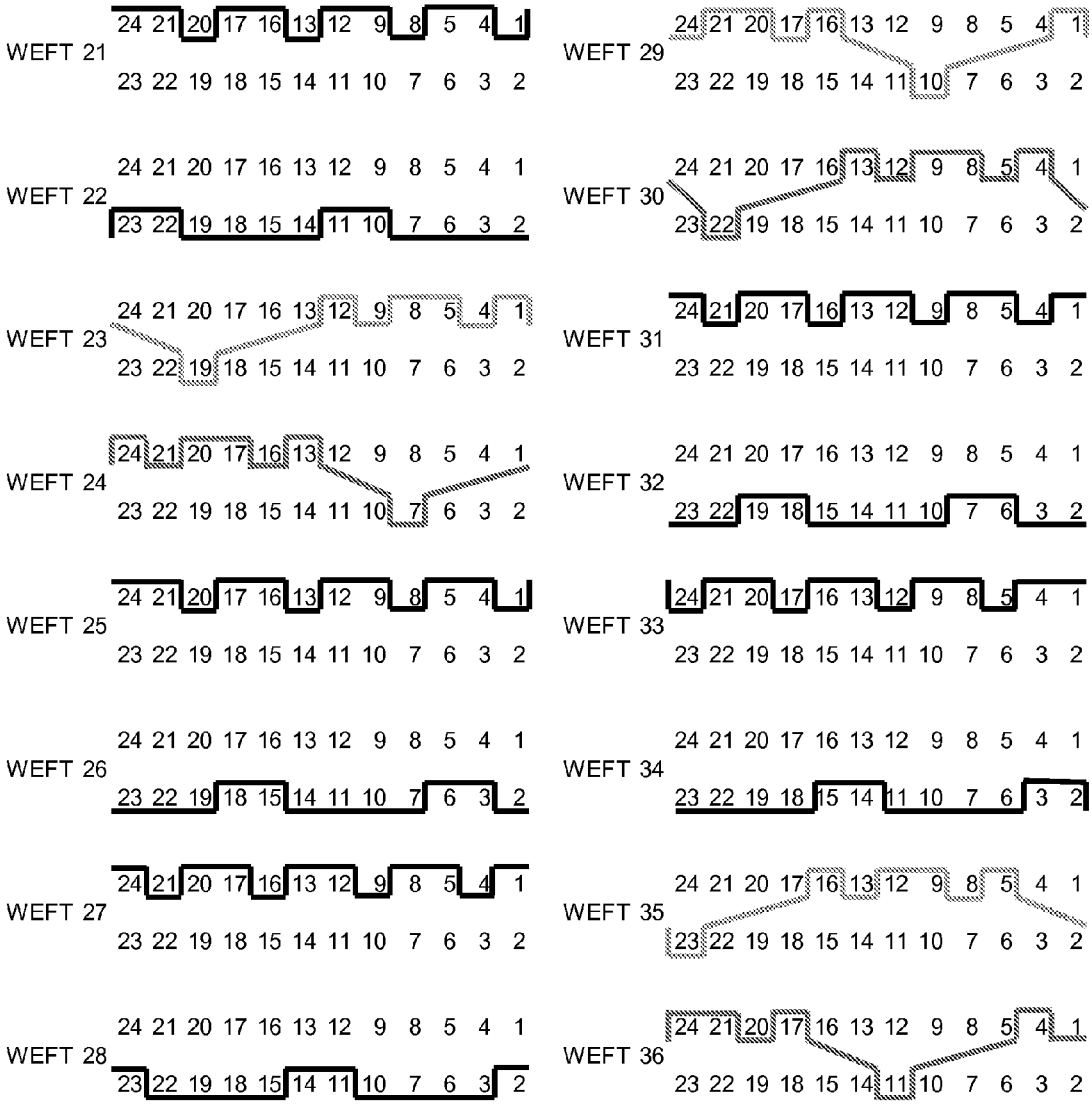
Figure 170:
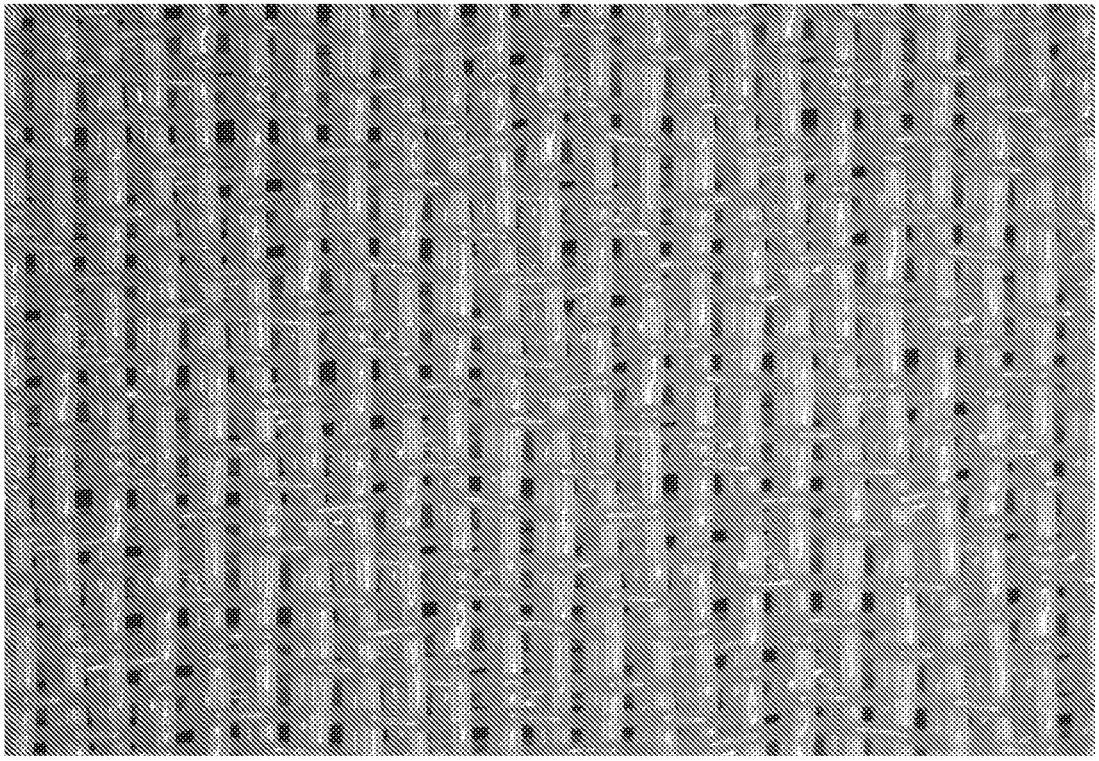
Figure 171:
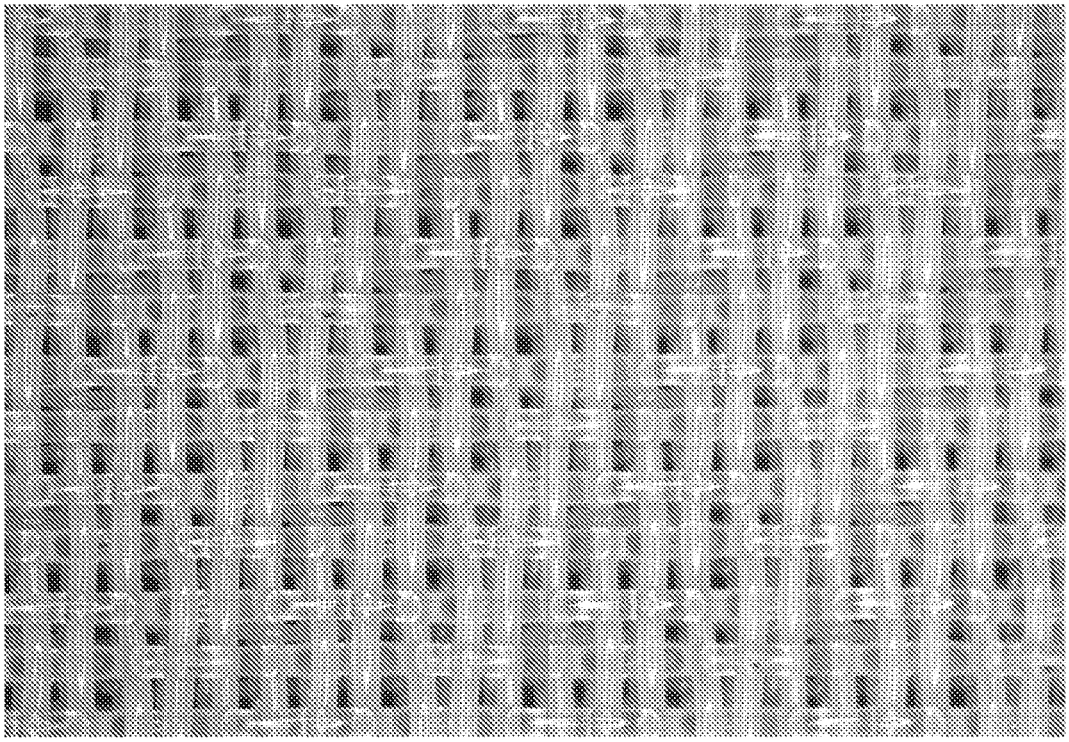
Figure 172:
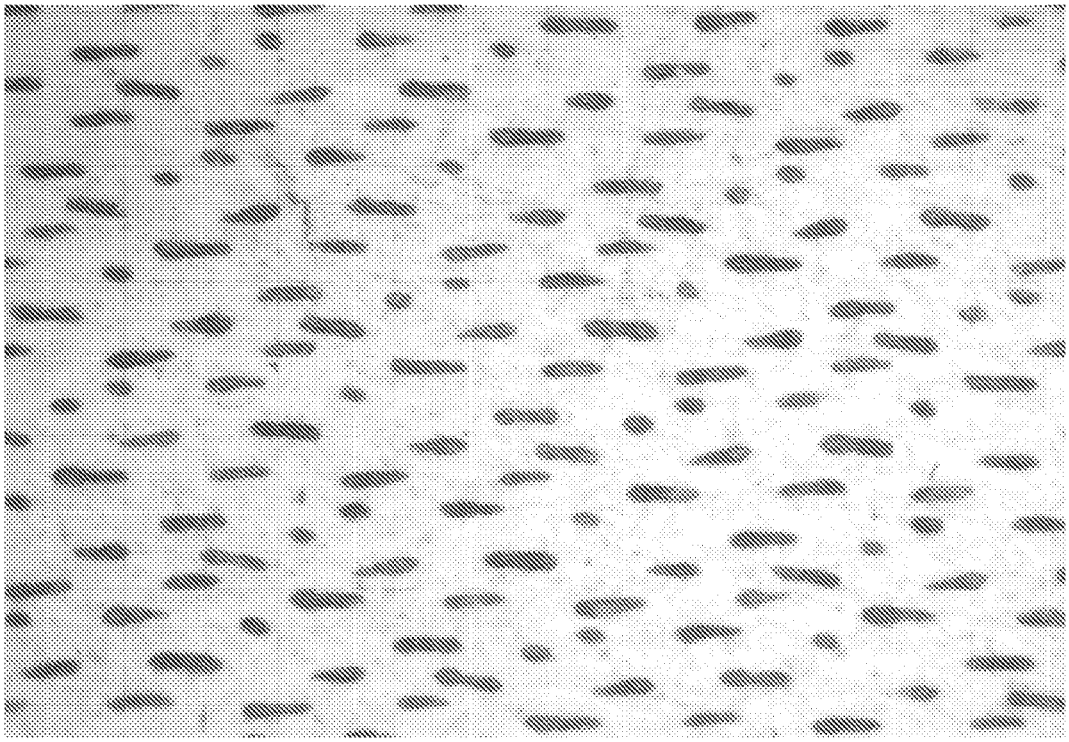
Figure 173:
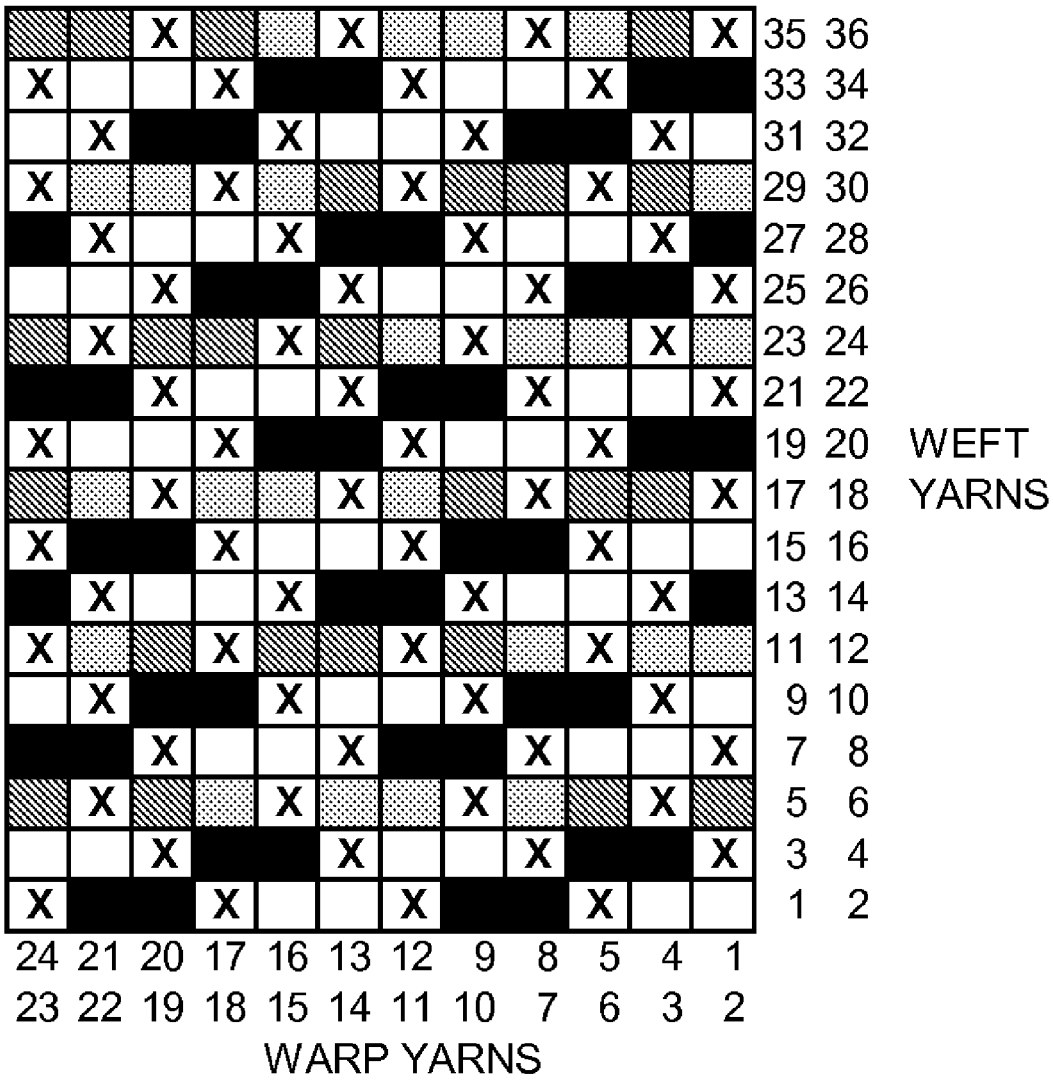
Figure 174:
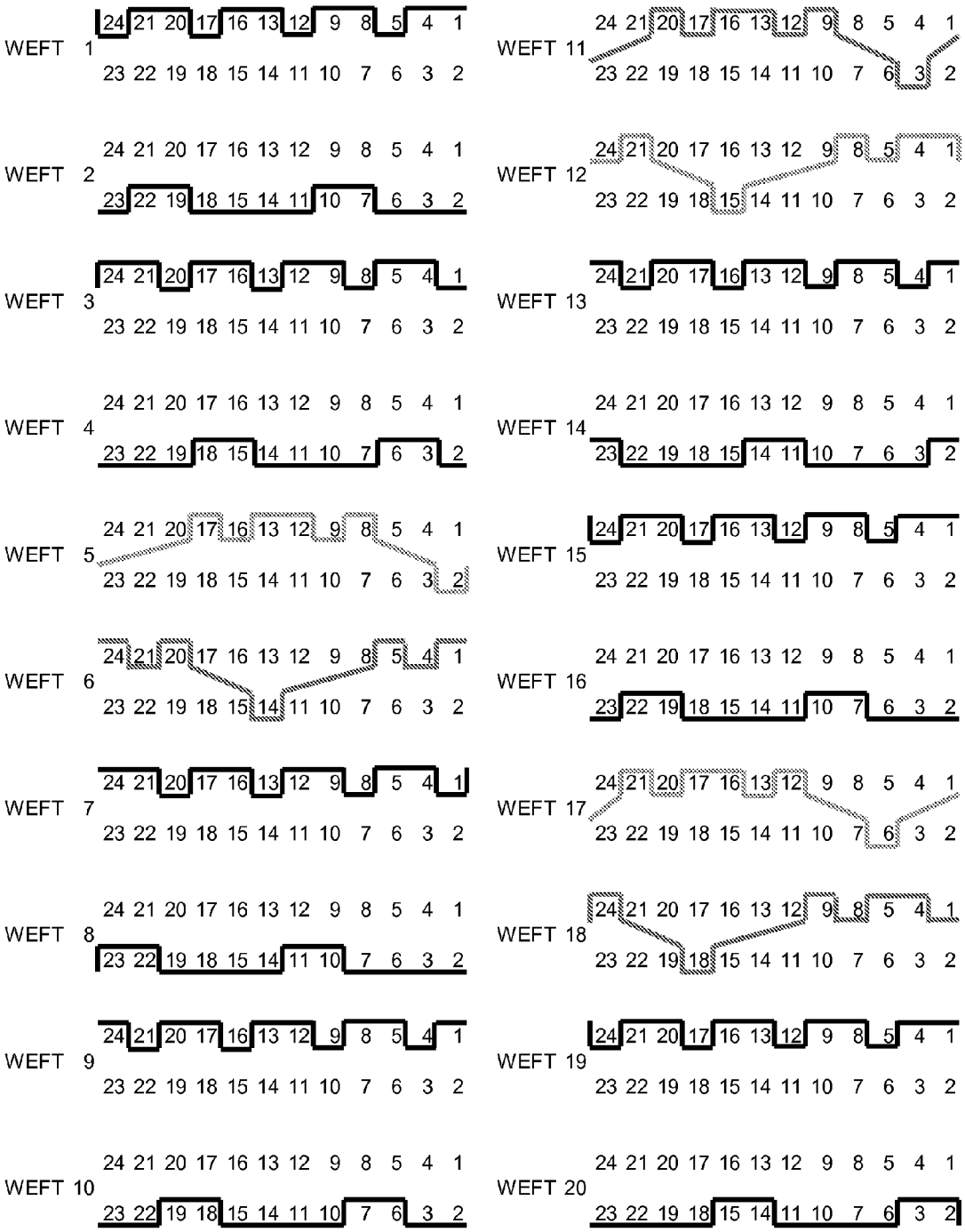
Figure 175:
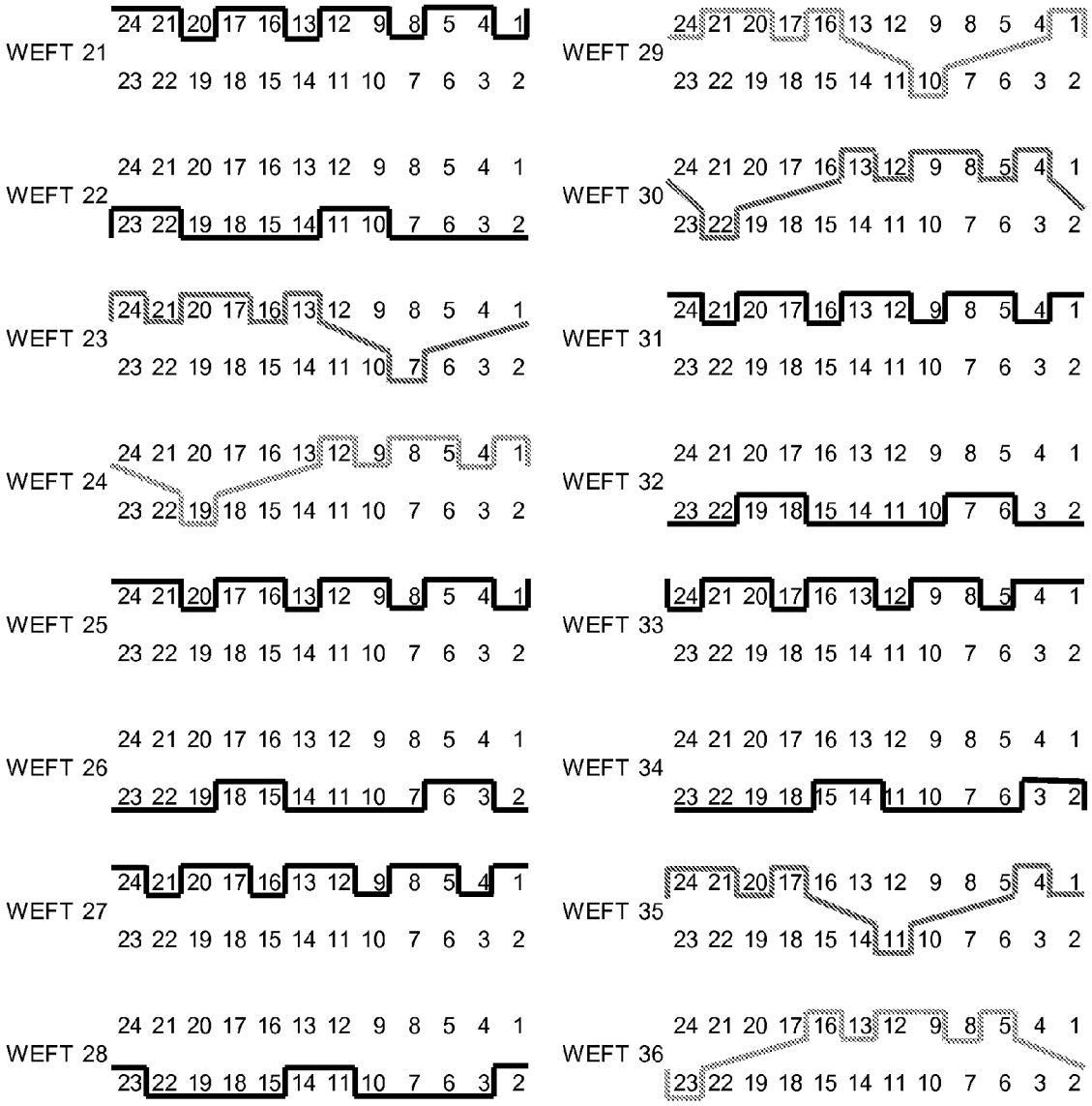
Figure 176:
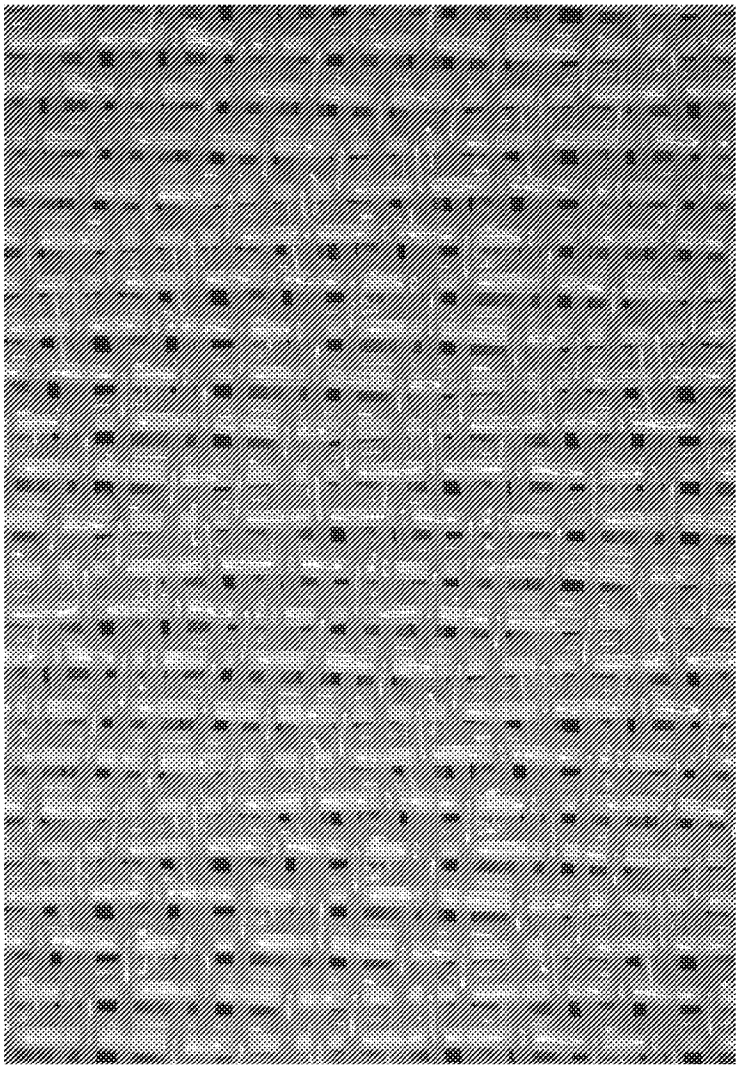
Figure 177:
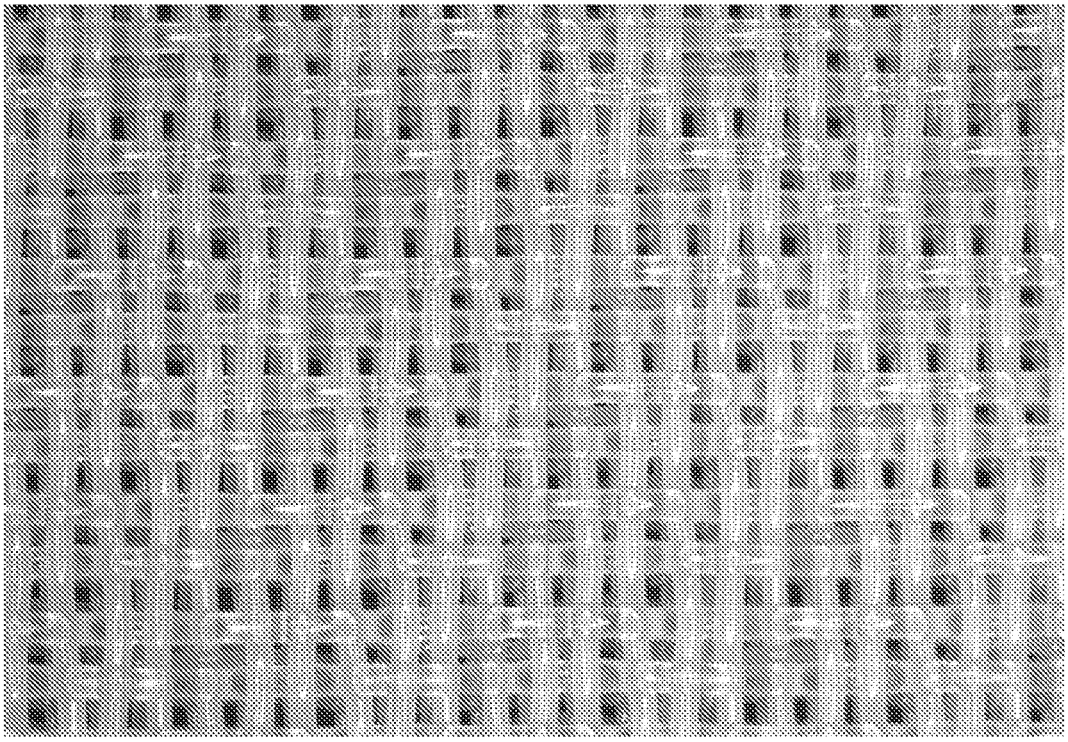
Figure 178:
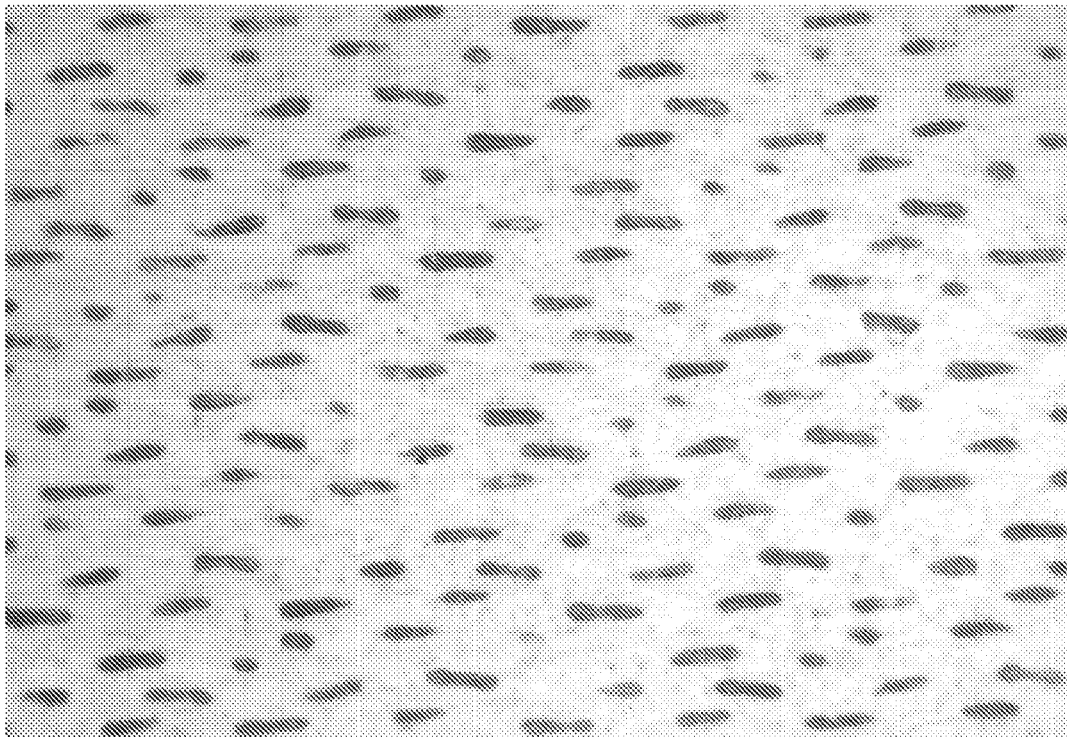
Figure 179:
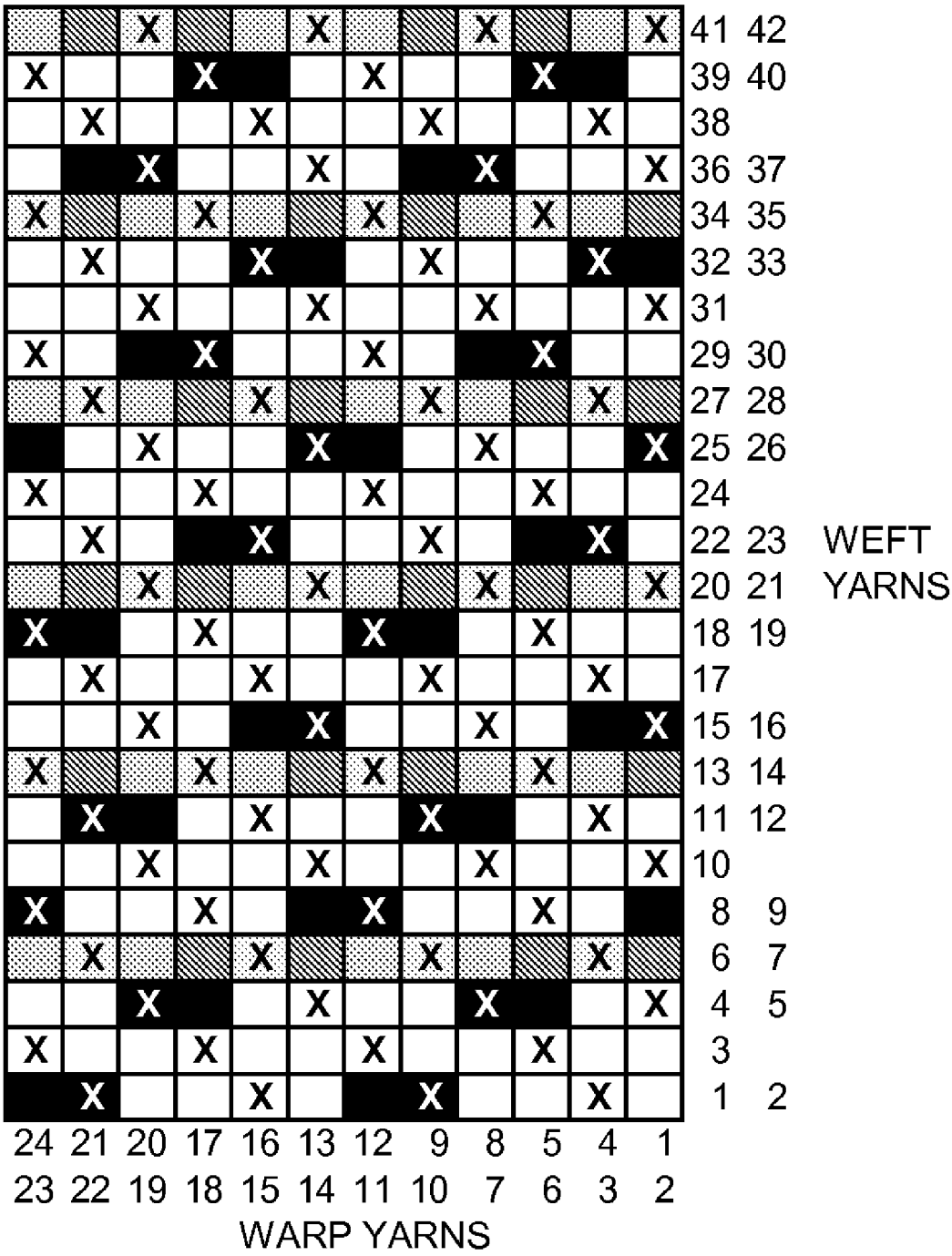
Figure 180:
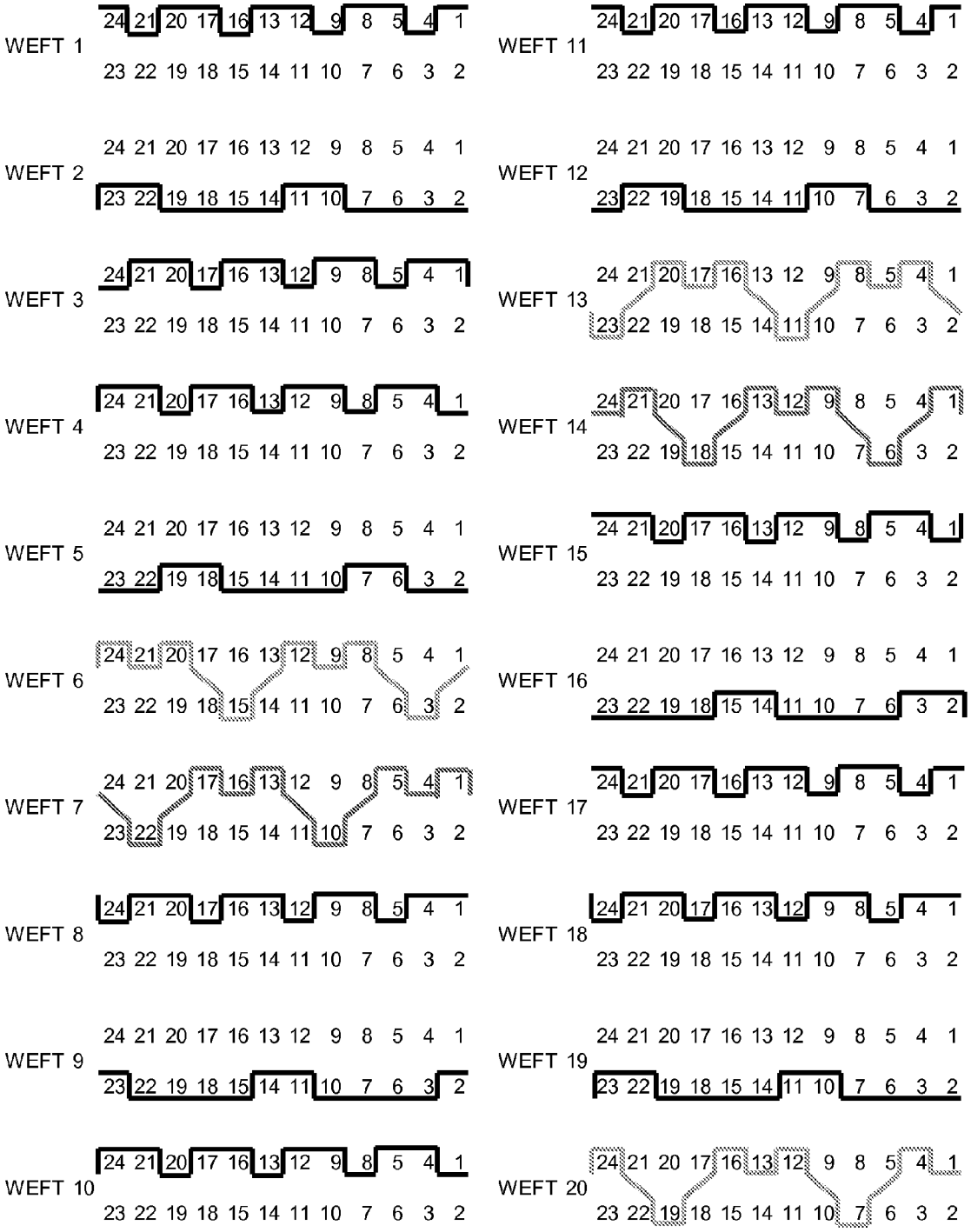
Figure 181:
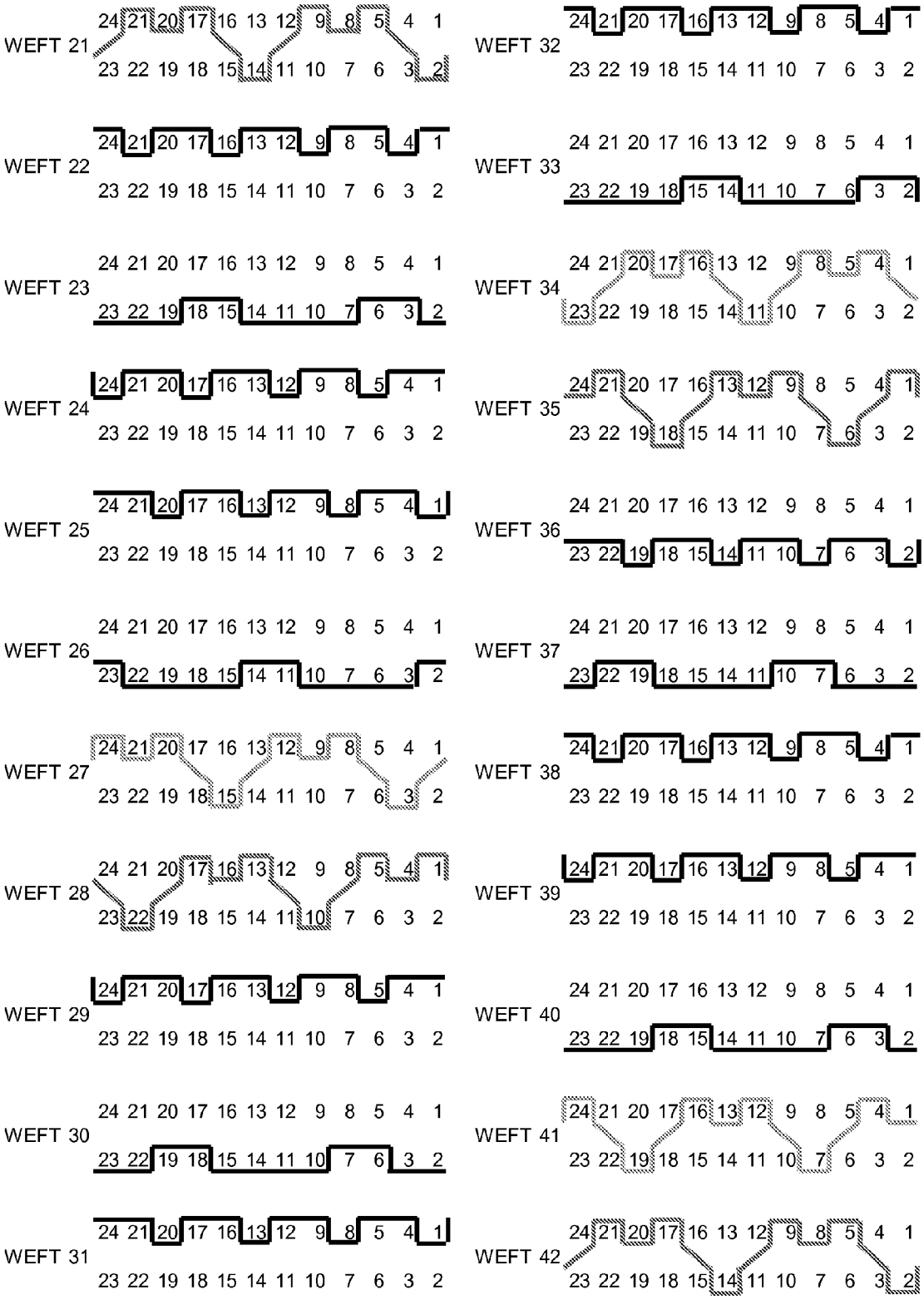
Figure 182:
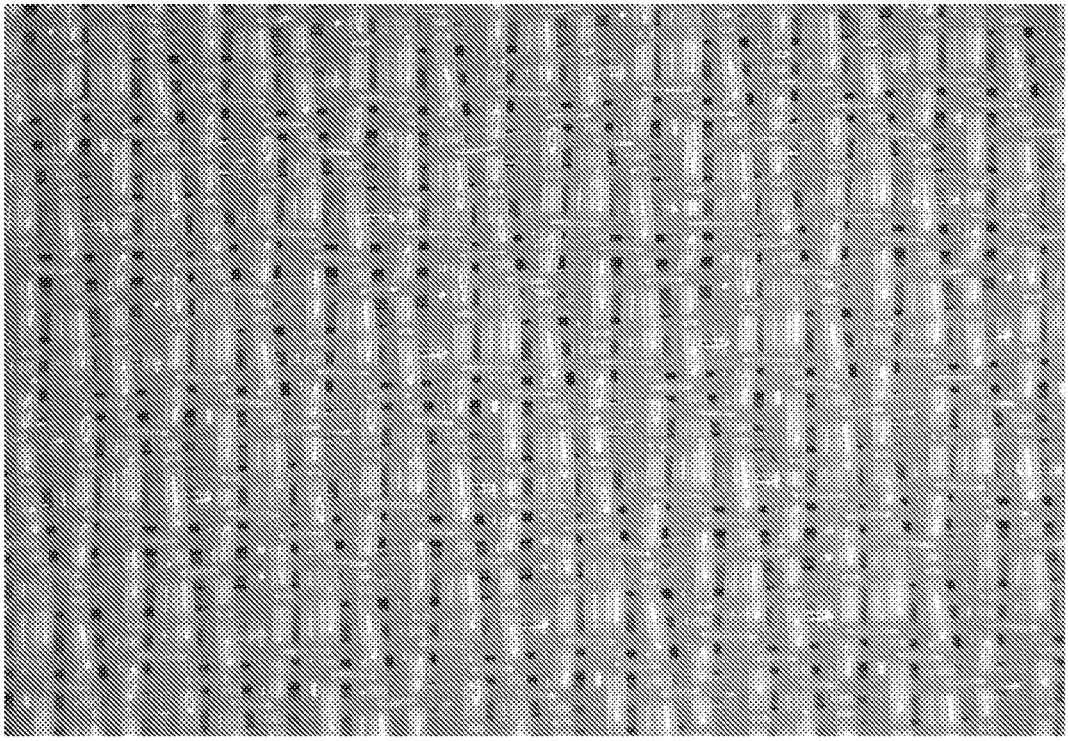
Figure 183:
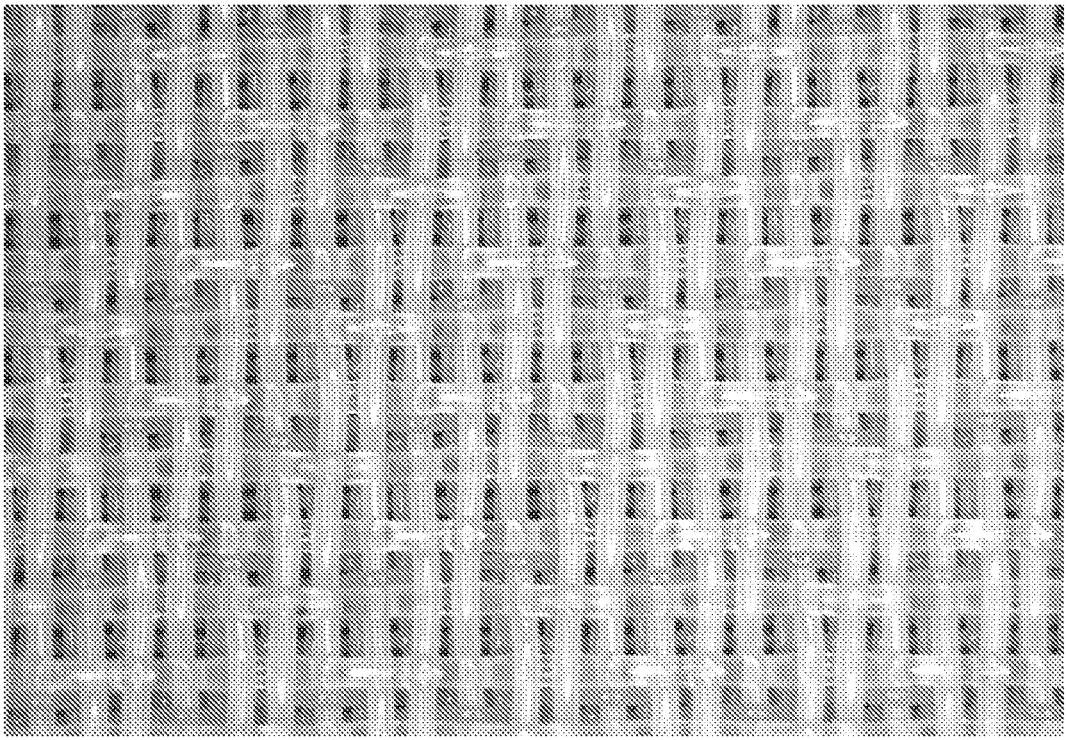
Figure 184:
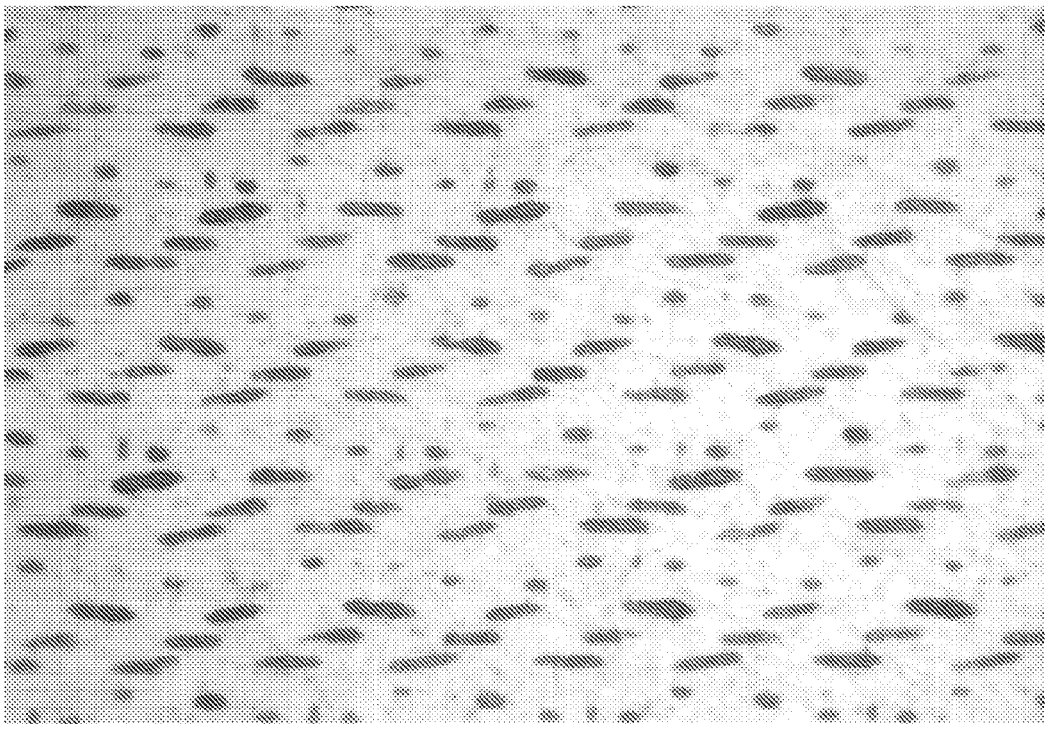
Figure 185:
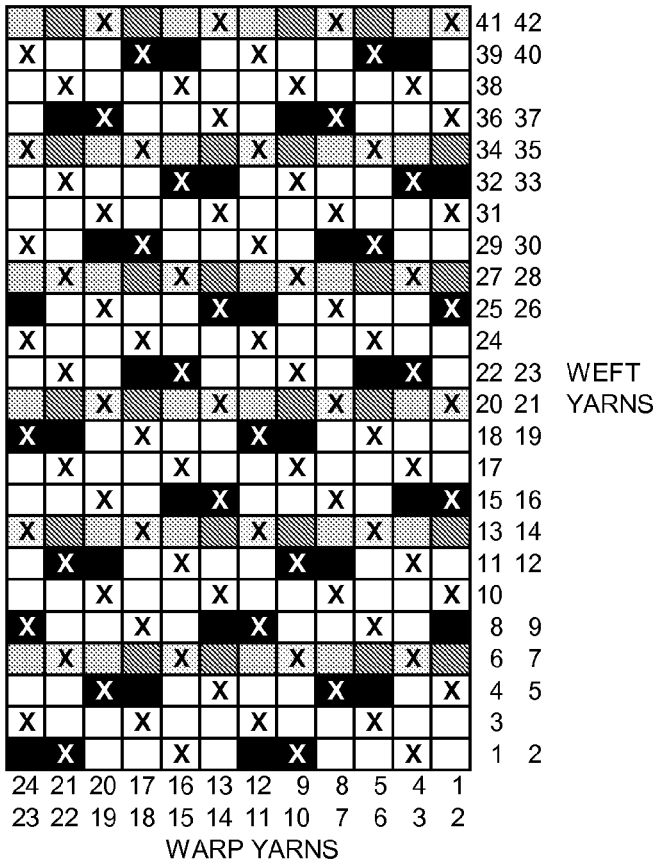
Figure 186:
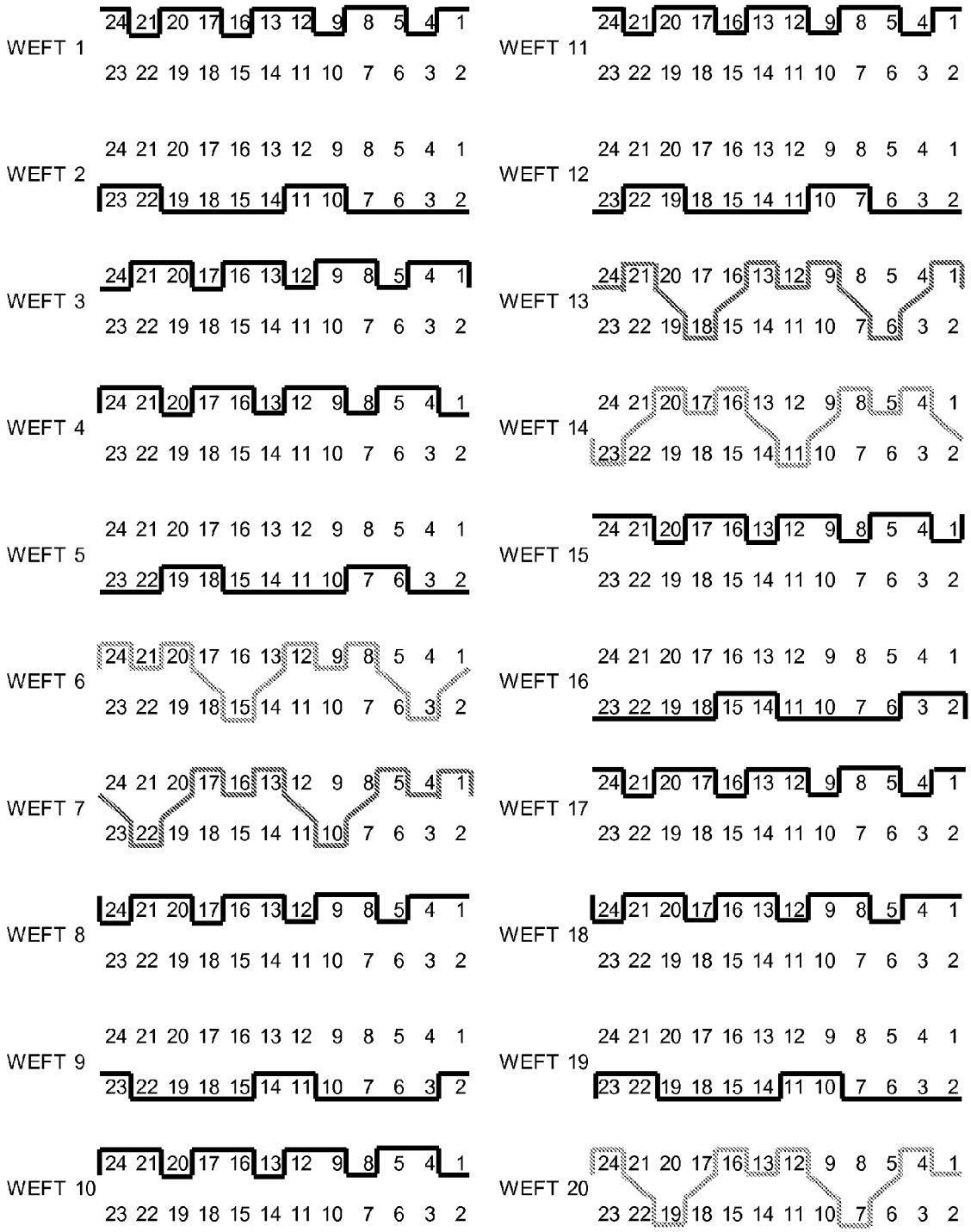
Figure 187:
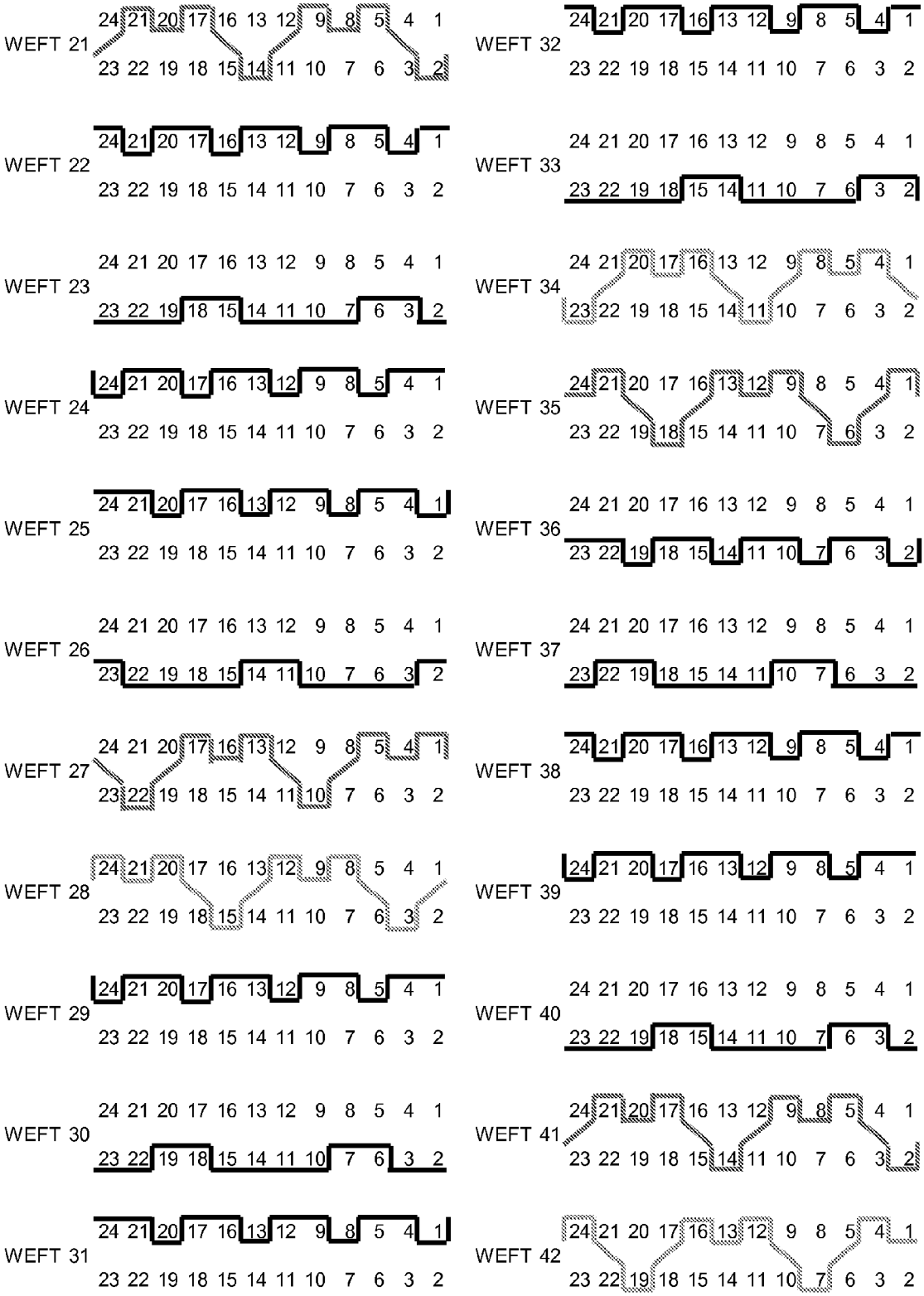
Figure 188:
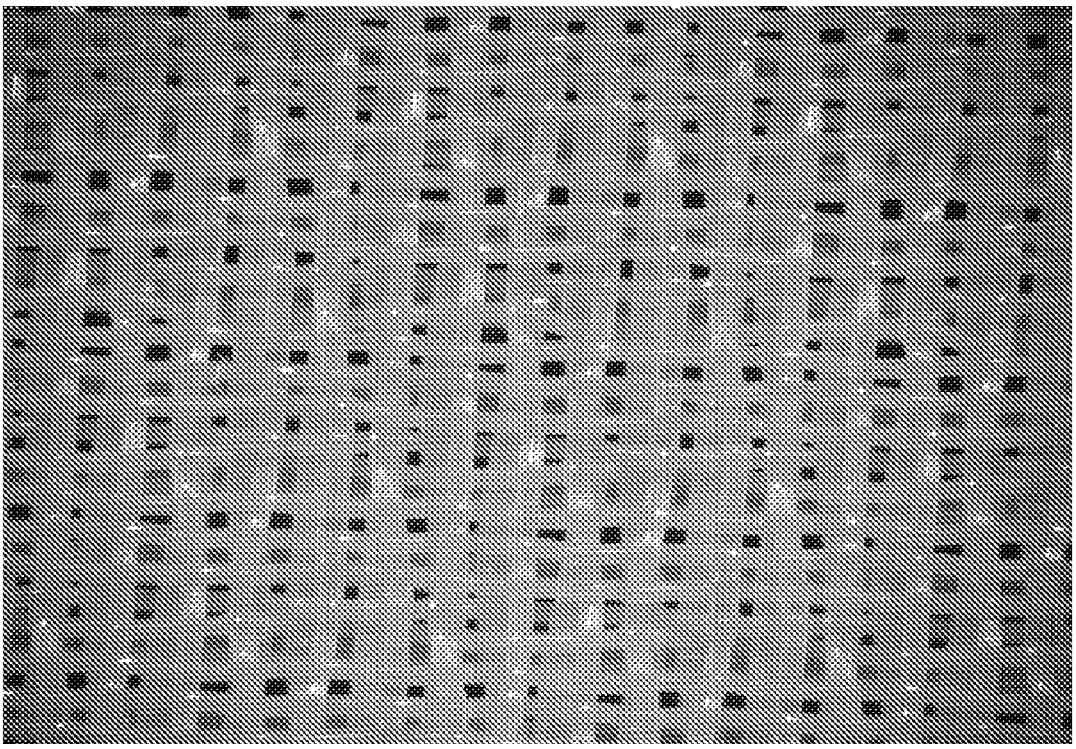
Figure 189:
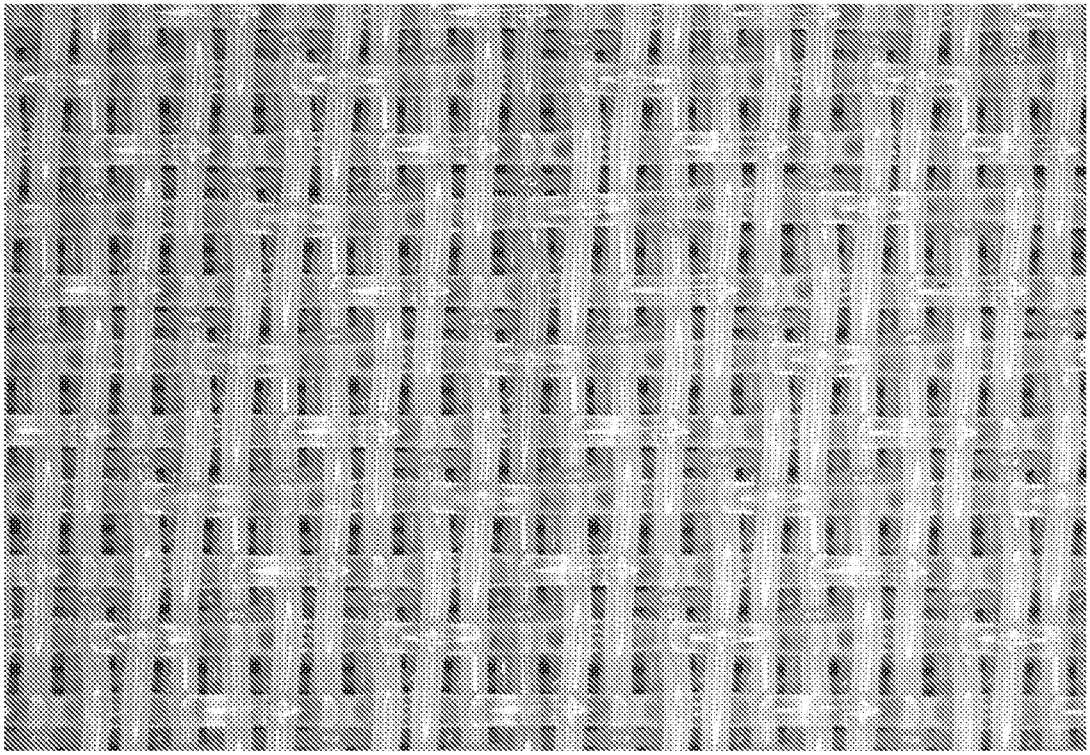
Figure 190:
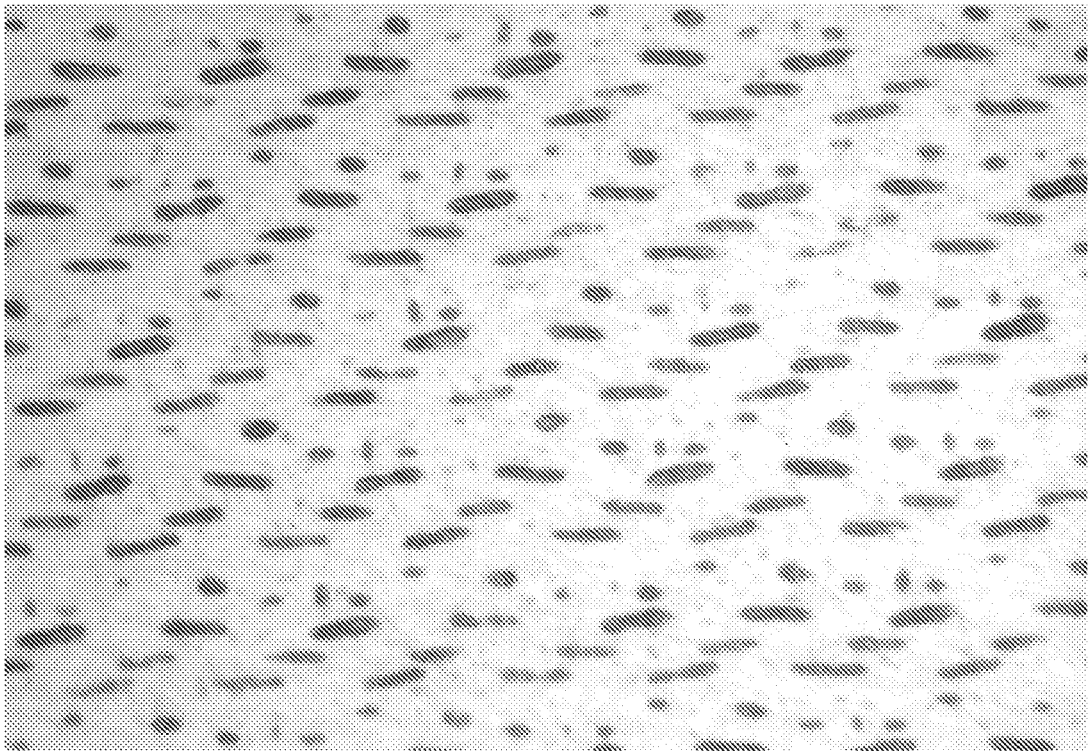
Figure 191:
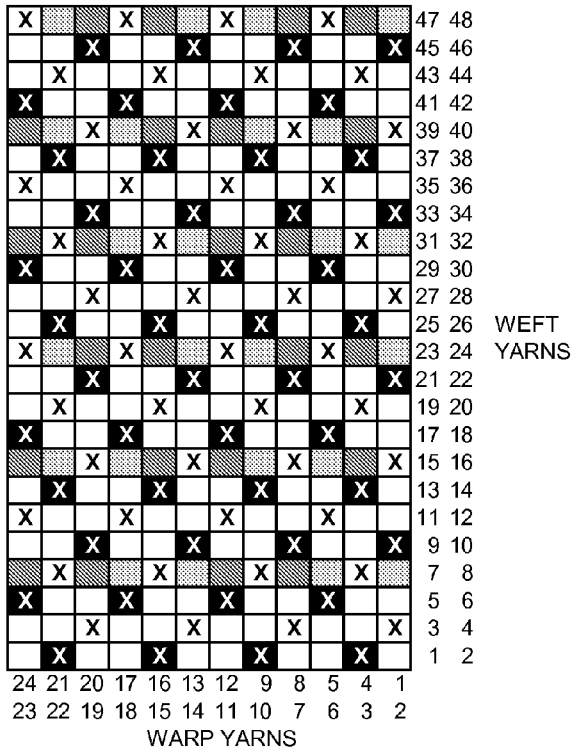
Figure 192:
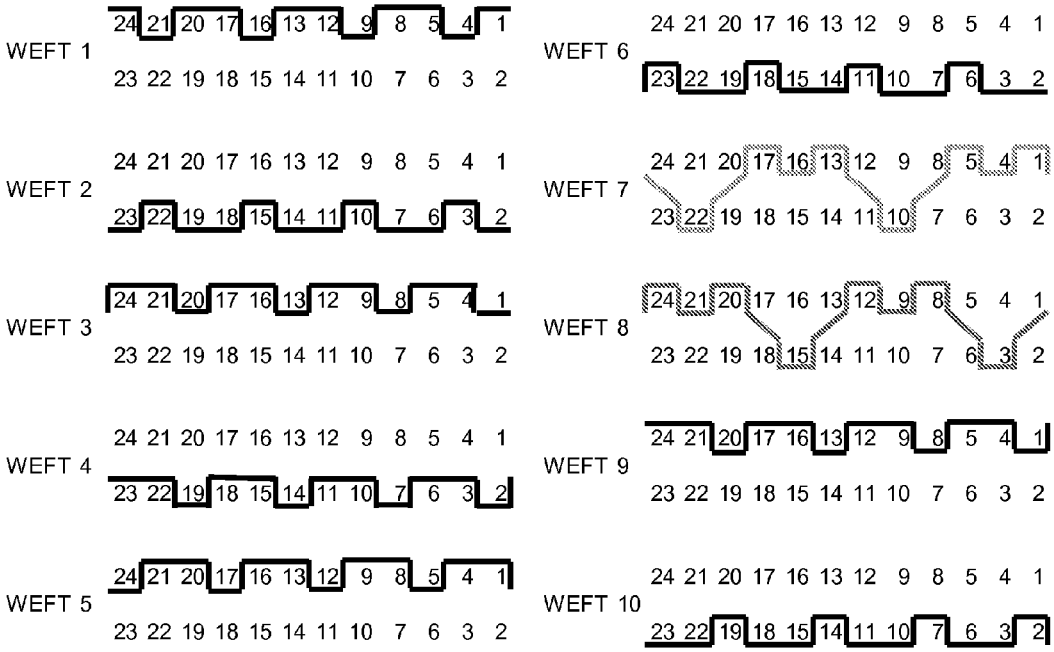
Figure 193:
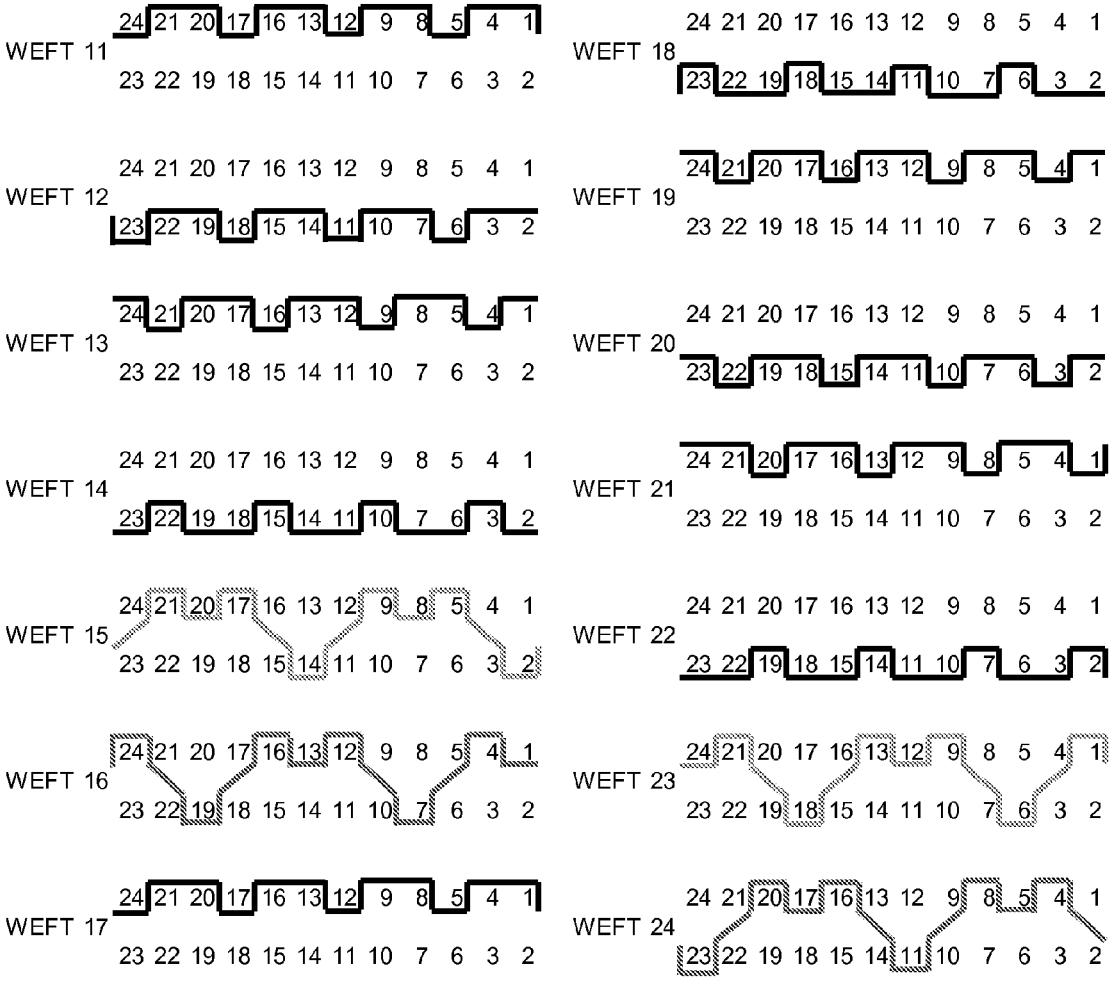
Figure 194:
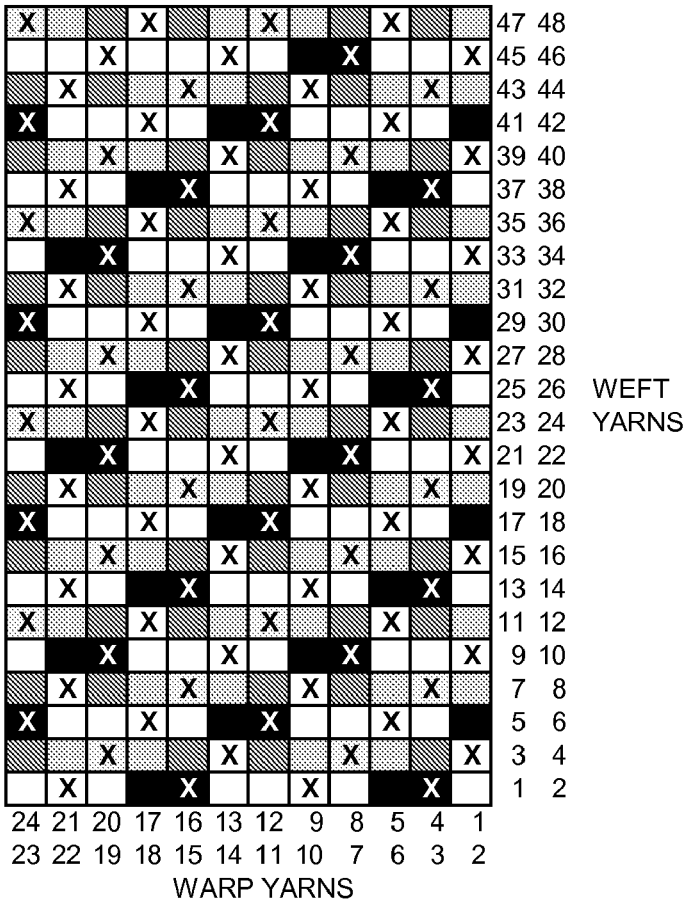
Figure 195:
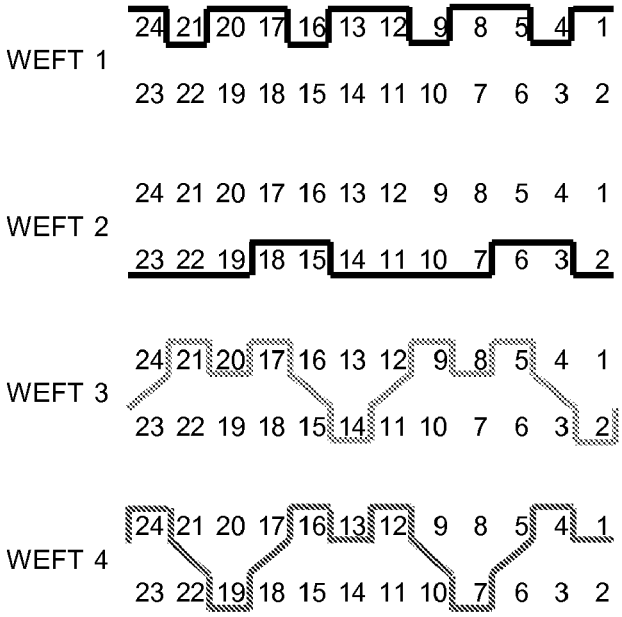
Figure 196:
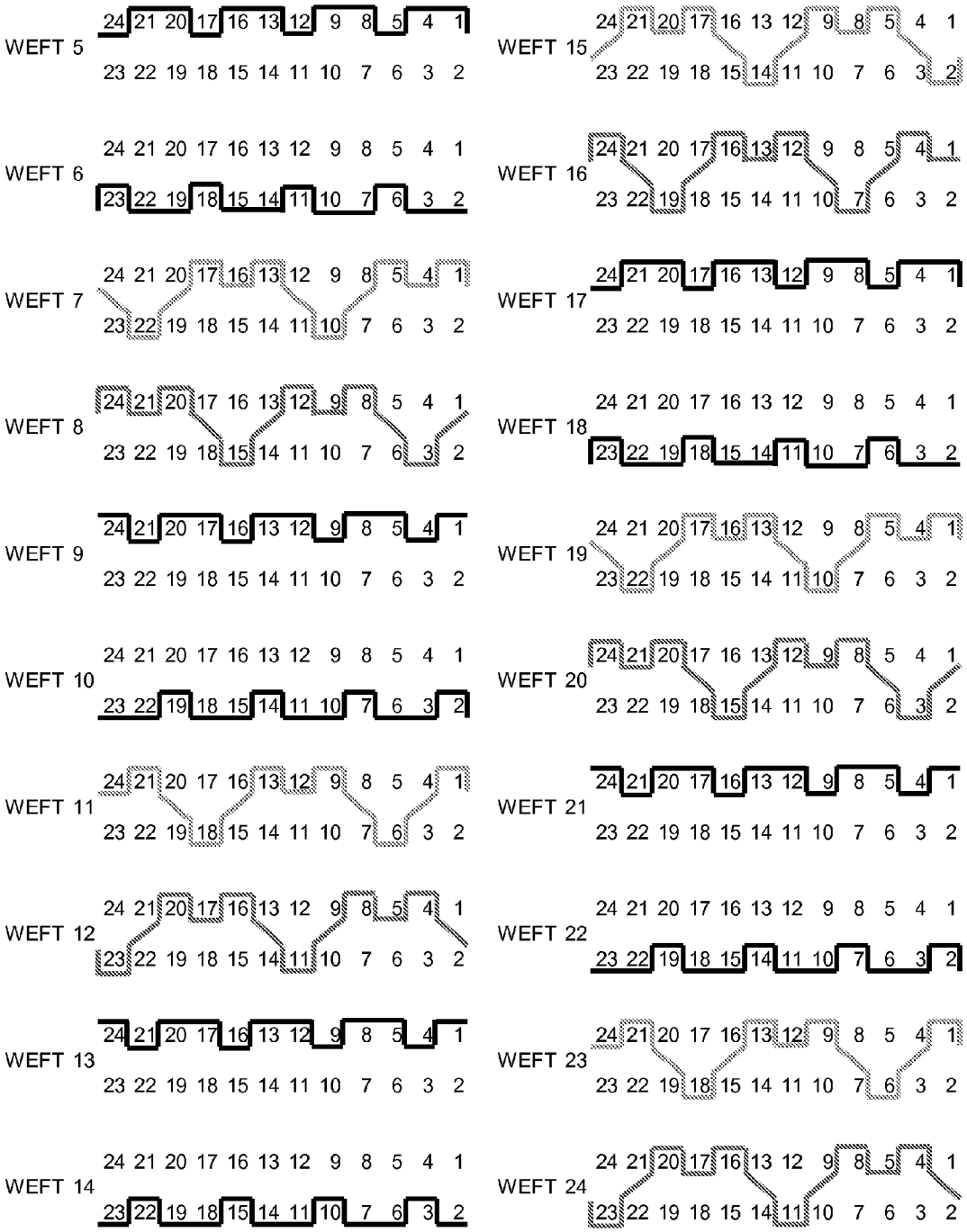

FIG. 129 shows a photograph of an impression of the upper surface of the forming fabric of FIG. 124;

FIG. 130 shows a repeating pattern area of a thirty ninth embodiment of a forming fabric according to the invention;

FIG. 131 shows a schematic representation of the weave pattern of individual weft yarns of FIG. 130 with the top and bottom warp yarns;

FIG. 132 shows an additional schematic representation of the weave pattern of individual weft yarns of FIG. 130 with the top and bottom warp yarns;

FIG. 133 shows a photograph of the upper surface or paper-facing surface of the forming fabric of FIG. 130;

FIG. 134 shows a photograph of a bottom layer of the forming fabric of FIG. 130;

FIG. 135 shows a photograph of an impression of the upper surface of the forming fabric of FIG. 130;

FIG. 136 shows a repeating pattern area of a fortieth embodiment of a forming fabric according to the invention;

FIG. 137 shows a schematic representation of the weave pattern of individual weft yarns of FIG. 136 with the top and bottom warp yarns;

FIG. 138 shows an additional schematic representation of the weave pattern of individual weft yarns of FIG. 136 with the top and bottom warp yarns;

FIG. 139 shows another photograph of the upper surface or paper-facing surface of the forming fabric of FIG. 136;

FIG. 140 shows a photograph of a bottom layer of the forming fabric of FIG. 136;

FIG. 141 shows a photograph of an impression of the upper surface of the forming fabric of FIG. 136;

FIG. 142 shows a repeating pattern area of a forty first embodiment of a forming fabric according to the invention;

FIG. 143 shows a schematic representation of the weave pattern of individual weft yarns of FIG. 142 with the top and bottom warp yarns;

FIG. 144 shows an additional schematic representation of the weave pattern of individual weft yarns of FIG. 142 with the top and bottom warp yarns;

FIG. 145 shows a photograph of the upper surface or paper-facing surface of the forming fabric of FIG. 142;

FIG. 146 shows a photograph of a bottom layer of the forming fabric of FIG. 142;

FIG. 147 shows a photograph of an impression of the upper surface of the forming fabric of FIG. 142;

FIG. 148 shows a repeating pattern area of a forty second embodiment of a forming fabric according to the invention;

FIG. 149 shows a schematic representation of the weave pattern of individual weft yarns of FIG. 148 with the top and bottom warp yarns;

FIG. 150 shows an additional schematic representation of the weave pattern of individual weft yarns of FIG. 148 with the top and bottom warp yarns;

FIG. 151 shows a photograph of the upper surface or paper-facing surface of the forming fabric of FIG. 148;

FIG. 152 shows a photograph of a bottom layer of the forming fabric of FIG. 148;

FIG. 153 shows a photograph of an impression of the upper surface of the forming fabric of FIG. 148;

FIG. 154 shows a repeating pattern area of a forty third embodiment of a forming fabric according to the invention;

FIG. 155 shows a schematic representation of the weave pattern of individual weft yarns of FIG. 154 with the top and bottom warp yarns;

FIG. 156 shows an additional schematic representation of the weave pattern of individual weft yarns of FIG. 154 with the top and bottom warp yarns;

FIG. 157 shows a photograph of the upper surface or paper-facing surface of the forming fabric of FIG. 154;

FIG. 158 shows a photograph of a bottom layer of the forming fabric of FIG. 154;

FIG. 159 shows a photograph of an impression of the upper surface of the forming fabric of FIG. 154;

FIG. 160 shows a repeating pattern area of a forty fourth embodiment of a forming fabric according to the invention;

FIG. 161 shows a schematic representation of the weave pattern of individual weft yarns of FIG. 160 with the top and bottom warp yarns;

FIG. 162 shows an additional schematic representation of the weave pattern of individual weft yarns of FIG. 160 with the top and bottom warp yarns;

FIG. 163 shows a photograph of the upper surface or paper-facing surface of the forming fabric of FIG. 160;

FIG. 164 shows a photograph of a bottom layer of the forming fabric of FIG. 160;

FIG. 165 shows a photograph of an impression of the upper surface of the forming fabric of FIG. 160;

FIG. 166 shows a repeating pattern area of a forty fifth embodiment of a forming fabric according to the invention;

FIG. 167 shows a repeating pattern area of a forty sixth embodiment of a forming fabric according to the invention;

FIG. 168 shows a schematic representation of the weave pattern of individual weft yarns of FIG. 167 with the top and bottom warp yarns;

FIG. 169 shows an additional schematic representation of the weave pattern of individual weft yarns of FIG. 167 with the top and bottom warp yarns;

FIG. 170 shows a photograph of the upper surface or paper-facing surface of the forming fabric of FIG. 167;

FIG. 171 shows a photograph of a bottom layer of the forming fabric of FIG. 167;

FIG. 172 shows a photograph of an impression of the upper surface of the forming fabric of FIG. 167;

FIG. 173 shows a repeating pattern area of a forty seventh embodiment of a forming fabric according to the invention;

FIG. 174 shows a schematic representation of the weave pattern of individual weft yarns of FIG. 173 with the top and bottom warp yarns;

FIG. 175 shows an additional schematic representation of the weave pattern of individual weft yarns of FIG. 173 with the top and bottom warp yarns;

FIG. 176 shows a photograph of the upper surface or paper-facing surface of the forming fabric of FIG. 173;

FIG. 177 shows a photograph of a bottom layer of the forming fabric of FIG. 173;

FIG. 178 shows a photograph of an impression of the upper surface of the forming fabric of FIG. 173;

FIG. 179 shows a repeating pattern area of a forty eighth embodiment of a forming fabric according to the invention;

FIG. 180 shows a schematic representation of the weave pattern of individual weft yarns of FIG. 179 with the top and bottom warp yarns;

FIG. 181 shows an additional schematic representation of the weave pattern of individual weft yarns of FIG. 179 with the top and bottom warp yarns;

FIG. 182 shows a photograph of the upper surface or paper-facing surface of the forming fabric of FIG. 179;

FIG. 183 shows a photograph of a bottom layer of the forming fabric of FIG. 179;

FIG. 184 shows a photograph of an impression of the upper surface of the forming fabric of FIG. 179;

FIG. 185 shows a repeating pattern area of a forty ninth embodiment of a forming fabric according to the invention;

FIG. 186 shows a schematic representation of the weave pattern of individual weft yarns of FIG. 185 with the top and bottom warp yarns;

FIG. 187 shows an additional schematic representation of the weave pattern of individual weft yarns of FIG. 185 with the top and bottom warp yarns;

FIG. 188 shows a photograph of the upper surface or paper-facing surface of the forming fabric of FIG. 185;

FIG. 189 shows a photograph of a bottom layer of the forming fabric of FIG. 185;

FIG. 190 shows a photograph of an impression of the upper surface of the forming fabric of FIG. 185;

FIG. 191 shows a repeating pattern area of a fiftieth embodiment of a forming fabric according to the invention;

FIG. 192 shows a schematic representation of the weave pattern of individual weft yarns of FIG. 191 with the top and bottom warp yarns;

FIG. 193 shows an additional schematic representation of the weave pattern of individual weft yarns of FIG. 191 with the top and bottom warp yarns;

FIG. 194 shows a repeating pattern area of a fifty third embodiment of a forming fabric according to the invention;

FIG. 195 shows a schematic representation of the weave pattern of individual weft yarns of FIG. 194 with the top and bottom warp yarns; and FIG. 196 shows an additional schematic representation of the weave pattern of individual weft yarns of FIG. 194 with the top and bottom warp yarns.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, and the description is taken with the drawings making apparent to those skilled in the art how the forms of the present invention may be embodied in practice.

The present invention relates to a double-layer forming fabric for a papermaking machine. The fabric includes a paper-side layer or top layer that contacts a paper web during a papermaking process. The top layer of the fabric includes top warp yarns (machine direction yarns) and top weft yarns (cross-direction yarns) that weave with the top warp yarns. The fabric also includes a machine-side layer or bottom layer that contacts components of a papermaking machine, such as rolls that support the fabric, during a papermaking process. The bottom layer of the fabric includes bottom warp yarns and bottom weft yarns that weave with the bottom warp yarns. The fabric further includes dual combination binder (DCB) weft yarns, some of which that weave with both the top and bottom warp yarns. All of the warp yarns and weft yarns are preferably interwoven in a repeating pattern.

Figure 1:
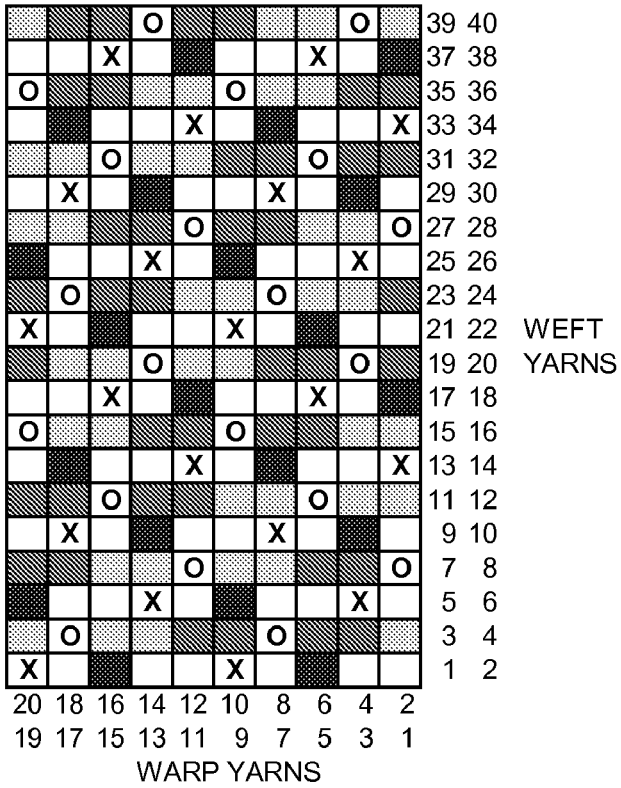
FIG. 1 shows a repeating pattern area of a first embodiment of a forming fabric according to the invention.
Figure 2:
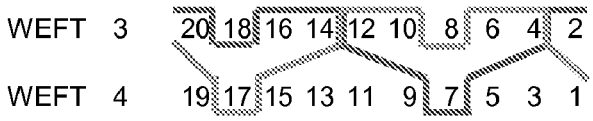
FIG. 2 shows a schematic representation of the interaction of dual combination binder (DCB) weft yarns with top and bottom warp yarns of the forming fabric of FIG. 1.
Figure 3:
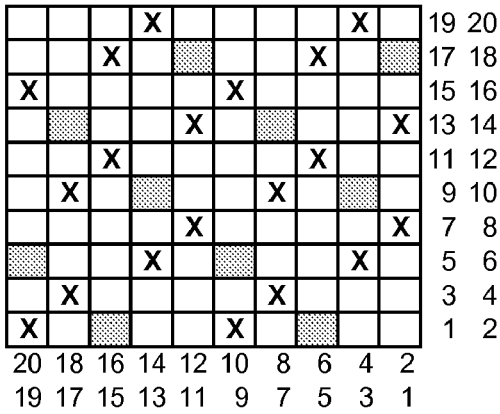
FIG. 3 shows a repeating pattern area of an upper surface of a top layer of the forming fabric of FIG. 1.
Figure 4:
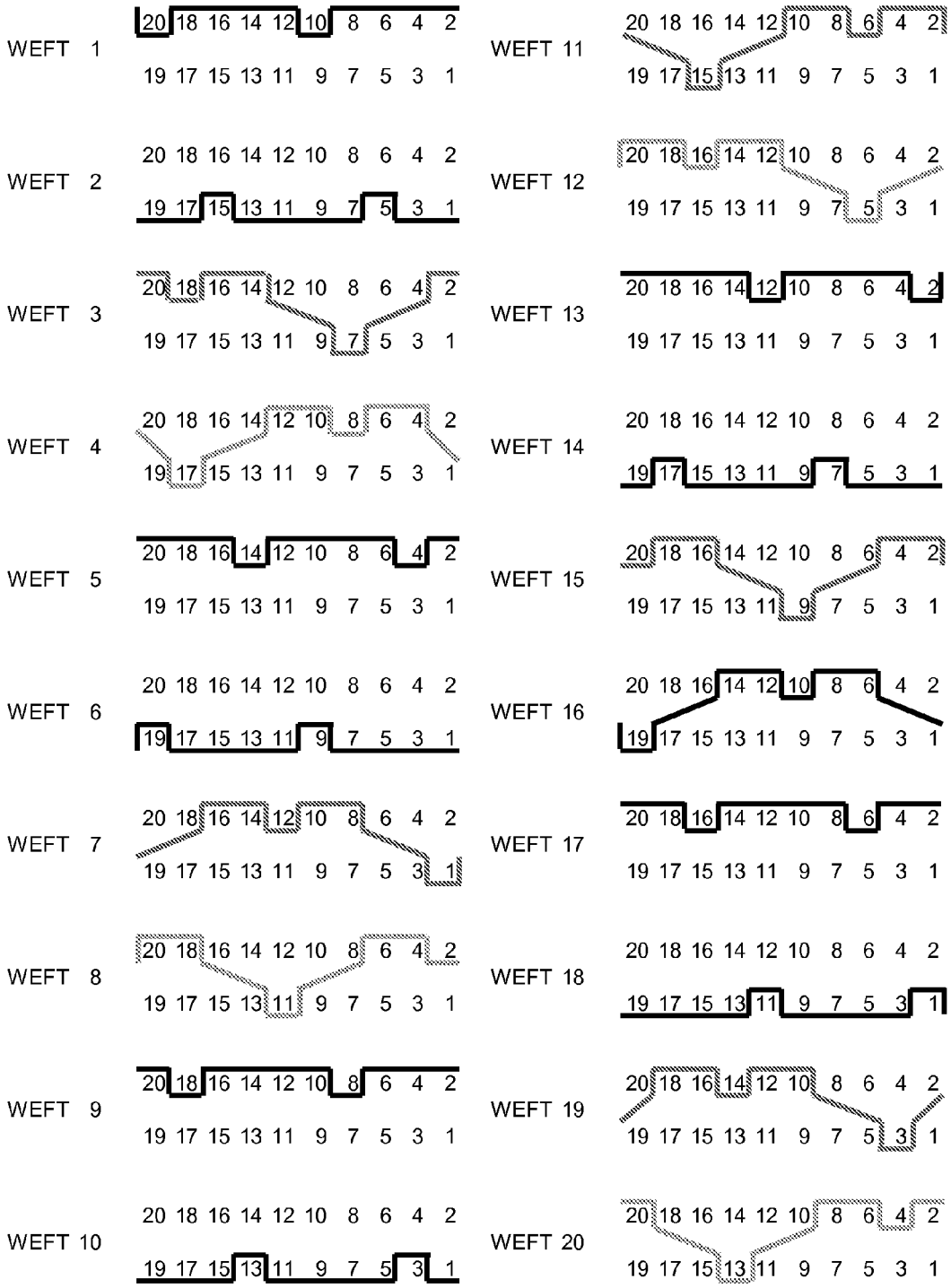
FIG. 4 shows a schematic representation of the weave pattern of individual weft yarns of FIG. 1 with the top and bottom warp yarns.
Figure 5:
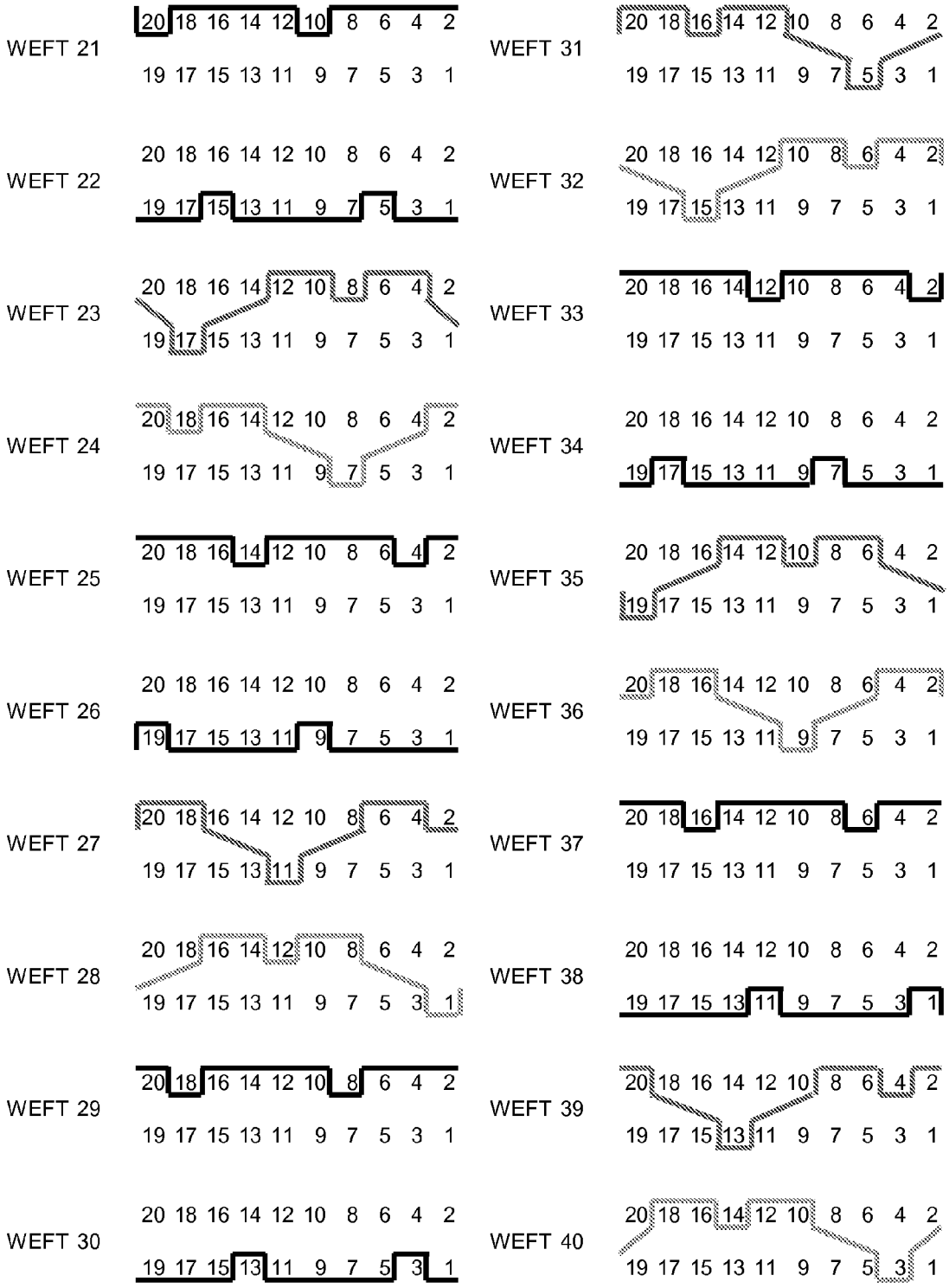
FIG. 5 shows an additional schematic representation of the weave pattern of individual weft yarns of FIG. 1 with the top and bottom warp yarns.
Figure 6:
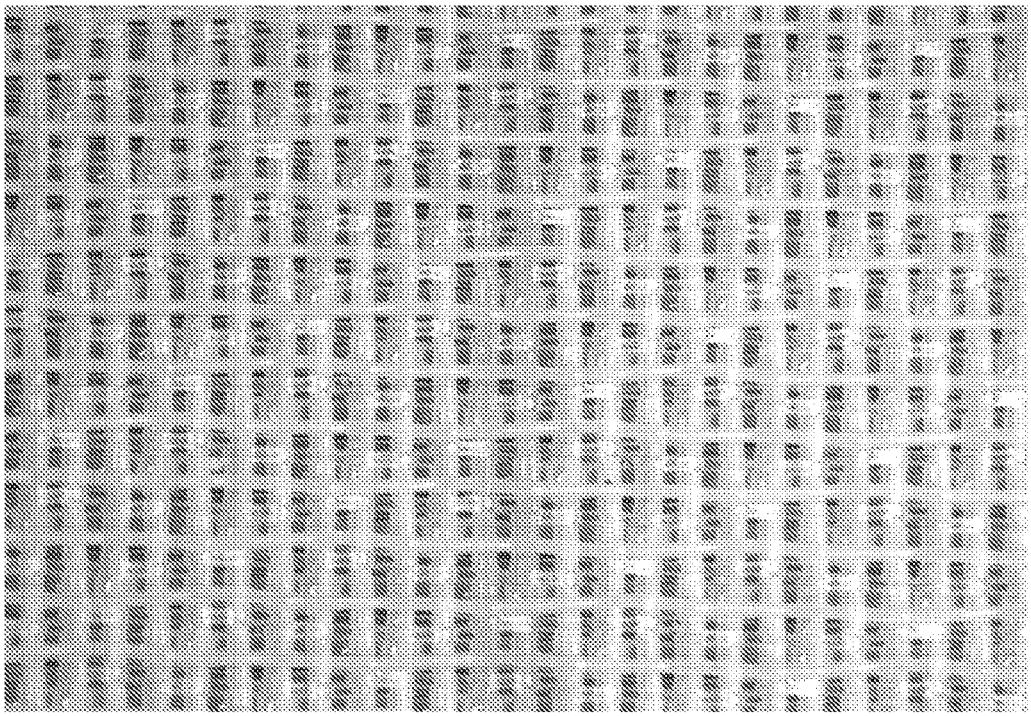
FIG. 6 shows a photograph of the upper surface or paper-facing surface of the forming fabric of FIG. 1.
Figure 7:
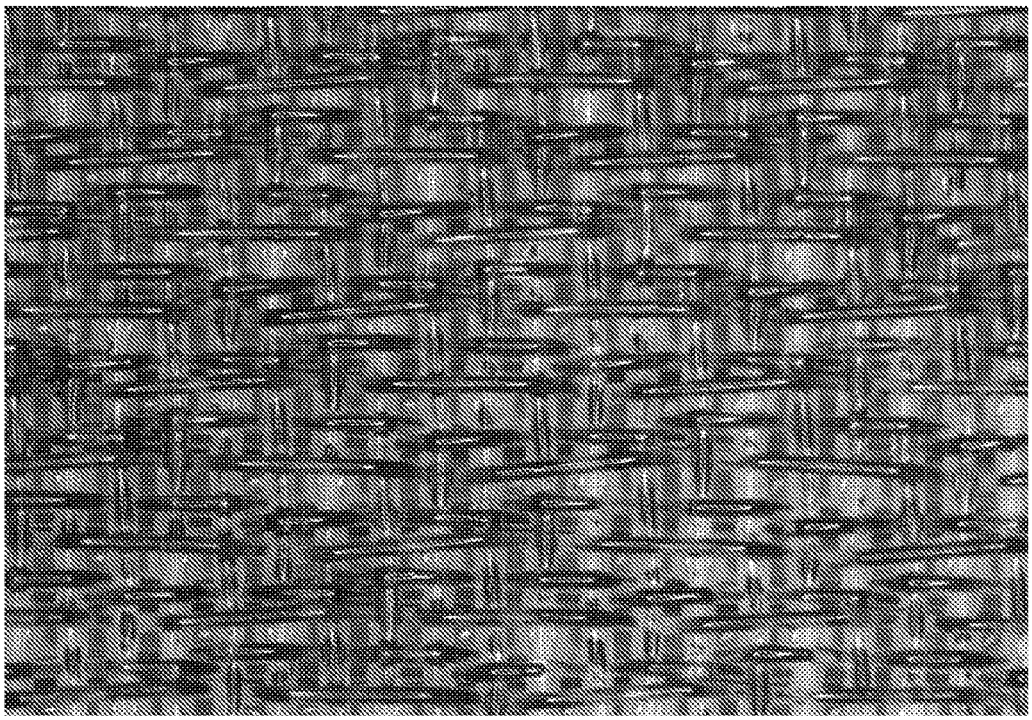
FIG. 7 shows another photograph of the upper surface or paper-facing surface of the forming fabric of FIG. 1.
Figure 8:
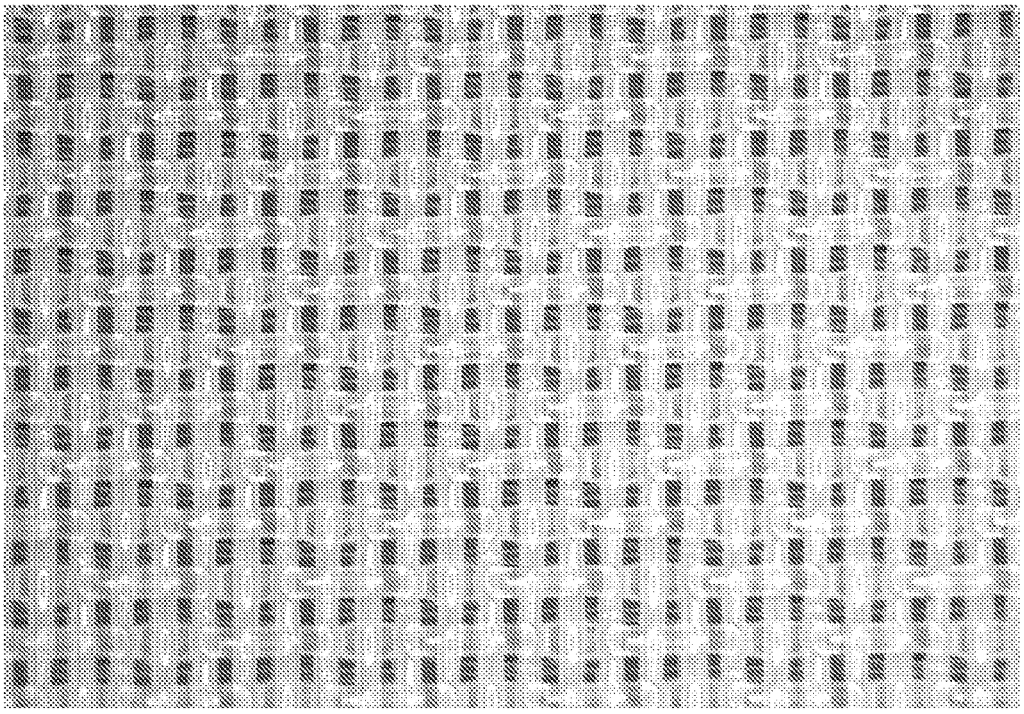
FIG. 8 shows a photograph of a bottom layer of the forming fabric of FIG. 1.
Figure 9:
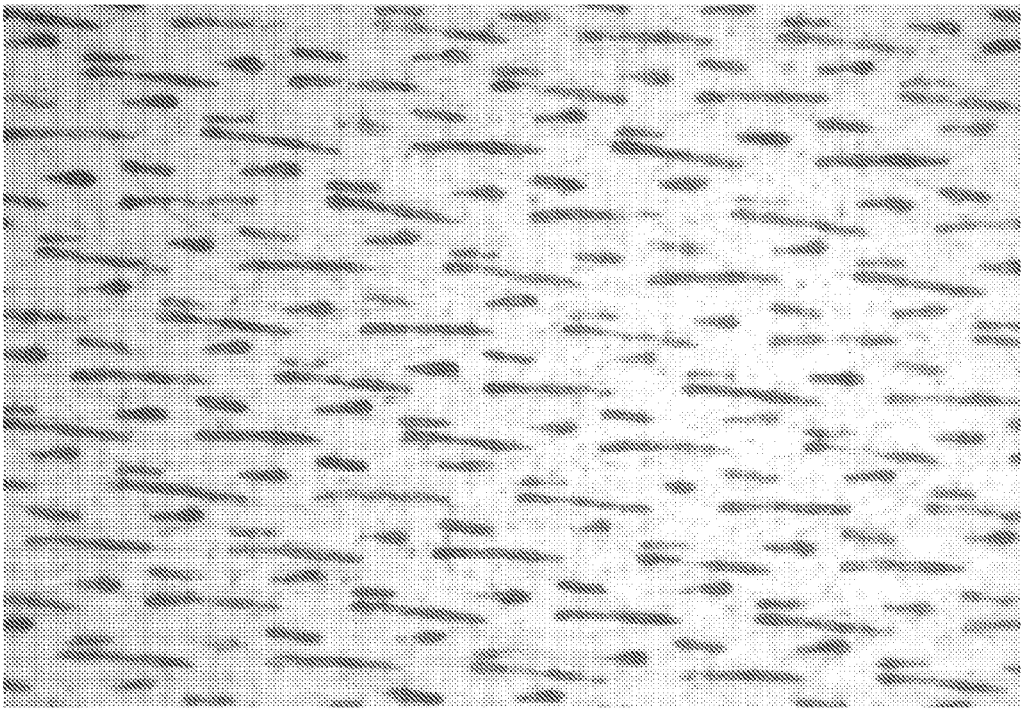
FIG. 9 shows a photograph of an impression of the upper surface of the forming fabric of FIG. 1.
Figure 10:
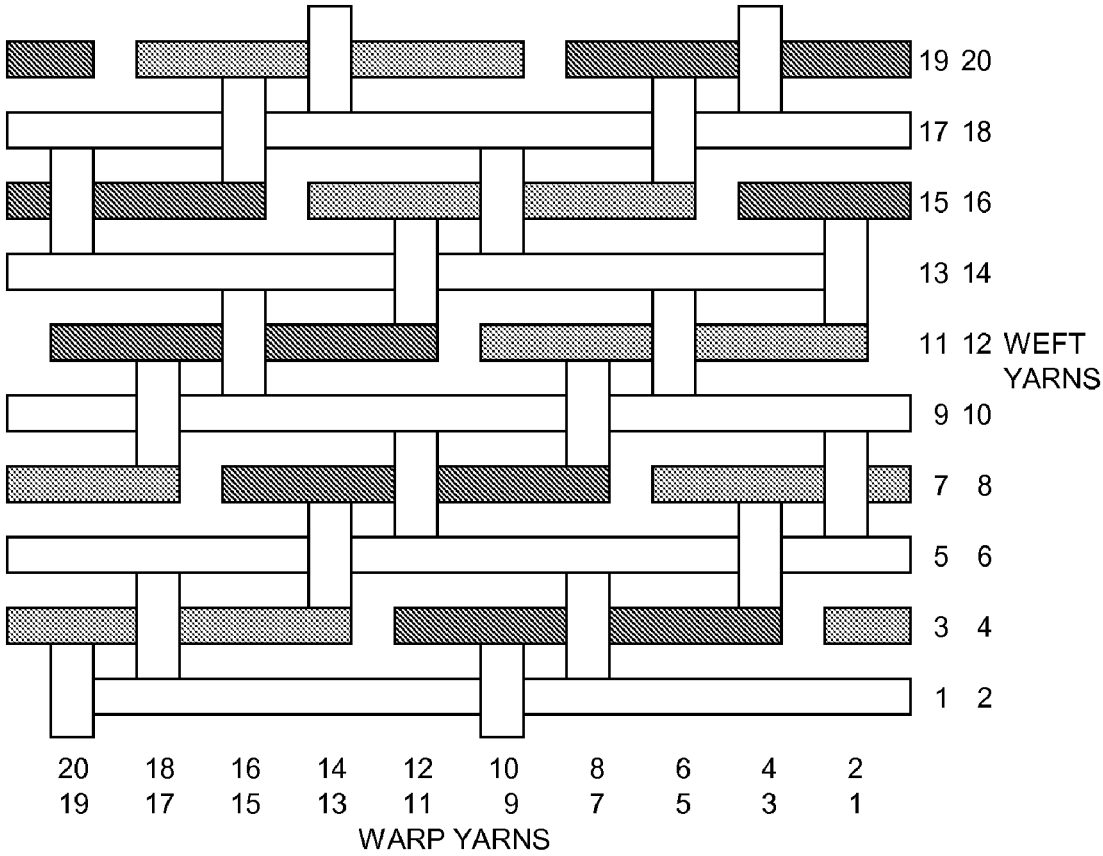
FIG. 10 shows the weave pattern of the upper surface or paper side of the forming fabric of FIG. 1.

A first non-limiting embodiment of the forming fabric of the present invention is illustrated in FIGS. 1-8 and 10, and an impression of the upper surface of the first embodiment of the forming fabric is illustrated in FIG. 9. The fabric is a butted-binder weave with a five shed bottom. FIG. 1 shows a single repeating pattern area of the fabric that encompasses twenty warp yarns (yarns 1-20 extending vertically in FIG. 1) and forty weft yarns (yarns 1-40 extending horizontally in FIG. 1). FIGS. 4 and 5 depict the paths of weft yarns 1-40 as they weave with warp yarns 1-20. While FIGS. 1, 4 and 5 only show a single section of the fabric, those of skill in the art will appreciate that in commercial applications the pattern shown in FIGS. 1, 4 and 5 would be repeated many times, in both the warp and weft directions, to form a large fabric suitable for use on a papermaking machine.

Referring specifically to FIG. 1, the top layer of the fabric includes top warp yarns (even numbered warp yarns) and top weft yarns (every other odd weft yarn). The bottom layer of the fabric includes bottom warp yarns (odd numbered warp yarns) and bottom weft yarns (every other even weft yarn). The fabric further includes DCB weft yarns (every other set of weft yarns, e.g., weft yarn set 3-4, weft yarn set 7-8, etc.) that weave in a repeating pattern with the warp yarns to create a DCB weft yarn repeat. In FIG. 1, three symbols illustrate the interaction of the top and bottom warp and weft yarns. Specifically, symbol X illustrates a location where a top weft yarn passes under a top warp yarn (e.g., weft yarn 1 passes under warp yarn 20). A black box illustrates a location where a bottom weft yarn passes over a bottom warp yarn (e.g., weft yarn 2 passes over warp yarn 15). A white box illustrates a location where a top weft yarn passes over a top warp yarn and a bottom weft yarn passes under a bottom warp yarn (e.g., weft yarn 1 passes over warp yarn 18 and weft yarn 2 passes under warp yarn 17). Similarly, three symbols illustrate the interaction of the DCB weft yarns with the top and bottom warp yarns. Specifically, a light gray box illustrates a location where a first of the DCB weft yarns passes over a top warp yarn and a second of the DCB weft yarns passes between top and bottom warp yarns (e.g., weft yarn 3 passes over warp yarn 20 and weft yarn 4 passes between warp yarns 19 and 20). Conversely, a dark grey box illustrates a location where the first of the DCB weft yarns passes between top and bottom warp yarns and the second of the DCB weft yarns passes over a top warp yarn (e.g., weft yarn 3 passes between warp yarns 11 and 12 and weft yarn 4 passes over warp yarn 12). Symbol 0 illustrates a location where one of the DCB weft yarns passes under a top warp yarn and the other of the DCB weft yarns passes under a bottom warp yarn (e.g., weft yarn 3 passes under warp yarn 18 and weft yarn 4 passes under warp yarn 17).

Each DCB weft yarn of the first embodiment of the forming fabric weaves with the top and bottom weft yarns in the same pattern. Specifically, each DCB weft yarn passes over two consecutive top warp yarns, then passes under one top warp yarn, then passes over two consecutive top warp yarns, then passes between two consecutive pairs of top and bottom warp yarns, then passes under one bottom warp yarn, and then passes between two consecutive pairs of top and bottom warp yarns. However, it should be noted that the pattern is offset between DCB weft yarns within a set and between adjacent sets. For example, weft yarn 3 passes under lower warp yarn 7 and well yarn 4 passes under lower warp yarn 17, resulting in an offset of five warp yarns within a set of DCB weft yarns. As another example, weft yarn 3 passes under lower warp yarn 7 and weft yarn 7 passes under lower warp yarn 1, resulting in an offset of three warp yarns between adjacent sets of DCB well yarns.

Referring now to FIGS. 2, 4 and 5, the DCB well yarns in each pair include two floats that each pass over two warp yarns. The floats combine to form a long weft float that passes over the same number of consecutive top warp yarns passed over by floats of the top weft yarns to match the weave pattern of the top weft yarns. That is, each top weft yarn or DCB weft yarn pair weaves with the top warp yarns by passing over four consecutive warp yarns, then passing under one warp yarn, then passing over four consecutive warp yarns, and then passing under one warp yarn. For each top well yarn, the adjacent DCB well yarns to one side are offset by one warp yarn. For example, top weft yarn 5 passes under top warp yarns 14 and 4, and DCB weft yarns 7 and 8 combine to pass under top warp yarns 2 and 12. The adjacent DCB weft yarns to the other side of each top weft yarn are offset by two warp yarns. For example, top well yarn 5 passes under top warp yarns 4 and 14, and DCB weft yarns 3 and 4 combine to pass under top warp yarns 8 and 18.

Referring to FIG. 3, the repeating pattern area included therein also illustrates how the DCB weft yarns in each pair combine to match the weave pattern of the top weft yarns. In FIG. 3, three symbols illustrate the interaction of the DCB weft yarns and the top and bottom warp and well yarns. Specifically, symbol X illustrates a location where a top warp yarn defines the upper surface of the top layer. A white box illustrates a location where a well yarn defines the upper surface of the top layer. A gray box illustrates a location where a weft yarn defines the upper surface of the top layer and a bottom well yarn passes over a bottom warp yarn. It should be apparent from FIG. 3 that the floats of the DCB well yarns and the top weft yarns are arranged in a series that extends diagonally relative to the direction of the top warp yarns and the top weft yarns.

The forming fabric has greater stability than previous forming fabrics due to increased interweaving of the warp and weft yarns. In addition, increased interweaving is also provided in conjunction with the DCB weft yarns weaving the same pattern as the top weft yarns, thereby providing long weft floats and a generally continuous paper-side surface on which a paper web may be formed. Further still, each DCB weft yarn floats over top warp yarns on either side of a top warp yarn it passes under, also thereby providing long weft floats and a generally continuous paper-side surface on which a paper web may be formed.

By way of non-limiting example, the forming fabric shown in FIGS. 1-8 and 10 can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the first embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 11:
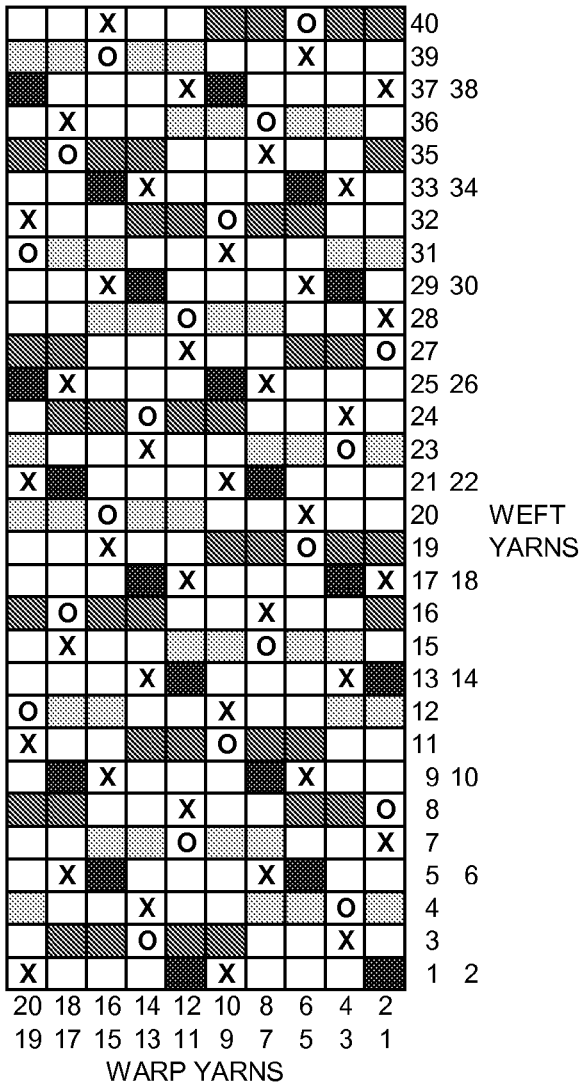
FIG. 11 shows a repeating pattern area of a second embodiment of a forming fabric according to the invention.
Figure 12:
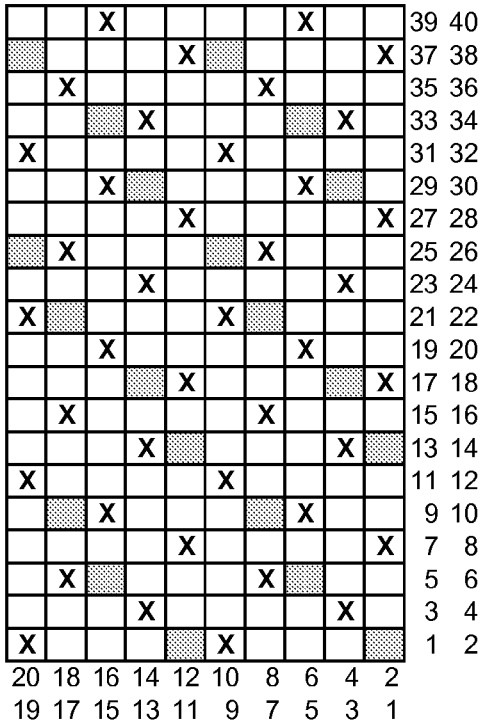
FIG. 12 shows a repeating pattern area of an upper surface of a top layer of the forming fabric of FIG. 11.
Figure 13:
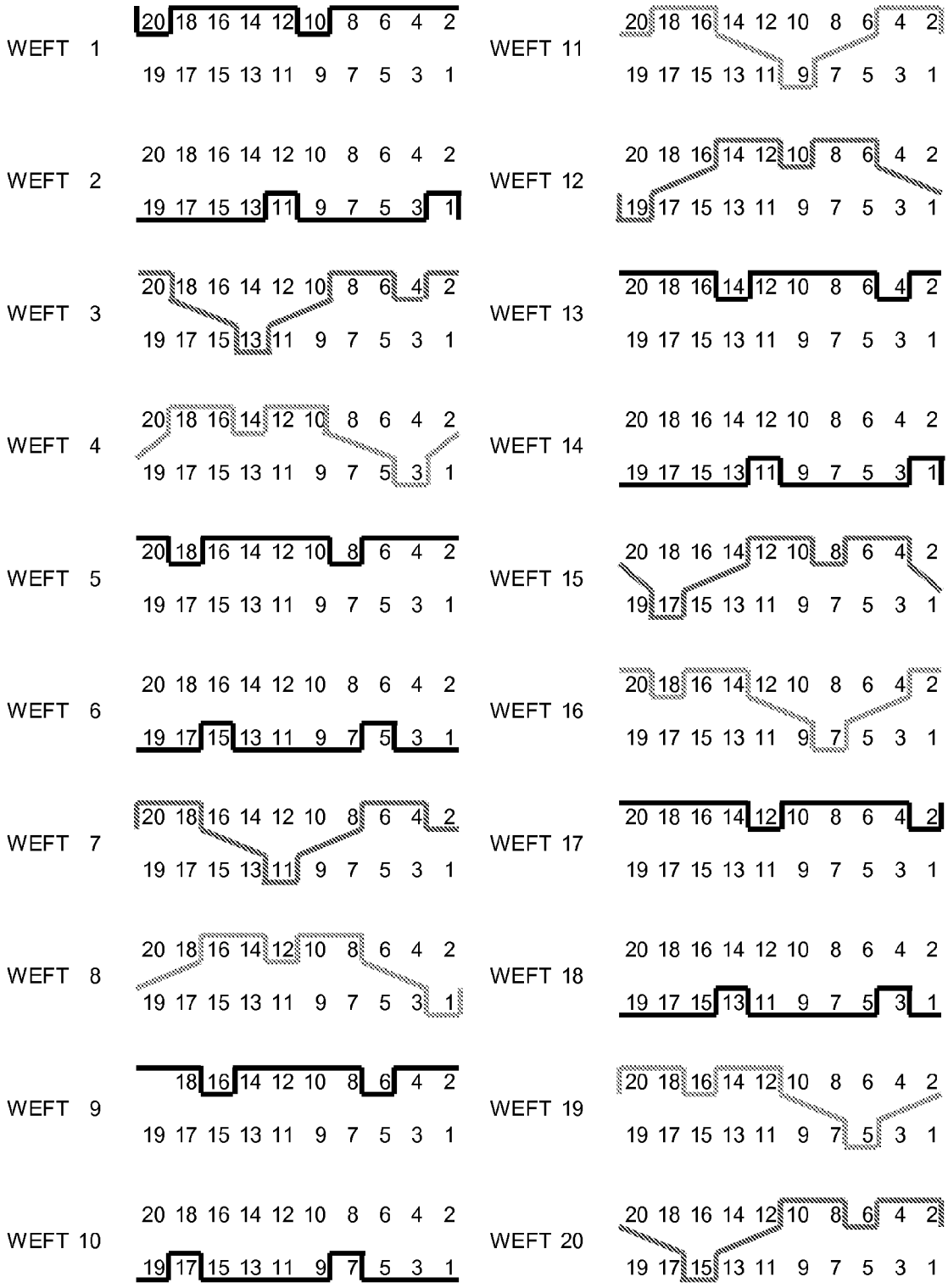
FIG. 13 shows a schematic representation of the weave pattern of individual weft yarns of FIG. 11 with the top and bottom warp yarns.
Figure 14:
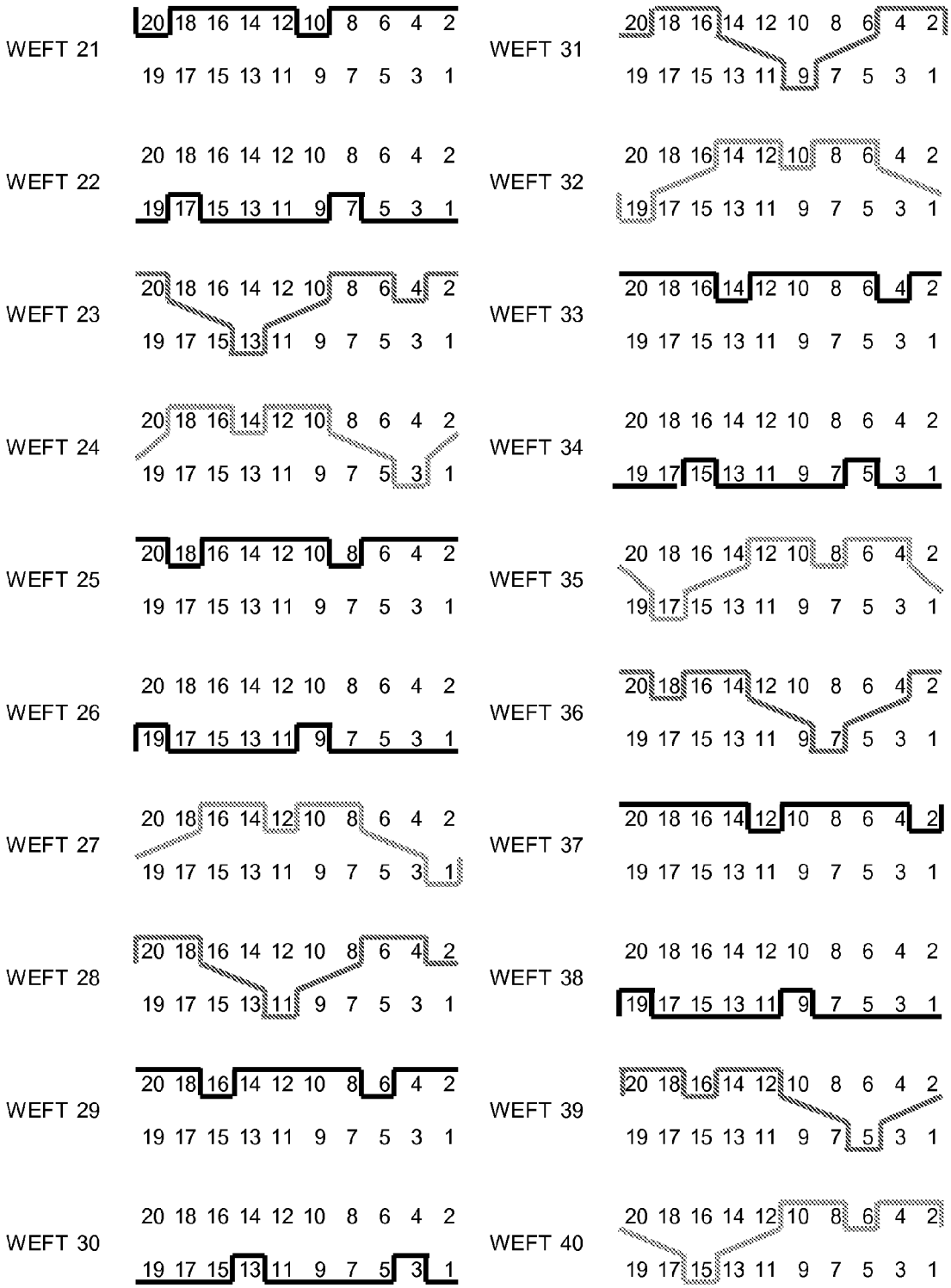
FIG. 14 shows an additional schematic representation of the weave pattern of individual weft yarns of FIG. 11 with the top and bottom warp yarns.
Figure 15:
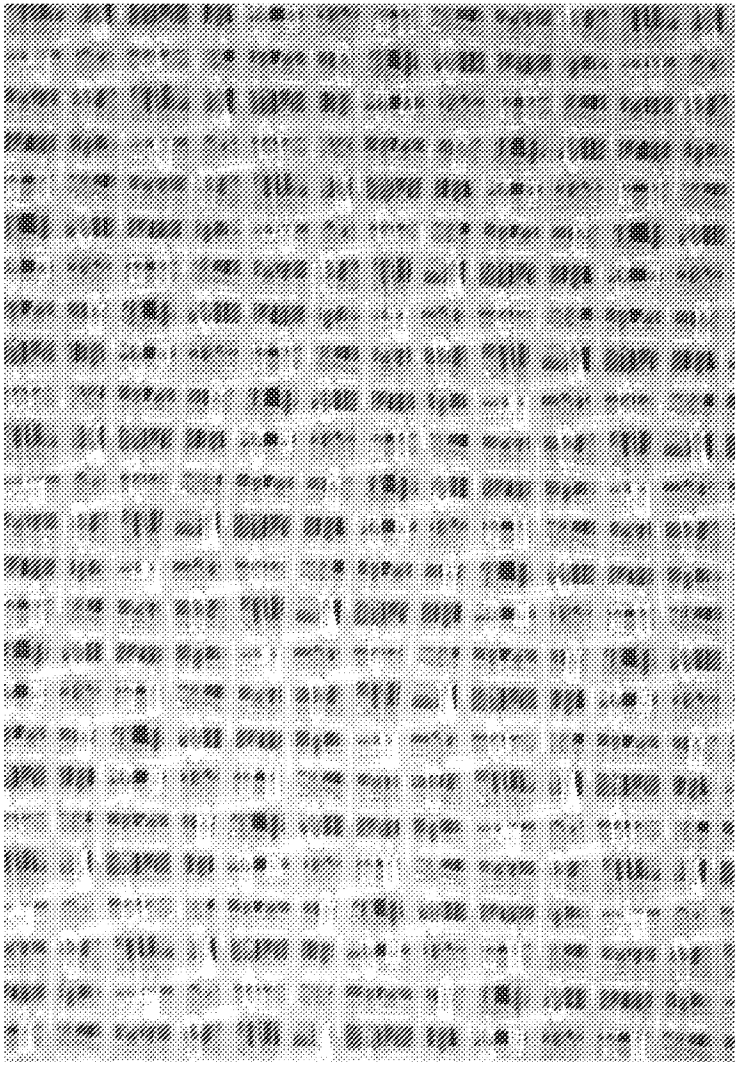
FIG. 15 shows a photograph of the upper surface or paper-facing surface of the forming fabric of FIG. 11.
Figure 16:
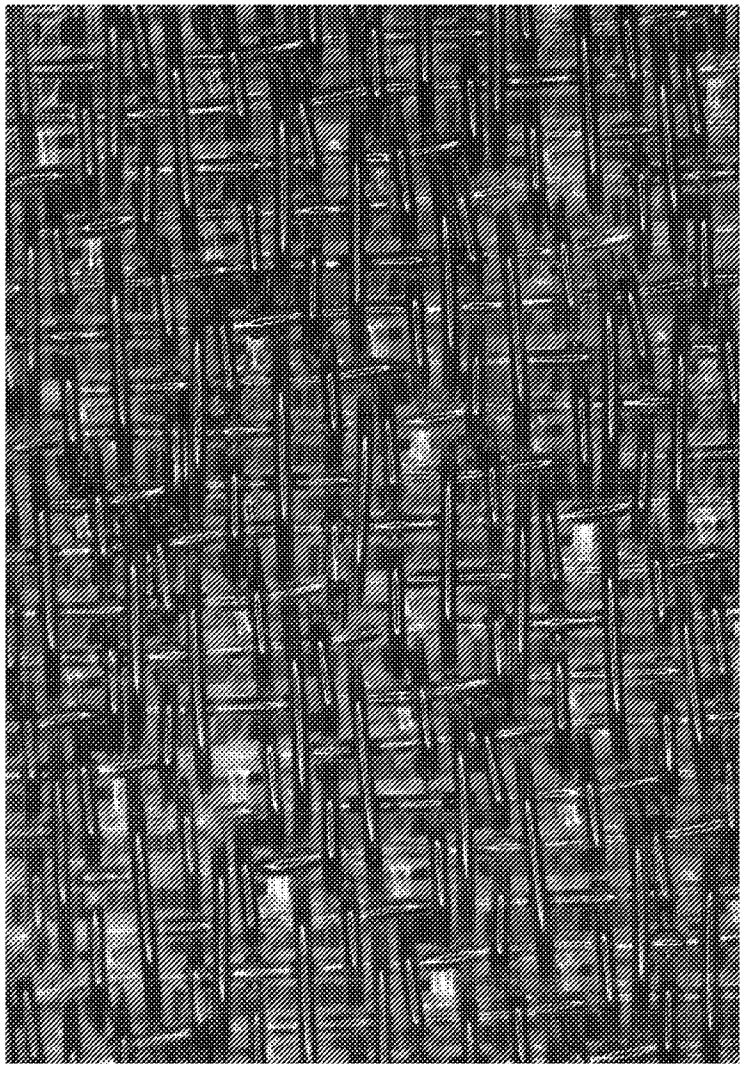
FIG. 16 shows another photograph of the upper surface or paper-facing surface of the forming fabric of FIG. 11.
Figure 17:
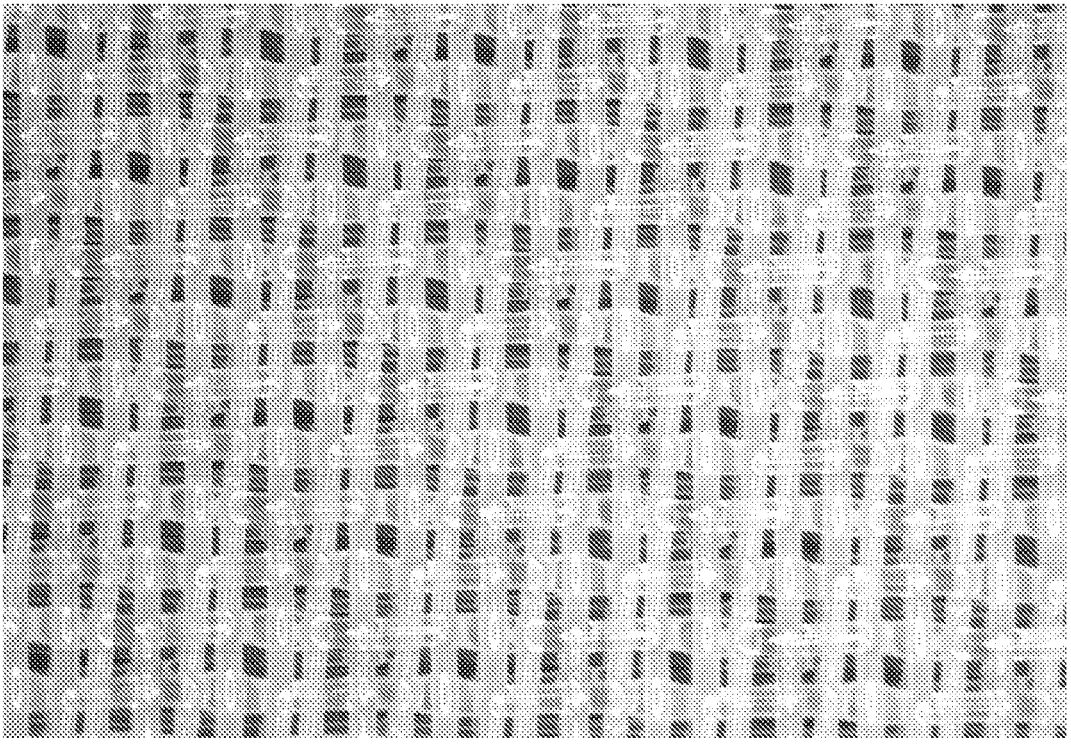
FIG. 17 shows a photograph of a bottom layer of the forming fabric of FIG. 11.
Figure 18:
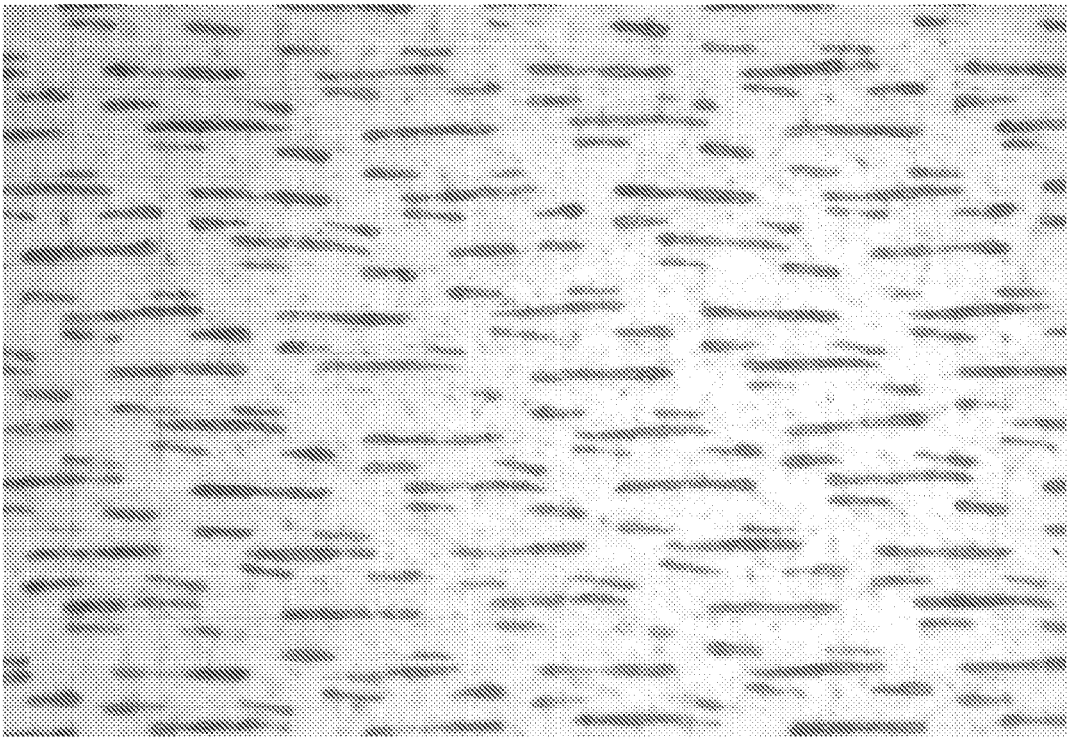
FIG. 18 shows a photograph of an impression of the upper surface of the forming fabric of FIG. 11.

A second non-limiting embodiment of the forming fabric of the present invention is illustrated in FIGS. 11-17, and an impression of the upper surface of the second embodiment of the forming fabric is illustrated in FIG. 18. The fabric of FIG. 11 shows a single repeating pattern area of the fabric that encompasses twenty warp yarns (yarns 1-20 extending vertically in FIG. 11) and forty weft yarns (yarns 1-40 extending horizontally in FIG. 11). The fabric is a butted-binder weave with a modified five shed bottom fabric. FIGS. 13 and 14 depict the paths of weft yarns 1-40 as they weave with warp yarns 1-20. Like the DCB weft yarns of the first embodiment of the forming fabric, the DCB weft yarns in each pair combine to match the weave pattern of the top weft yarns. Also like the DCB weft yarns of the first embodiment, each DCB weft yarn passes over two consecutive top warp yarns, then passes under one top warp yarn, then passes over two consecutive top warp yarns, then passes between two consecutive pairs of top and bottom warp yarns, then passes under one bottom warp yarn, and then passes between two consecutive pairs of top and bottom warp yarns. However, the weave pattern of the DCB weft yarns is offset from adjacent top and bottom weft yarns differently than those of the first embodiment as shown in FIGS. 11-17.

By way of non-limiting example, the second embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the second embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 19:
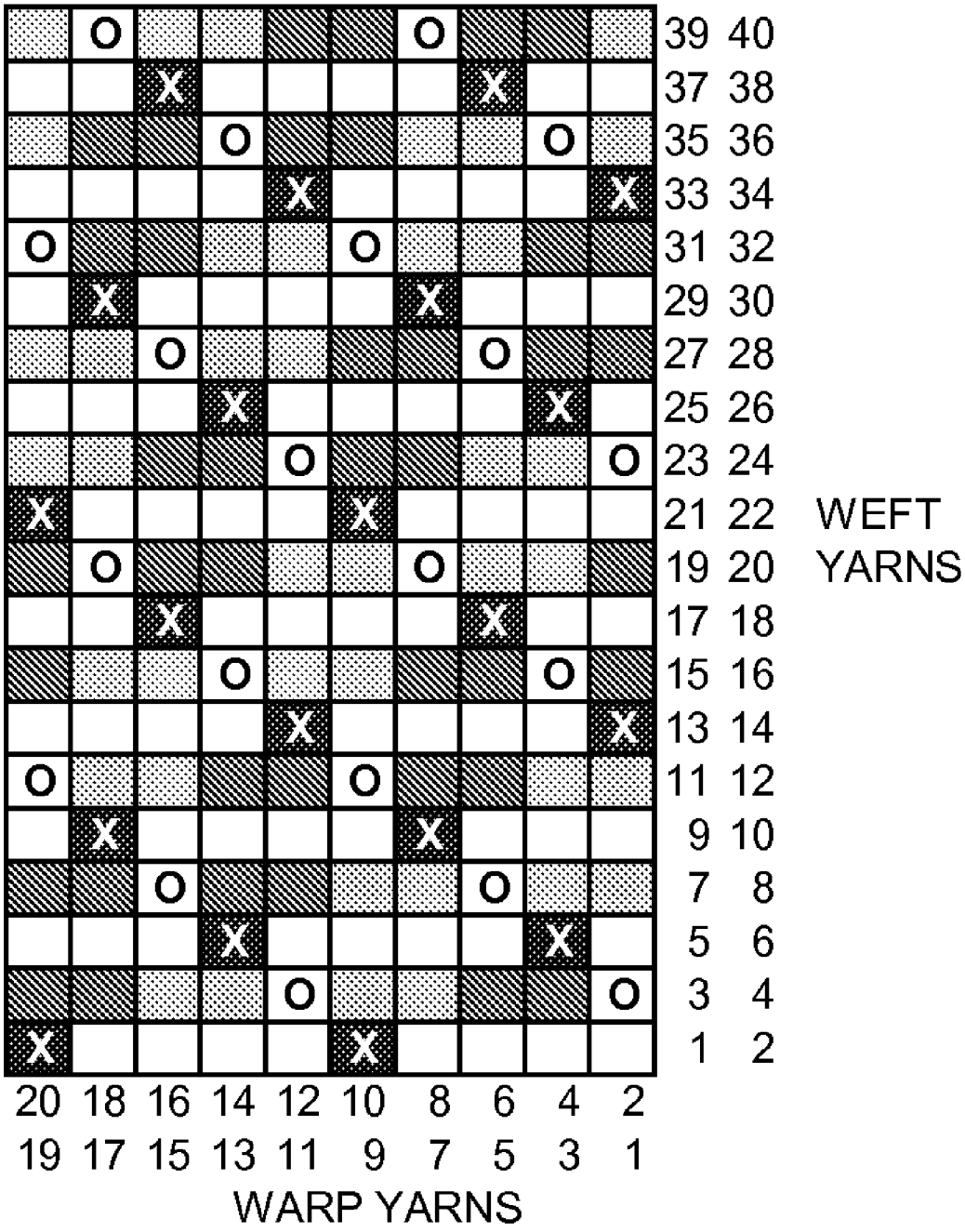
FIG. 19 shows a repeating pattern area of a third embodiment of a forming fabric according to the invention.
Figure 20:
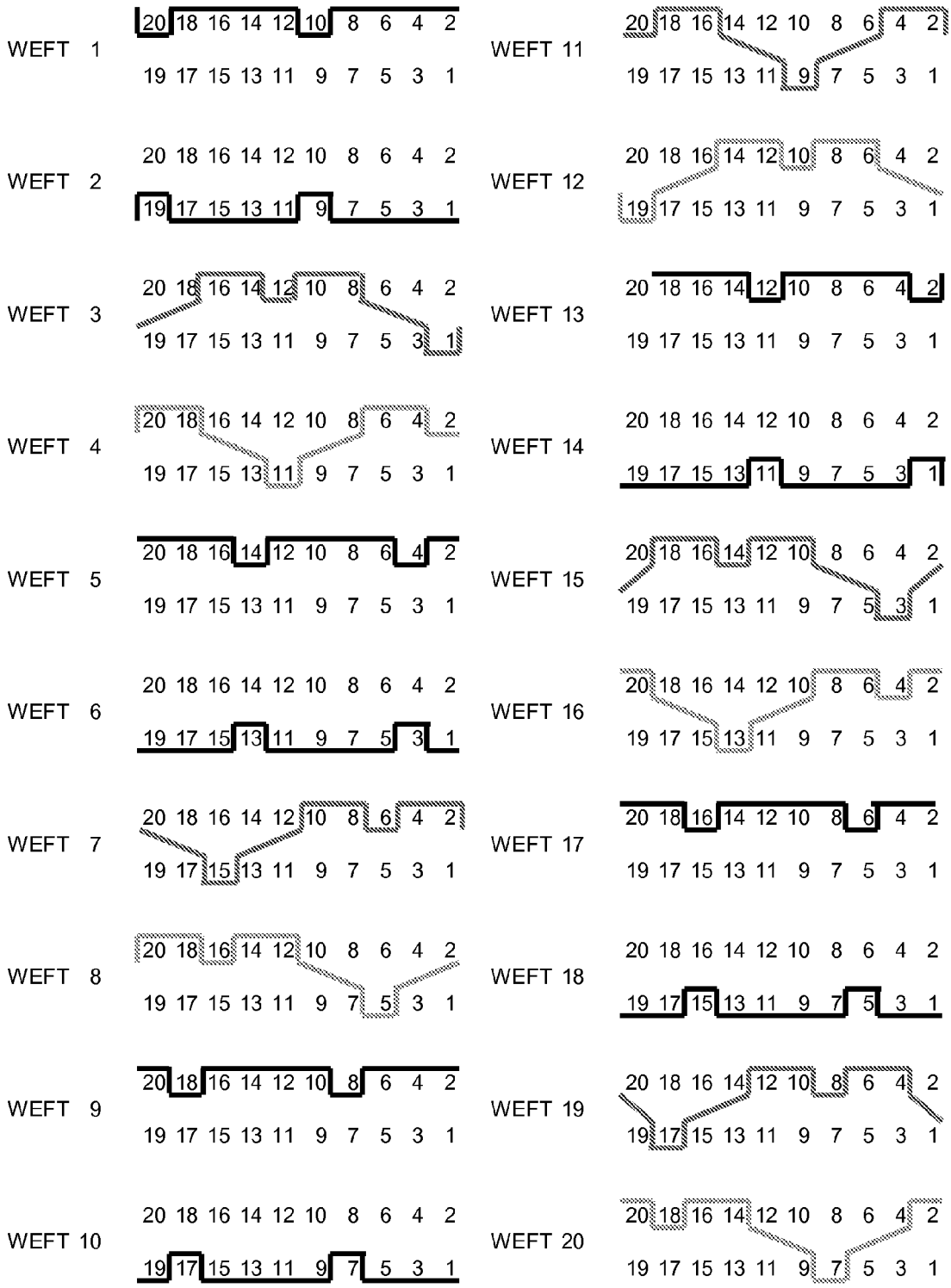
FIG. 20 shows a schematic representation of the weave pattern of individual weft yarns of FIG. 19 with the top and bottom warp yarns.
Figure 21:
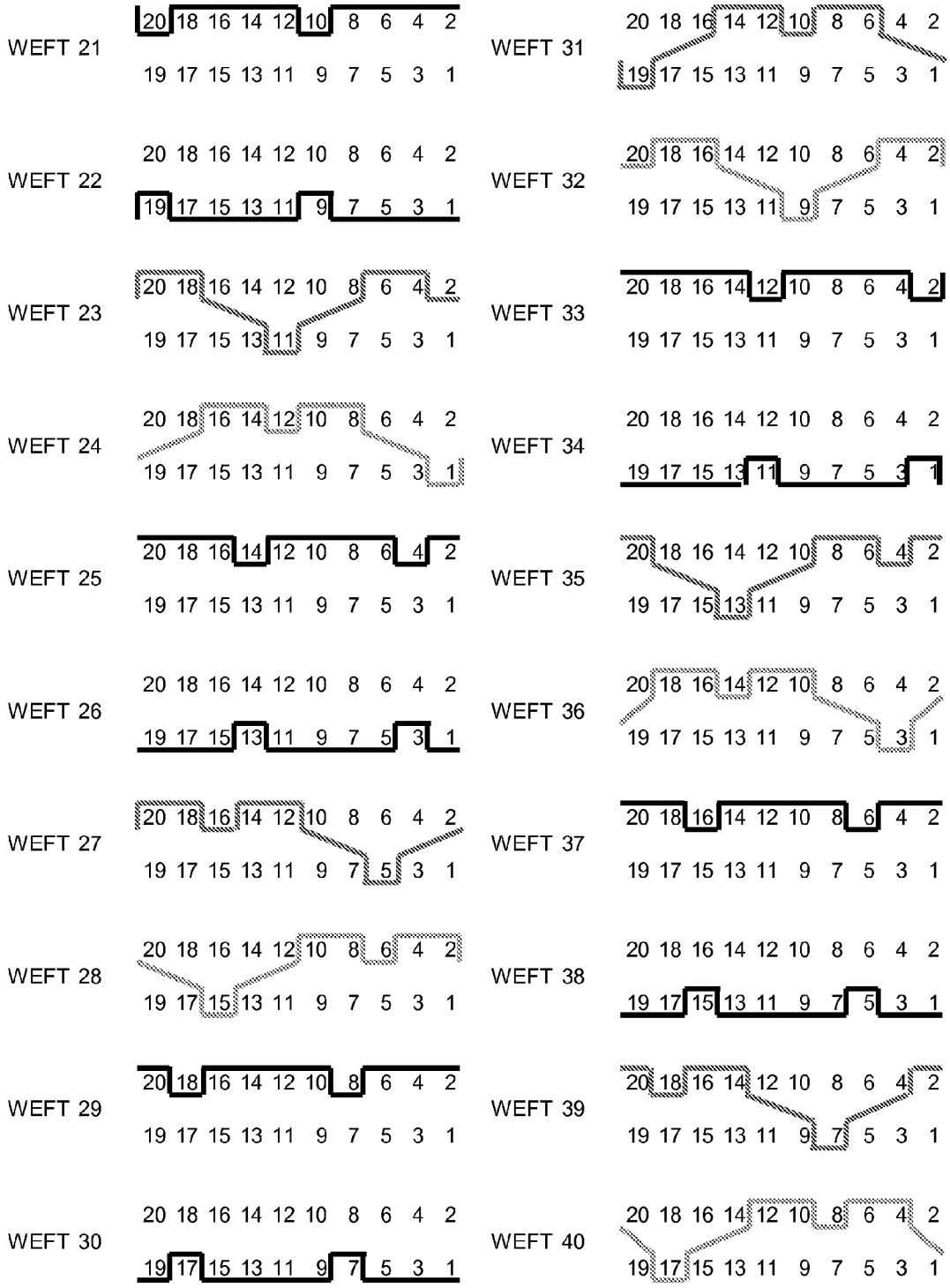
FIG. 21 shows an additional schematic representation of the weave pattern of individual weft yarns of FIG. 19 with the top and bottom warp yarns.
Figure 22:
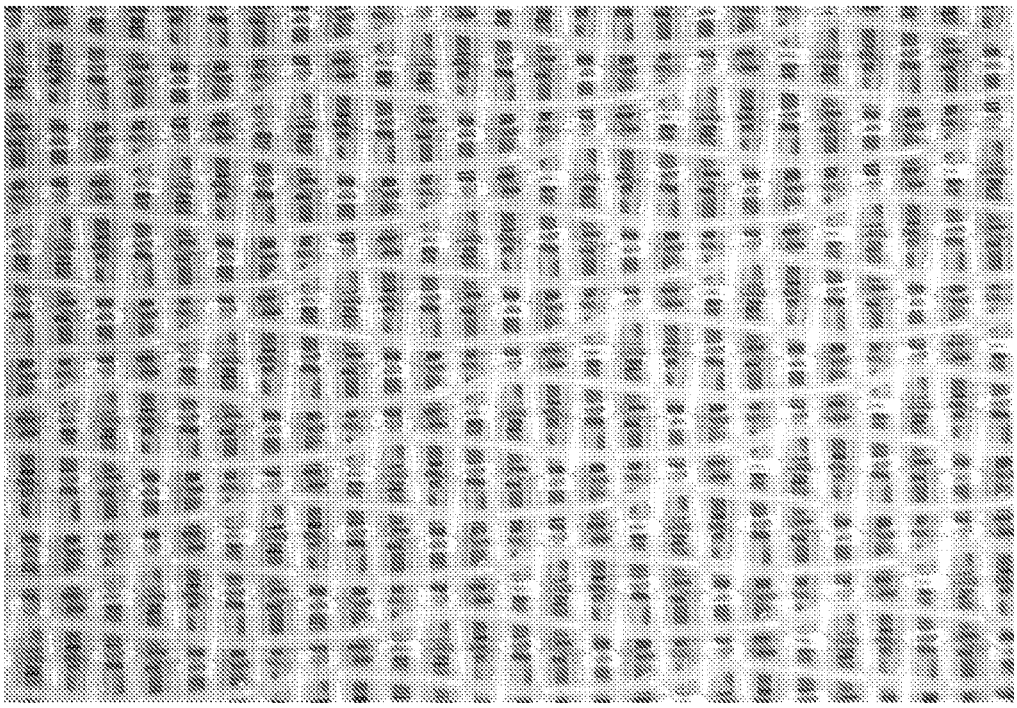
FIG. 22 shows a photograph of the upper surface or paper-facing surface of the forming fabric of FIG. 19.
Figure 23:
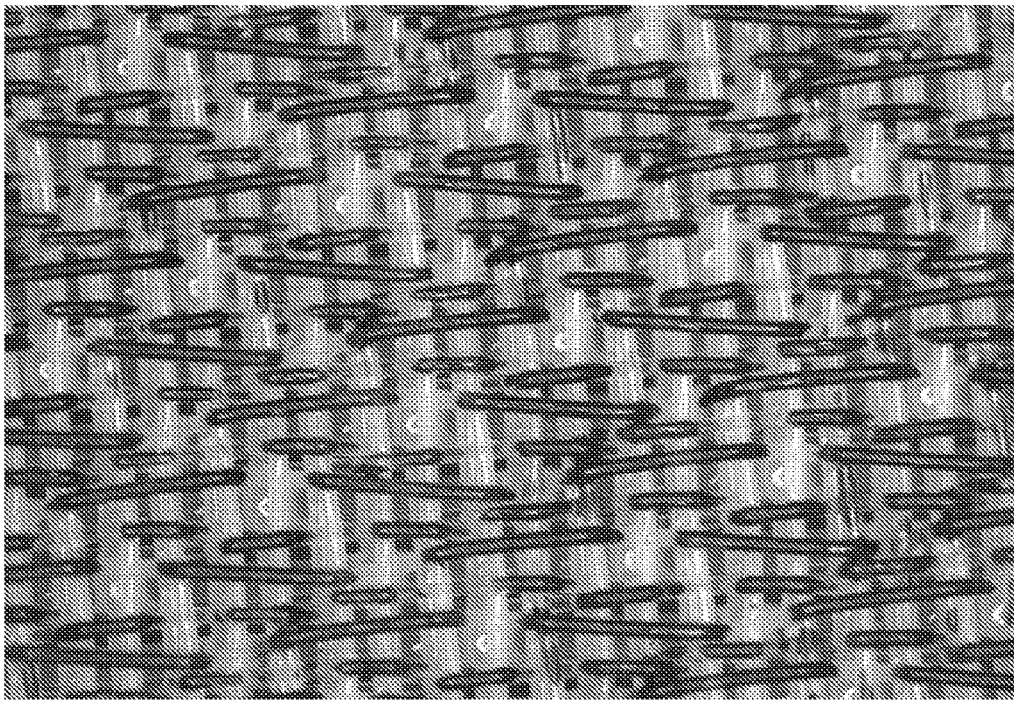
FIG. 23 shows another photograph of the upper surface or paper-facing surface of the forming fabric of FIG. 19.
Figure 24:
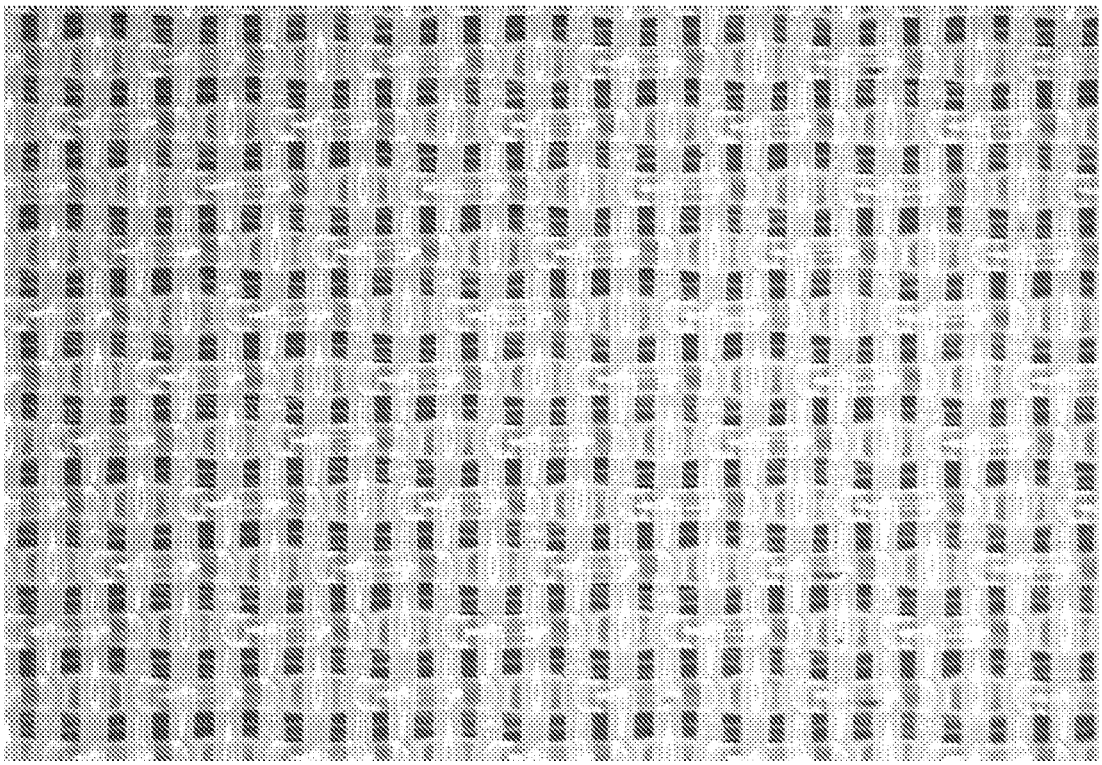
FIG. 24 shows a photograph of a bottom layer of the forming fabric of FIG. 19.
Figure 25:
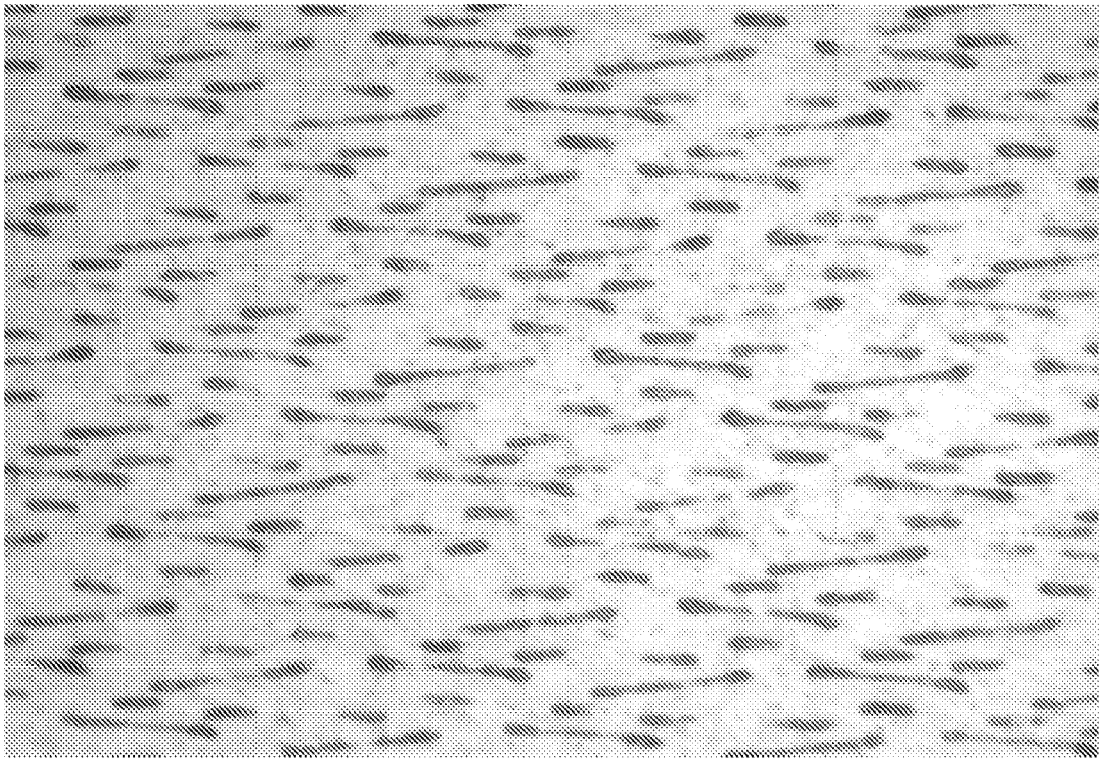
FIG. 25 shows a photograph of an impression of the upper surface of the forming fabric of FIG. 19.

A third non-limiting embodiment of the forming fabric of the present invention is illustrated in FIGS. 19-24, and an impression of the upper surface of the third embodiment of the forming fabric is illustrated in FIG. 25. The fabric of FIG. 19 shows a single repeating pattern area of the fabric that encompasses twenty warp yarns (yarns 1-20 extending vertically in FIG. 19) and forty weft yarns (yarns 1-40 extending horizontally in FIG. 19). The fabric is a butted-binder straight twill top, five shed bottom fabric. FIGS. 20 and 21 depict the paths of weft yarns 1-40 as they weave with warp yarns 1-20. Like the DCB weft yarns of the previous embodiments of the forming fabric, the DCB weft yarns in each pair combine to match the weave pattern of the top weft yarns. Also like the DCB weft yarns of the previous embodiments, each DCB weft yarn passes over two consecutive top warp yarns, then passes under one top warp yarn, then passes over two consecutive top warp yarns, then passes between two consecutive pairs of top and bottom warp yarns, then passes under one bottom warp yarn, and then passes between two consecutive pairs of top and bottom warp yarns. However, the weave pattern of the DCB weft yarns is offset from adjacent top and bottom weft yarns differently than those of the previous embodiments as shown in FIGS. 19-24.

By way of non-limiting example, the third embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the third embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 26:
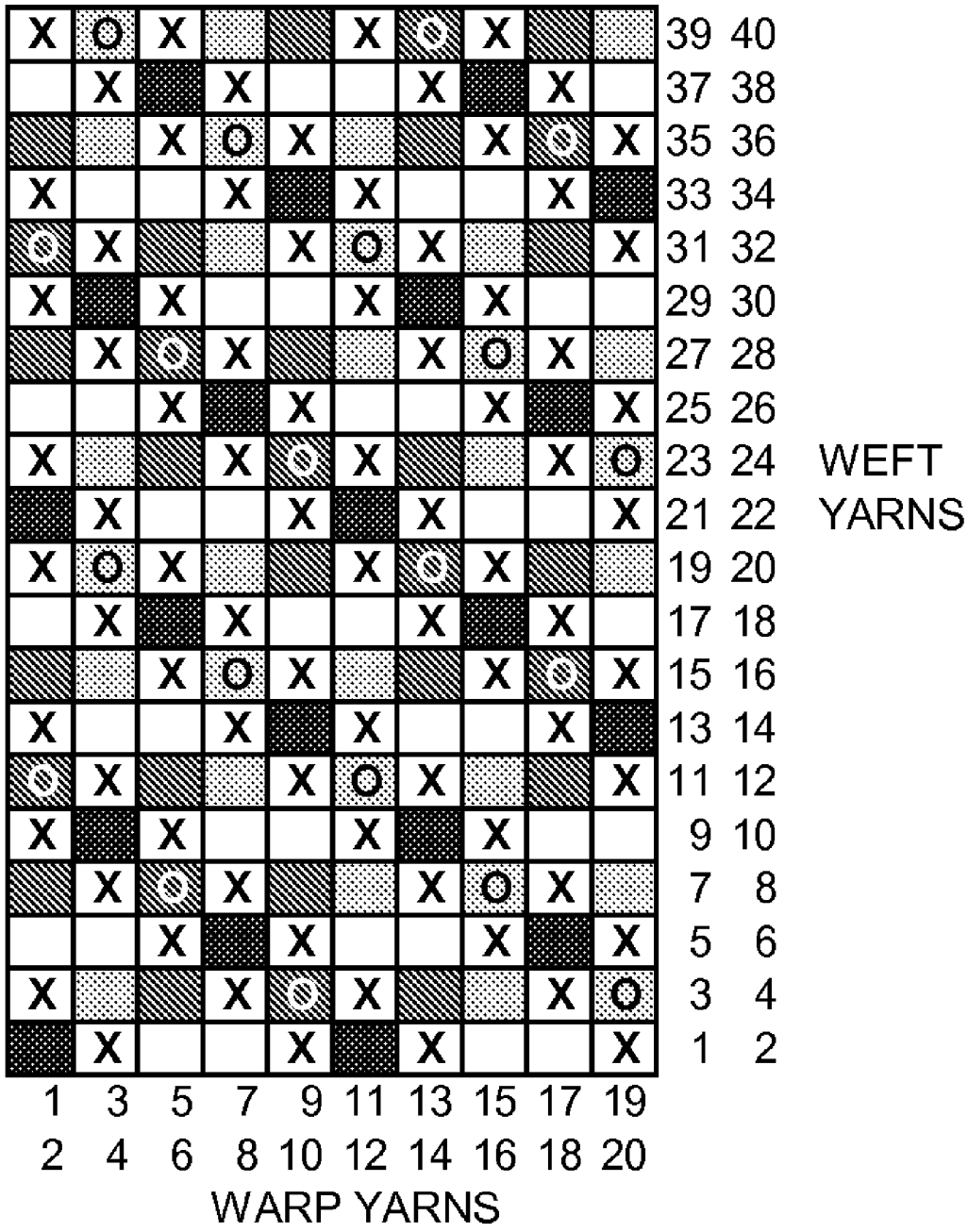
FIG. 26 shows a repeating pattern area of a fourth embodiment of a forming fabric according to the invention.
Figure 27:
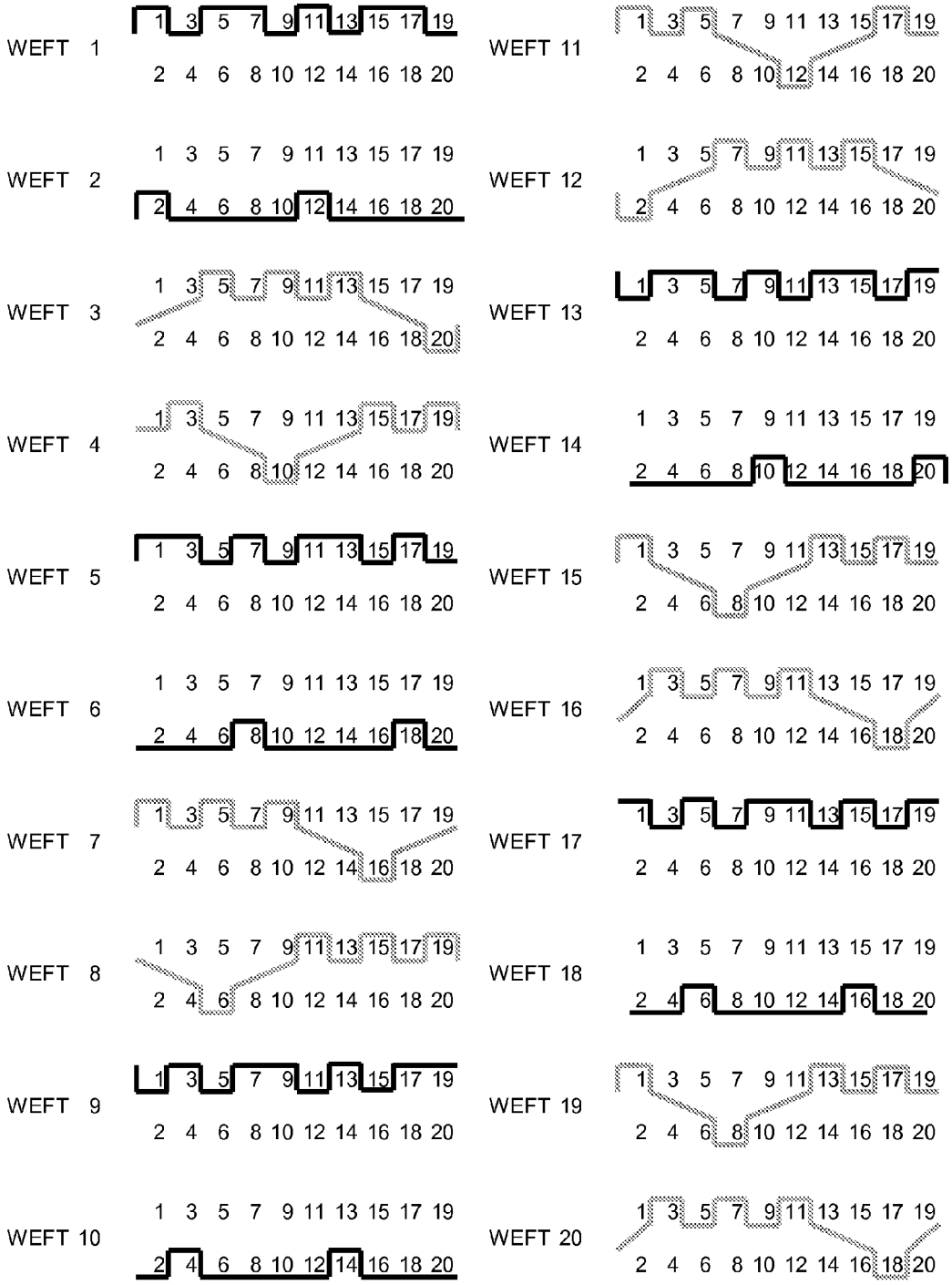
FIG. 27 shows a schematic representation of the weave pattern of individual weft yarns of FIG. 26 with the top and bottom warp yarns.
Figure 28:
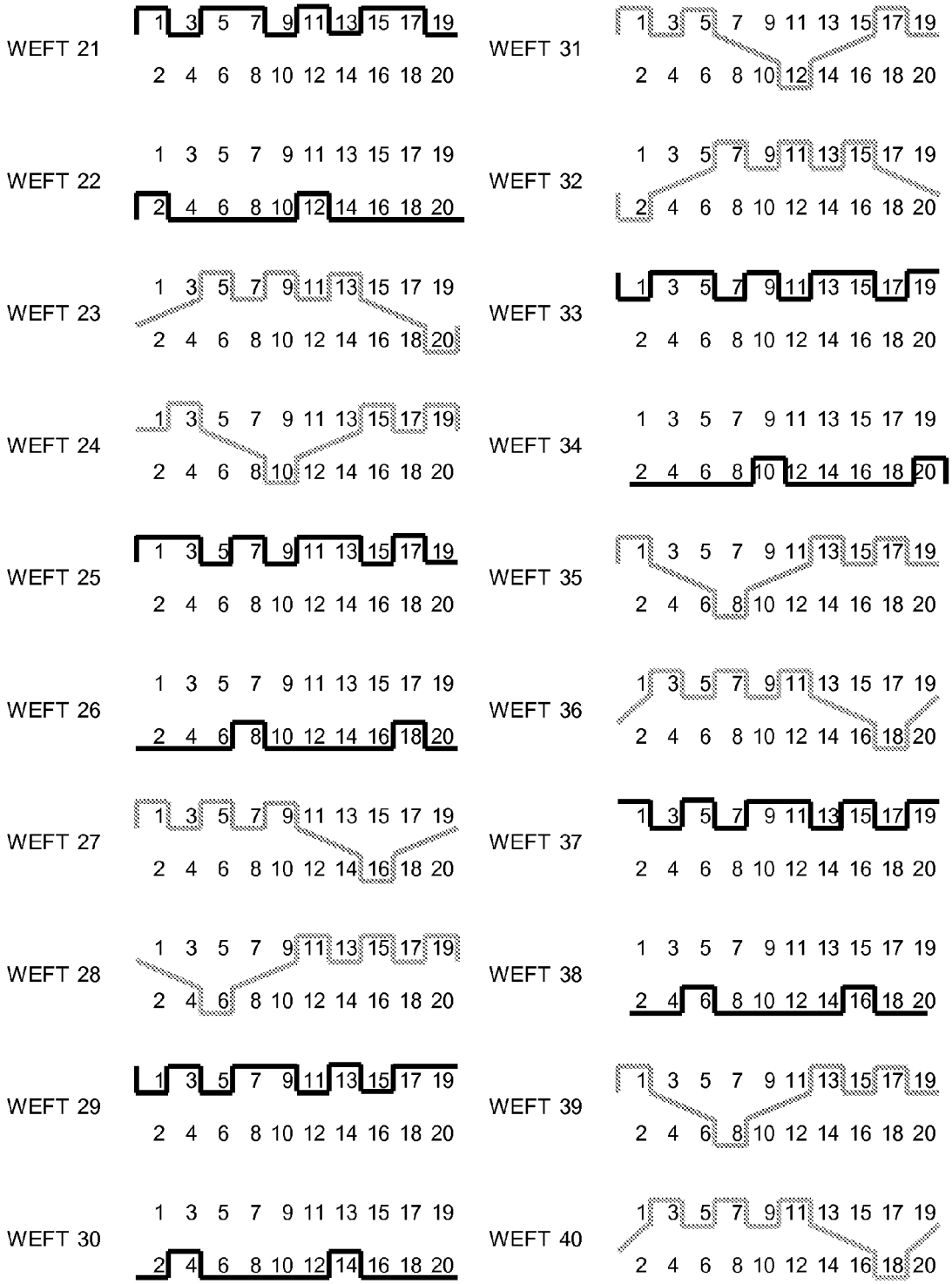
FIG. 28 shows an additional schematic representation of the weave pattern of individual weft yarns of FIG. 26 with the top and bottom warp yarns.
Figure 29:
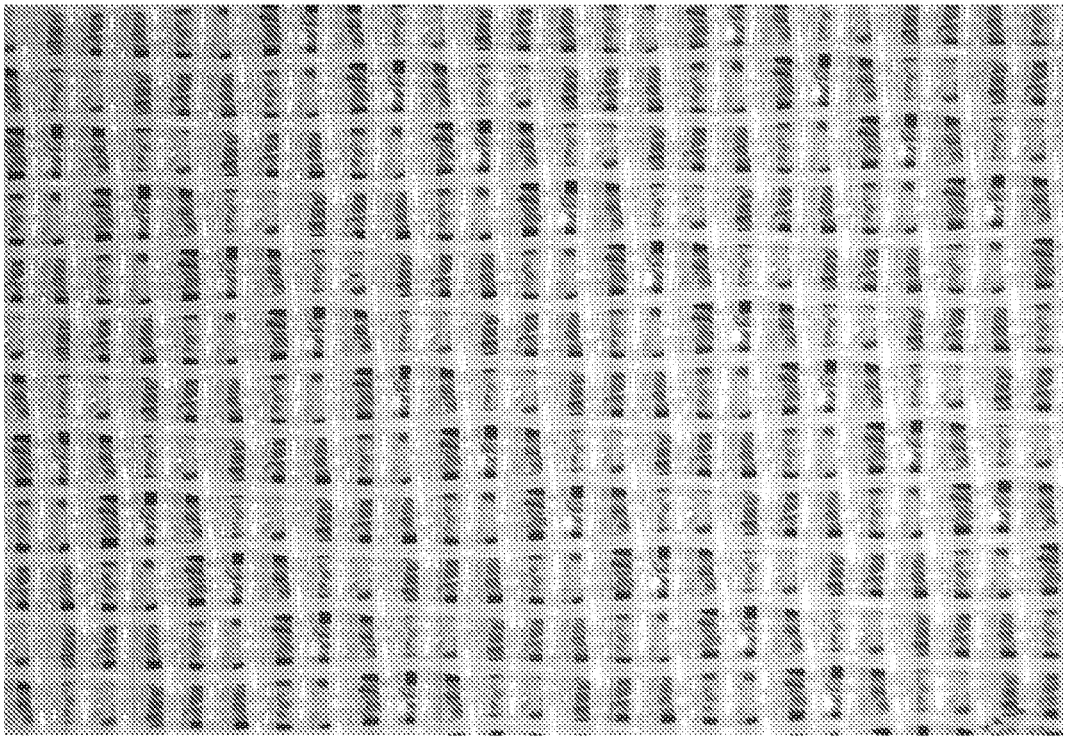
FIG. 29 shows a photograph of the upper surface or paper-facing surface of the forming fabric of FIG. 26.
Figure 30:
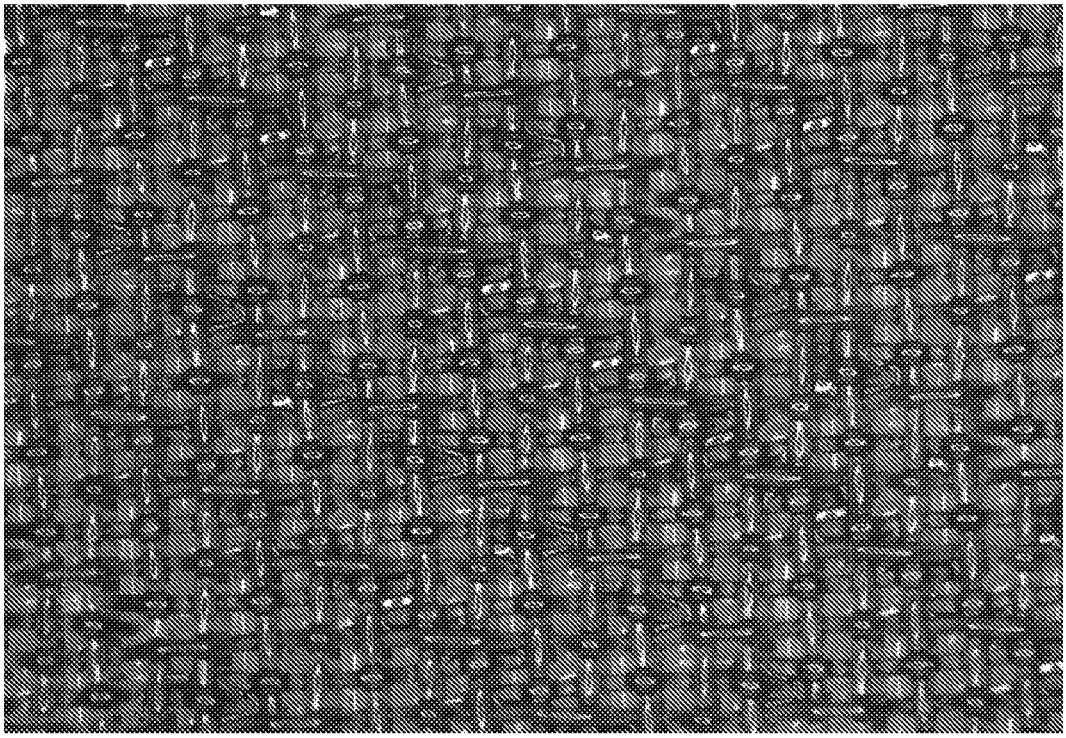
FIG. 30 shows another photograph of the upper surface or paper-facing surface of the forming fabric of FIG. 26.
Figure 31:
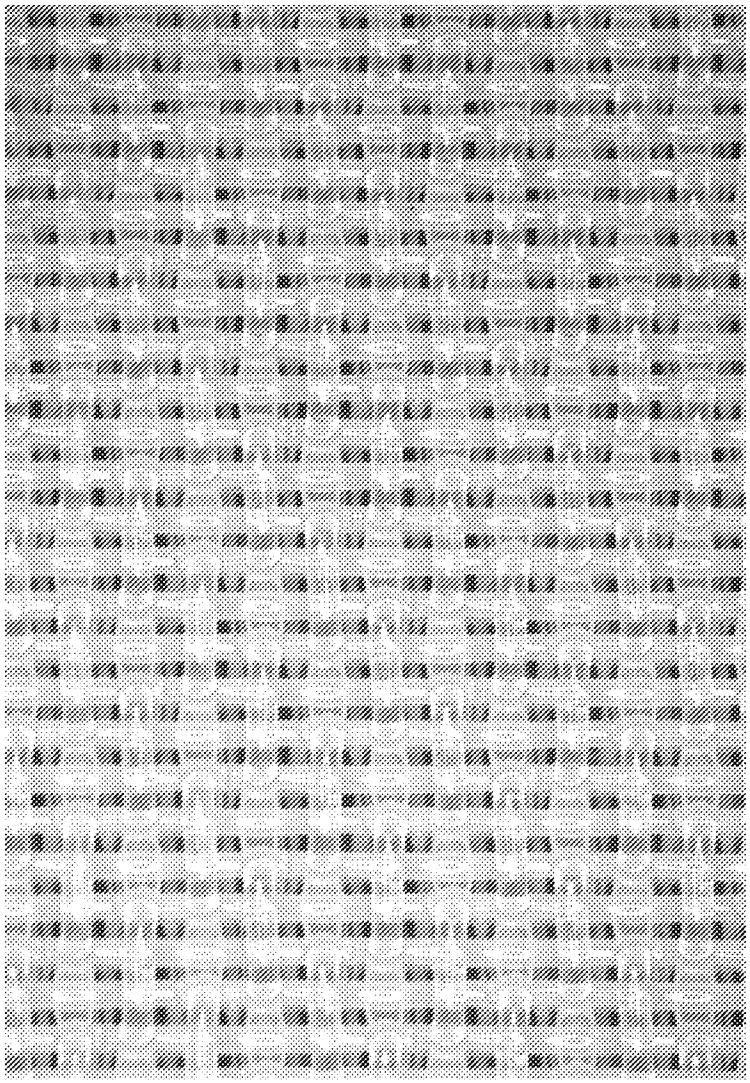
FIG. 31 shows a photograph of a bottom layer of the forming fabric of FIG. 26.
Figure 32:
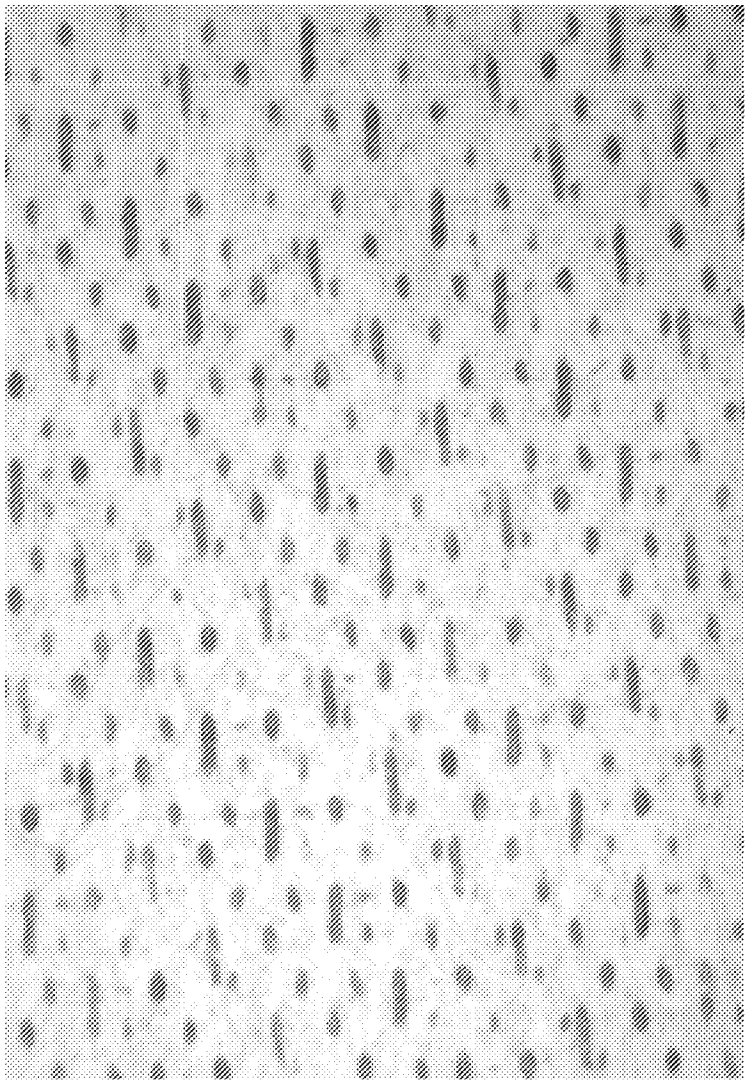
FIG. 32 shows a photograph of an impression of the upper surface of the forming fabric of FIG. 26.

A fourth non-limiting embodiment of the forming fabric of the present invention is illustrated in FIGS. 26-31, and an impression of the upper surface of the fourth embodiment of the forming fabric is illustrated in FIG. 32. The fabric of FIG. 26 shows a single repeating pattern area of the fabric that encompasses twenty warp yarns (yarns 1-20 extending vertically in FIG. 26) and forty weft yarns (yarns 1-40 extending horizontally in FIG. 26). The fabric is a one two over five shed straight fabric. FIGS. 27 and 28 depict the paths of weft yarns 1-40 as they weave with warp yarns 1-20. Like the DCB weft yarns of the previous embodiments of the forming fabric, the DCB weft yarns in each pair combine to match the weave pattern of the top weft yarns. However, unlike the previous embodiments of the forming fabric, each DCB weft yarn passes over one top warp yarn, then passes under one top warp yarn, then passes over one top warp yarn, then passes under one top warp yarn, then passes over one top warp yarn, then passes between two consecutive pairs of top and bottom warp yarns, then passes under one bottom warp yarn, and then passes between two consecutive pairs of top and bottom warp yarns.

By way of non-limiting example, the fourth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the fourth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 33:
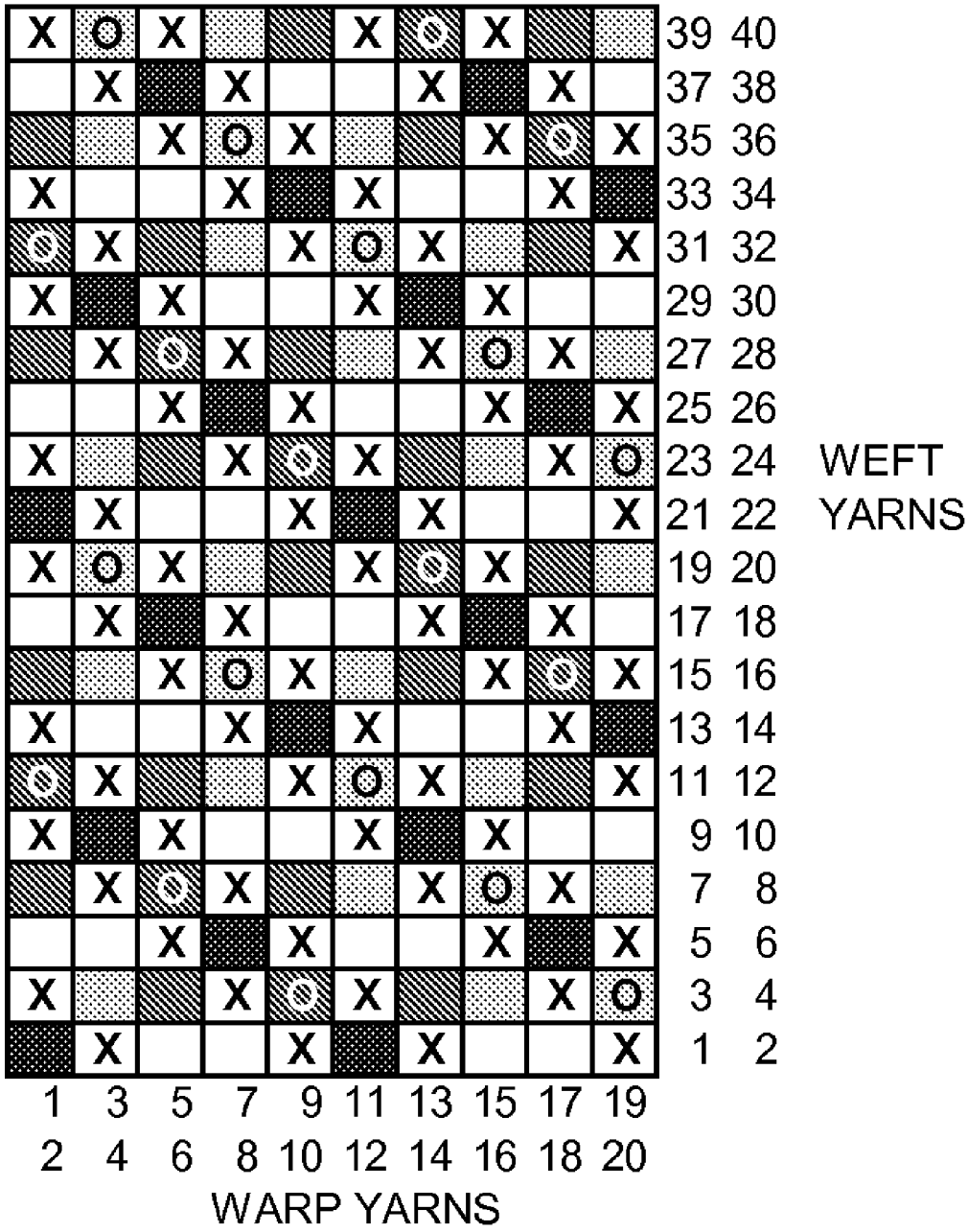
FIG. 33 shows a repeating pattern area of a fifth embodiment of a forming fabric according to the invention.
Figure 34:
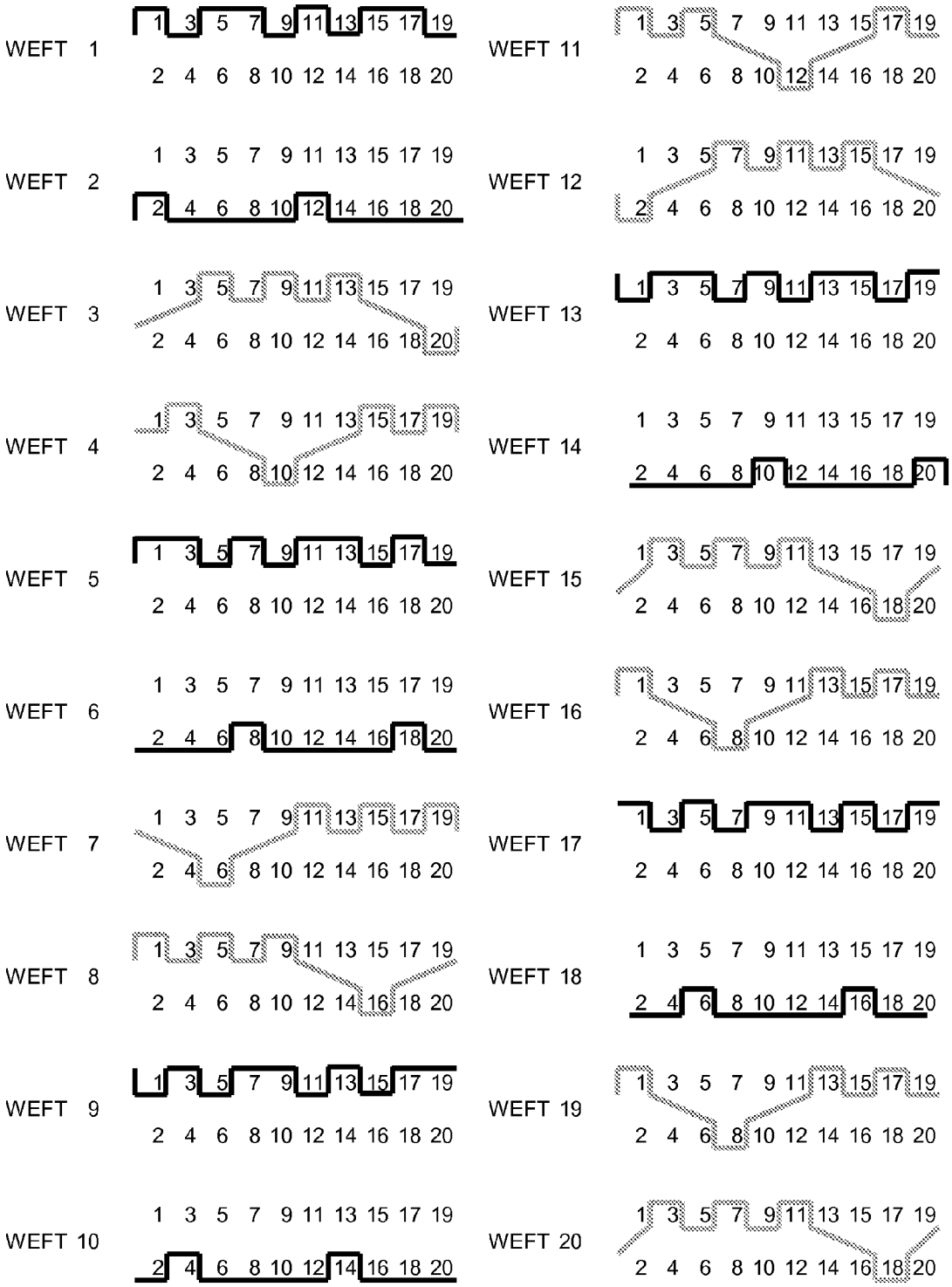
FIG. 34 shows a schematic representation of the weave pattern of individual weft yarns of FIG. 33 with the top and bottom warp yarns.
Figure 35:
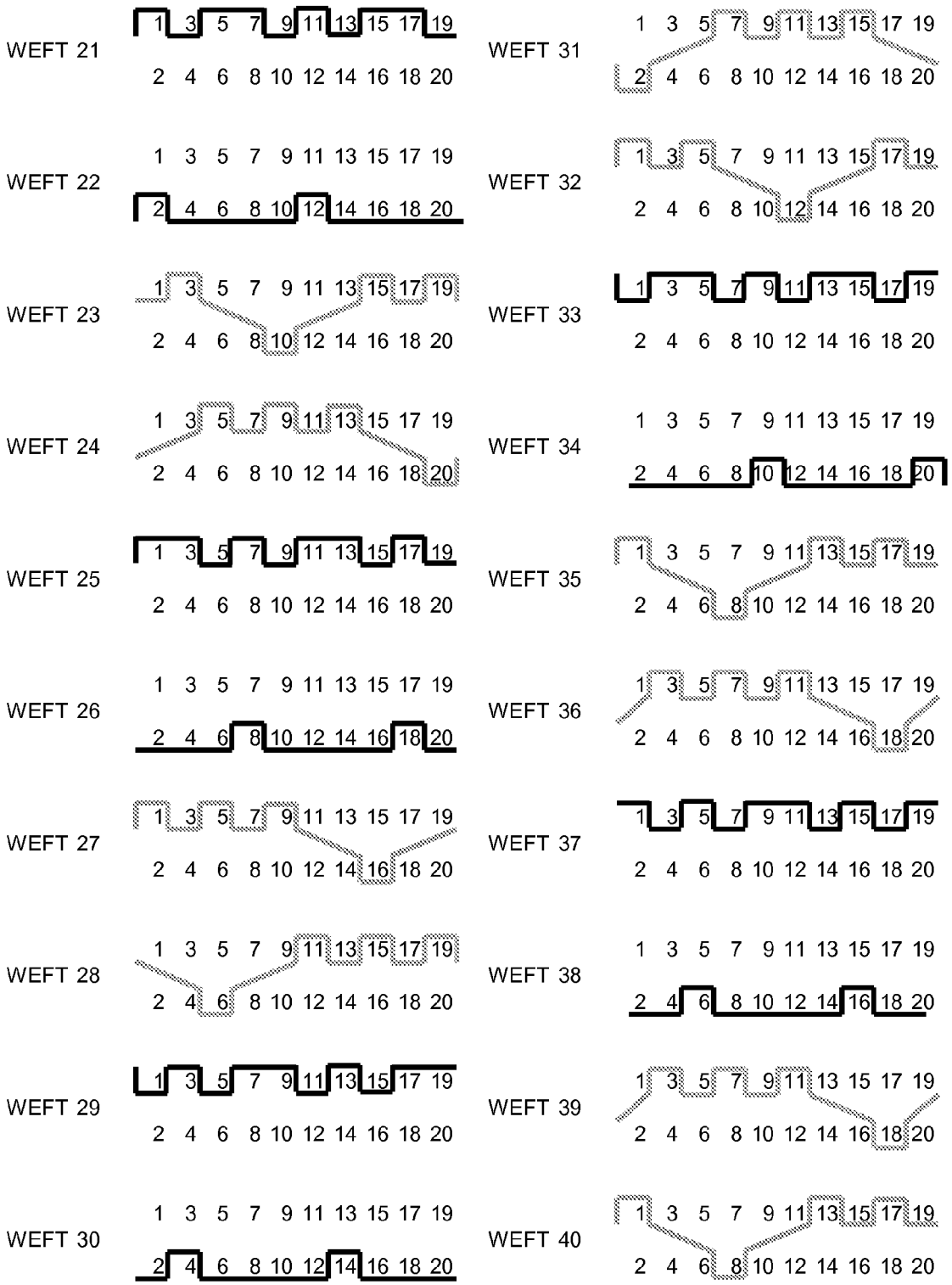
FIG. 35 shows an additional schematic representation of the weave pattern of individual weft yarns of FIG. 33 with the top and bottom warp yarns.
Figure 36:
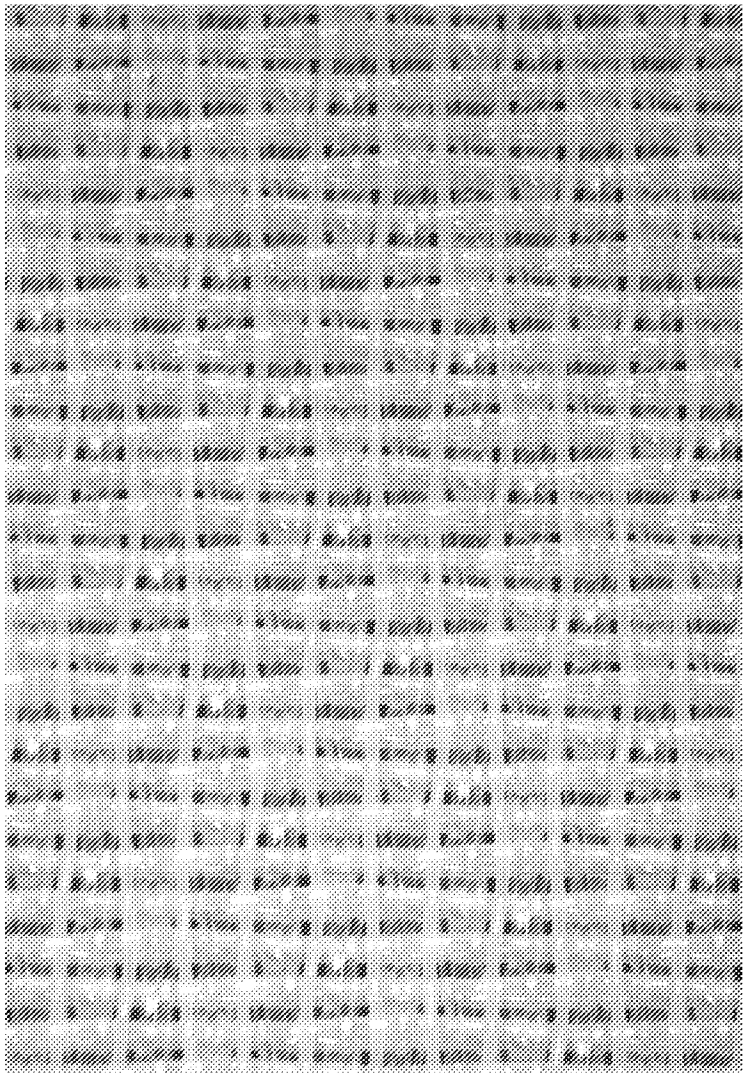
FIG. 36 shows a photograph of the upper surface or paper-facing surface of the forming fabric of FIG. 33.
Figure 37:
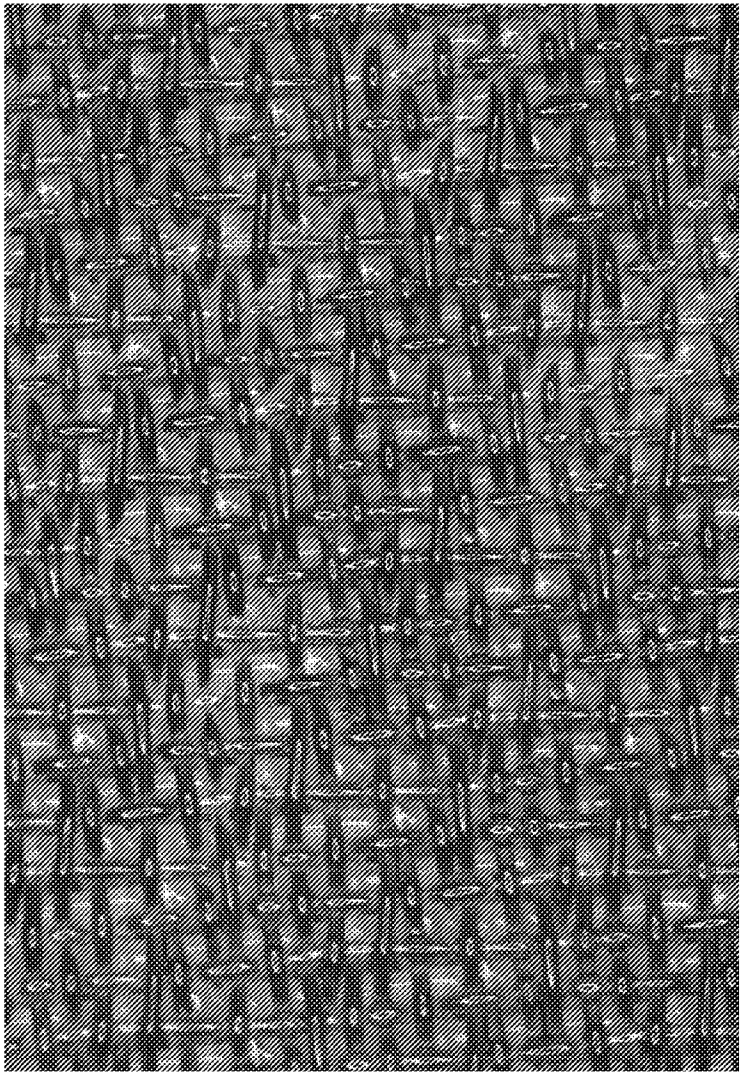
FIG. 37 shows another photograph of the upper surface or paper-facing surface of the forming fabric of FIG. 33.
Figure 38:
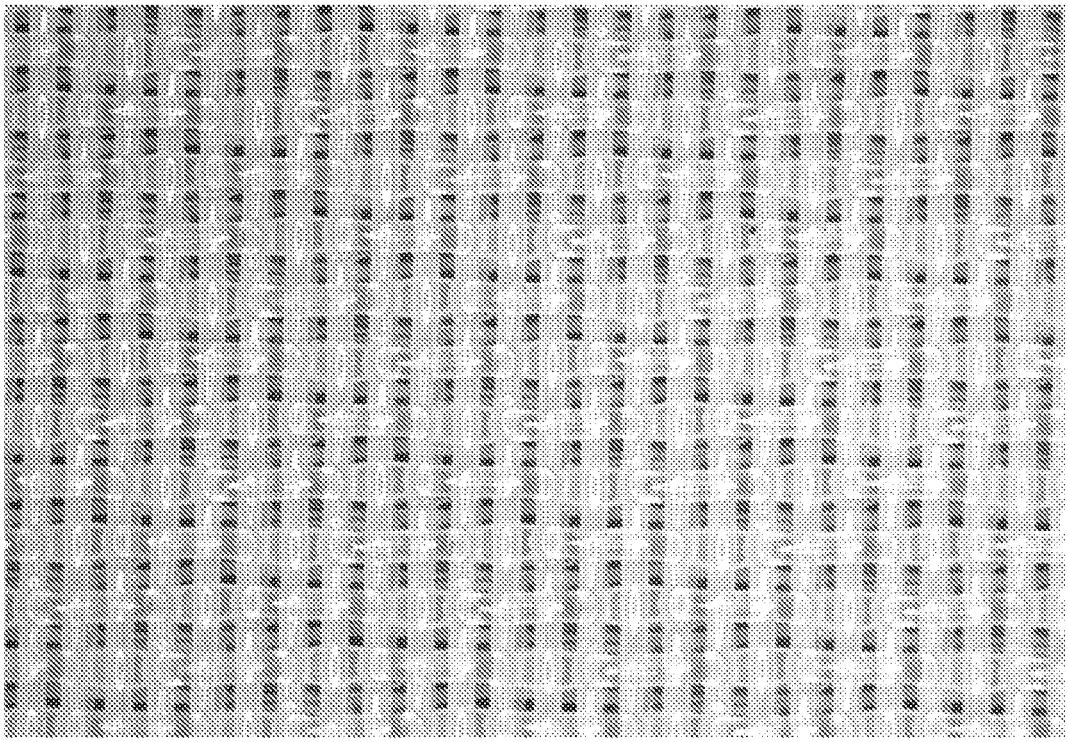
FIG. 38 shows a photograph of a bottom layer of the forming fabric of FIG. 33.
Figure 39:
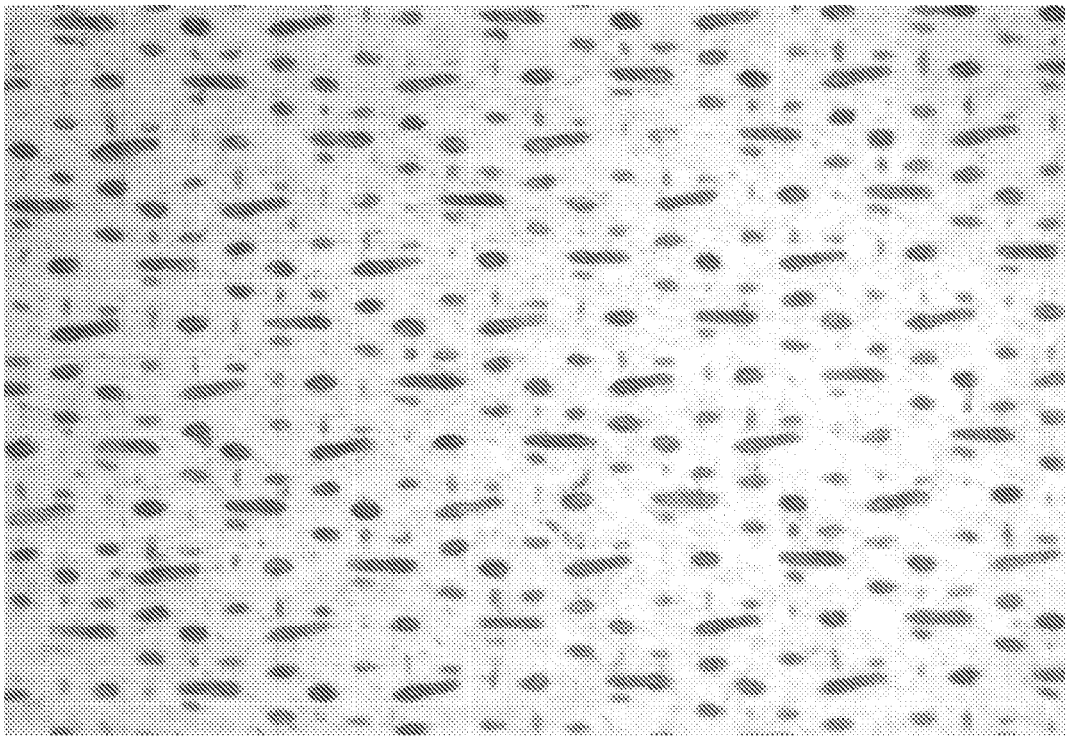
FIG. 39 shows a photograph of an impression of the upper surface of the forming fabric of FIG. 33.

A fifth non-limiting embodiment of the forming fabric of the present invention is illustrated in FIGS. 33-38, and an impression of the upper surface of the fifth embodiment of the forming fabric is illustrated in FIG. 39. The fabric of FIG. 33 shows a single repeating pattern area of the fabric that encompasses twenty warp yarns (yarns 1-20 extending vertically in FIG. 33) and forty weft yarns (yarns 1-40 extending horizontally in FIG. 33). The fabric is a one two over five shed fabric. FIGS. 34 and 35 depict the paths of weft yarns 1-40 as they weave with warp yarns 1-20. Like the DCB weft yarns of the previous embodiments of the forming fabric, the DCB weft yarns in each pair combine to match the weave pattern of the top weft yarns. Like the previous embodiment of the forming fabric, each DCB weft yarn passes over one top warp yarn, then passes under one top warp yarn, then passes over one top warp yarn, then passes under one top warp yarn, then passes over one top warp yarn, then passes between two consecutive pairs of top and bottom warp yarns, then passes under one bottom warp yarn, and then passes between two consecutive pairs of top and bottom warp yarns. However, the weave pattern of the DCB weft yarns is offset from adjacent top and bottom weft yarns differently than those of the previous embodiment as shown in FIGS. 33-38.

By way of non-limiting example, the fifth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the fifth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 40A:
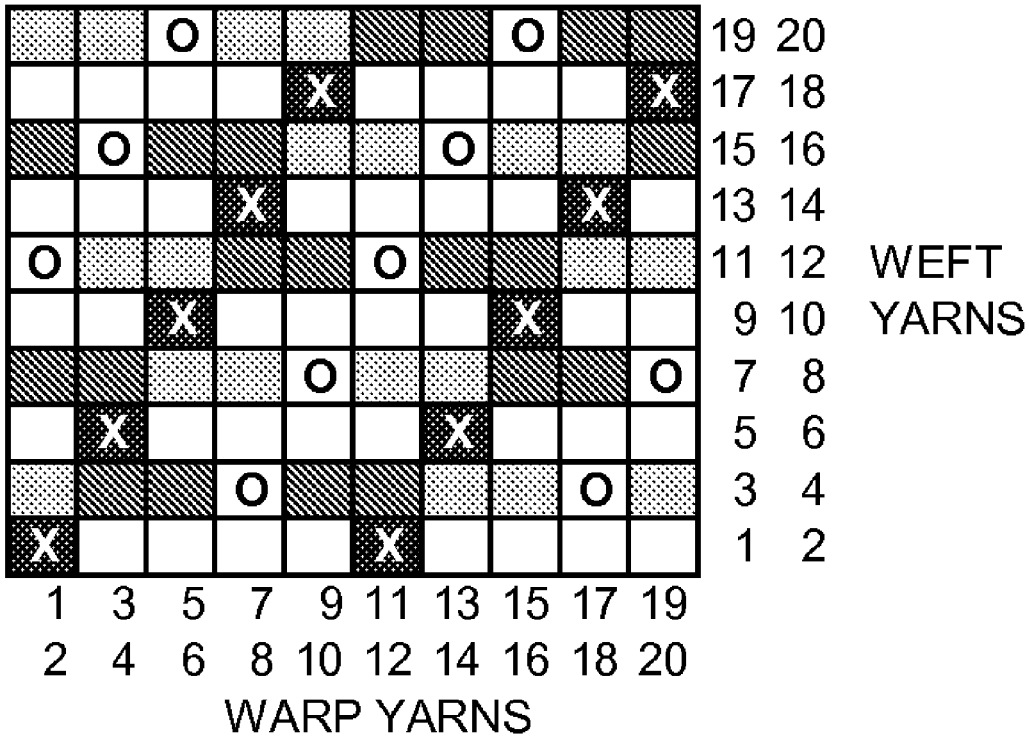
FIG. 40A shows a repeating pattern area of a sixth embodiment of a forming fabric according to the invention.
Figure 40B:
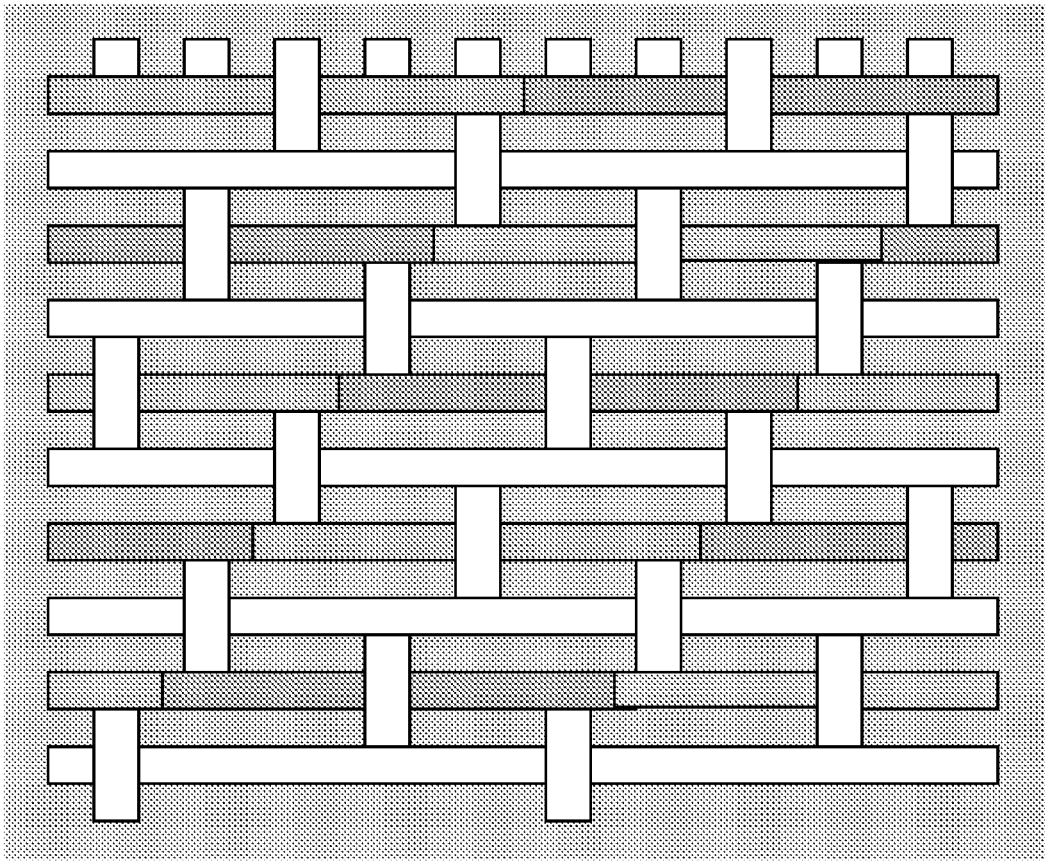
FIG. 40B shows the weave pattern of the upper surface or paper side of the forming fabric of FIG. 40A.
Figure 41:
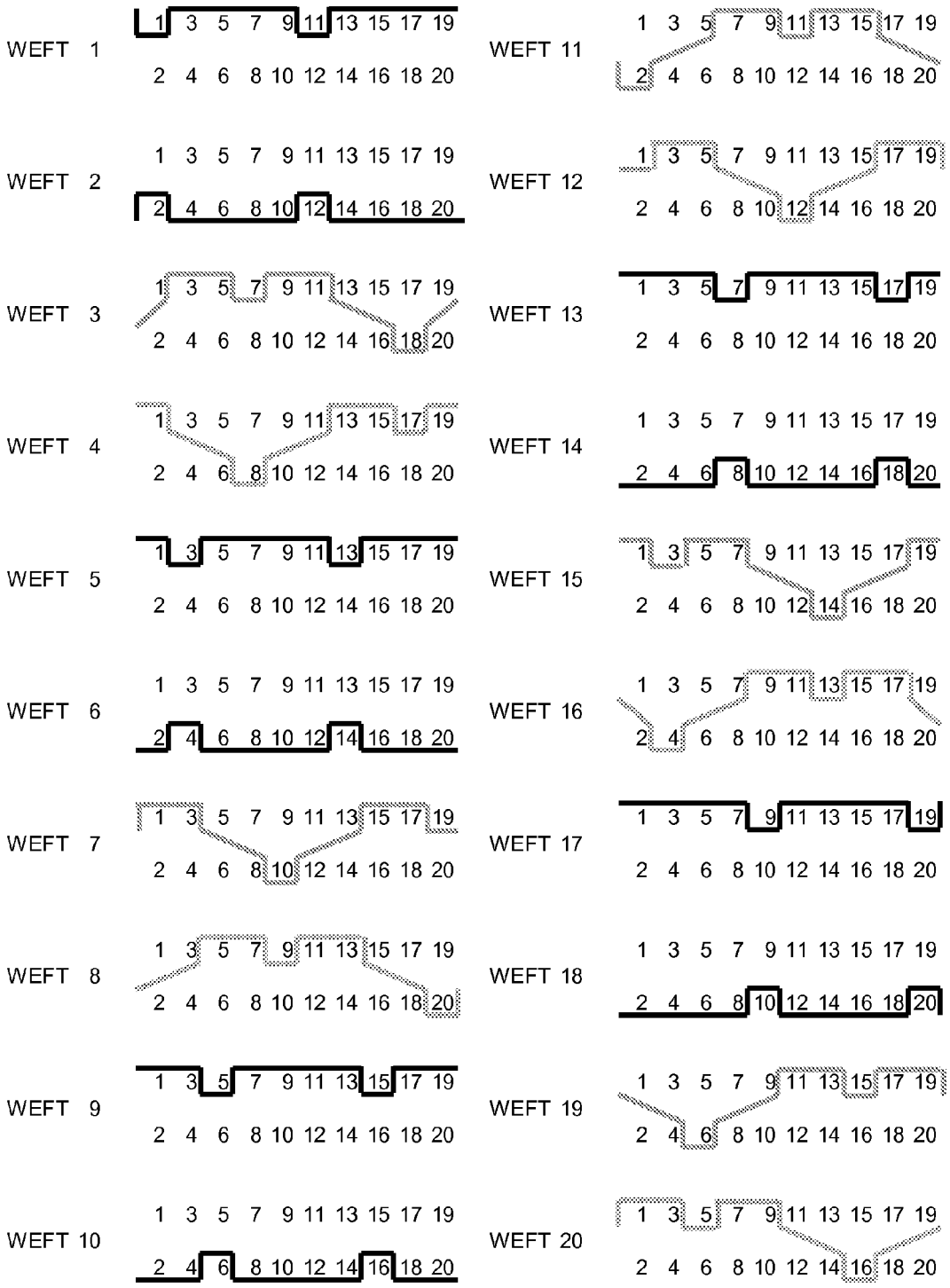
FIG. 41 shows a schematic representation of the weave pattern of individual weft yarns of FIG. 40 with the top and bottom warp yarns.

A sixth non-limiting embodiment of the forming fabric of the present invention is illustrated in FIGS. 40 and 41. The fabric of FIG. 40 shows a single repeating pattern area of the fabric that encompasses twenty warp yarns (yarns 1-20 extending vertically in FIG. 40) and twenty weft yarns (yarns 1-20 extending horizontally in FIG. 40). The fabric is a straight twill bottom fabric. FIG. 41 depicts the paths of weft yarns 1-20 as they weave with warp yarns 1-20. Like the DCB weft yarns of the previous embodiments of the forming fabric, the DCB weft yarns in each pair combine to match the weave pattern of the top weft yarns. Like the DCB weft yarns of the first embodiment, each DCB weft yarn passes over two consecutive top warp yarns, then passes under one top warp yarn, then passes over two consecutive top warp yarns, then passes between two consecutive pairs of top and bottom warp yarns, then passes under one bottom warp yarn, and then passes between two consecutive pairs of top and bottom warp yarns. However, the weave pattern of the DCB weft yarns is offset from adjacent top and bottom weft yarns differently than those of the previous embodiments as shown in FIGS. 40 and 41.

By way of non-limiting example, the sixth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the sixth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 42:
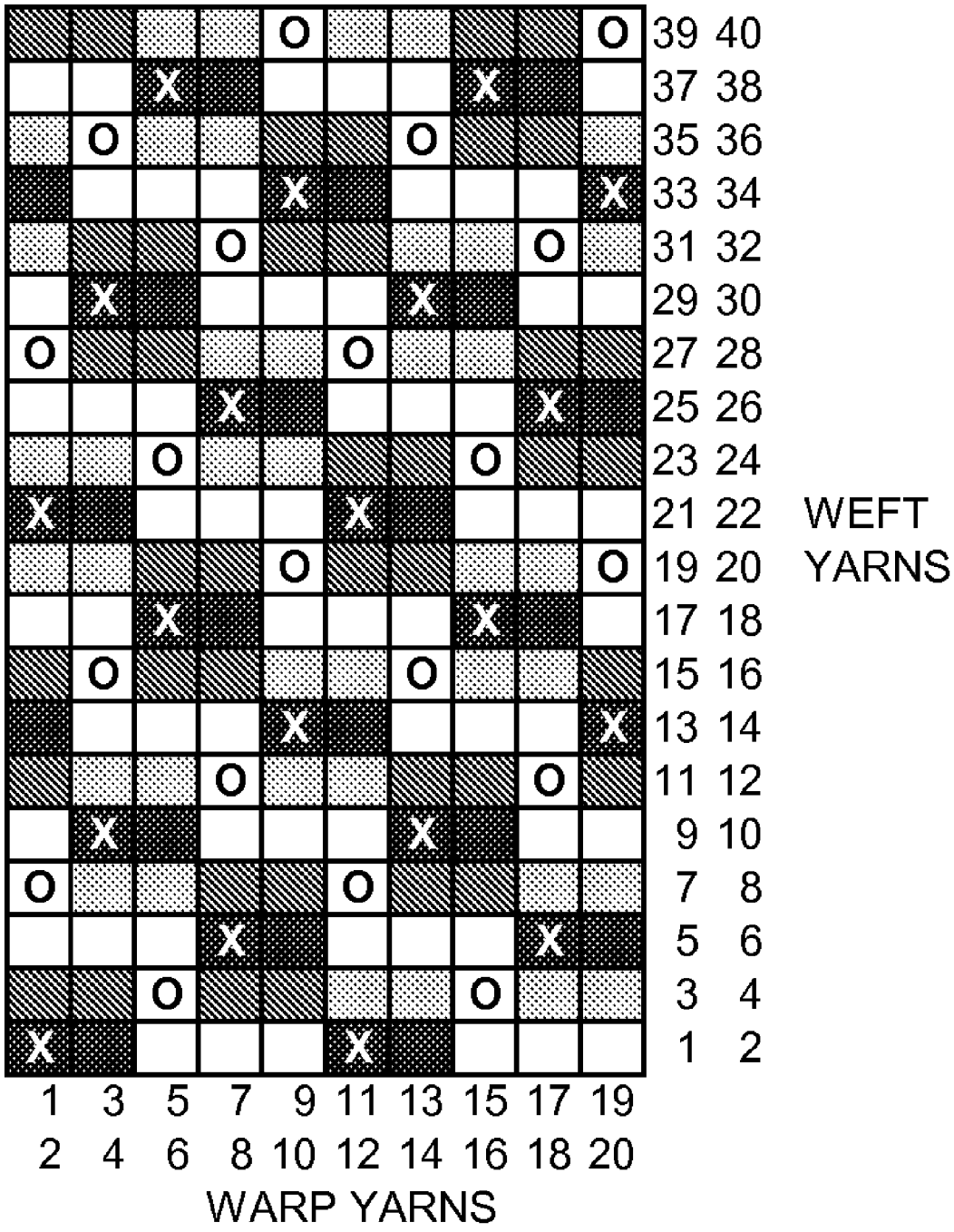
FIG. 42 shows a repeating pattern area of a seventh embodiment of a forming fabric according to the invention.
Figure 43:
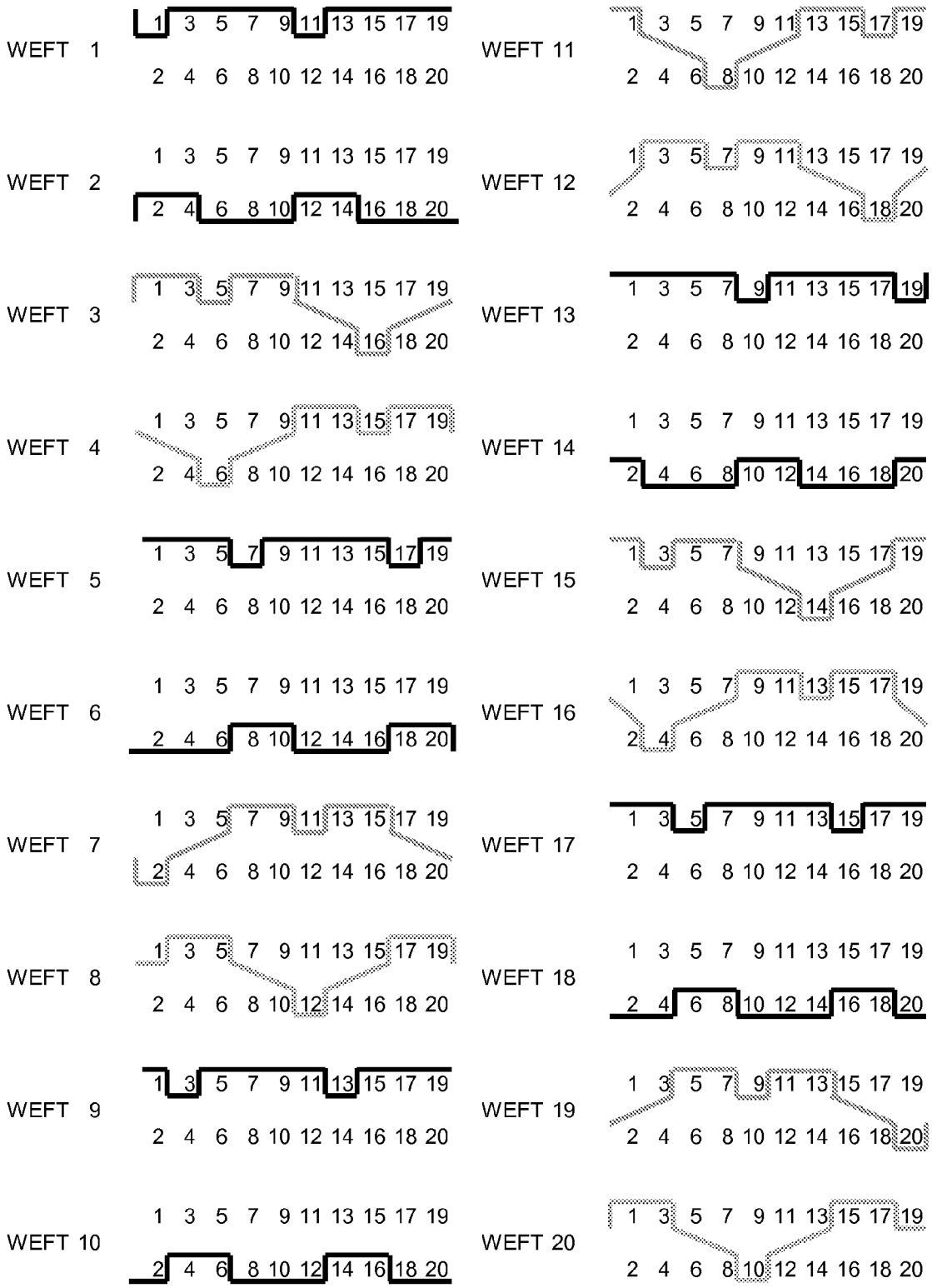
FIG. 43 shows a schematic representation of the weave pattern of individual weft yarns of FIG. 42 with the top and bottom warp yarns.
Figure 44:
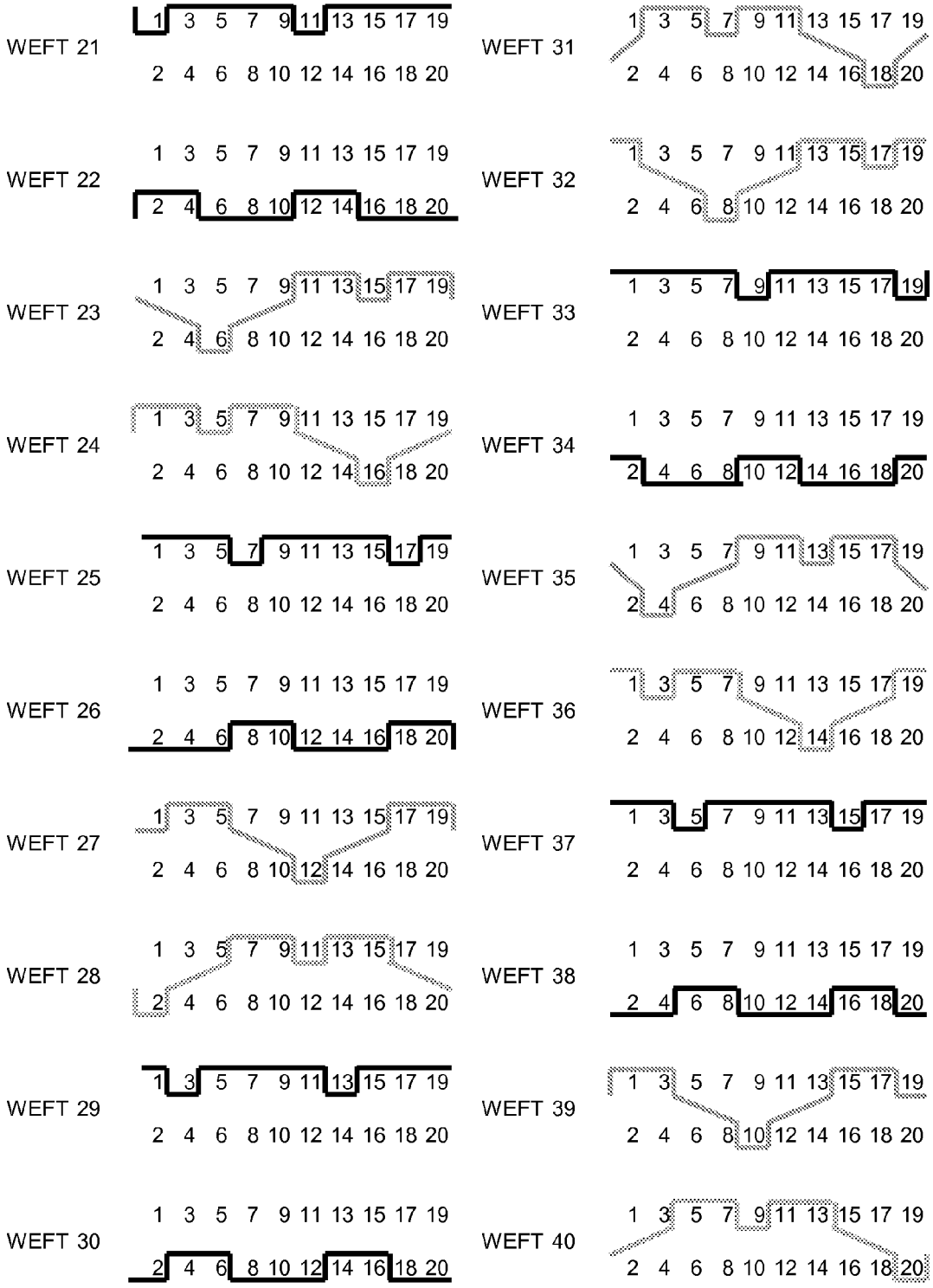
FIG. 44 shows an additional schematic representation of the weave pattern of individual weft yarns of FIG. 42 with the top and bottom warp yarns.
Figure 45:
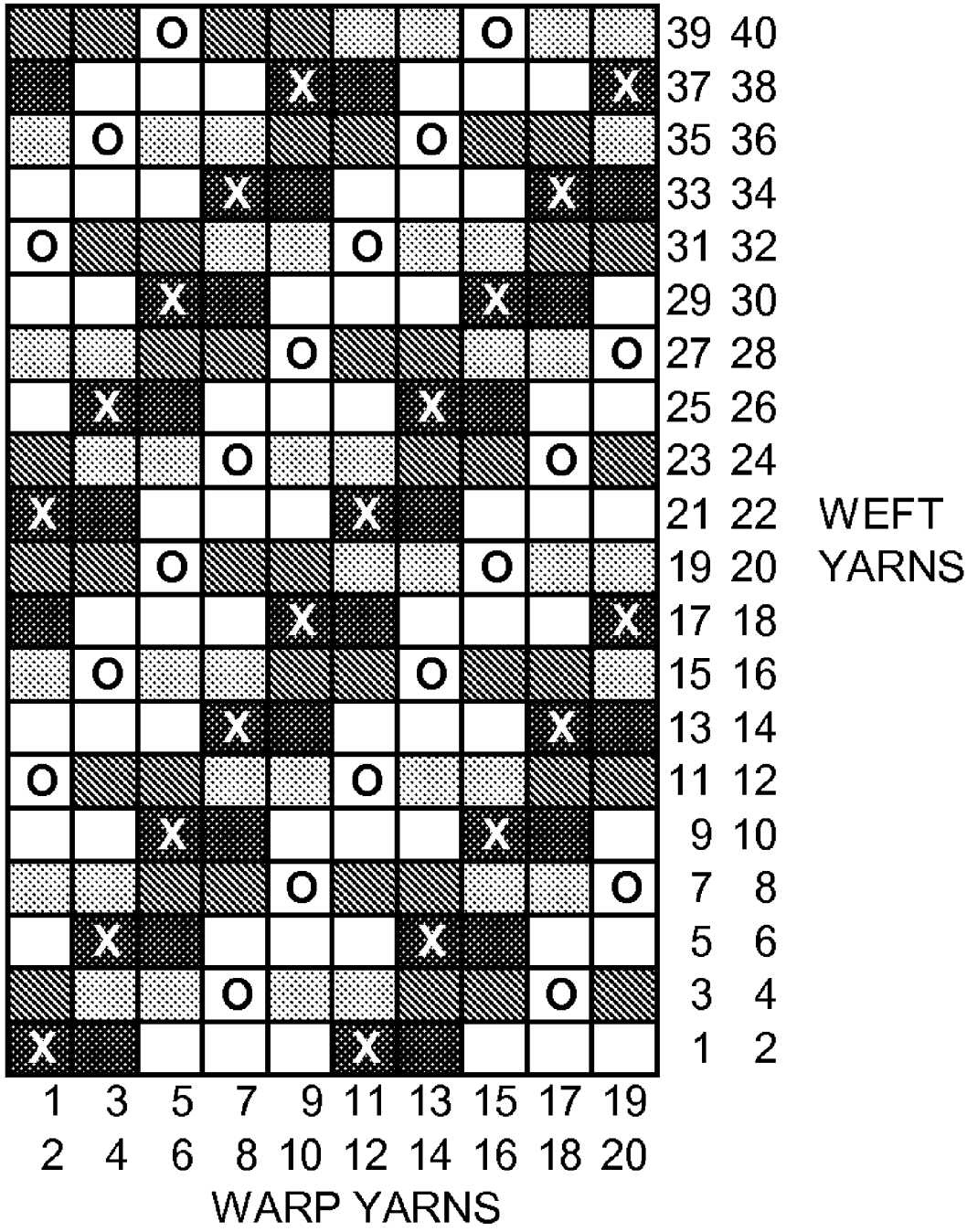
FIG. 45 shows a repeating pattern area of an eighth embodiment of a forming fabric according to the invention.

A seventh non-limiting embodiment of the forming fabric of the present invention is illustrated in FIGS. 42-44. The fabric of FIG. 42 shows a single repeating pattern area of the fabric that encompasses twenty warp yarns (yarns 1-20 extending vertically in FIG. 42) and forty weft yarns (yarns 1-40 extending horizontally in FIG. 42). The fabric is a double-knuckle bottom fabric. FIGS. 43 and 45 depict the paths of weft yarns 1-40 as they weave with warp yarns 1-20. Like the DCB weft yarns of the previous embodiments of the forming fabric, the DCB weft yarns in each pair combine to match the weave pattern of the top weft yarns. Like the DCB weft yarns of the first embodiments, each DCB weft yarn passes over two consecutive top warp yarns, then passes under one top warp yarn, then passes over two consecutive top warp yarns, then passes between two consecutive pairs of top and bottom warp yarns, then passes under one bottom warp yarn, and then passes between two consecutive pairs of top and bottom warp yarns. However, the weave pattern of the DCB weft yarns is offset from adjacent top and bottom weft yarns differently than those of the previous embodiments as shown in FIGS. 42-44.

By way of non-limiting example, the seventh embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the seventh embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 46:
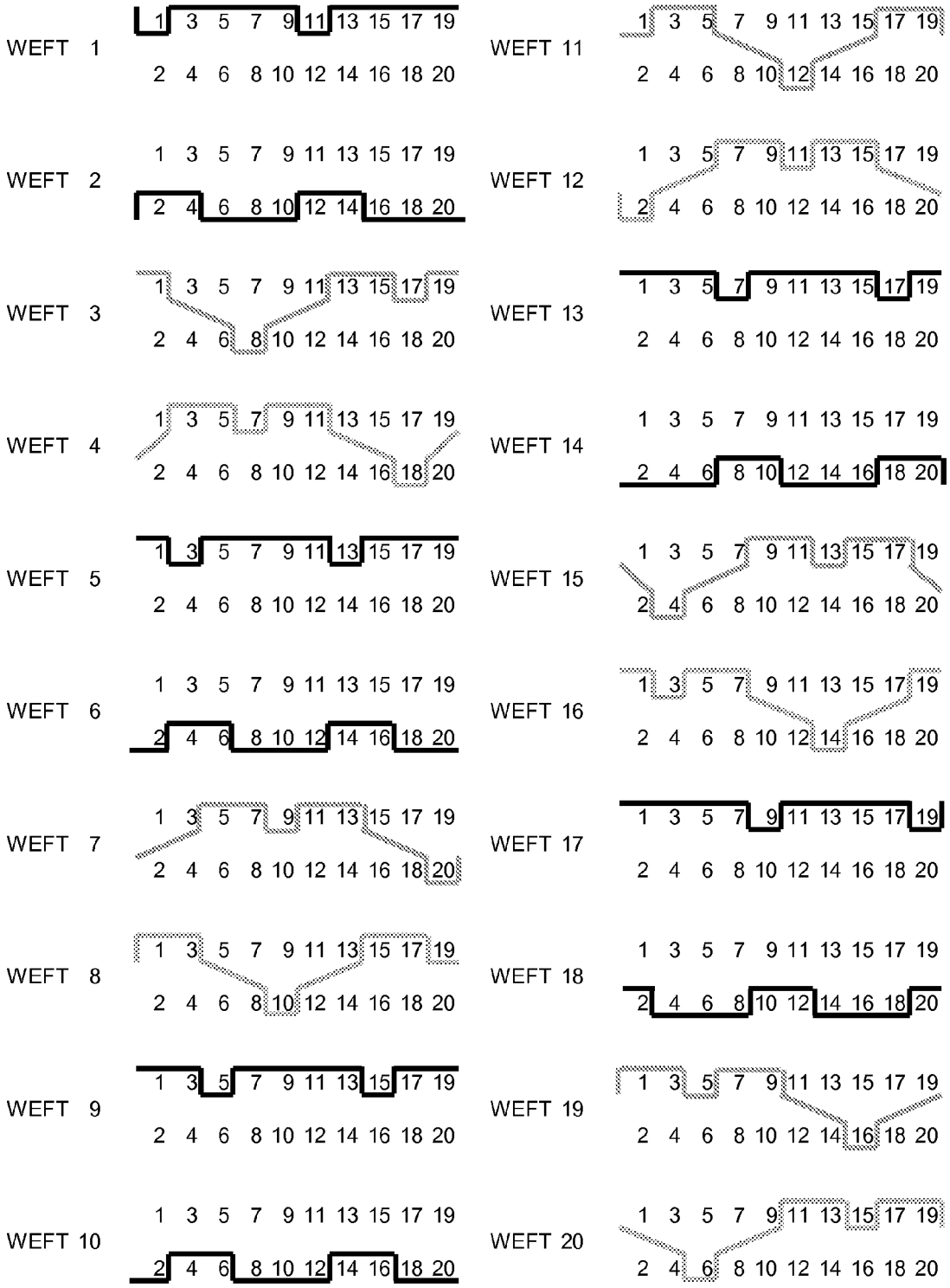
FIG. 46 shows a schematic representation of the weave pattern of individual weft yarns of FIG. 45 with the top and bottom warp yarns.
Figure 47:
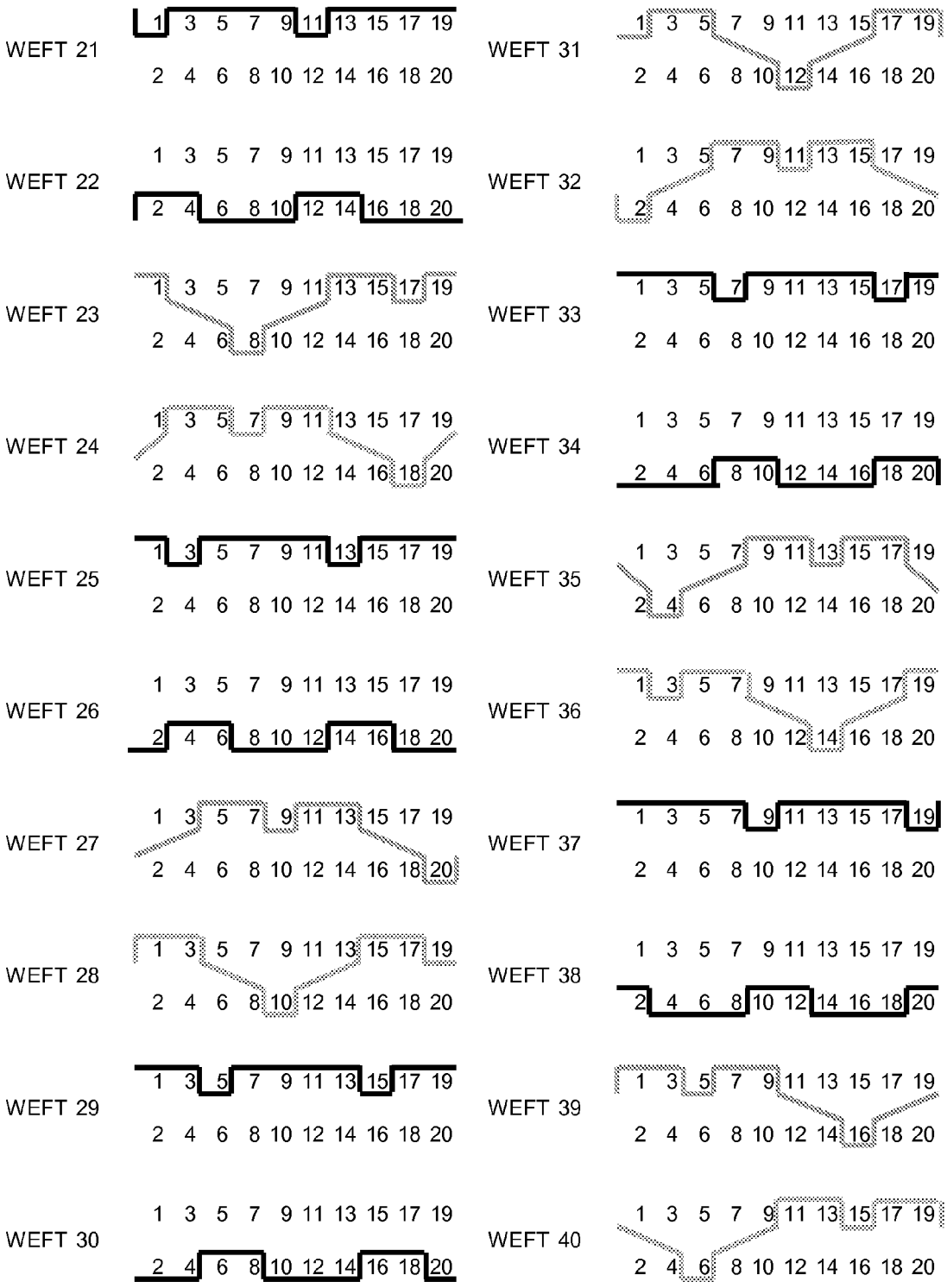
FIG. 47 shows an additional schematic representation of the weave pattern of individual weft yarns of FIG. 45 with the top and bottom warp yarns.

An eighth non-limiting embodiment of the forming fabric of the present invention is illustrated in FIGS. 45-47. The fabric of FIG. 45 shows a single repeating pattern area of the fabric that encompasses twenty warp yarns (yarns 1-20 extending vertically in FIG. 45) and forty weft yarns (yarns 1-40 extending horizontally in FIG. 45). The fabric is a straight twill double-knuckle bottom fabric. FIGS. 46 and 47 depict the paths of weft yarns 1-40 as they weave with warp yarns 1-20. Like the DCB weft yarns of the previous embodiments of the forming fabric, the DCB weft yarns in each pair combine to match the weave pattern of the top weft yarns. Like the DCB weft yarns of the first embodiment, each DCB weft yarn passes over two consecutive top warp yarns, then passes under one top warp yarn, then passes over two consecutive top warp yarns, then passes between two consecutive pairs of top and bottom warp yarns, then passes under one bottom warp yarn, and then passes between two consecutive pairs of top and bottom warp yarns. However, the weave pattern of the DCB weft yarns is offset from adjacent top and bottom weft yarns differently than those of the previous embodiments as shown in FIGS. 45-47.

By way of non-limiting example, the eighth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the eighth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 48:
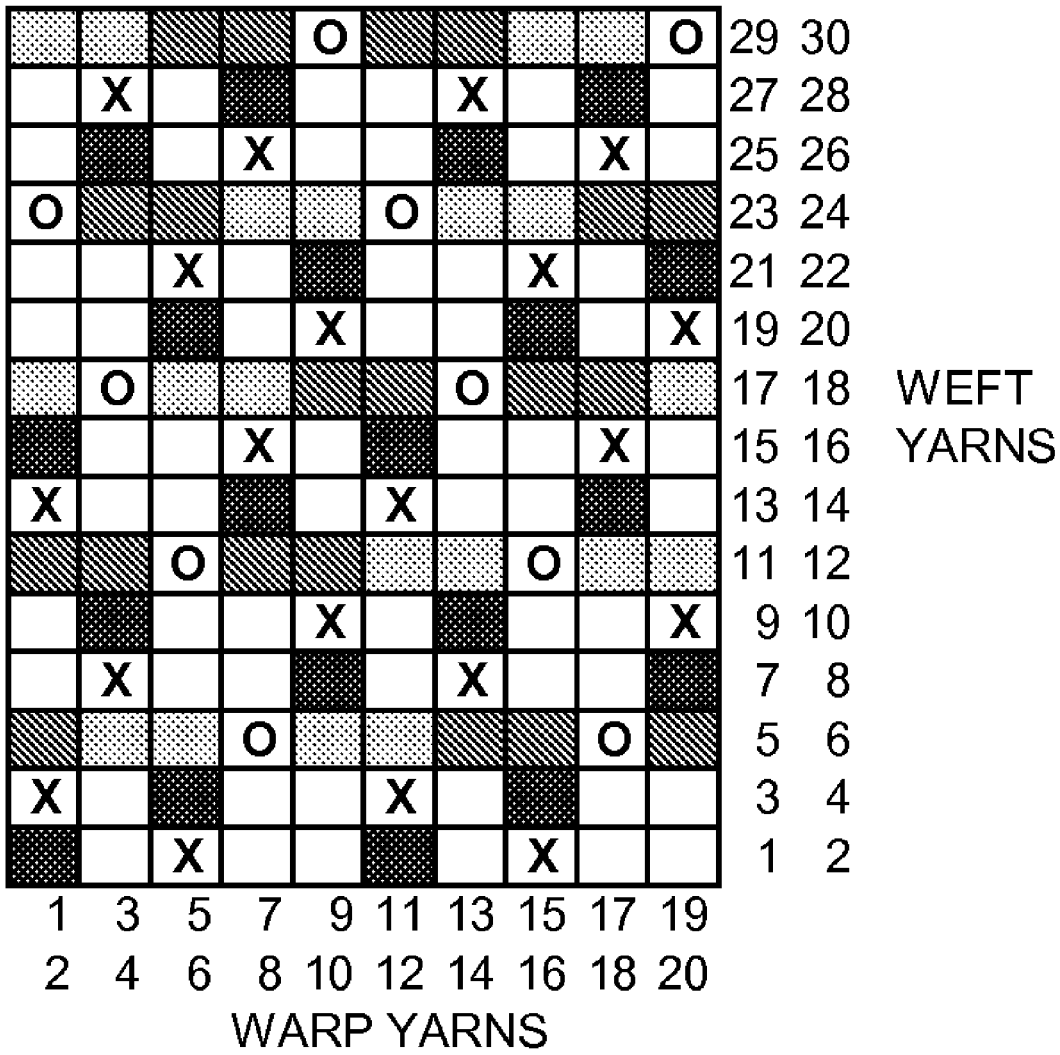
FIG. 48 shows a repeating pattern area of a ninth embodiment of a forming fabric according to the invention.
Figure 49:
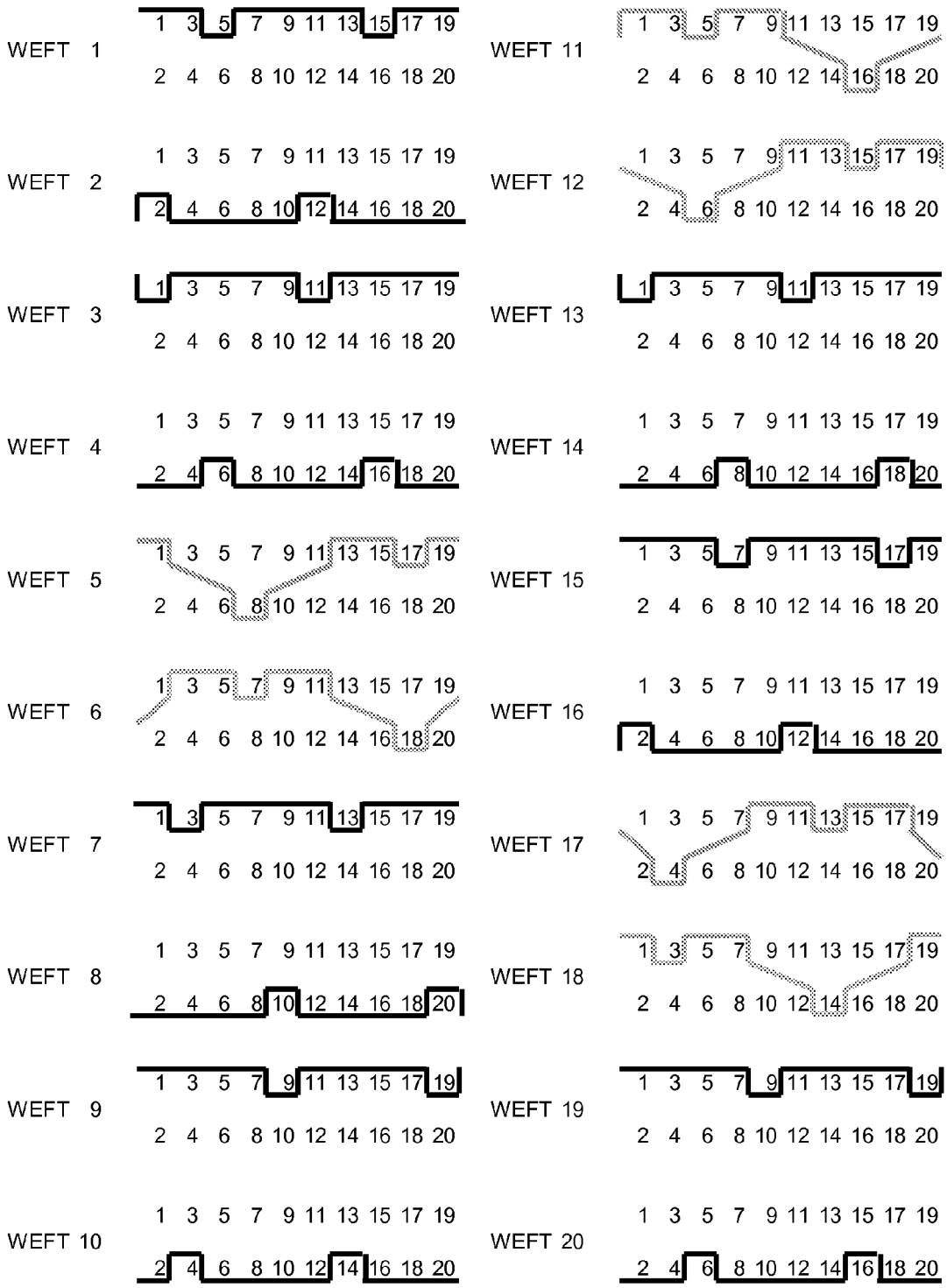
FIG. 49 shows a schematic representation of the weave pattern of individual weft yarns of FIG. 48 with the top and bottom warp yarns.
Figure 50:
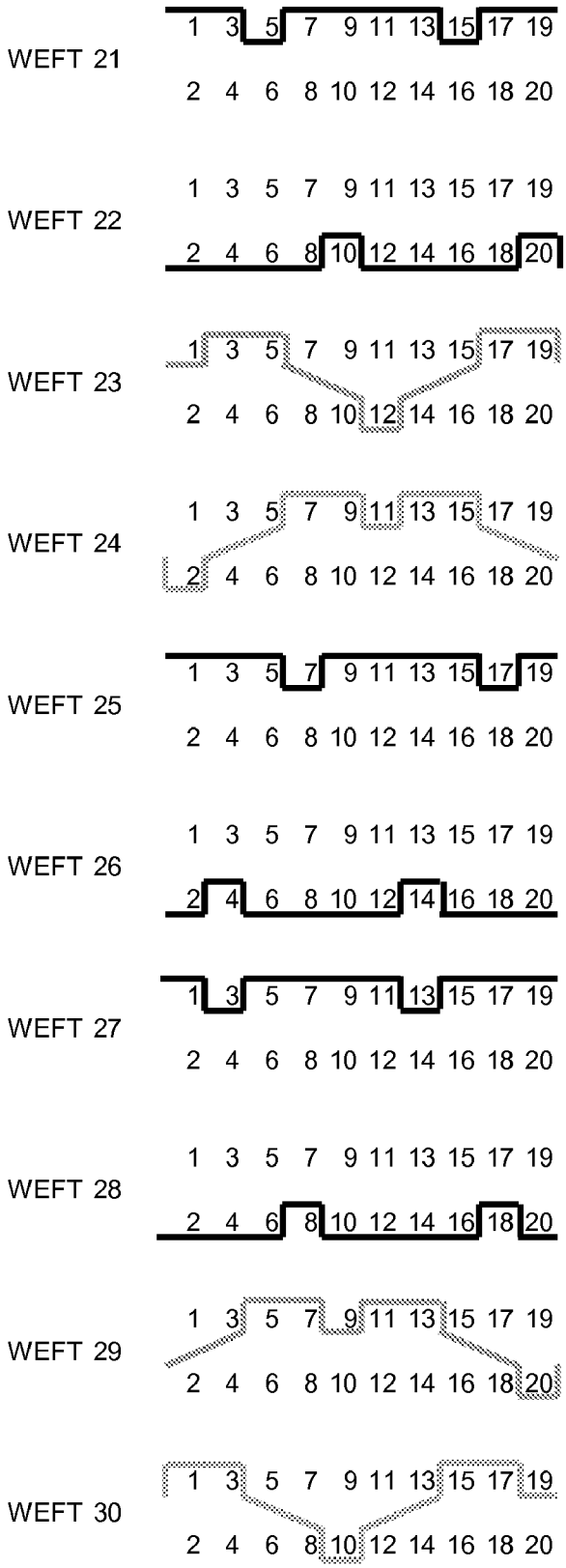
FIG. 50 shows an additional schematic representation of the weave pattern of individual weft yarns of FIG. 48 with the top and bottom warp yarns.

A ninth non-limiting embodiment of the forming fabric of the present invention is illustrated in FIGS. 48-50. The fabric of FIG. 48 shows a single repeating pattern area of the fabric that encompasses twenty warp yarns (yarns 1-20 extending vertically in FIG. 48) and thirty weft yarns (yarns 1-30 extending horizontally in FIG. 48). The fabric is a three-to-two weft ratio fabric. FIGS. 49 and 50 depict the paths of weft yarns 1-31 as they weave with warp yarns 1-20. Like the DCB weft yarns of the previous embodiments of the forming fabric, the DCB weft yarns in each pair combine to match the weave pattern of the top weft yarns. Like the DCB weft yarns of the first embodiment, each DCB weft yarn passes over two consecutive top warp yarns, then passes under one top warp yarn, then passes over two consecutive top warp yarns, then passes between two consecutive pairs of top and bottom warp yarns, then passes under one bottom warp yarn, and then passes between two consecutive pairs of top and bottom warp yarns. However, the weave pattern of the DCB weft yarns is offset from adjacent top and bottom weft yarns differently than those of the previous embodiments as shown in FIGS. 48-50.

By way of non-limiting example, the ninth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the ninth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 51:
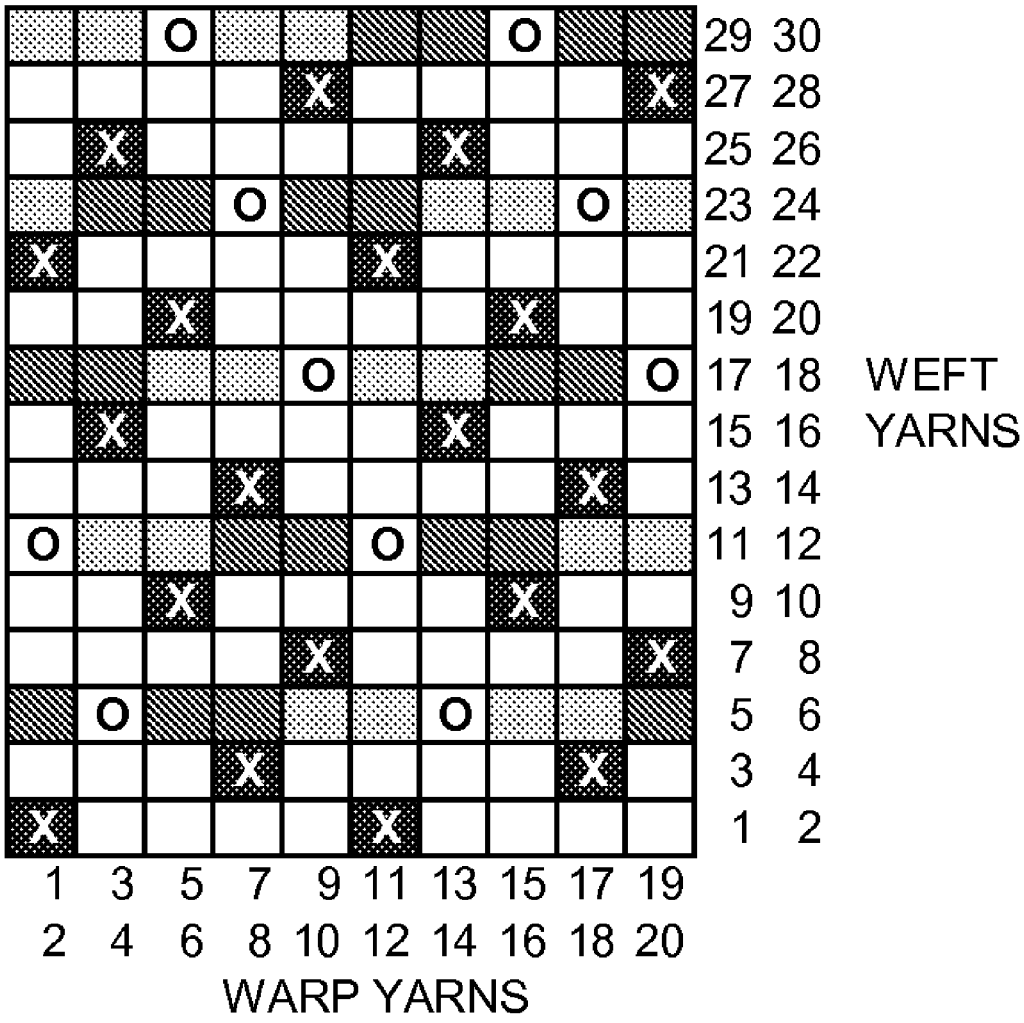
FIG. 51 shows a repeating pattern area of a tenth embodiment of a forming fabric according to the invention.
Figure 52:
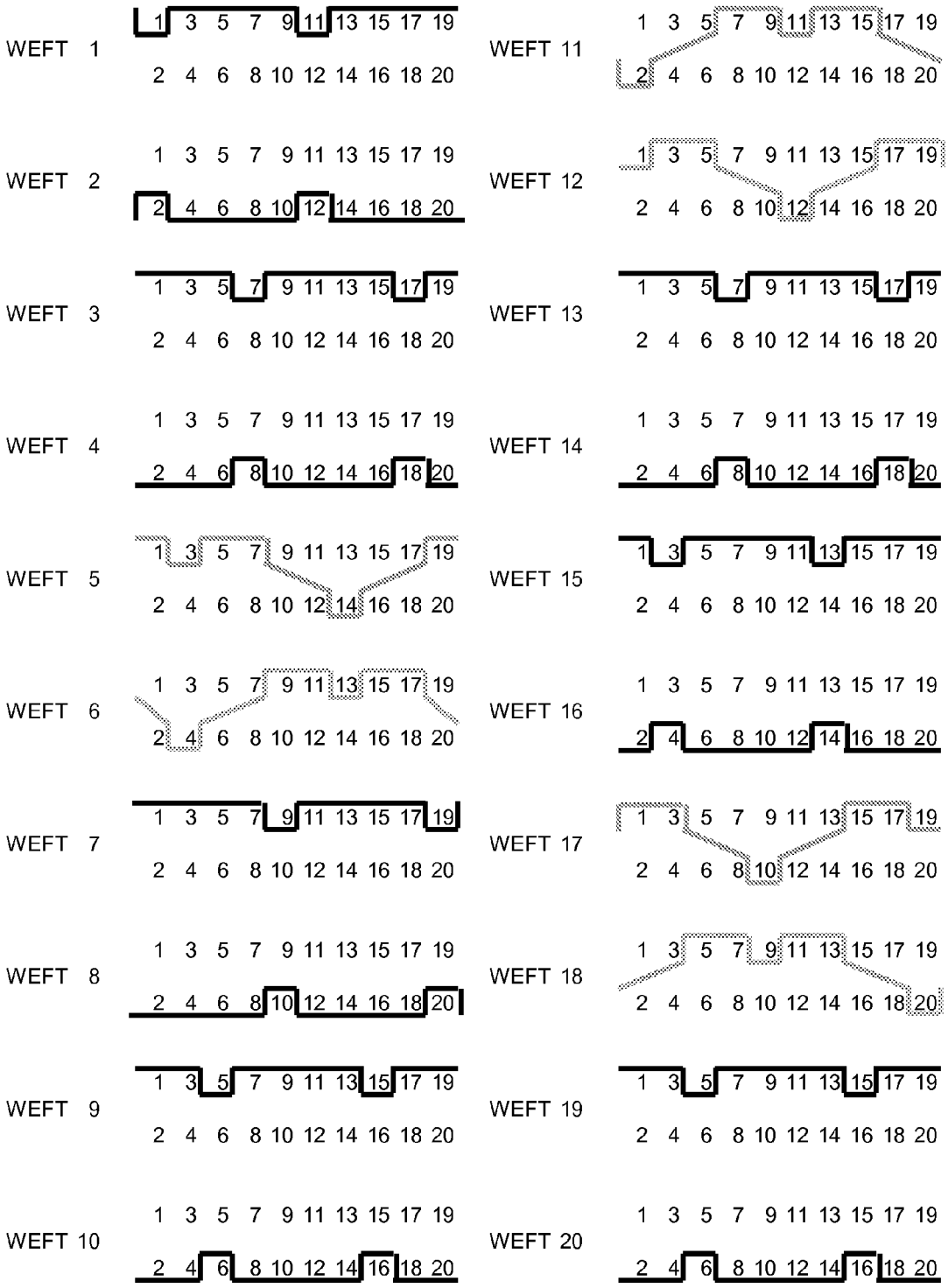
FIG. 52 shows a schematic representation of the weave pattern of individual weft yarns of FIG. 51 with the top and bottom warp yarns.
Figure 53:
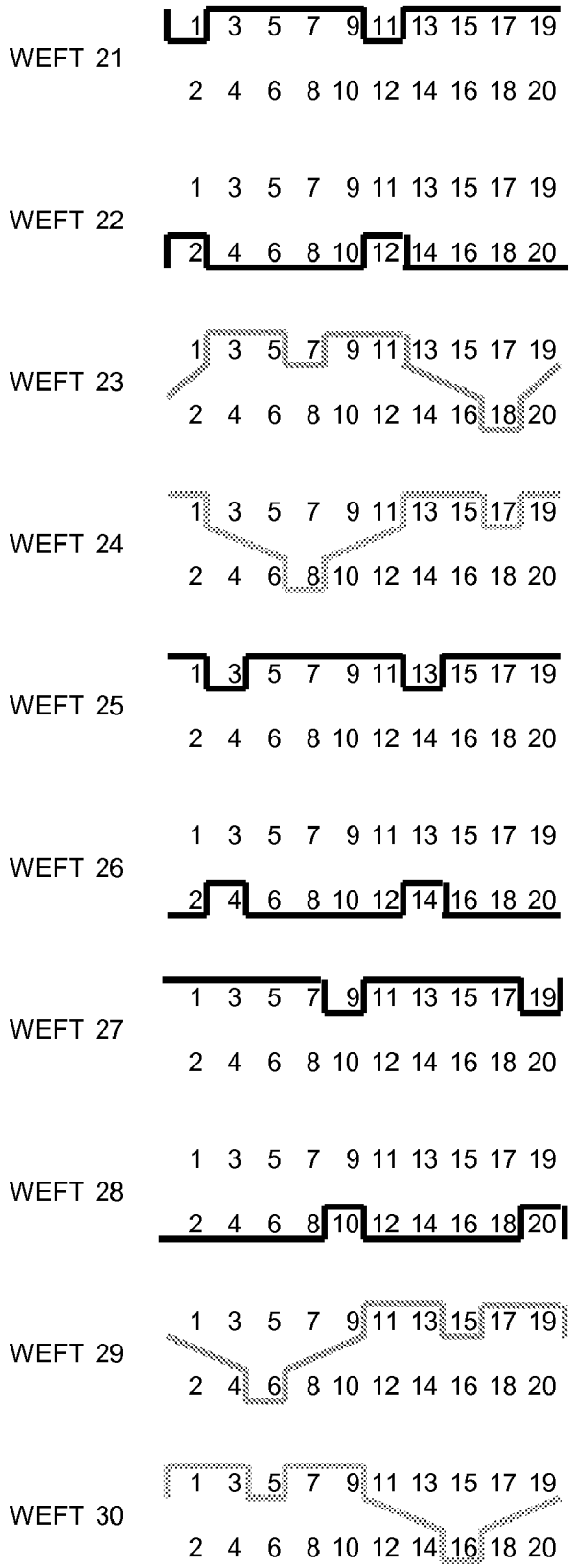
FIG. 53 shows an additional schematic representation of the weave pattern of individual weft yarns of FIG. 51 with the top and bottom warp yarns.

A tenth non-limiting embodiment of the forming fabric of the present invention is illustrated in FIGS. 51-53. The fabric of FIG. 51 shows a single repeating pattern area of the fabric that encompasses twenty warp yarns (yarns 1-20 extending vertically in FIG. 51) and thirty weft yarns (yarns 1-30 extending horizontally in FIG. 51). The fabric is a three-to-two weft ratio modified bottom fabric. FIGS. 52 and 53 depict the paths of weft yarns 1-30 as they weave with warp yarns 1-20. Like the DCB weft yarns of the previous embodiments of the forming fabric, the DCB weft yarns in each pair combine to match the weave pattern of the top weft yarns. Like the DCB weft yarns of the first embodiment, each DCB weft yarn passes over two consecutive top warp yarns, then passes under one top warp yarn, then passes over two consecutive top warp yarns, then passes between two consecutive pairs of top and bottom warp yarns, then passes under one bottom warp yarn, and then passes between two consecutive pairs of top and bottom warp yarns. However, the weave pattern of the DCB weft yarns is offset from adjacent top and bottom weft yarns differently than those of the previous embodiments as shown in FIGS. 51-53.

By way of non-limiting example, the tenth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the tenth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 54:
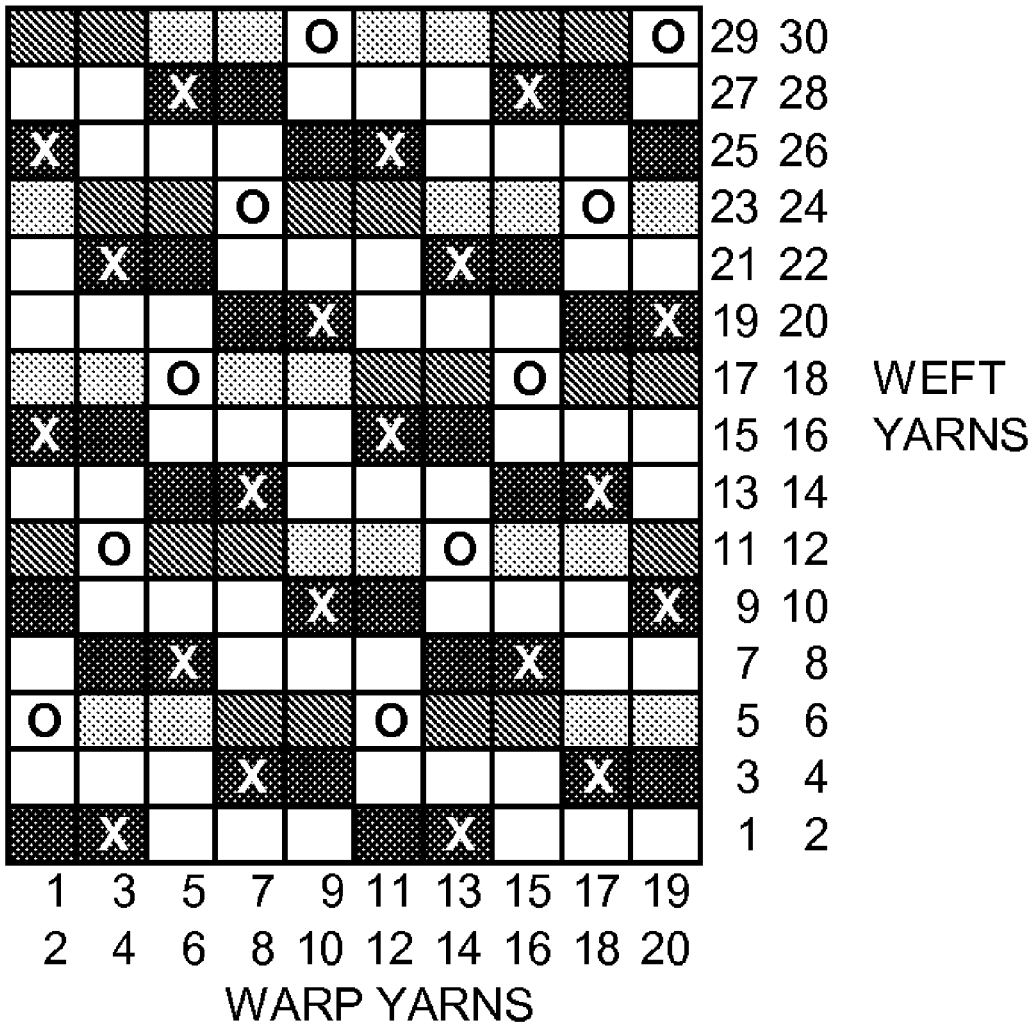
FIG. 54 shows a repeating pattern area of an eleventh embodiment of a forming fabric according to the invention.
Figure 55:
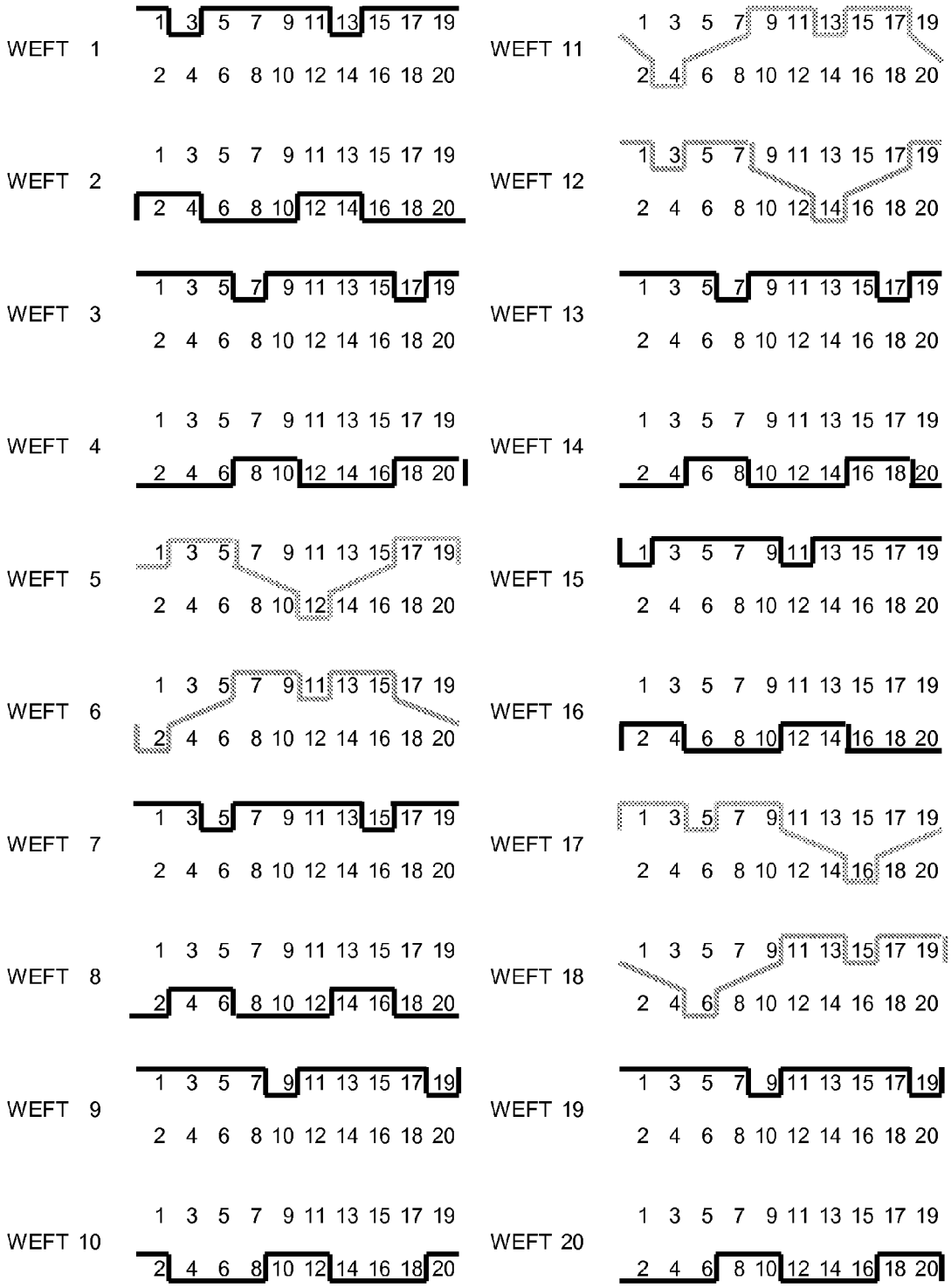
FIG. 55 shows a schematic representation of the weave pattern of individual weft yarns of FIG. 54 with the top and bottom warp yarns.
Figure 56:
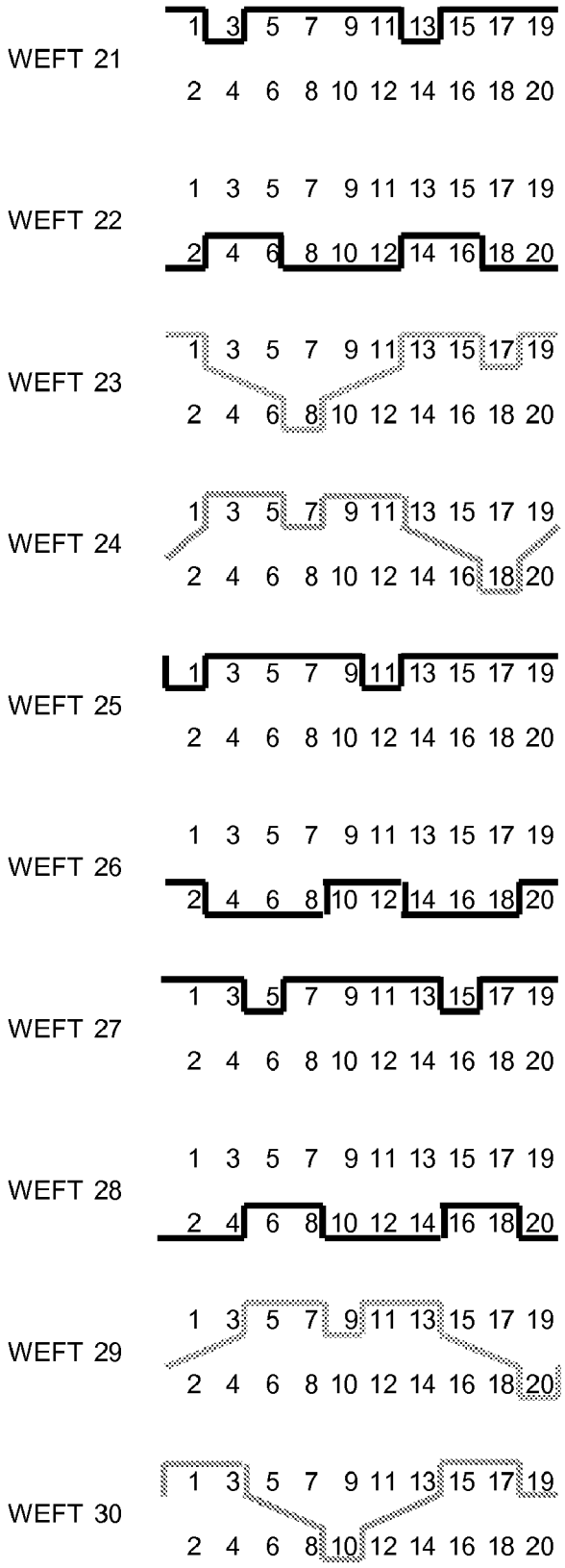
FIG. 56 shows an additional schematic representation of the weave pattern of individual weft yarns of FIG. 54 with the top and bottom warp yarns.

An eleventh non-limiting embodiment of the forming fabric of the present invention is illustrated in FIGS. 54-56. The fabric of FIG. 56 shows a single repeating pattern area of the fabric that encompasses twenty warp yarns (yarns 1-20 extending vertically in FIG. 56) and thirty weft yarns (yarns 1-30 extending horizontally in FIG. 56). The fabric is a three-to-two weft ratio double knuckle fabric. FIGS. 55 and 56 depict the paths of weft yarns 1-30 as they weave with warp yarns 1-20. Like the DCB weft yarns of the previous embodiments of the forming fabric, the DCB weft yarns in each pair combine to match the weave pattern of the top weft yarns. Like the DCB weft yarns of the first embodiment, each DCB weft yarn passes over two consecutive top warp yarns, then passes under one top warp yarn, then passes over two consecutive top warp yarns, then passes between two consecutive pairs of top and bottom warp yarns, then passes under one bottom warp yarn, and then passes between two consecutive pairs of top and bottom warp yarns. However, the weave pattern of the DCB weft yarns is offset from adjacent top and bottom weft yarns differently than those of the previous embodiments as shown in FIGS. 54-56.

By way of non-limiting example, the eleventh embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the eleventh embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 57:
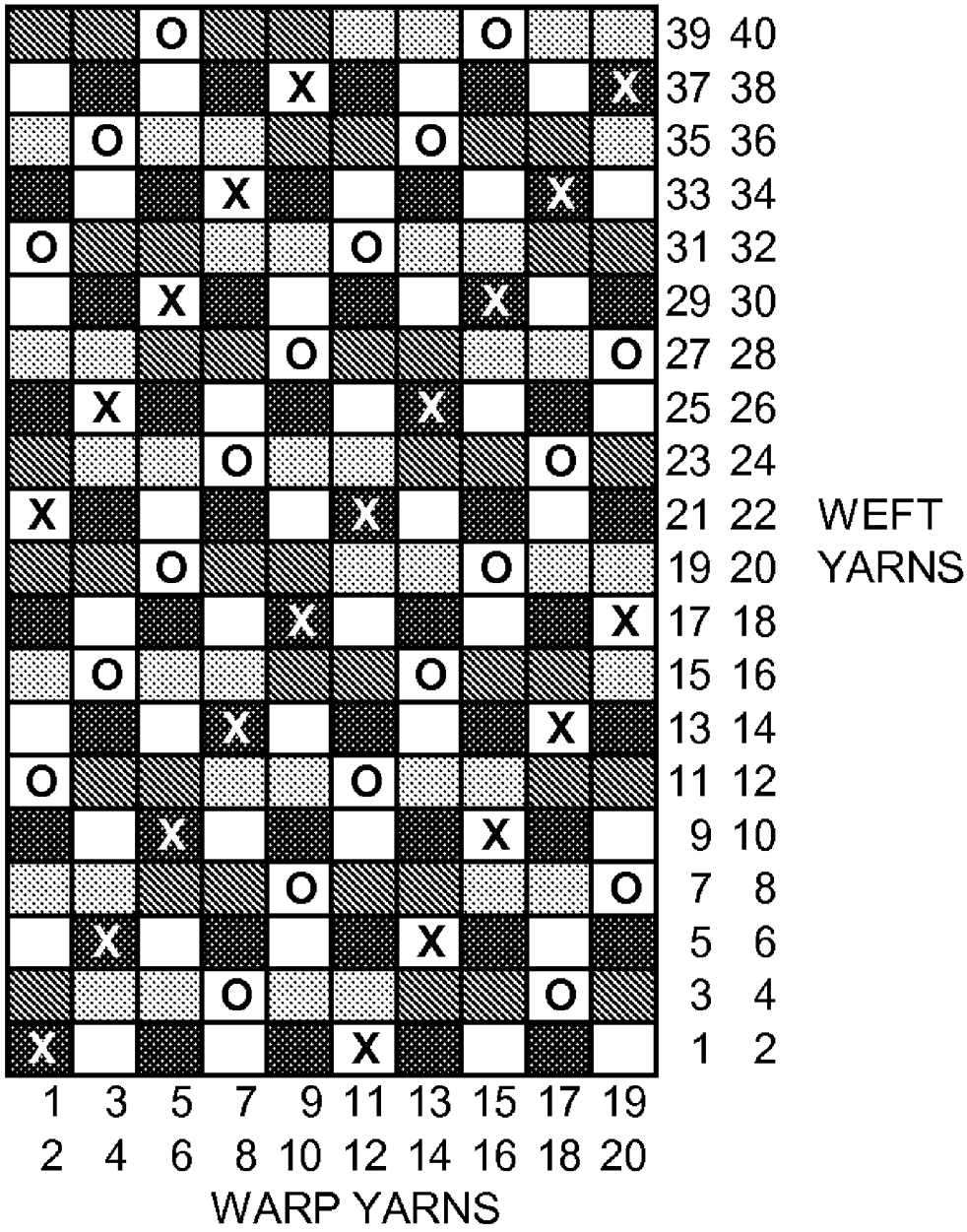
FIG. 57 shows a repeating pattern area of a twelfth embodiment of a forming fabric according to the invention.
Figure 58:
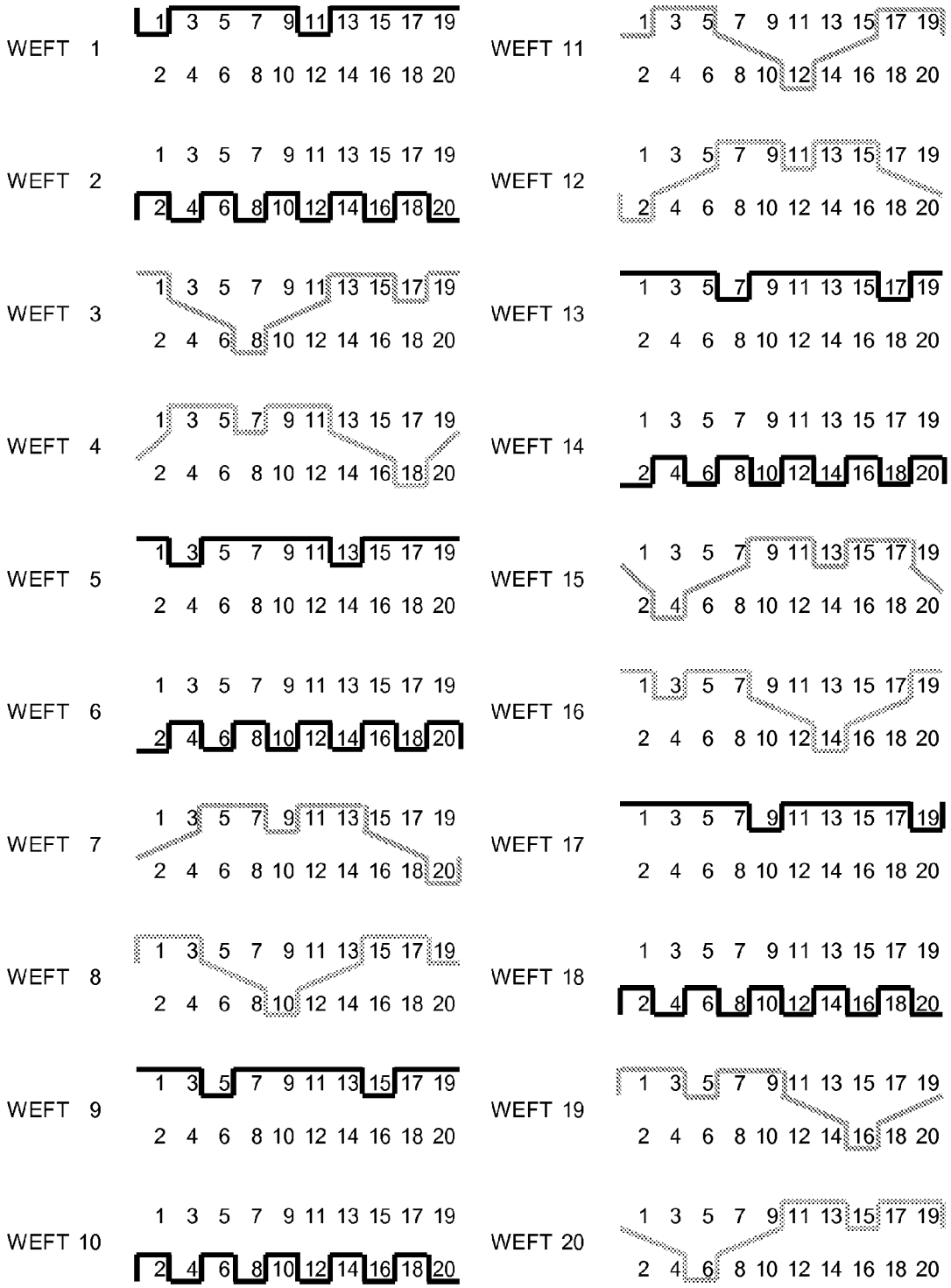
FIG. 58 shows a schematic representation of the weave pattern of individual weft yarns of FIG. 57 with the top and bottom warp yarns.
Figure 59:
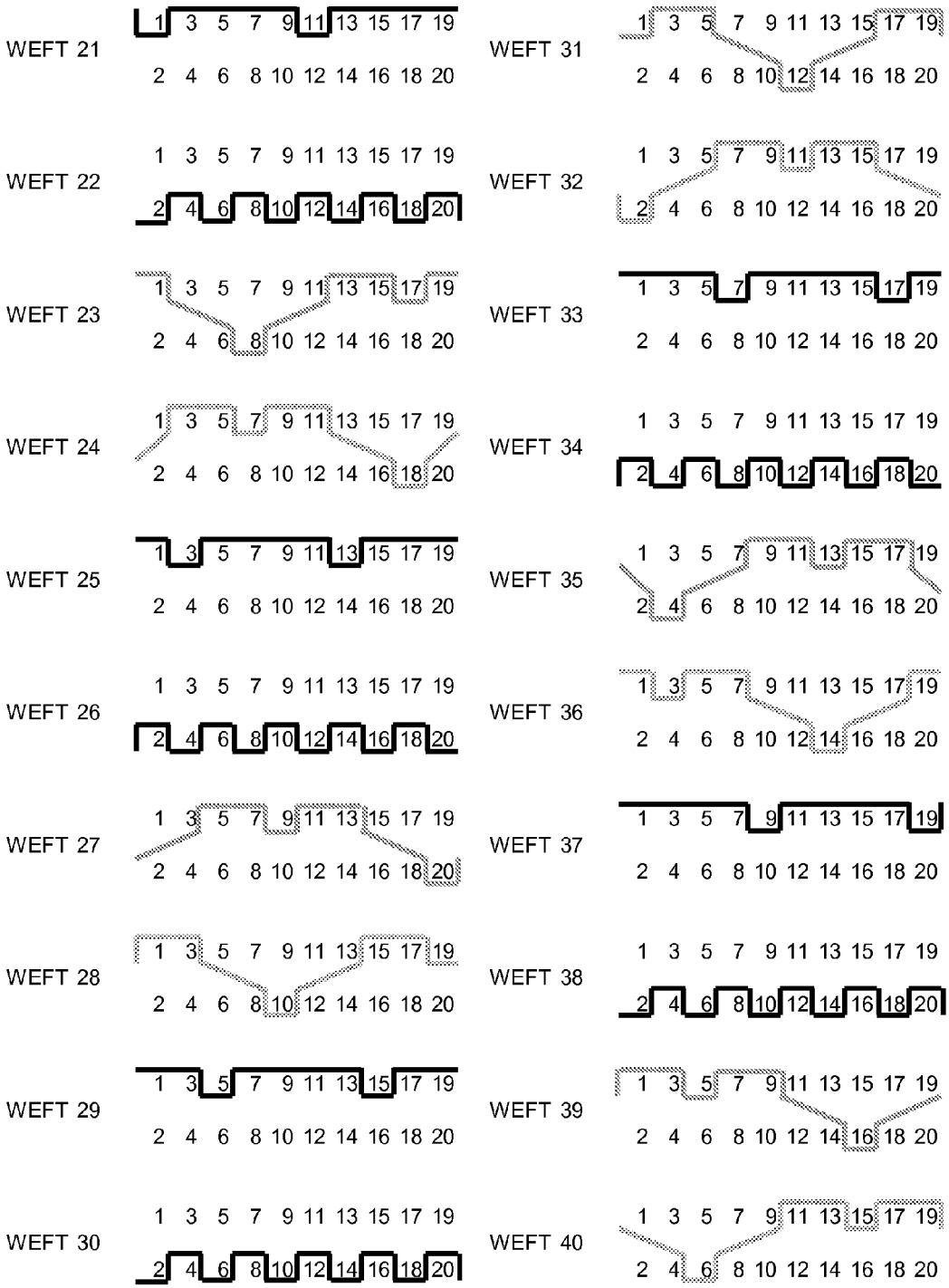
FIG. 59 shows an additional schematic representation of the weave pattern of individual weft yarns of FIG. 57 with the top and bottom warp yarns.
Figure 60:
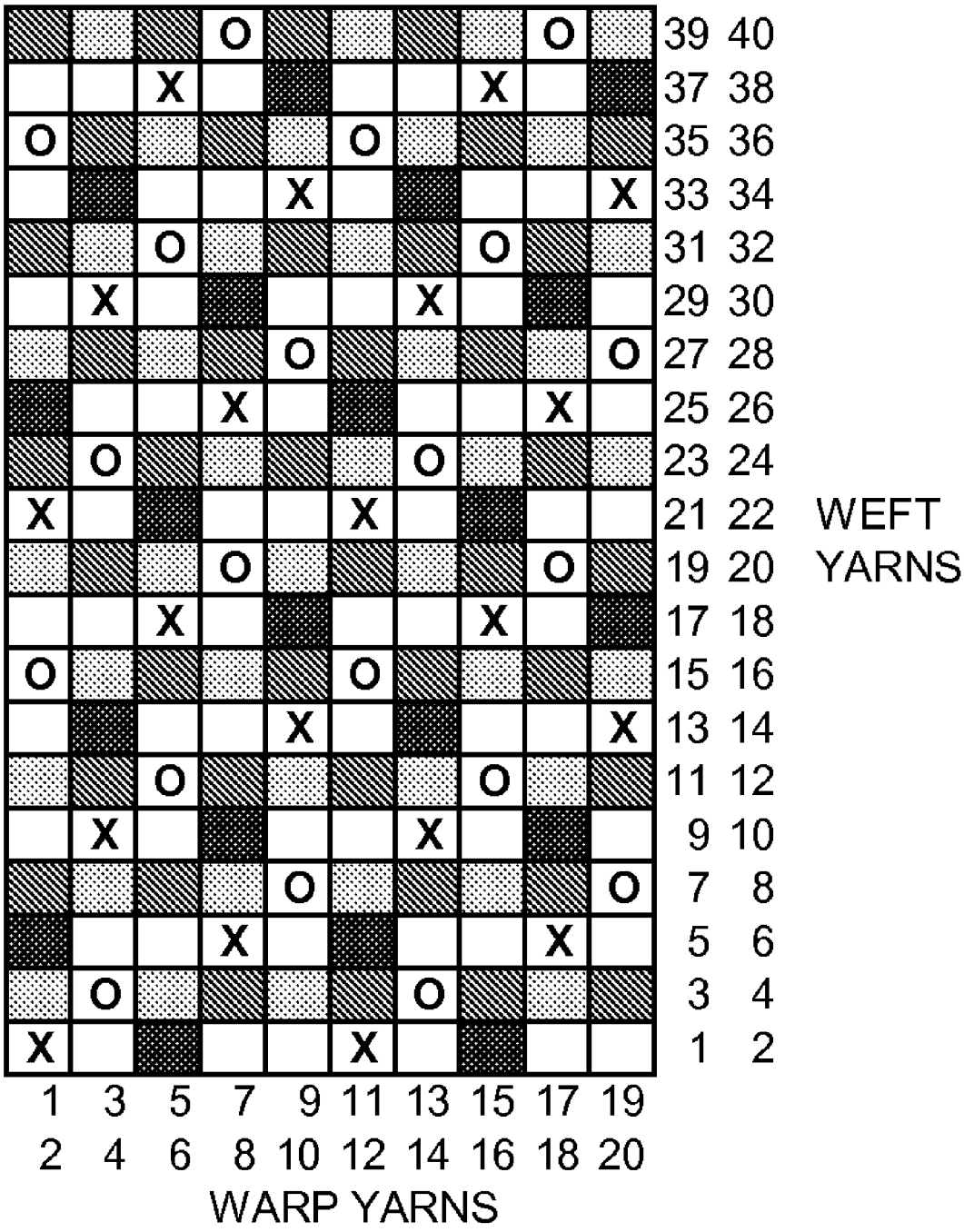
FIG. 60 shows a repeating pattern area of a thirteenth embodiment of a forming fabric according to the invention.
Figure 61:
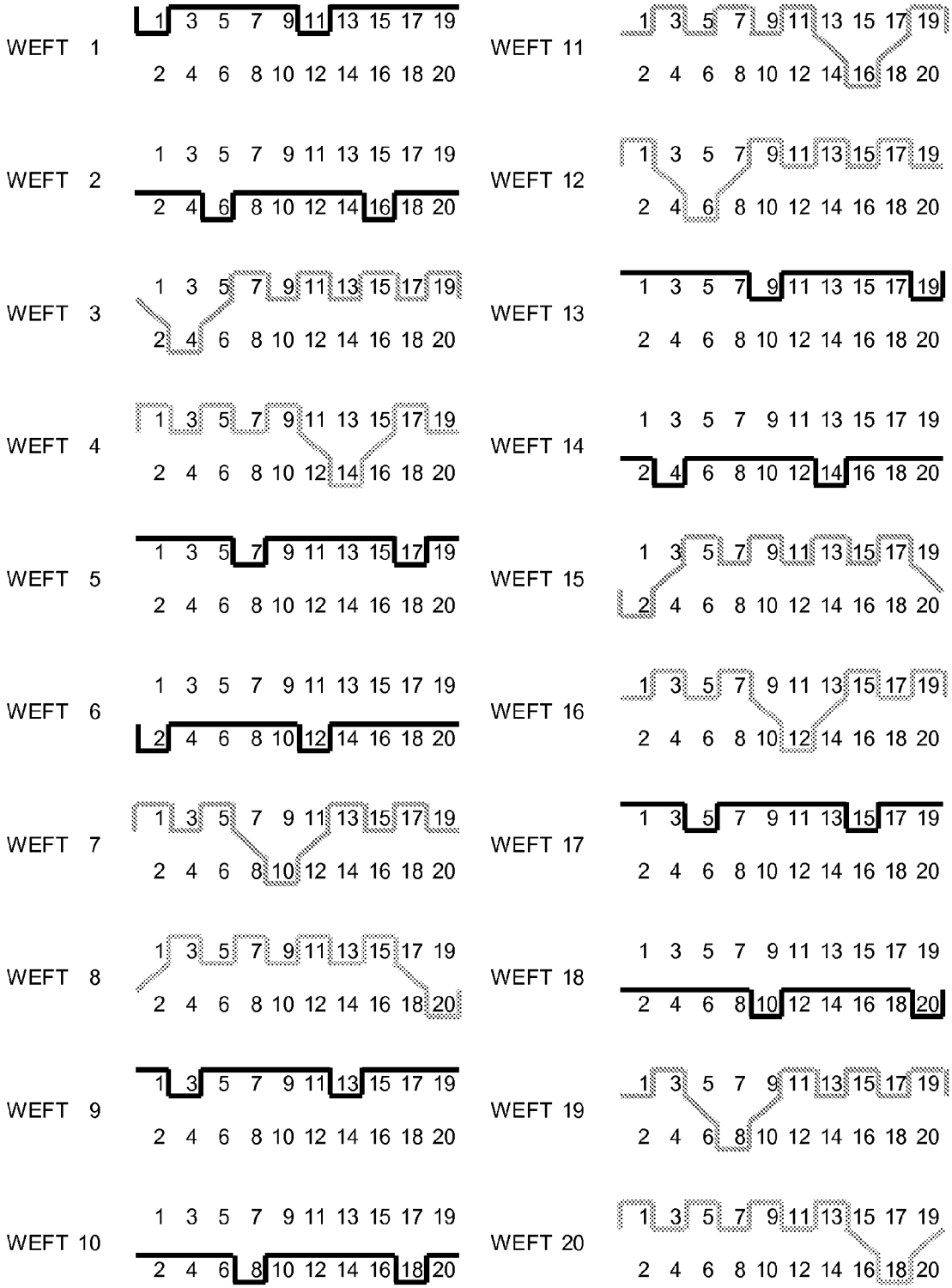
FIG. 61 shows a schematic representation of the weave pattern of individual weft yarns of FIG. 60 with the top and bottom warp yarns.
Figure 62:
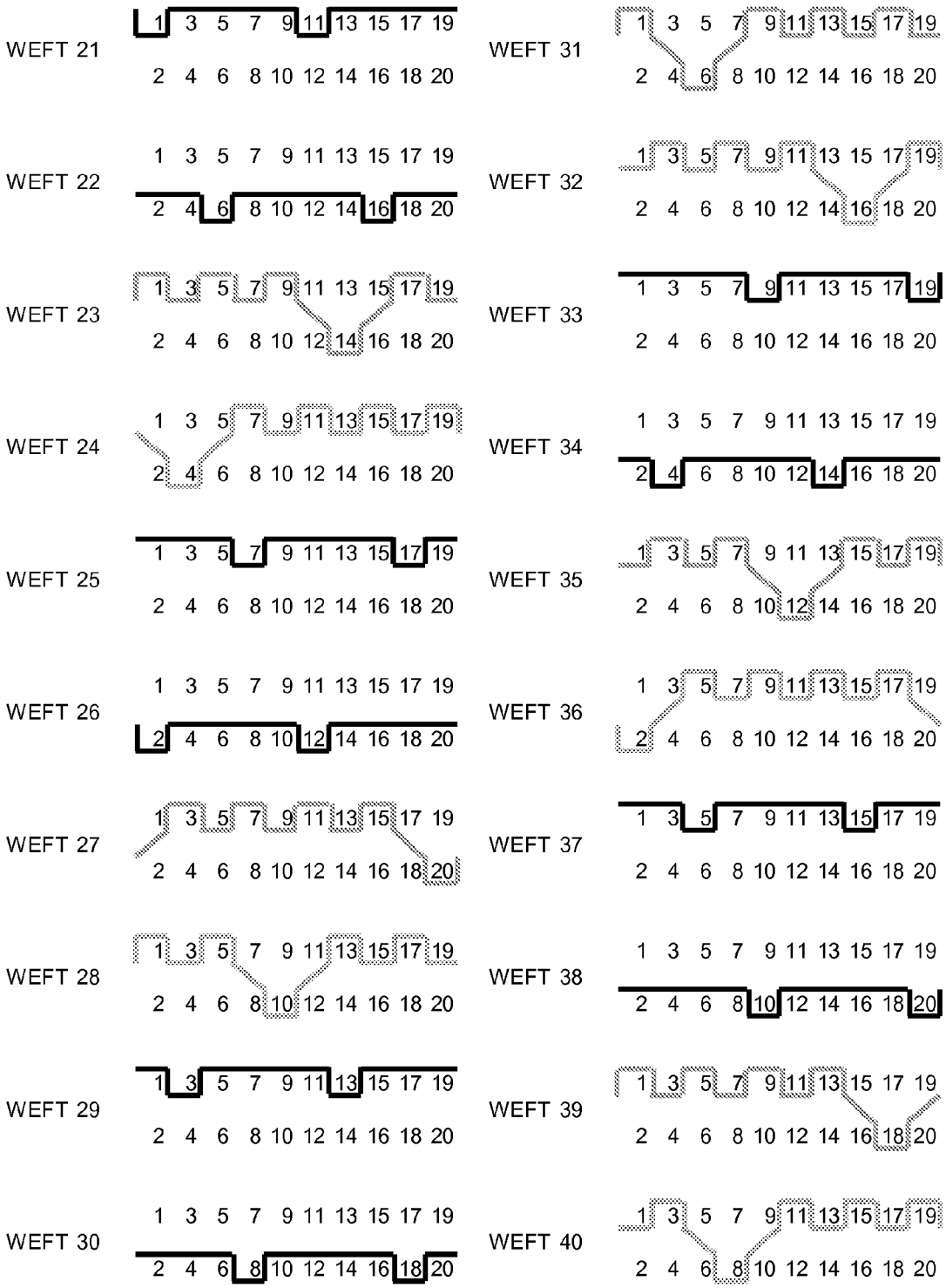
FIG. 62 shows an additional schematic representation of the weave pattern of individual weft yarns of FIG. 60 with the top and bottom warp yarns.
Figure 63:
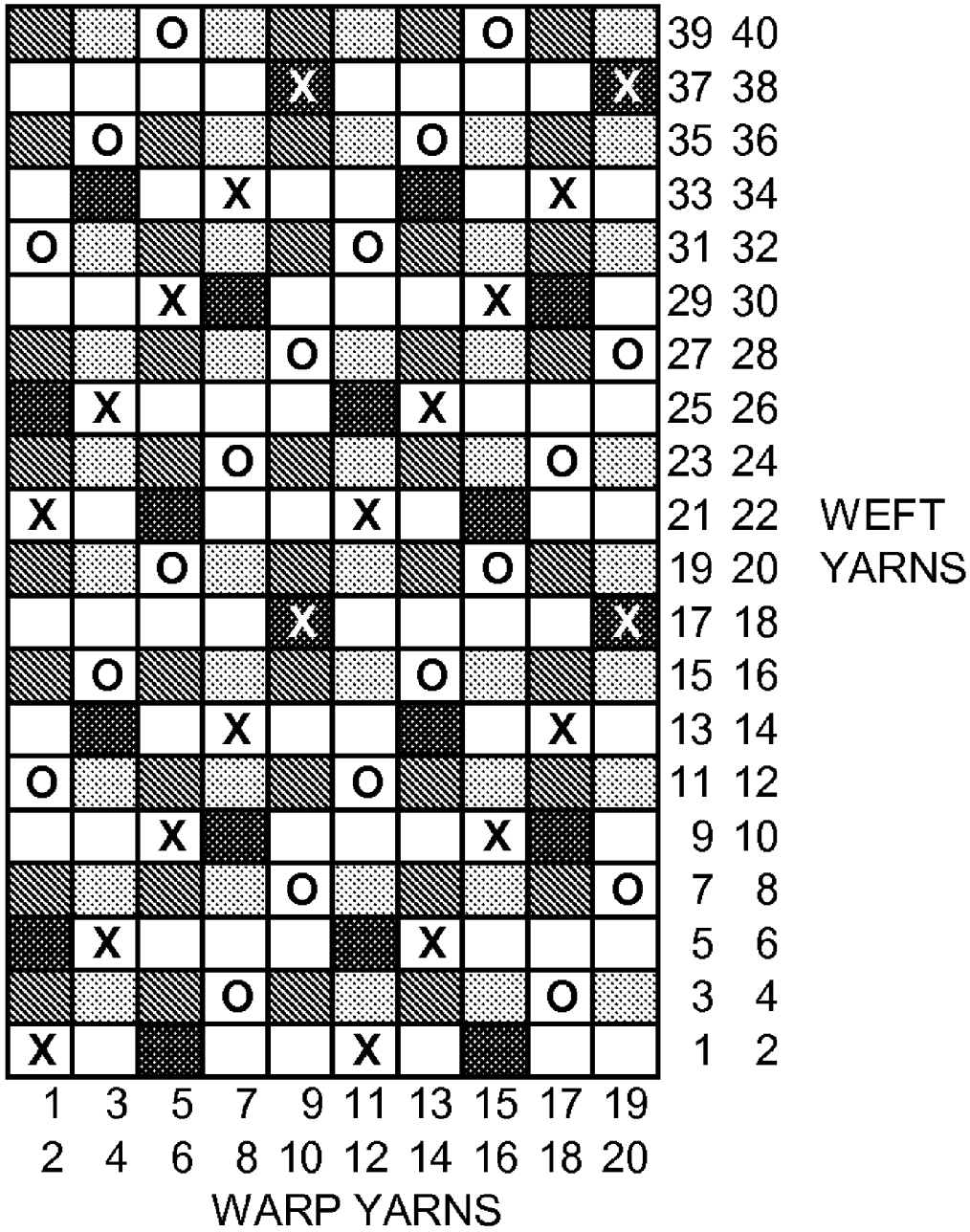
FIG. 63 shows a repeating pattern area of a fourteenth embodiment of a forming fabric according to the invention.
Figure 64:
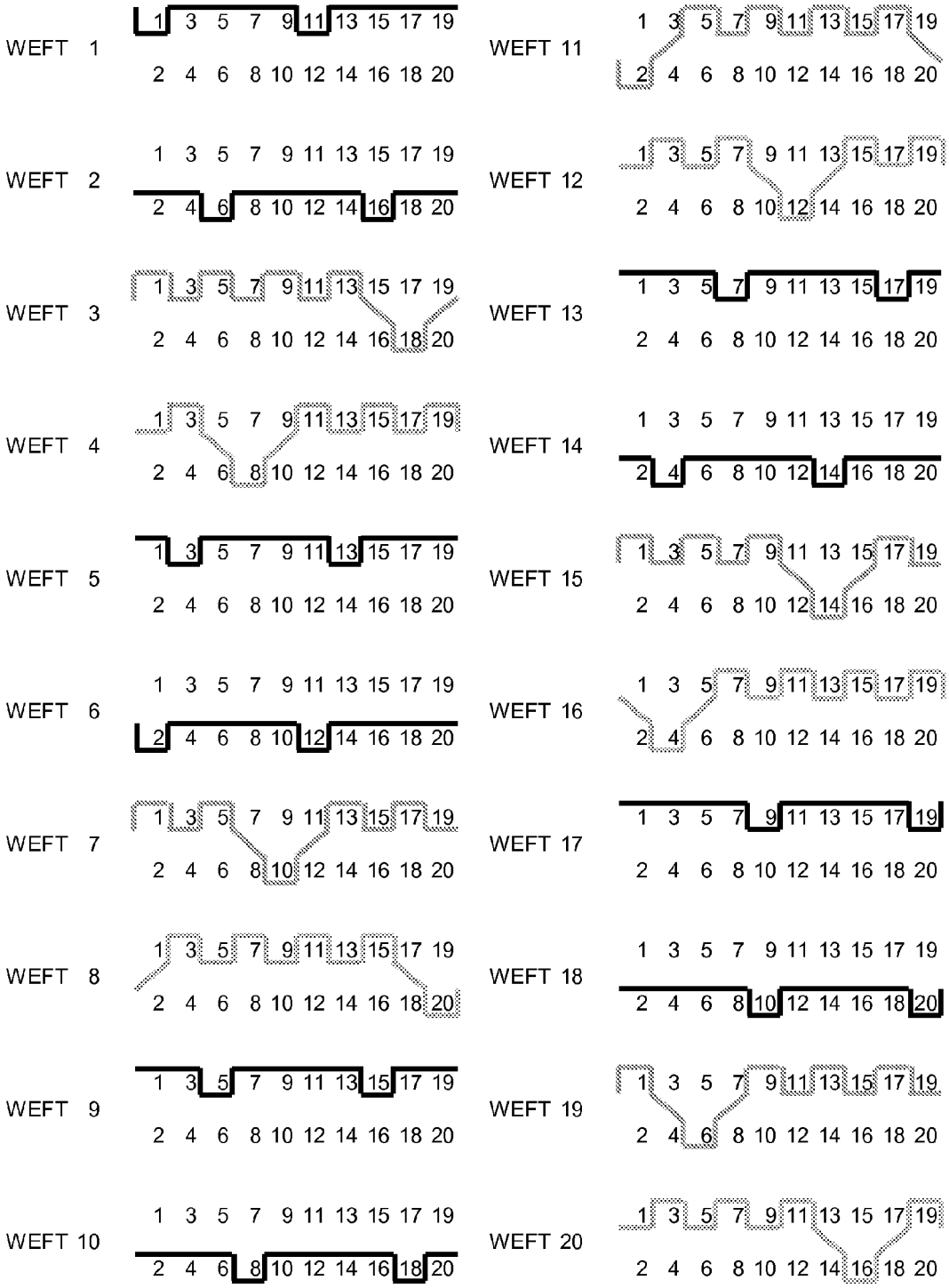
FIG. 64 shows a schematic representation of the weave pattern of individual weft yarns of FIG. 63 with the top and bottom warp yarns.
Figure 65:
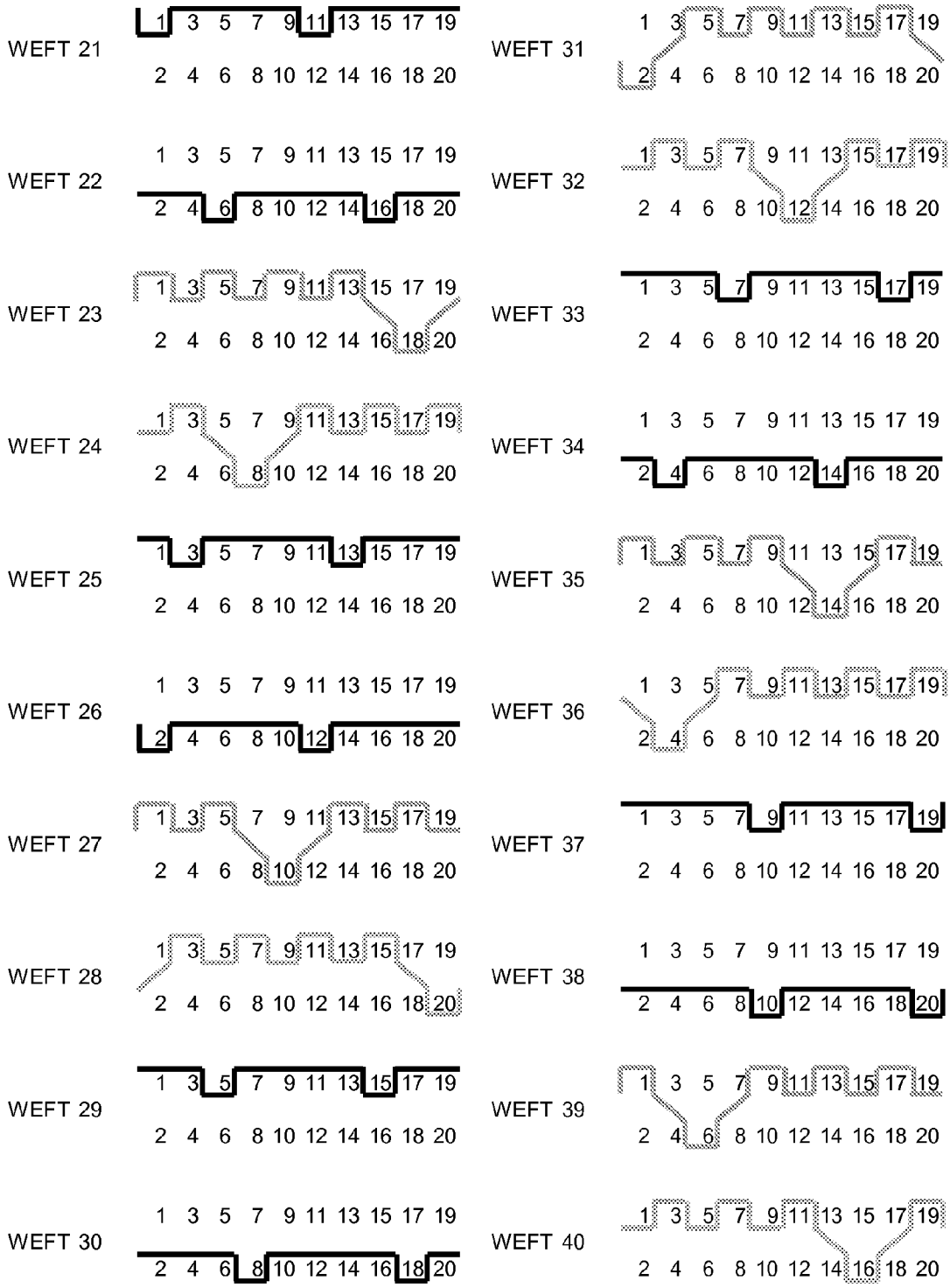
FIG. 65 shows an additional schematic representation of the weave pattern of individual weft yarns of FIG. 63 with the top and bottom warp yarns.
Figure 66:
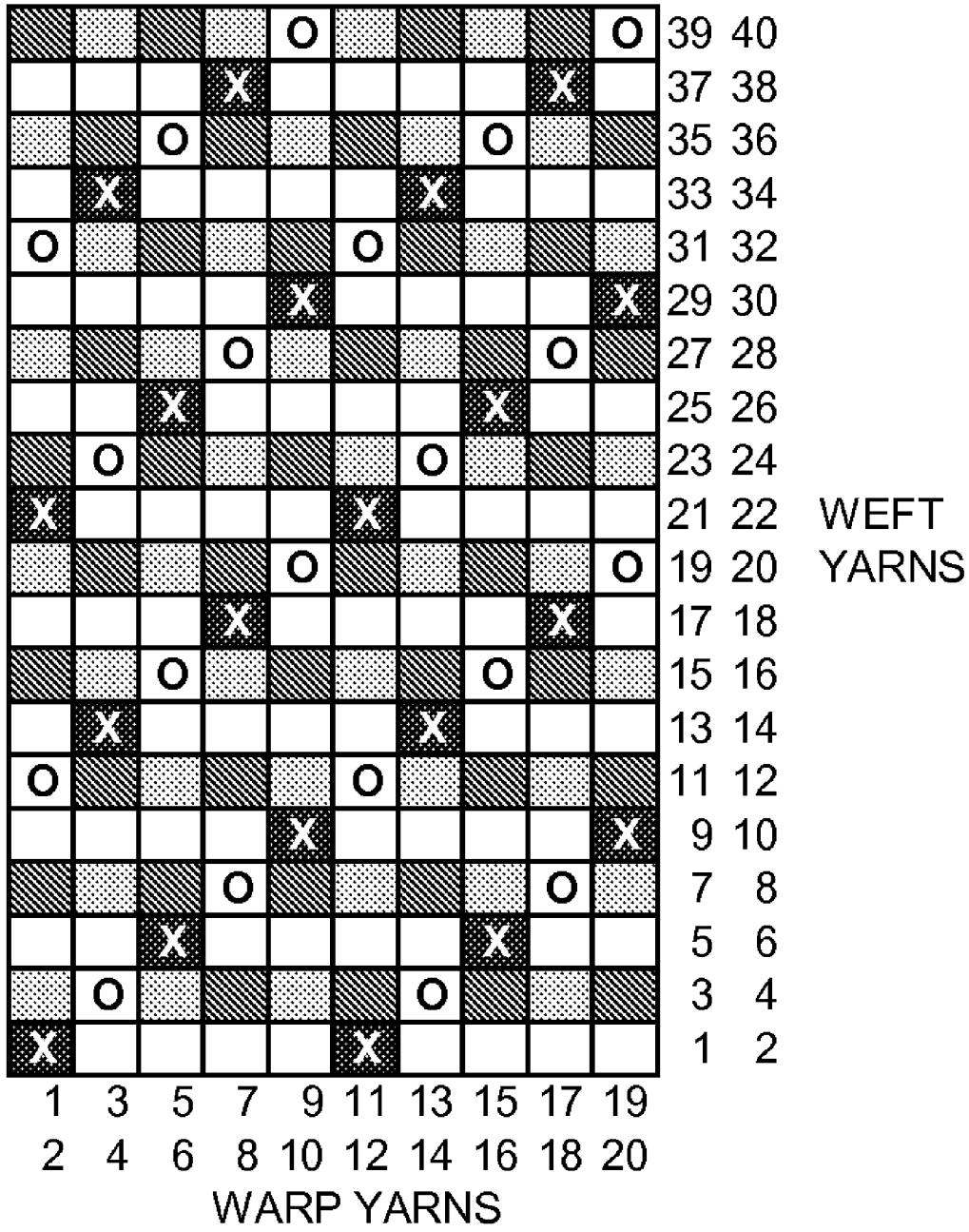
FIG. 66 shows a repeating pattern area of a fifteenth embodiment of a forming fabric according to the invention.
Figure 67:
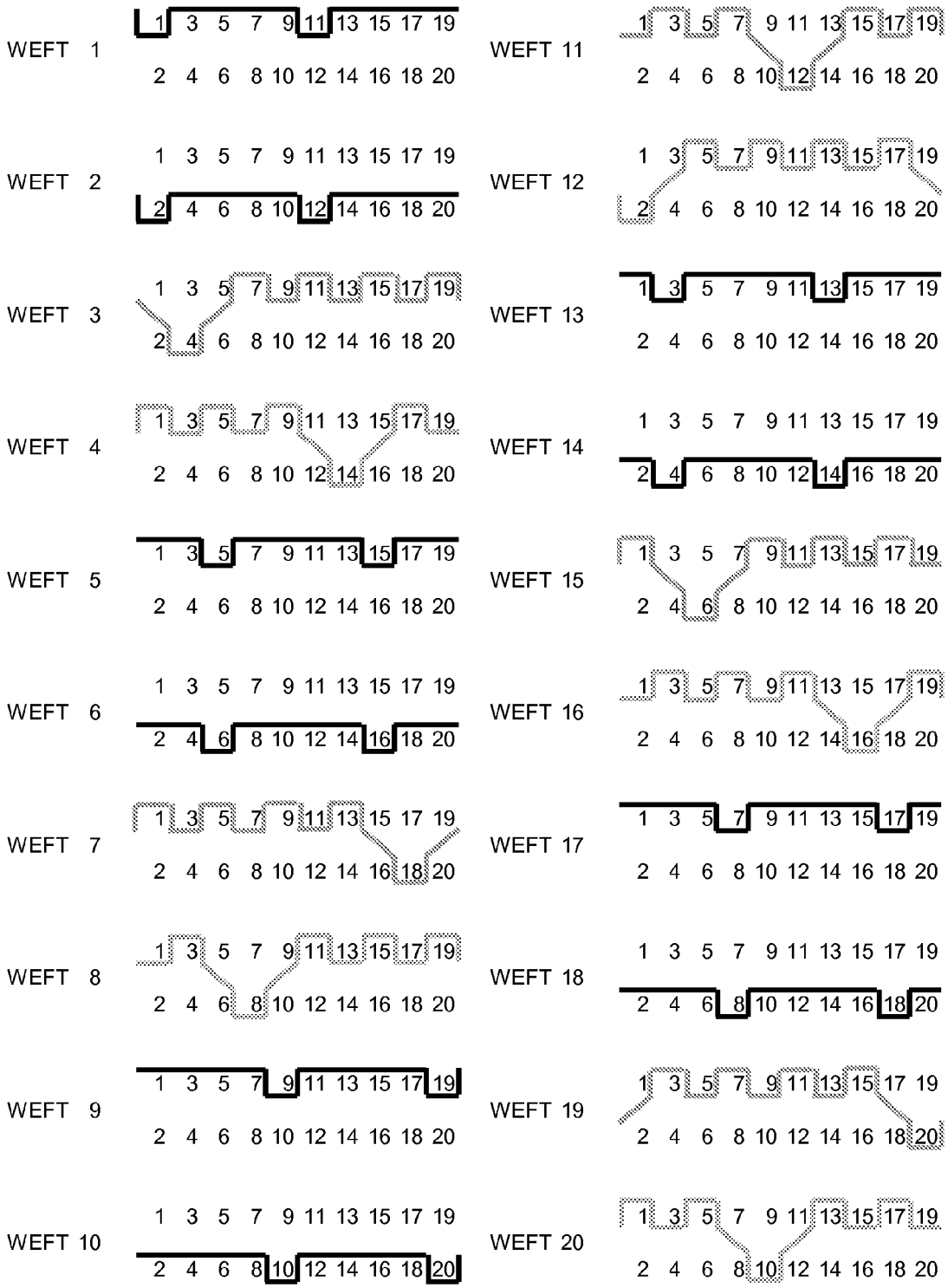
FIG. 67 shows a schematic representation of the weave pattern of individual weft yarns of FIG. 66 with the top and bottom warp yarns.
Figure 68:
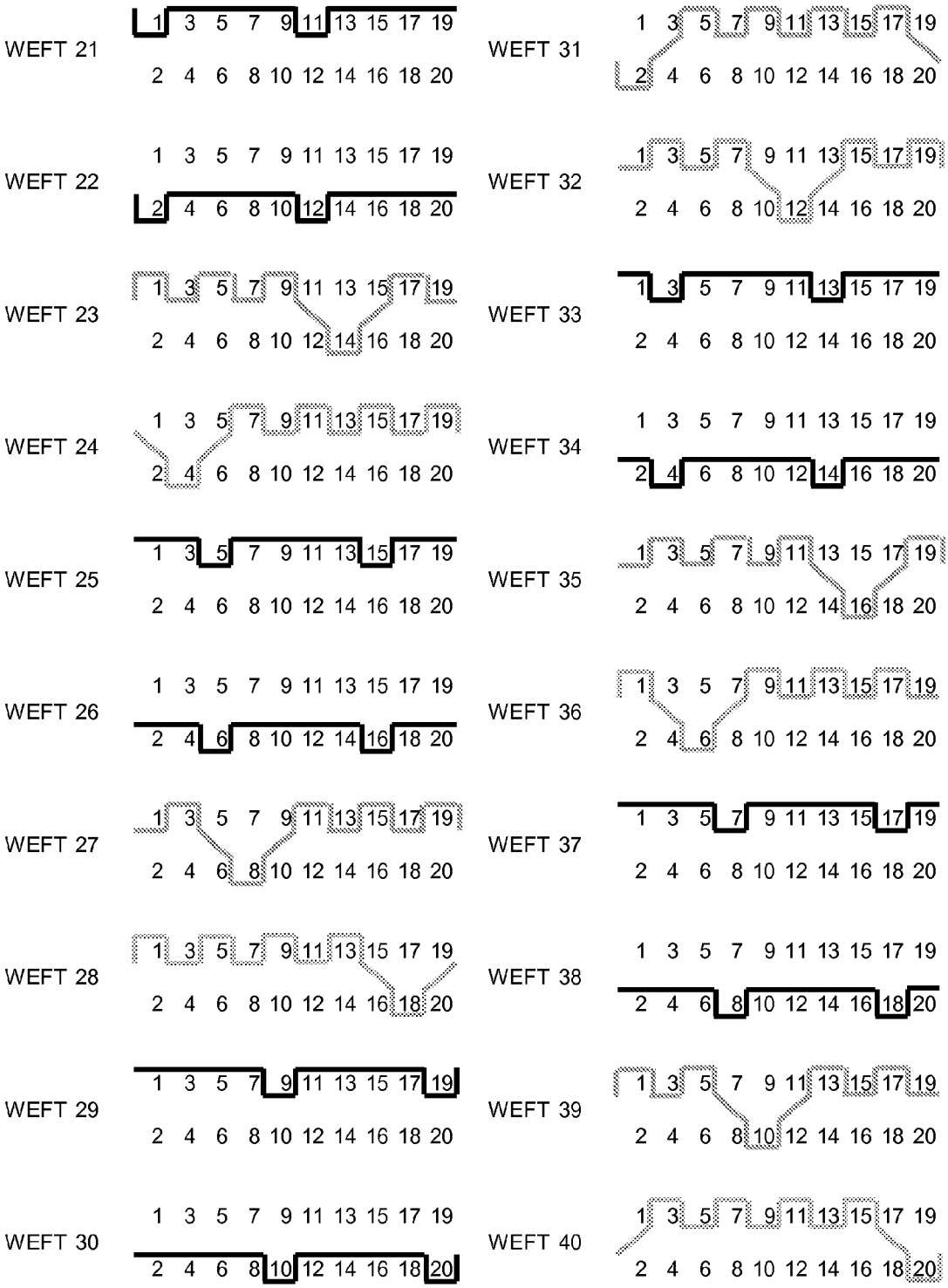
FIG. 68 shows an additional schematic representation of the weave pattern of individual weft yarns of FIG. 66 with the top and bottom warp yarns.
Figure 69:
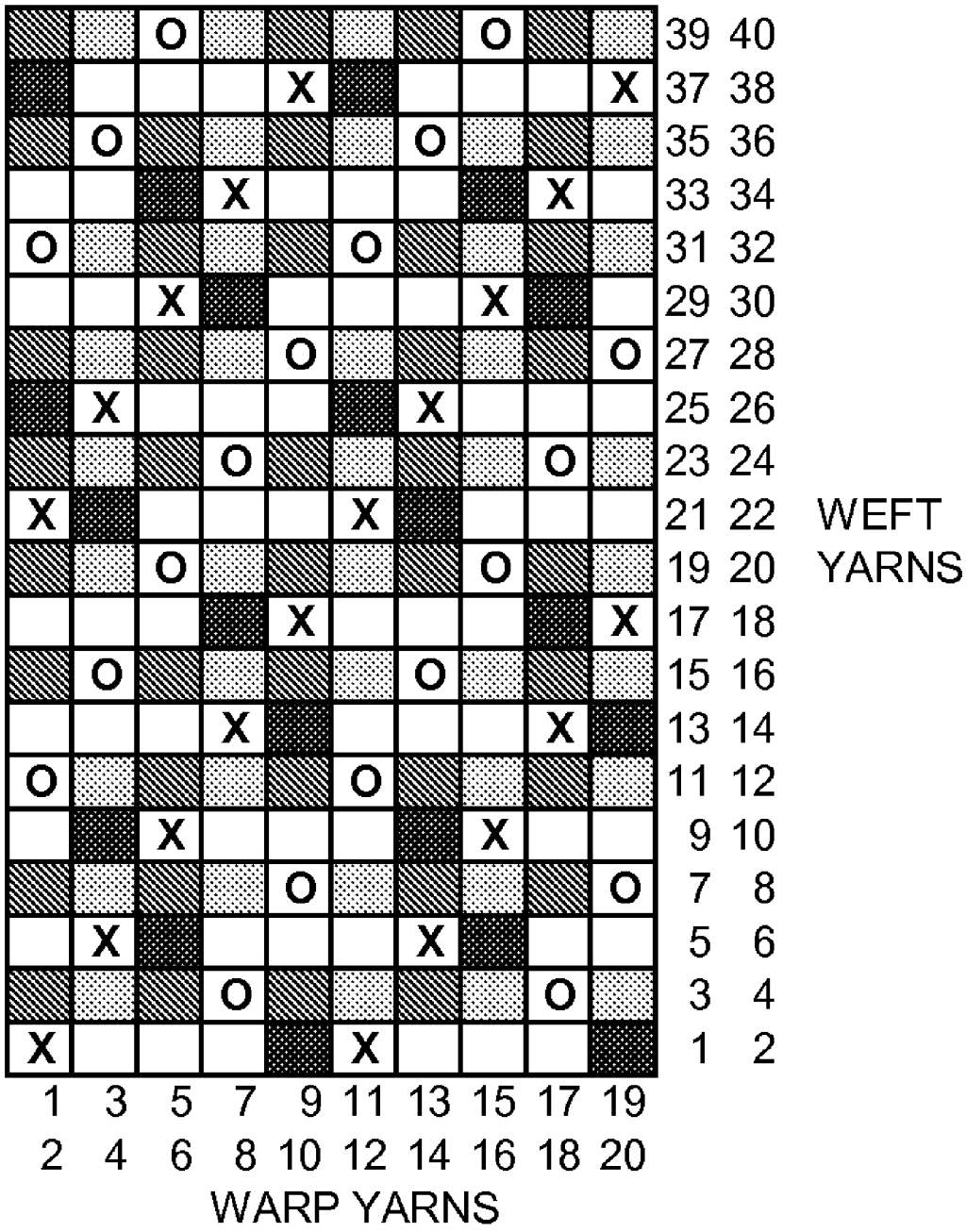
FIG. 69 shows a repeating pattern area of a sixteenth embodiment of a forming fabric according to the invention.
Figure 70:
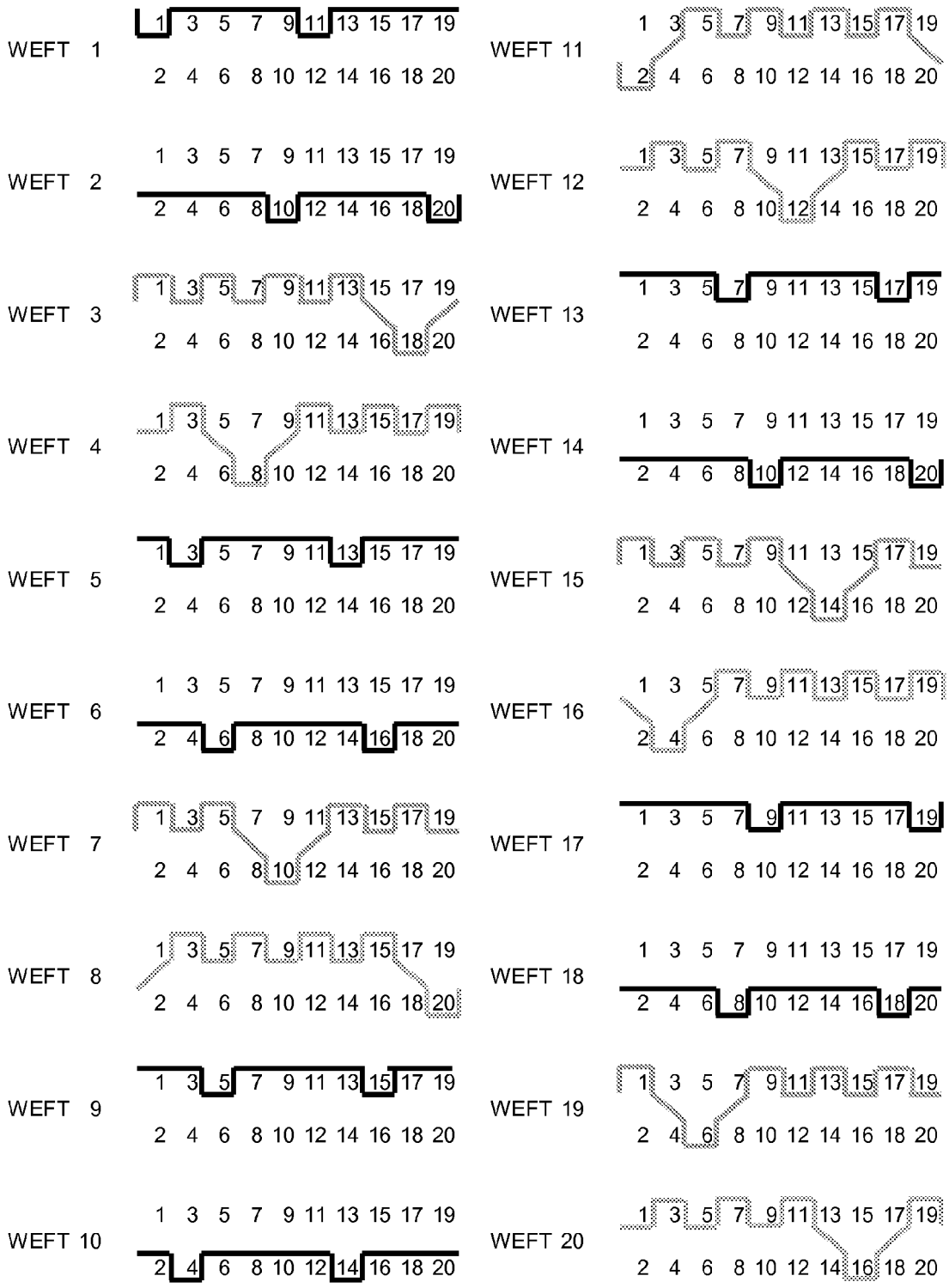
FIG. 70 shows a schematic representation of the weave pattern of individual weft yarns of FIG. 69 with the top and bottom warp yarns.
Figure 71:
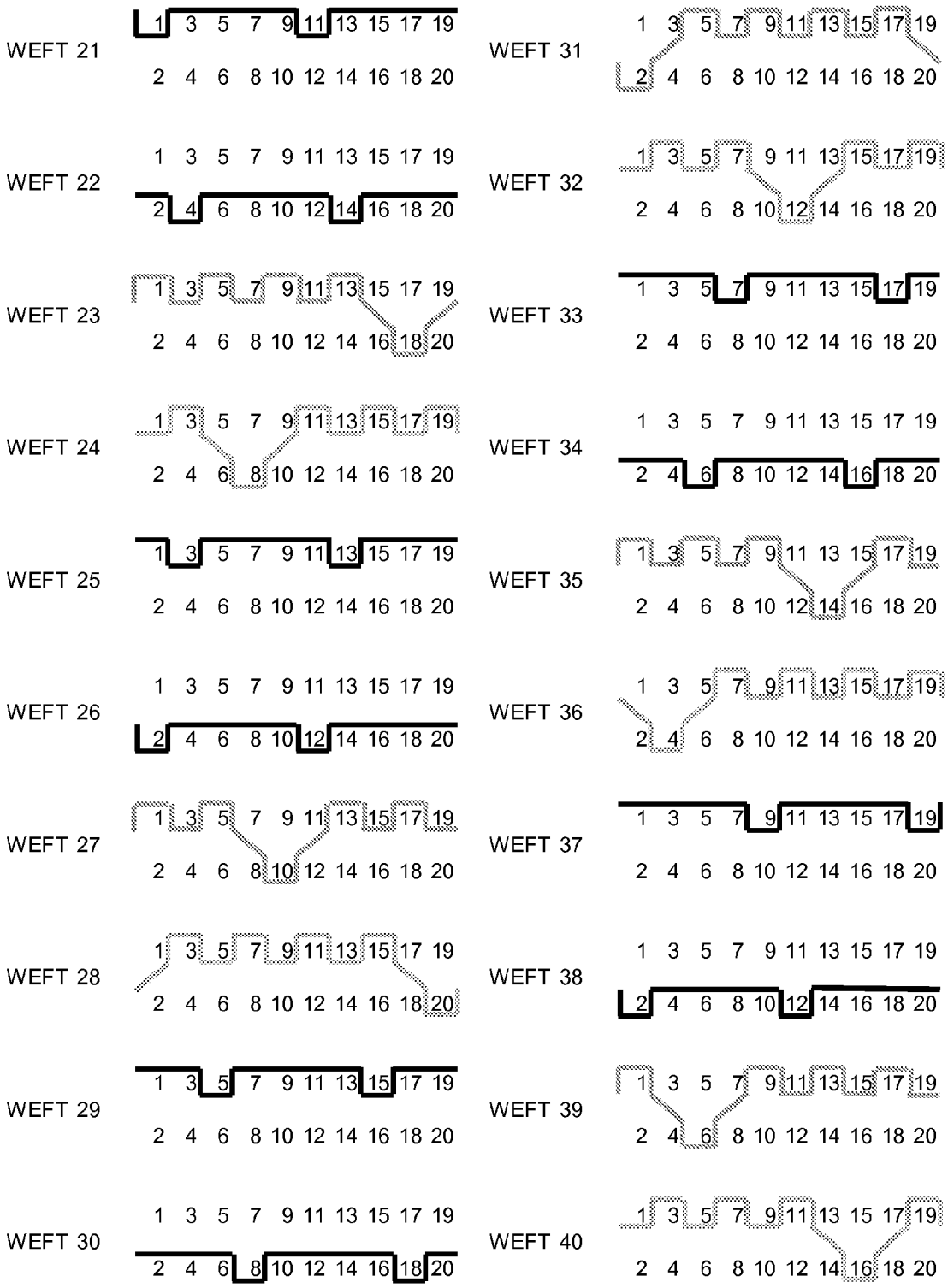
FIG. 71 shows an additional schematic representation of the weave pattern of individual weft yarns of FIG. 69 with the top and bottom warp yarns.
Figure 72:
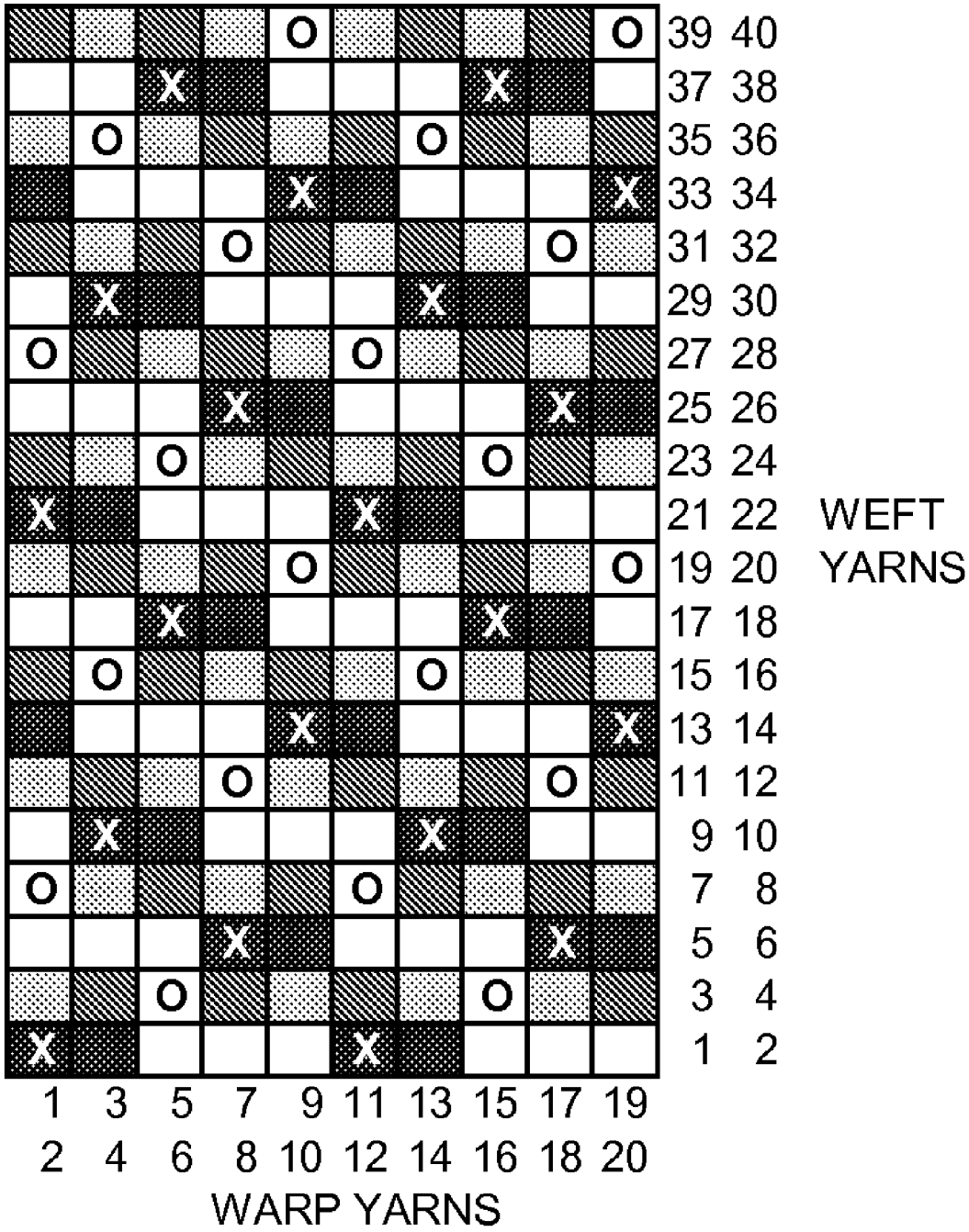
FIG. 72 shows a repeating pattern area of a seventeenth embodiment of a forming fabric according to the invention.
Figure 73:
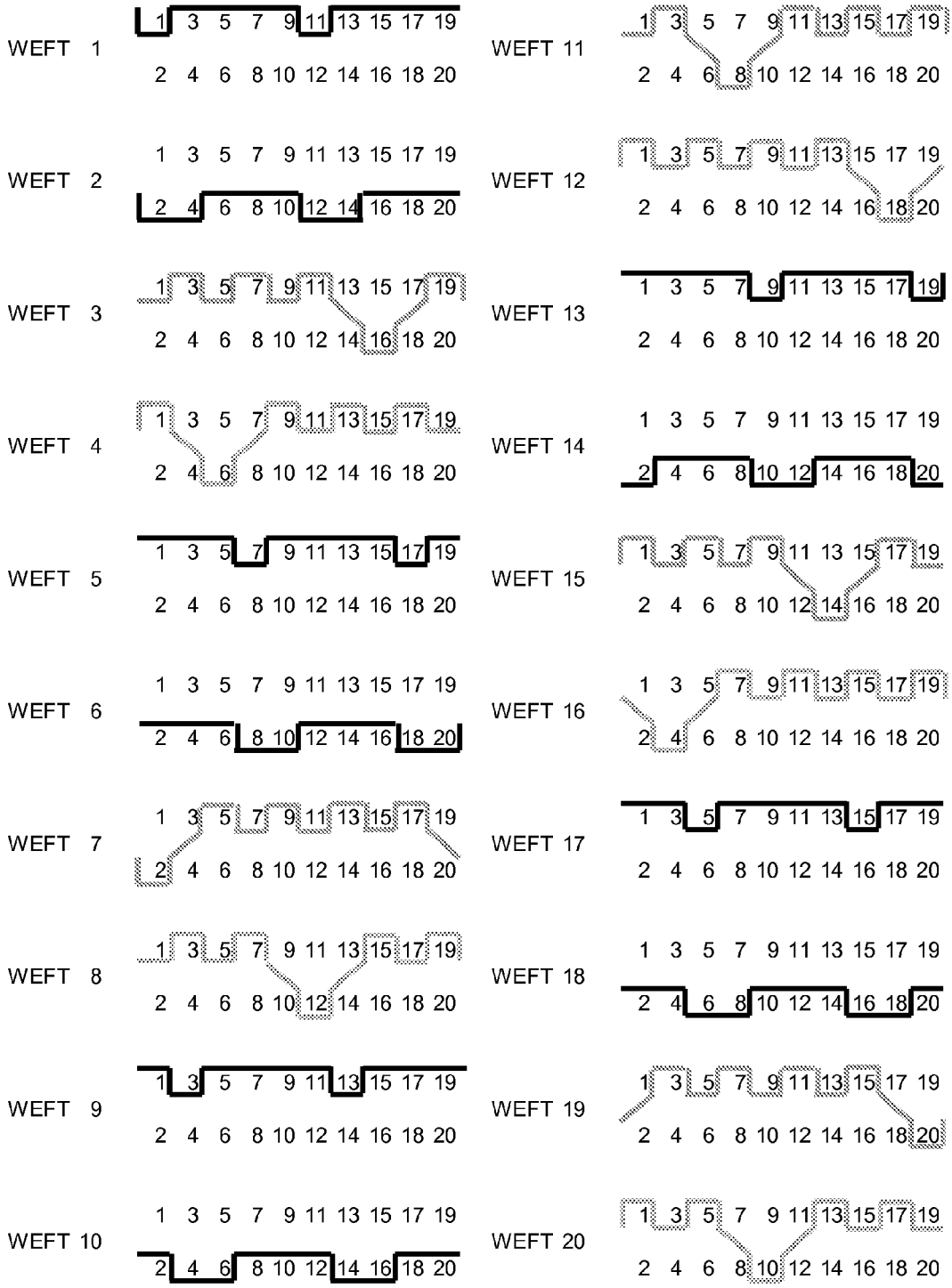
FIG. 73 shows a schematic representation of the weave pattern of individual weft yarns of FIG. 72 with the top and bottom warp yarns.
Figure 74:
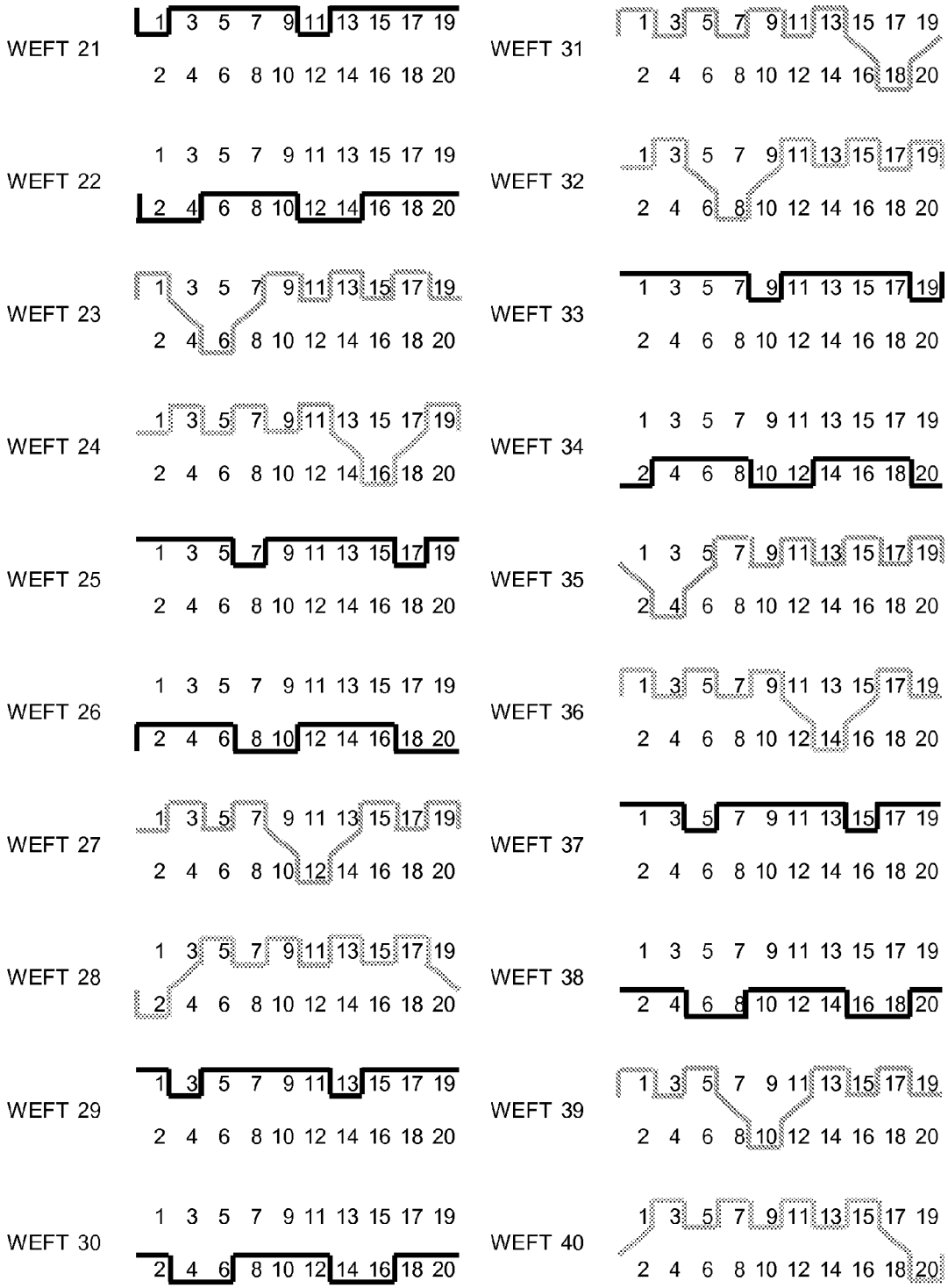
FIG. 74 shows an additional schematic representation of the weave pattern of individual weft yarns of FIG. 72 with the top and bottom warp yarns.
Figure 75A:
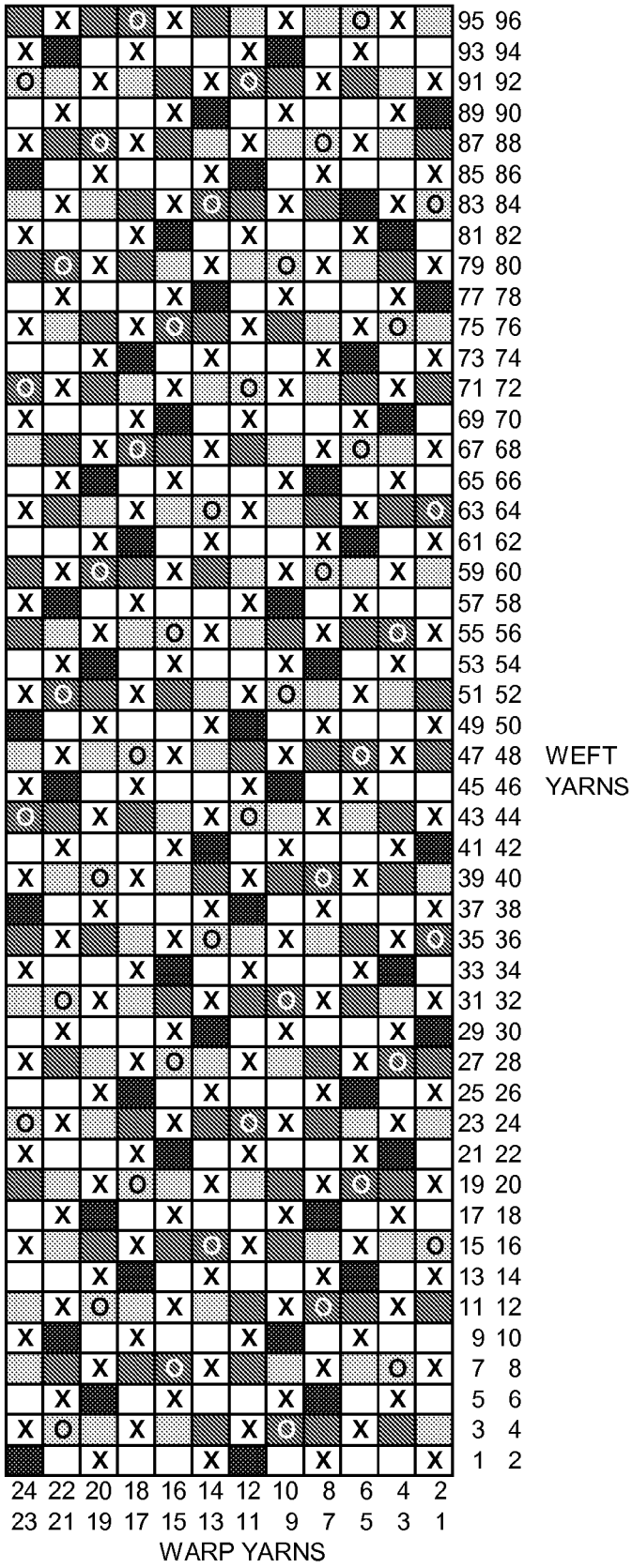
FIG. 75A shows a repeating pattern area of a twentieth embodiment of a forming fabric according to the invention.
Figure 75B:
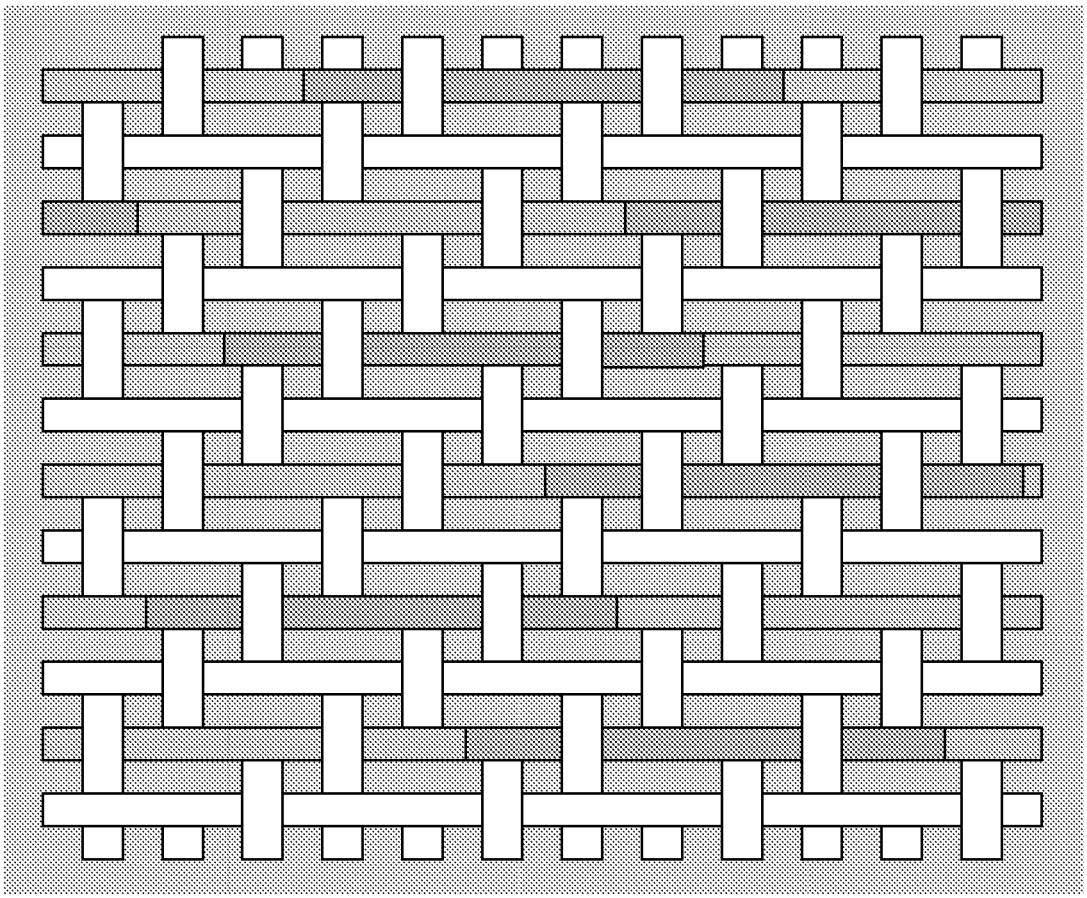
FIG. 75B shows the weave pattern of the upper surface or paper side of the forming fabric of FIG. 75A.
Figure 76:
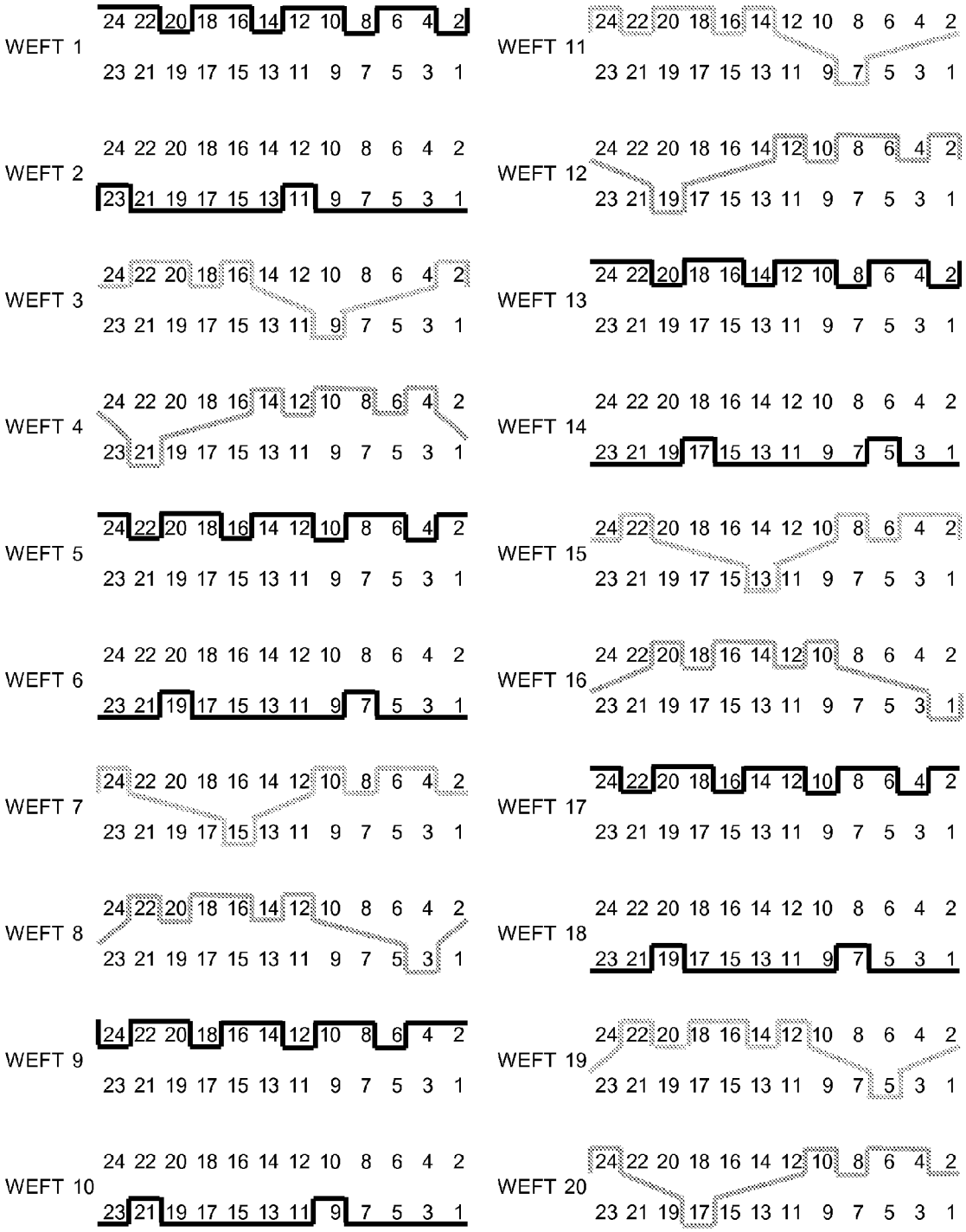
FIG. 76 shows a schematic representation of the weave pattern of individual weft yarns of FIG. 75 with the top and bottom warp yarns.
Figure 77:
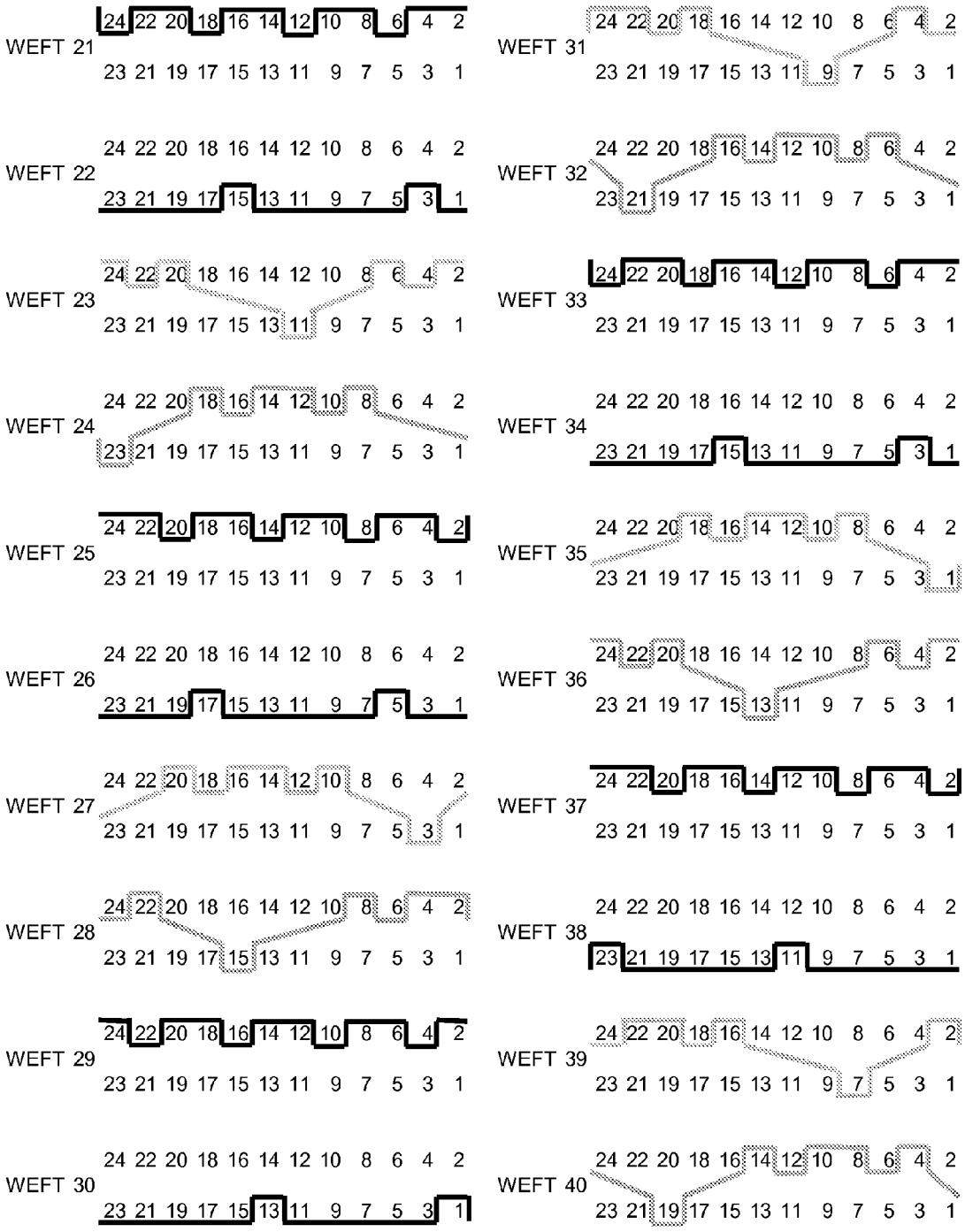
FIG. 77 shows an additional schematic representation of the weave pattern of individual weft yarns of FIG. 75 with the top and bottom warp yarns.
Figure 80:
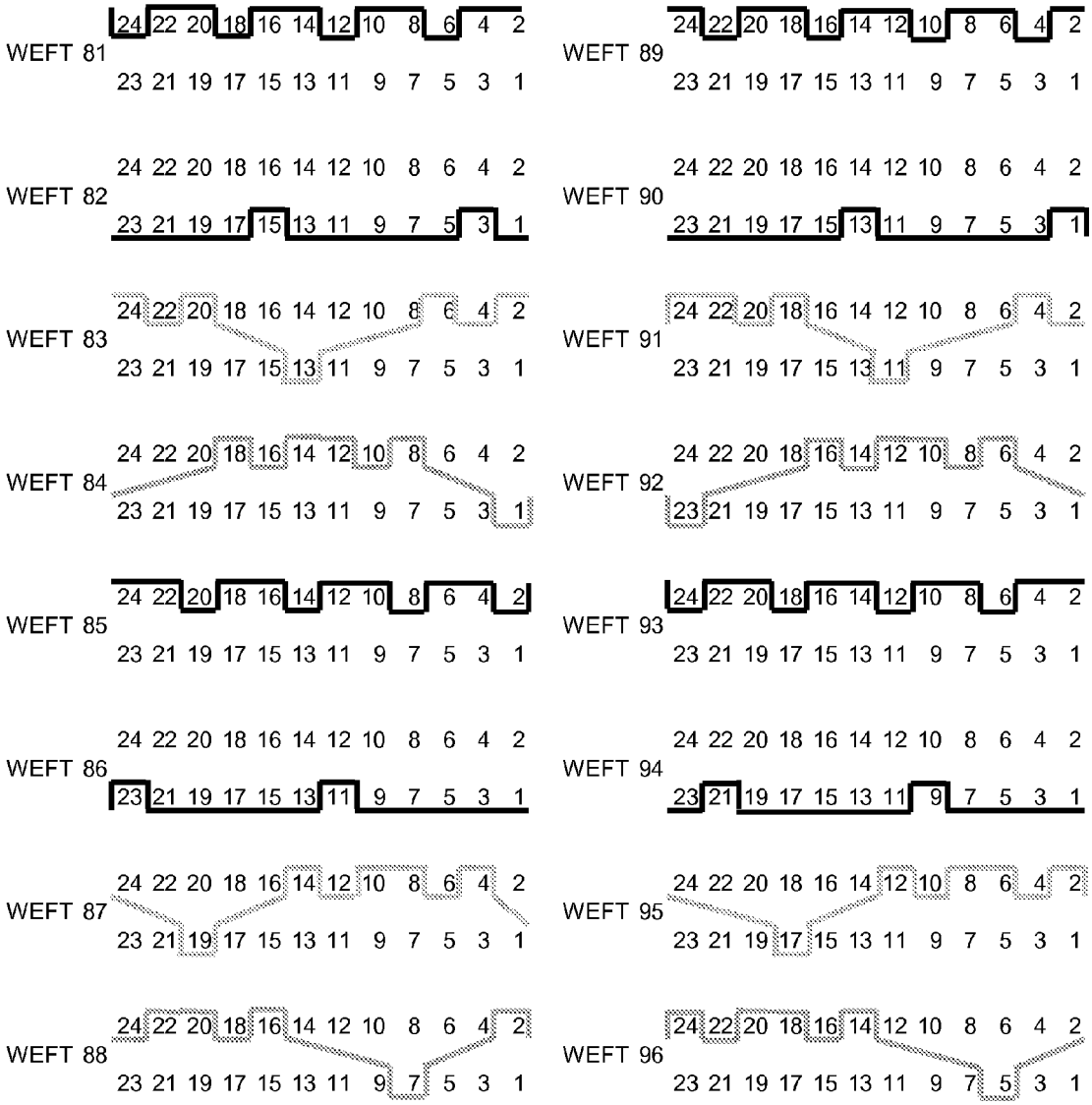
FIG. 80 shows an additional schematic representation of the weave pattern of individual weft yarns of FIG. 75 with the top and bottom warp yarns.

A twelfth non-limiting embodiment of the forming fabric of the present invention is illustrated in FIGS. 57-59. The fabric of FIG. 57 shows a single repeating pattern area of the fabric that encompasses twenty warp yarns (yarns 1-20 extending vertically in FIG. 57) and forty weft yarns (yarns 1-40 extending horizontally in FIG. 57). The fabric is a five shed over plain fabric. FIGS. 58 and 59 depict the paths of weft yarns 1-40 as they weave with warp yarns 1-20. Like the DCB weft yarns of the previous embodiments of the forming fabric, the DCB weft yarns in each pair combine to match the weave pattern of the top weft yarns. Like the DCB weft yarns of the first embodiment, each DCB weft yarn passes over two consecutive top warp yarns, then passes under one top warp yarn, then passes over two consecutive top warp yarns, then passes between two consecutive pairs of top and bottom warp yarns, then passes under one bottom warp yarn, and then passes between two consecutive pairs of top and bottom warp yarns. However, the weave pattern of the DCB weft yarns is offset from adjacent top and bottom weft yarns differently than those of the previous embodiments as shown in FIGS. 57-59.

By way of non-limiting example, the twelfth embodiment of the forming fabric can have a mesh (number of warp yarns per inch) of 160 and a count (number of weft yarns per inch)

of 160. The fabric can have a caliper of about 0.030 inches. In addition, the fabric preferably has a permeability in the range of 500-600 cfm. Regarding yarn dimensions, the twelfth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Thirteenth through seventeenth non-limiting embodiments of the forming fabric of the present invention are illustrated in FIGS. 60-74. Each embodiment is illustrated as a repeating pattern area that encompasses twenty warp yarns (yarns 1-20 extending vertically) and forty weft yarns (yarns 1-40 extending horizontally). These fabrics are single knuckle fabrics. That is, unlike the DCB weft yarns of the previous embodiments of the forming fabric, each DCB weft yarn passes over one top warp yarn, then under one top warp yarn, then over one top warp yarn, then under one top warp yarn, then over one top warp yarn, then under one top warp yarn, then over one top warp yarn, then between one pair of top and bottom warp yarns, then under one bottom warp yarn, and then between one pair of top and bottom warp yarns. However, like the DCB weft yarns of the previous embodiments, the DCB weft yarns in each pair combine to match the weave pattern of the top weft yarns.

By way of non-limiting example, the thirteenth through seventeenth embodiments of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the thirteenth through seventeenth embodiments of the forming fabric typically have warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

An eighteenth non-limiting embodiment of the forming fabric of the present invention is illustrated in FIGS. 75-80. This fabric is a butted-binder three shed fabric. Like the DCB weft yarns of the previous embodiments of the forming fabric, the DCB weft yarns in each pair combine to match the weave pattern of the top weft yarns.

By way of non-limiting example, the eighteenth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the eighteenth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 81:
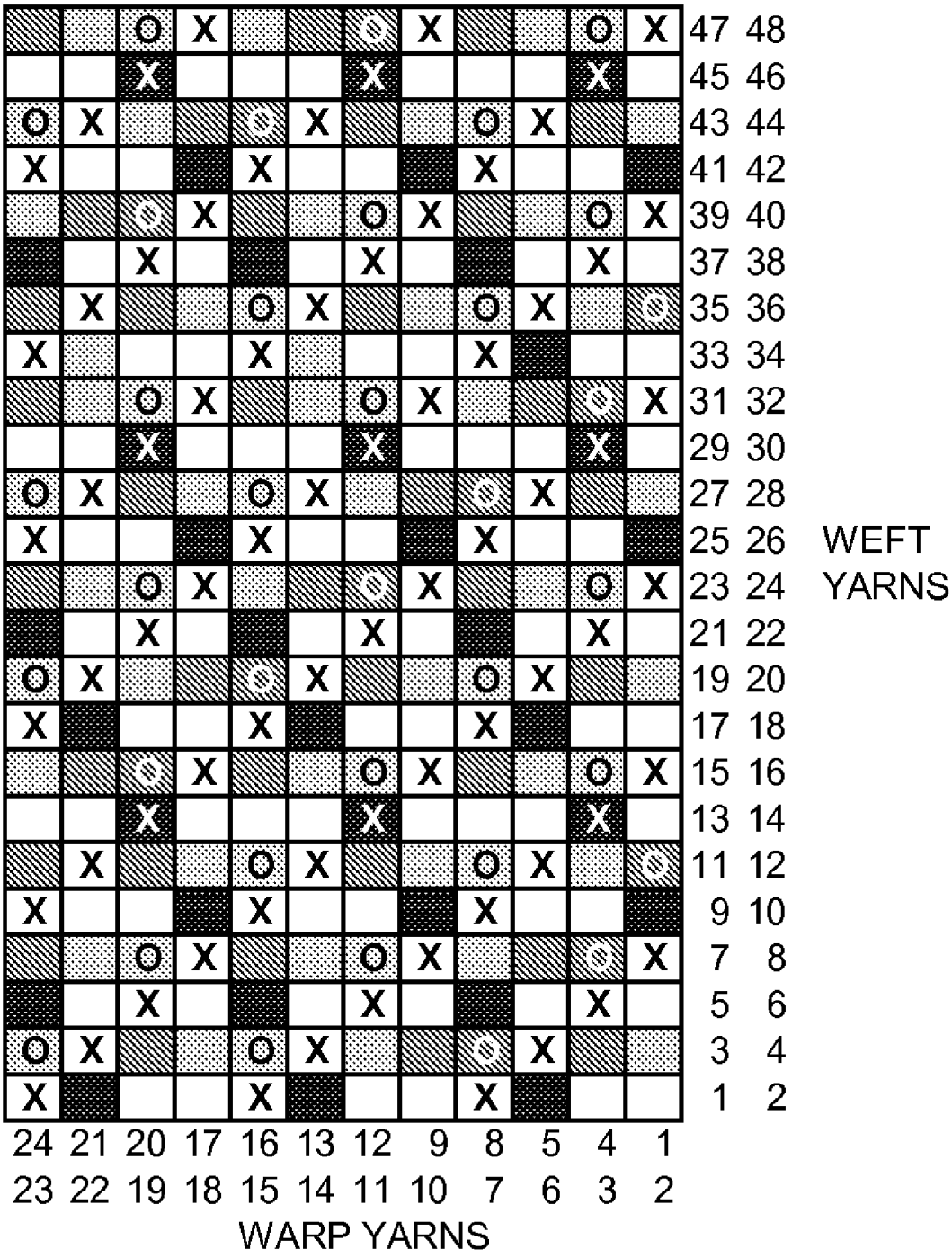
FIG. 81 shows a repeating pattern area of a twenty eighth embodiment of a forming fabric according to the invention.
Figure 82:
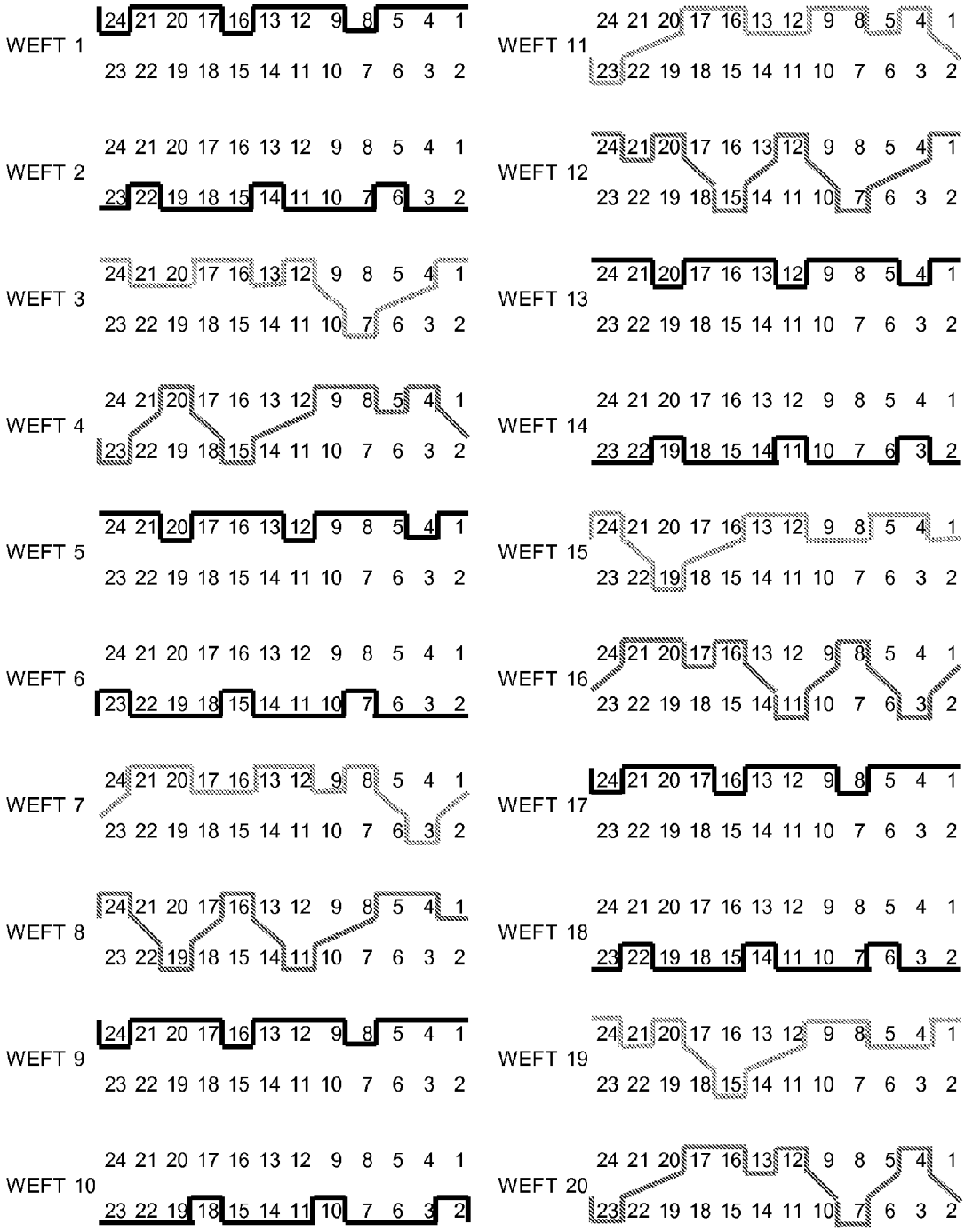
FIG. 82 shows a schematic representation of the weave pattern of individual weft yarns of FIG. 81 with the top and bottom warp yarns.
Figure 83:
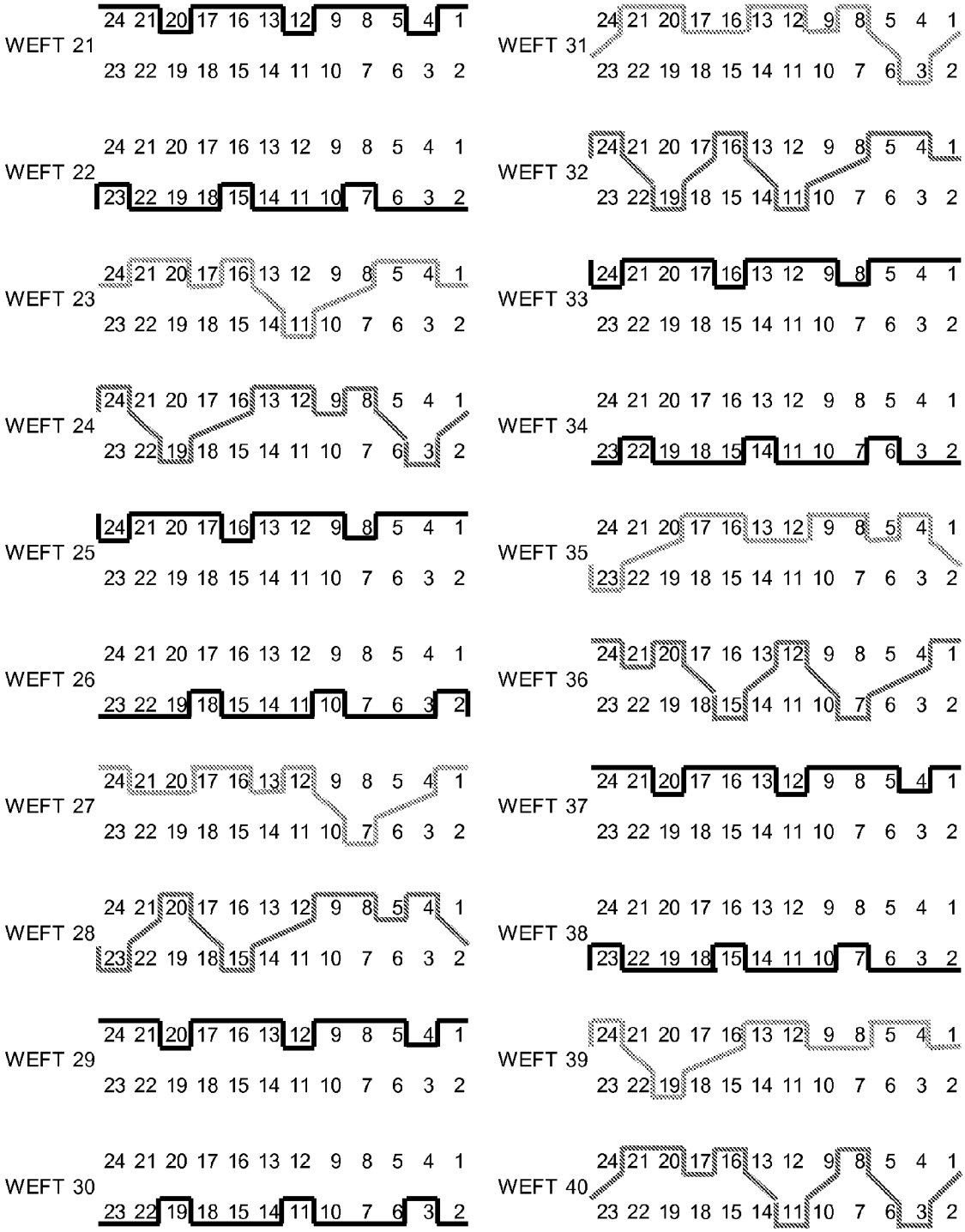
FIG. 83 shows an additional schematic representation of the weave pattern of individual weft yarns of FIG. 81 with the top and bottom warp yarns.
Figure 84:
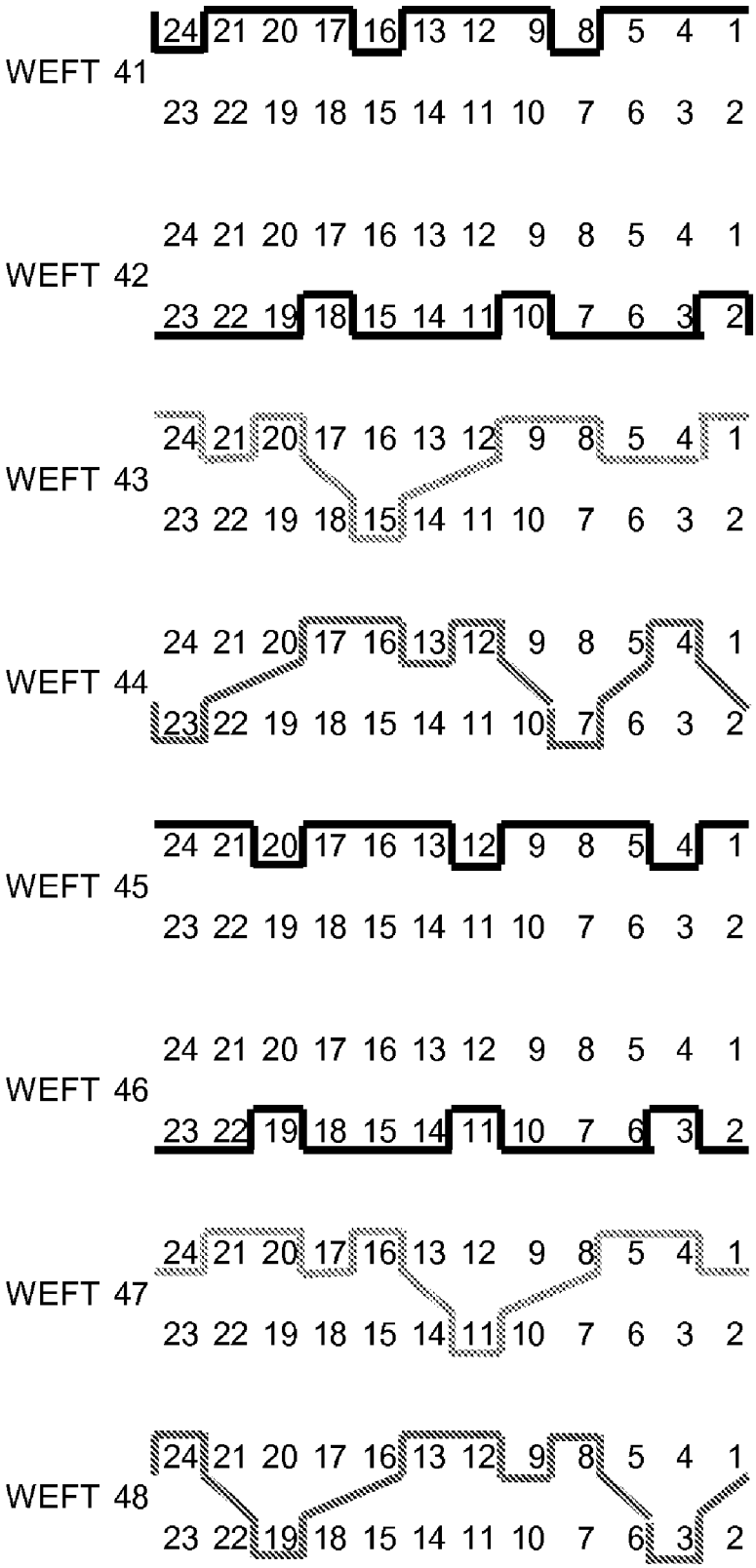
FIG. 84 shows an additional schematic representation of the weave pattern of individual weft yarns of FIG. 81 with the top and bottom warp yarns.
Figure 85:
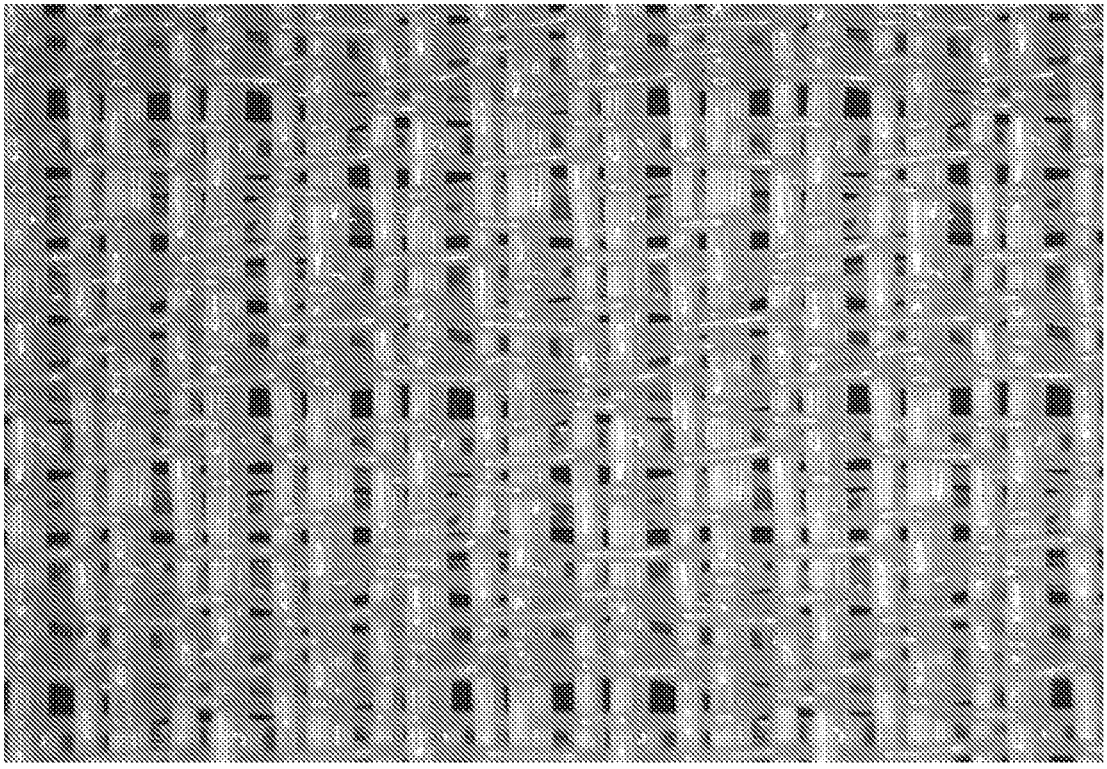
FIG. 85 shows a photograph of the upper surface or paper-facing surface of the forming fabric of FIG. 81.
Figure 86:
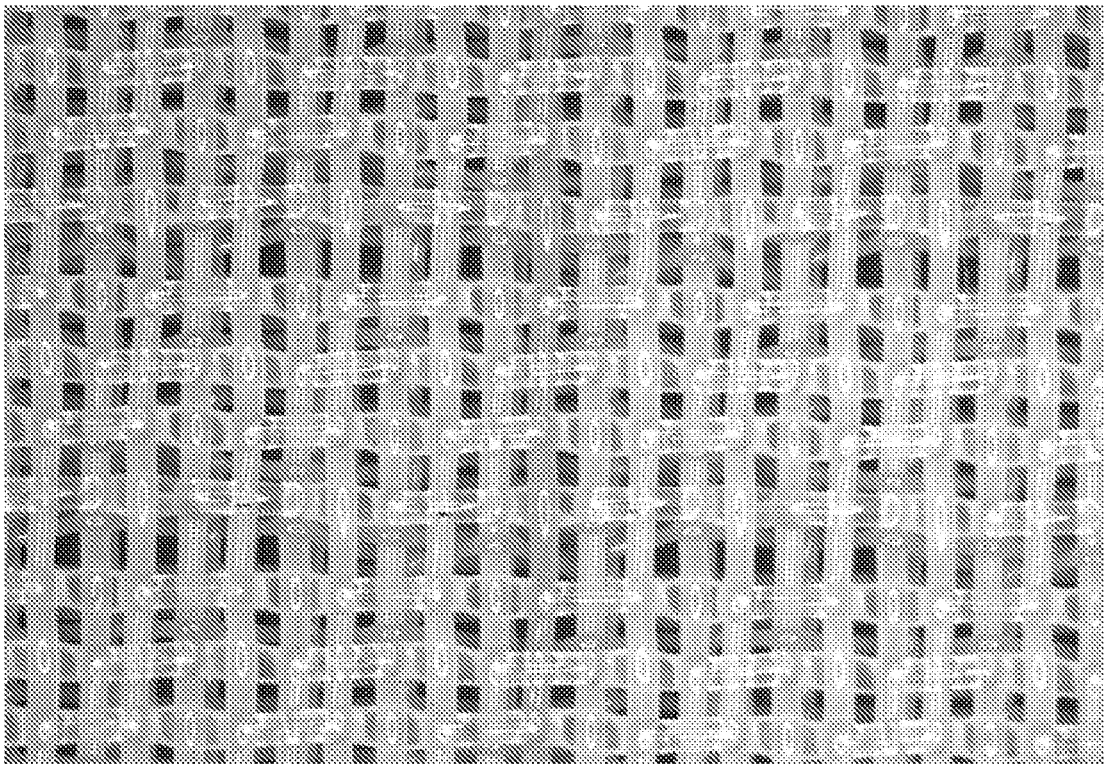
FIG. 86 shows a photograph of a bottom layer of the forming fabric of FIG. 81.
Figure 87:
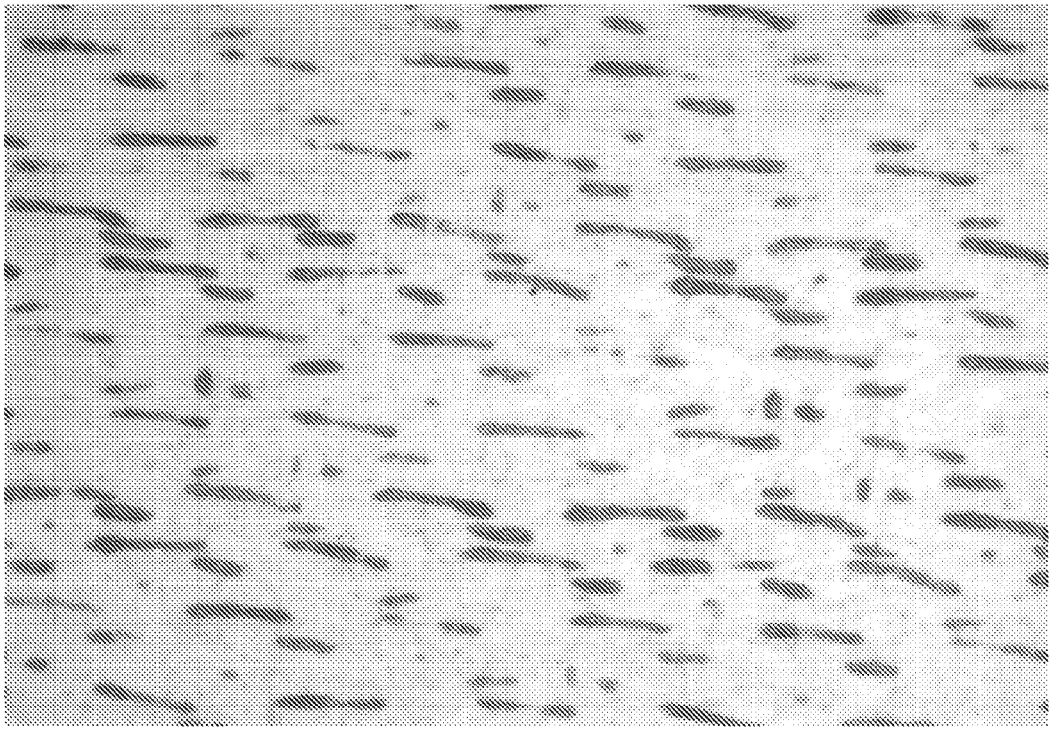
FIG. 87 shows a photograph of an impression of the upper surface of the forming fabric of FIG. 81.
Figure 88:
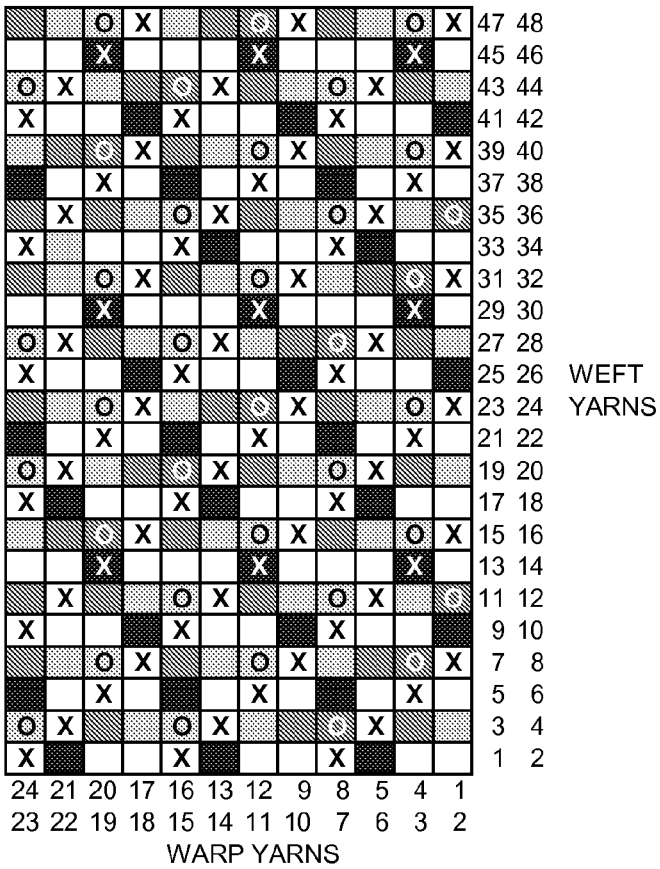
FIG. 88 shows a repeating pattern area of a twenty ninth embodiment of a forming fabric according to the invention.
Figure 89:
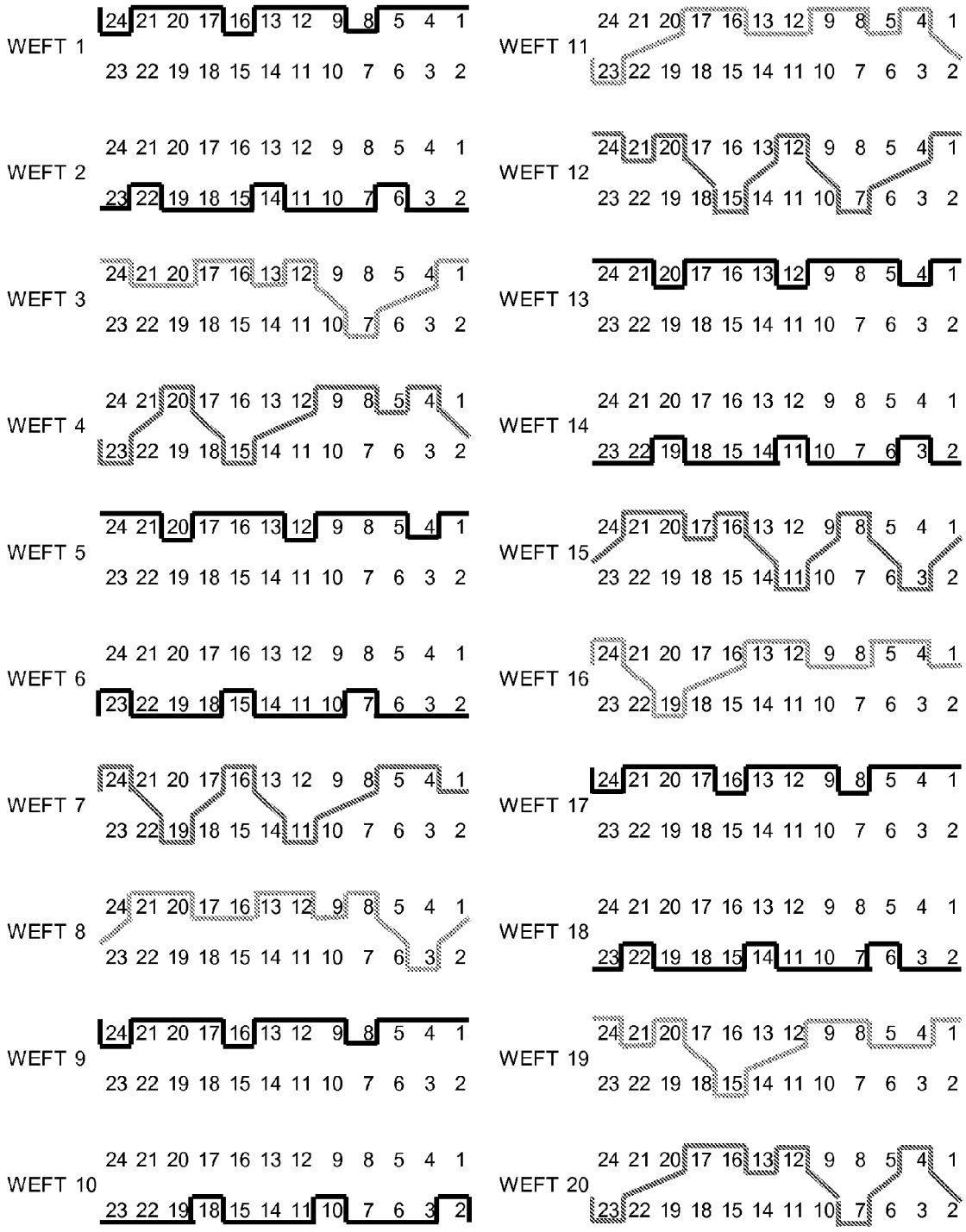
FIG. 89 shows a schematic representation of the weave pattern of individual weft yarns of FIG. 88 with the top and bottom warp yarns.
Figure 90:
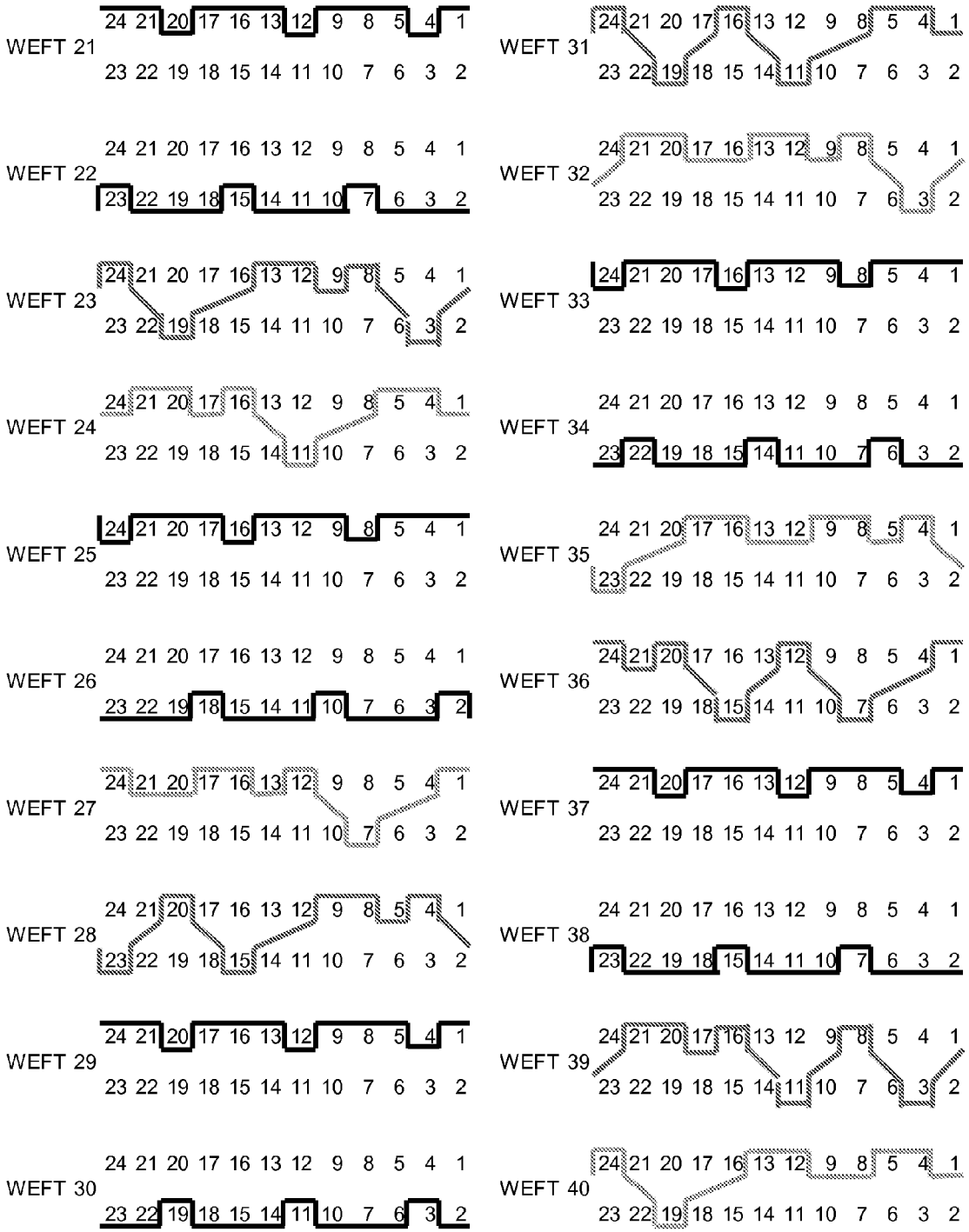
FIG. 90 shows an additional schematic representation of the weave pattern of individual weft yarns of FIG. 88 with the top and bottom warp yarns.
Figure 91:
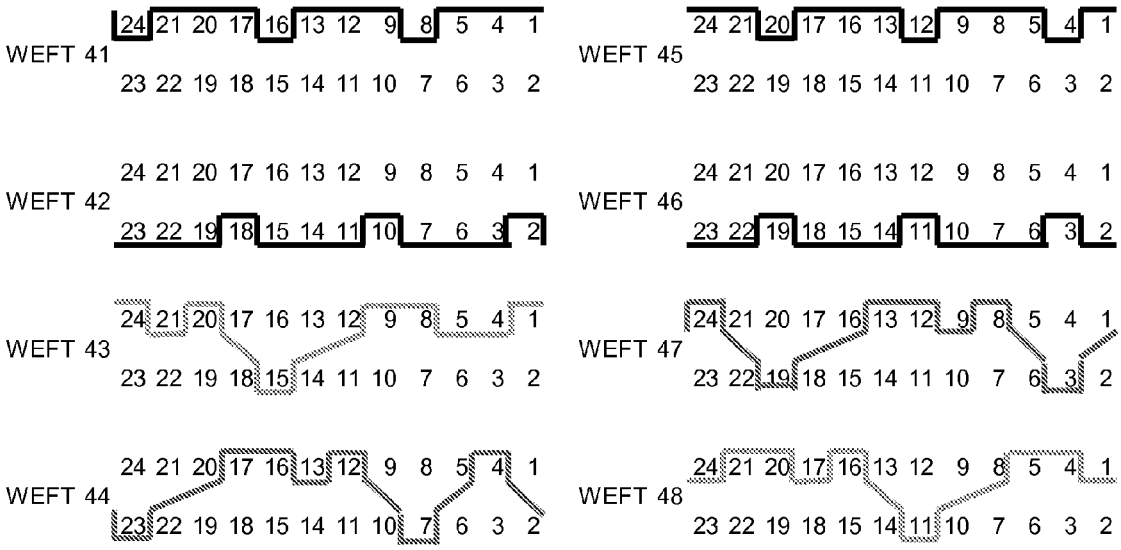
FIG. 91 shows an additional schematic representation of the weave pattern of individual weft yarns of FIG. 88 with the top and bottom warp yarns.
Figure 92:
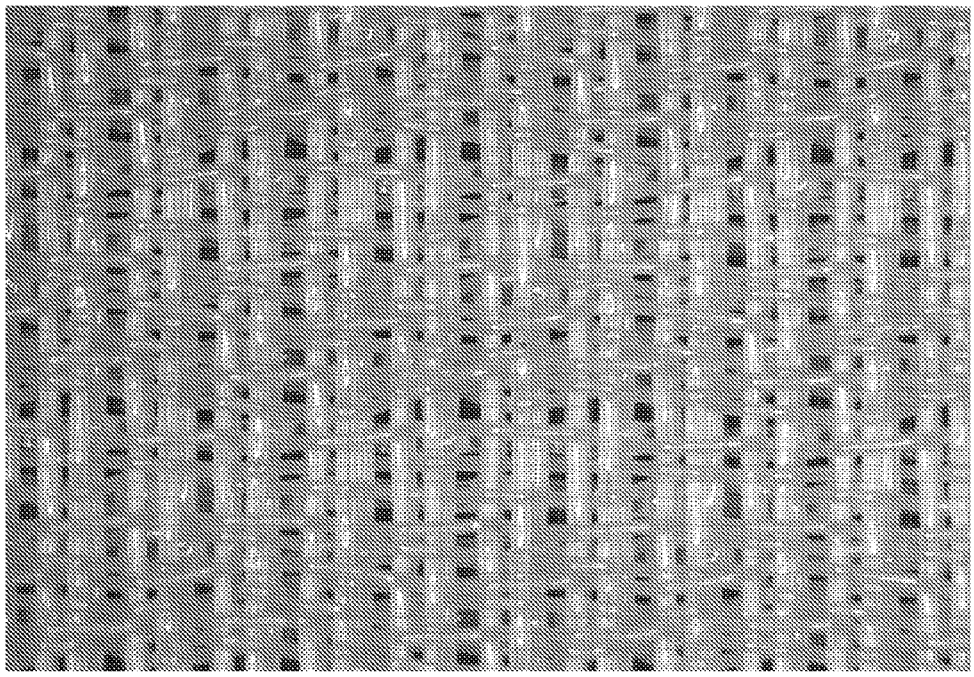
FIG. 92 shows a photograph of the upper surface or paper-facing surface of the forming fabric of FIG. 88.
Figure 93:
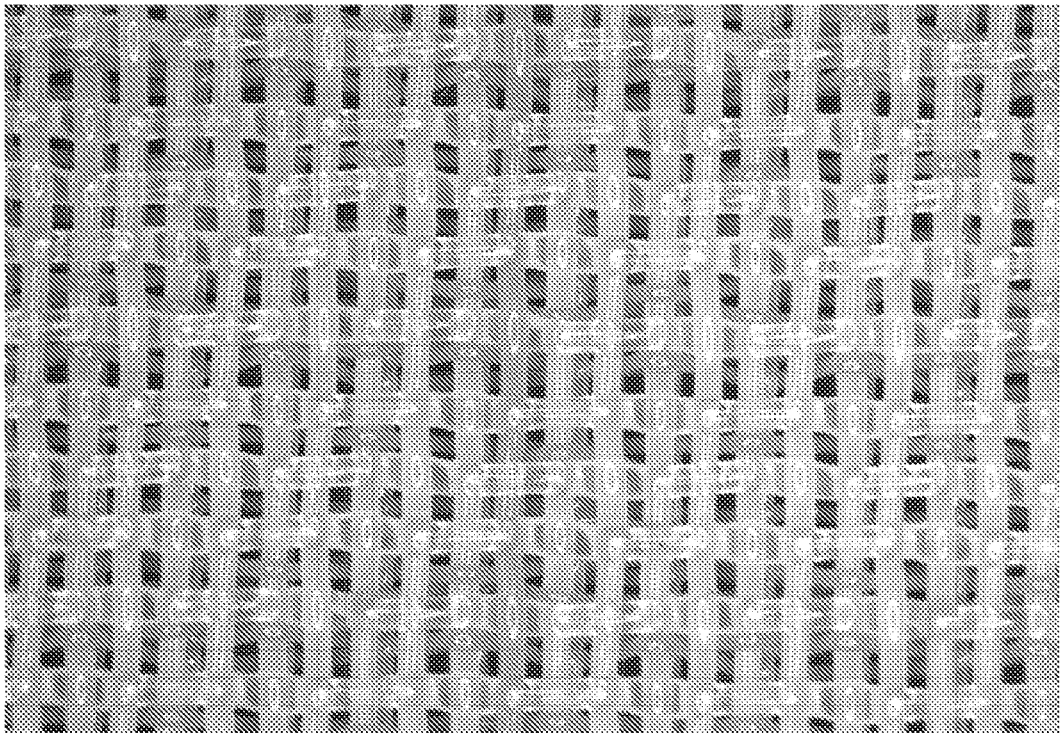
FIG. 93 shows a photograph of a bottom layer of the forming fabric of FIG. 88.
Figure 94:
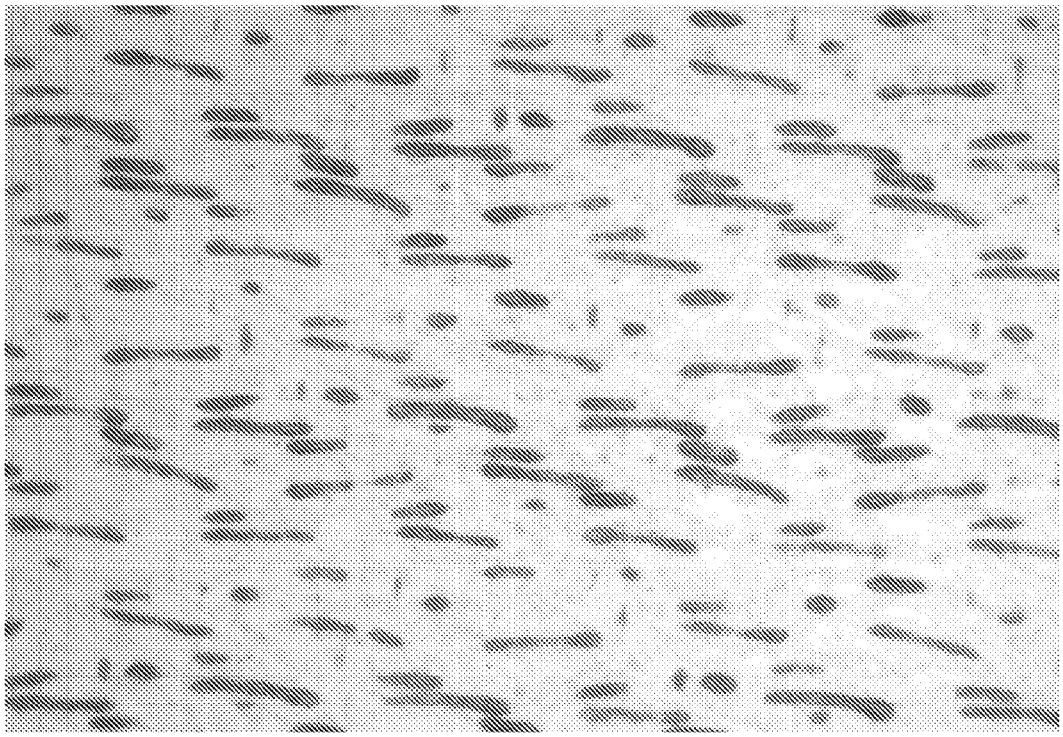
FIG. 94 shows a photograph of an impression of the upper surface of the forming fabric of FIG. 88.

Nineteenth and twentieth non-limiting embodiments of the forming fabric of the present invention are illustrated in FIGS. 81-86 and 88-93, and impressions of the upper surfaces of the fabrics are illustrated in FIGS. 87 and 94. The fabrics four over four butted-binder fabrics. FIGS. 81 and 88 show single repeating pattern areas of the fabric that encompasses twenty four warp yarns (yarns 1-24 extending vertically) and forty eight weft yarns (yarns 1-48 extending horizontally). Like the DCB weft yarns of the previous embodiments of the forming fabric, the DCB weft yarns in each pair combine to match the weave pattern of the top weft yarns.

By way of non-limiting example, the nineteenth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the nineteenth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

By way of non-limiting example, the twentieth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the twentieth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 95:
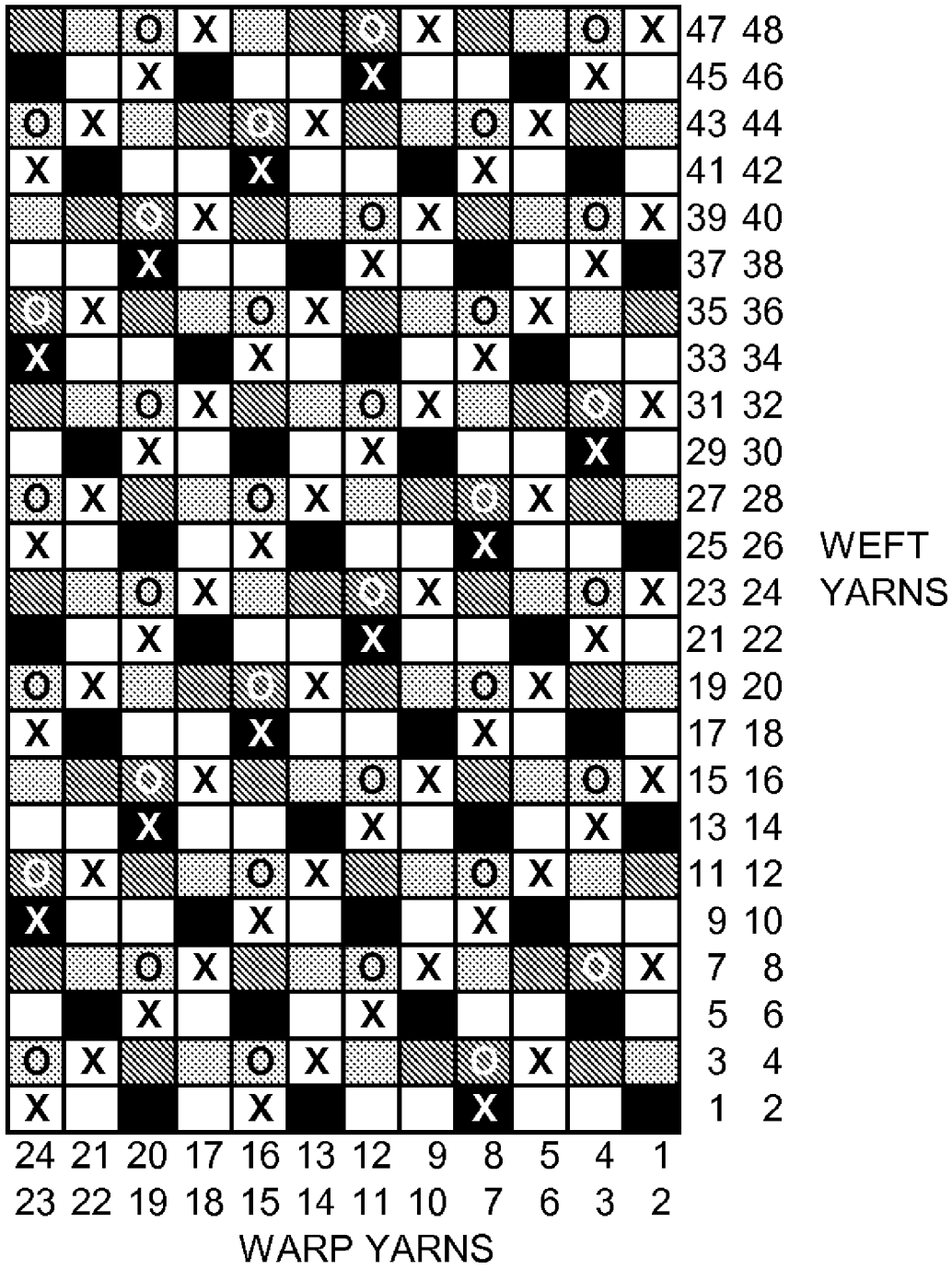
FIG. 95 shows a repeating pattern area of a thirtieth embodiment of a forming fabric according to the invention.
Figure 96:
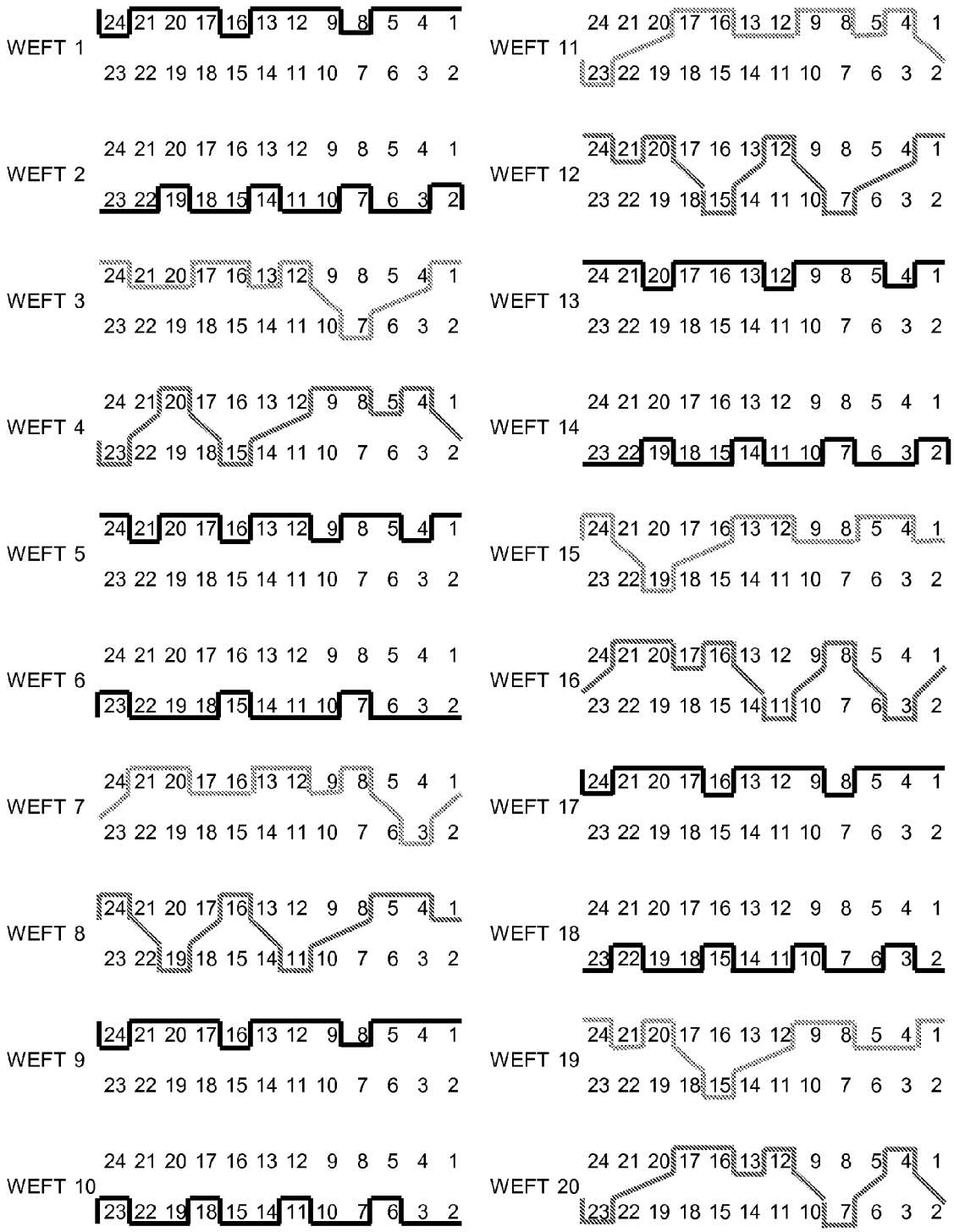
FIG. 96 shows a schematic representation of the weave pattern of individual weft yarns of FIG. 95 with the top and bottom warp yarns.
Figure 97:
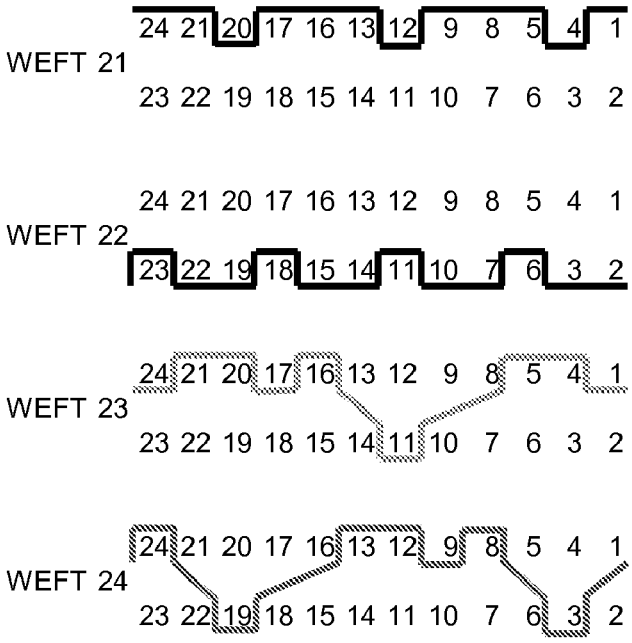
FIG. 97 shows an additional schematic representation of the weave pattern of individual weft yarns of FIG. 95 with the top and bottom warp yarns.
Figure 98:
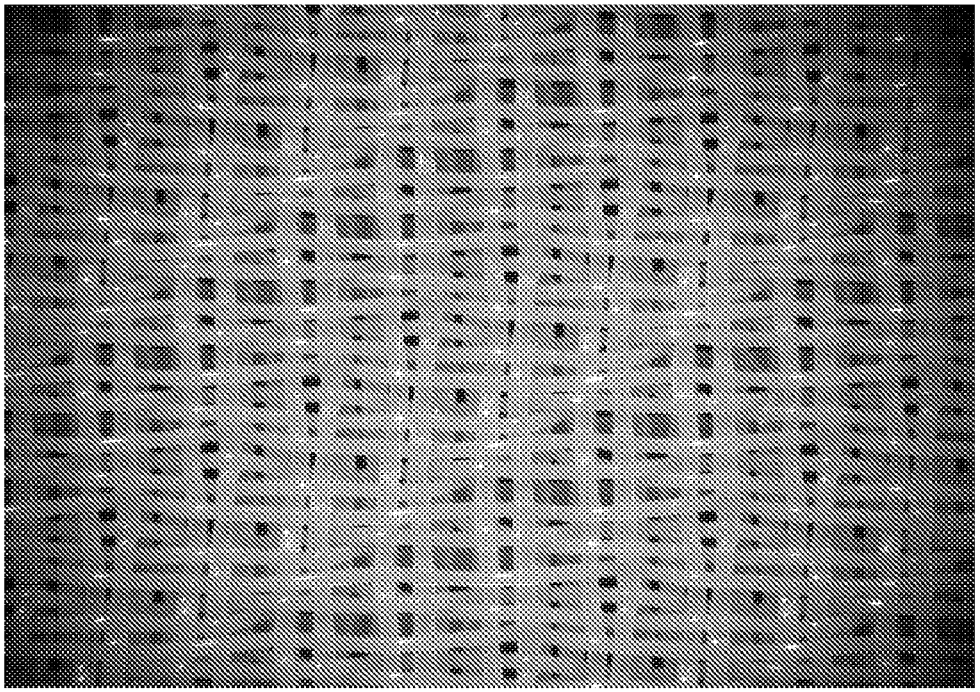
FIG. 98 shows another photograph of the upper surface or paper-facing surface of the forming fabric of FIG. 95.
Figure 99:
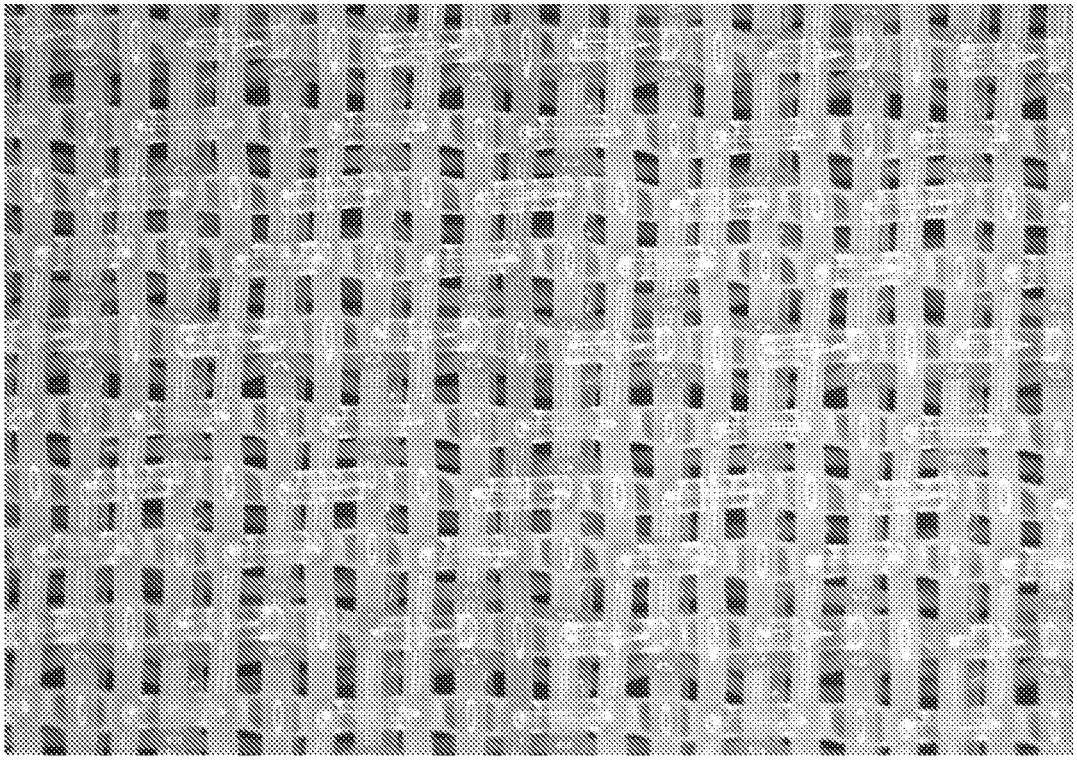
FIG. 99 shows a photograph of a bottom layer of the forming fabric of FIG. 95.
Figure 100:
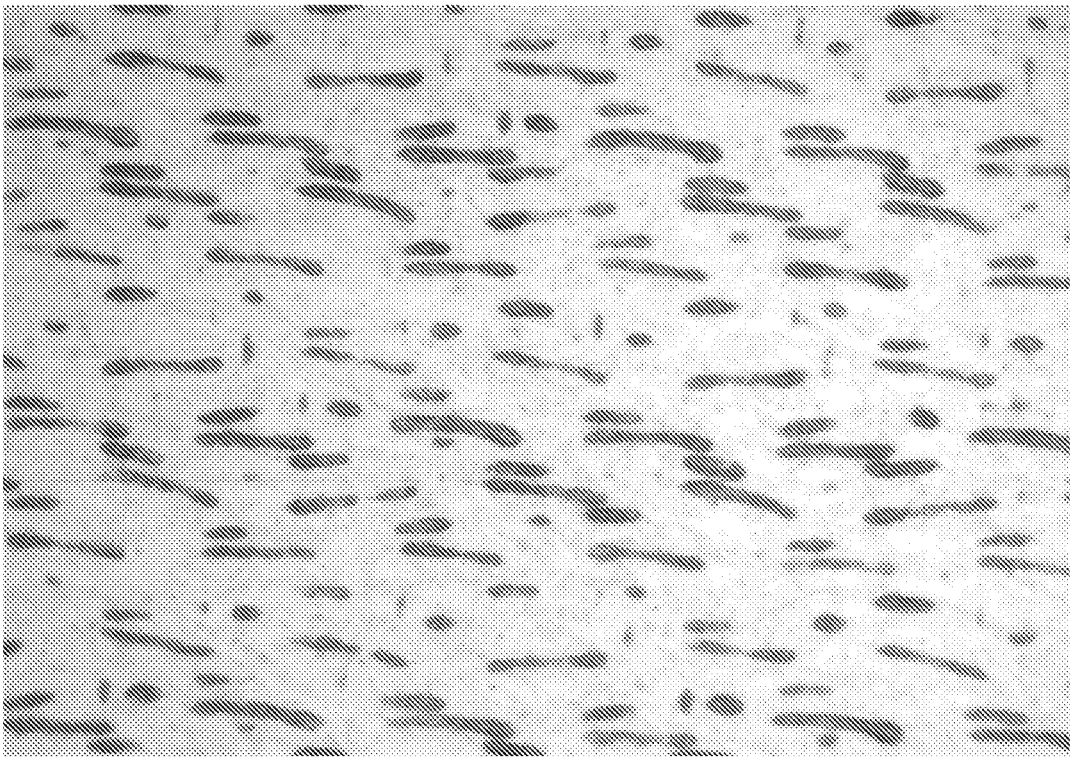
FIG. 100 shows a photograph of an impression of the upper surface of the forming fabric of FIG. 95.

A twenty first non-limiting embodiment of the forming fabric of the present invention is illustrated in FIGS. 95-99, and an impression of the upper surface of the twenty first embodiment of the forming fabric is illustrated in FIG. 100. The fabric is a four over three butted-binder single straight weave fabric. The fabric of FIG. 95 shows a single repeating pattern area of the fabric that encompasses twenty four warp yarns (yarns 1-24 extending vertically in FIG. 95) and forty eight weft yarns (yarns 1-48 extending horizontally in FIG. 95). FIGS. 96 and 97 depict the paths of weft yarns 1-24 as they weave with warp yarns 1-24. Like the DCB weft yarns of the previous embodiments of the forming fabric, the DCB weft yarns in each pair combine to match the weave pattern of the top weft yarns.

By way of non-limiting example, the twenty first embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the twenty first embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-

0.25 mm, and is most preferably about 0.12-0.22 mm. Those of skill in the art will appreciate that yarns having diameters outside the above ranges may be used in certain applications.

Figure 101:
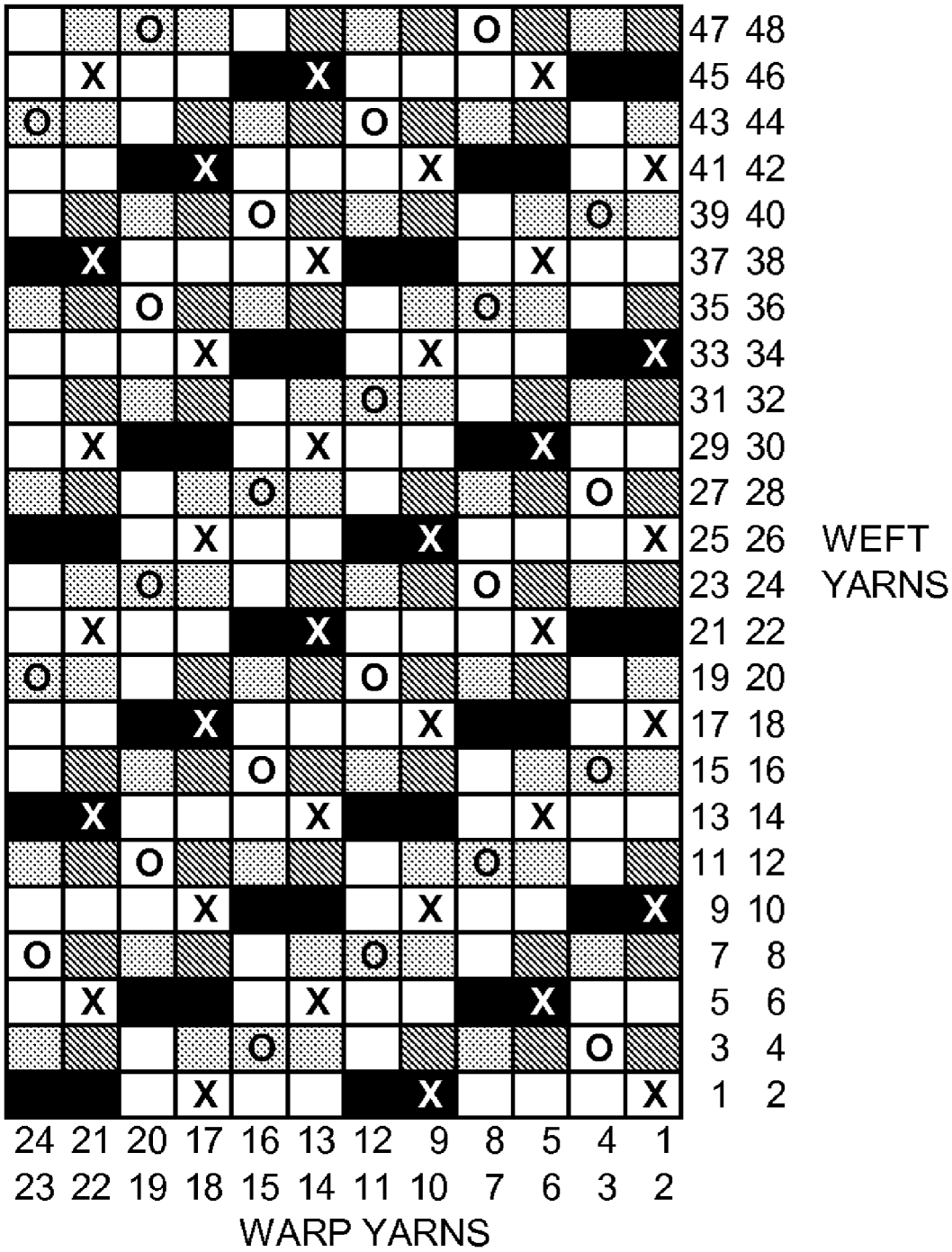
FIG. 101 shows a repeating pattern area of a thirty third embodiment of a forming fabric according to the invention.
Figure 103:
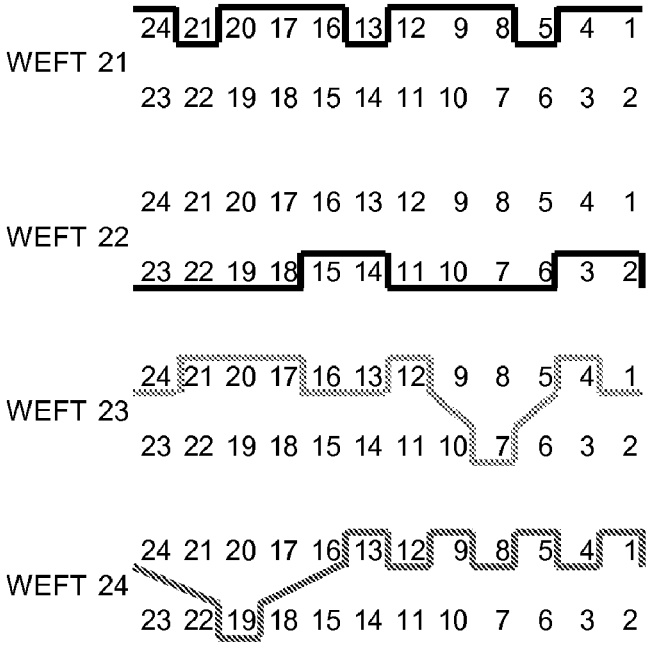
FIG. 103 shows an additional schematic representation of the weave pattern of individual weft yarns of FIG. 101 with the top and bottom warp yarns.
Figure 104:
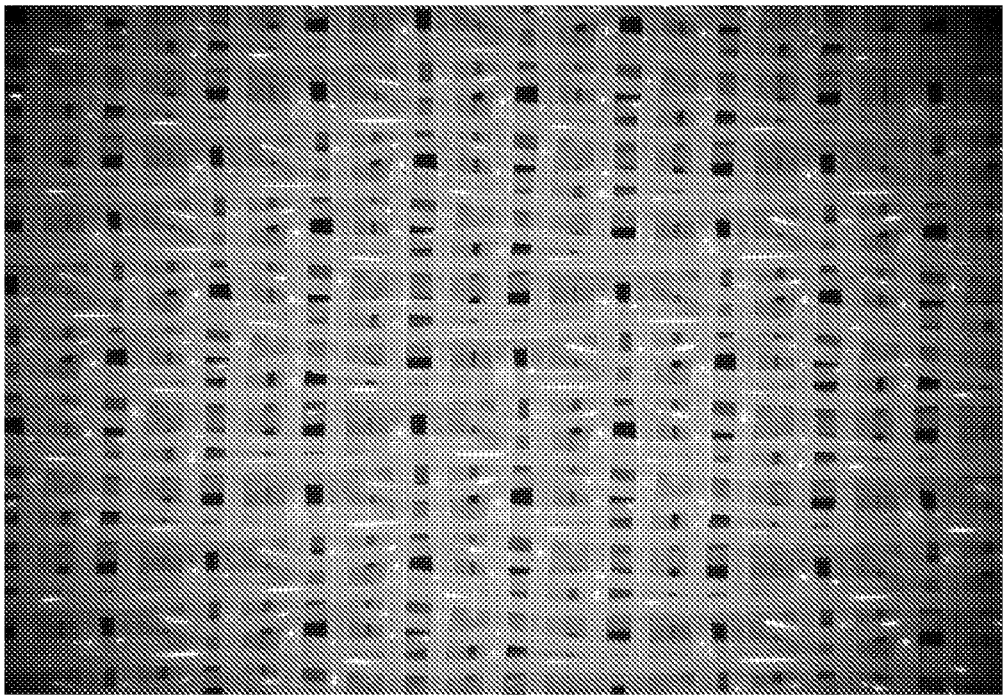
FIG. 104 shows another photograph of the upper surface or paper-facing surface of the forming fabric of FIG. 101.
Figure 105:
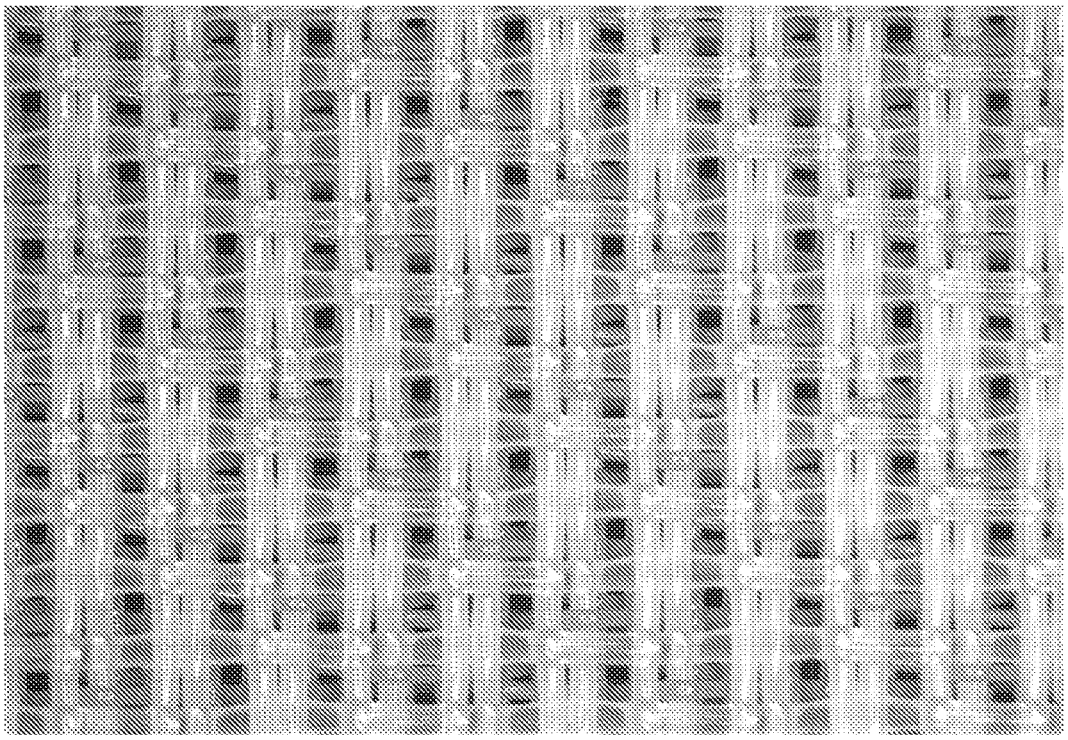
FIG. 105 shows a photograph of a bottom layer of the forming fabric of FIG. 101.
Figure 106:
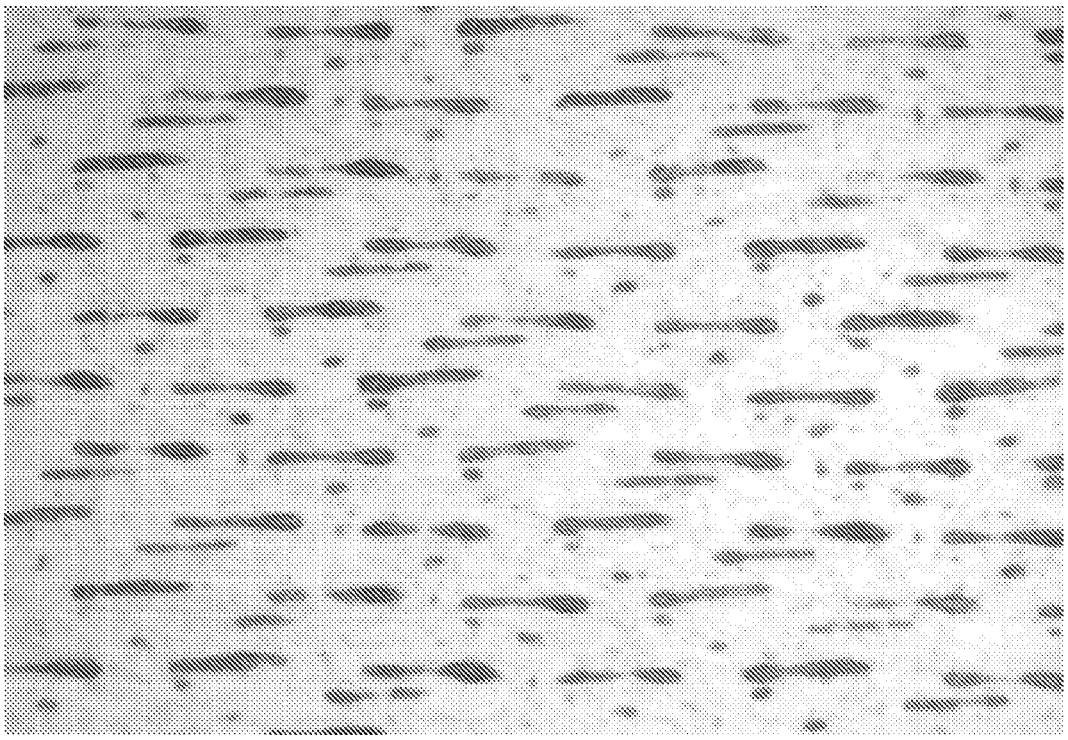
FIG. 106 shows a photograph of an impression of the upper surface of the forming fabric of FIG. 101.
Figure 107:
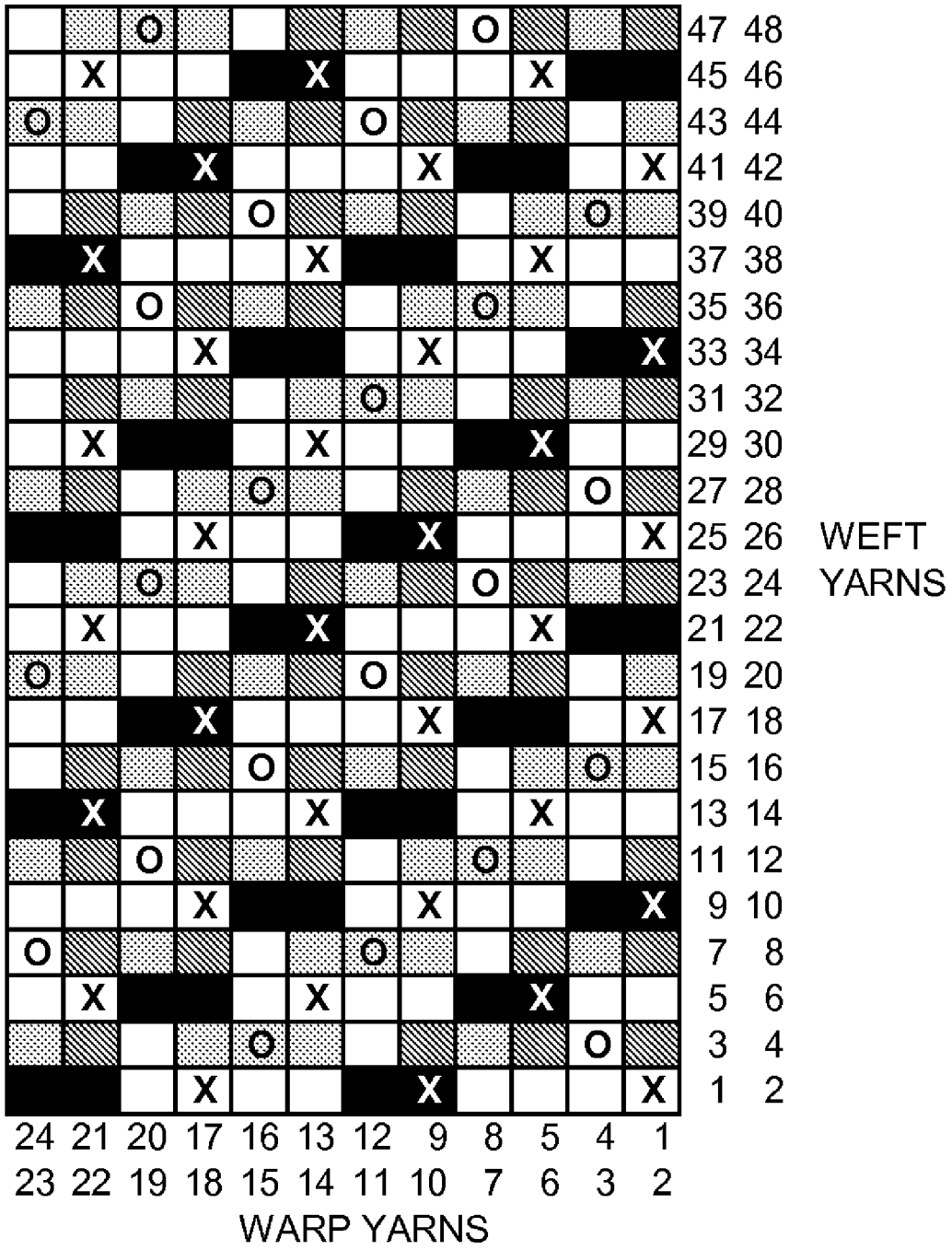
FIG. 107 shows a repeating pattern area of a thirty fourth embodiment of a forming fabric according to the invention.
Figure 108:
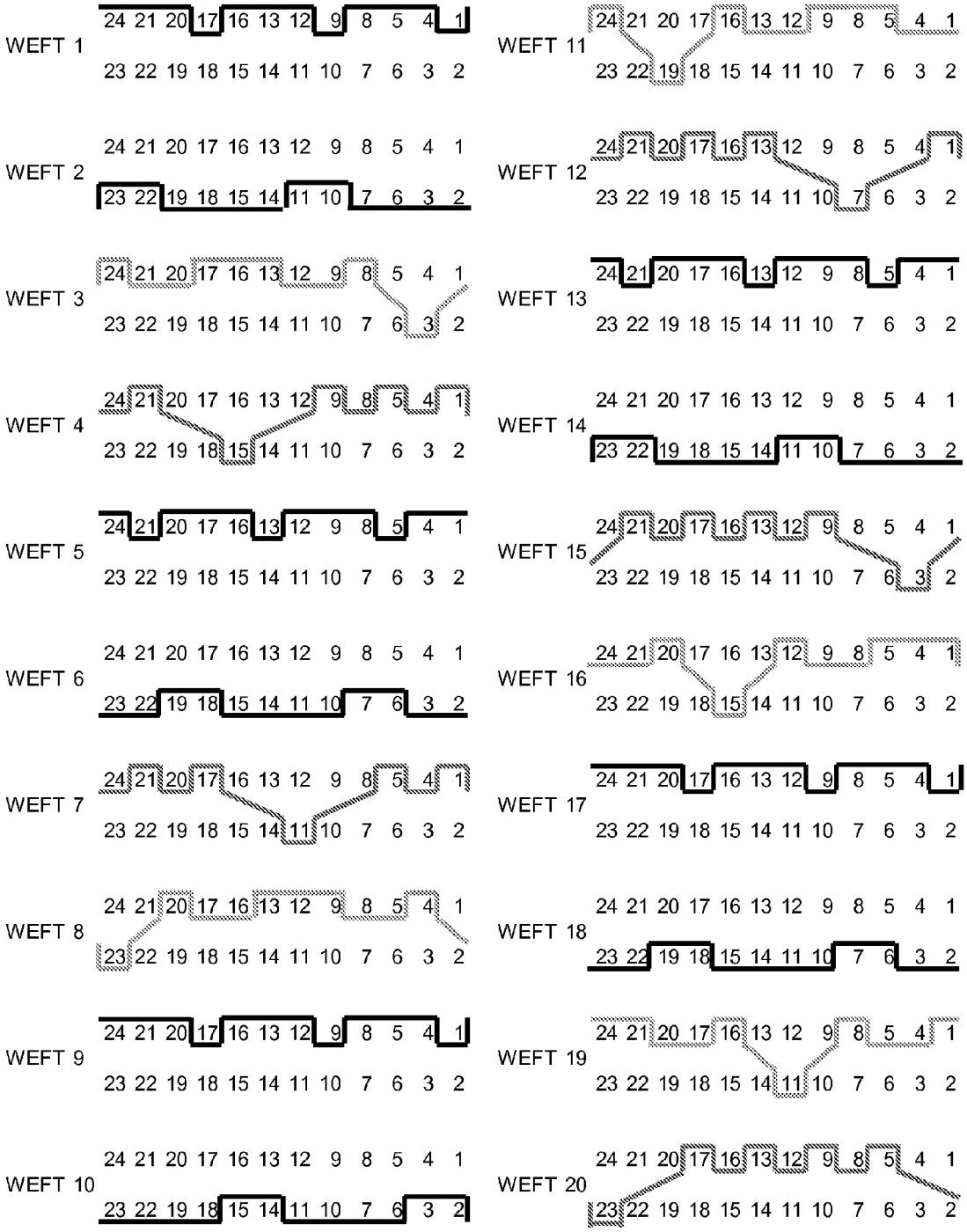
FIG. 108 shows a schematic representation of the weave pattern of individual weft yarns of FIG. 107 with the top and bottom warp yarns.
Figure 109:
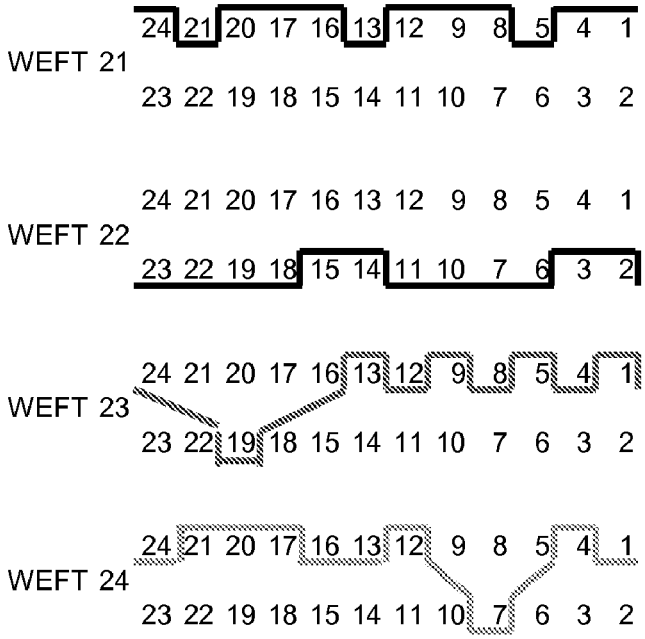
FIG. 109 shows an additional schematic representation of the weave pattern of individual weft yarns of FIG. 107 with the top and bottom warp yarns.
Figure 110:
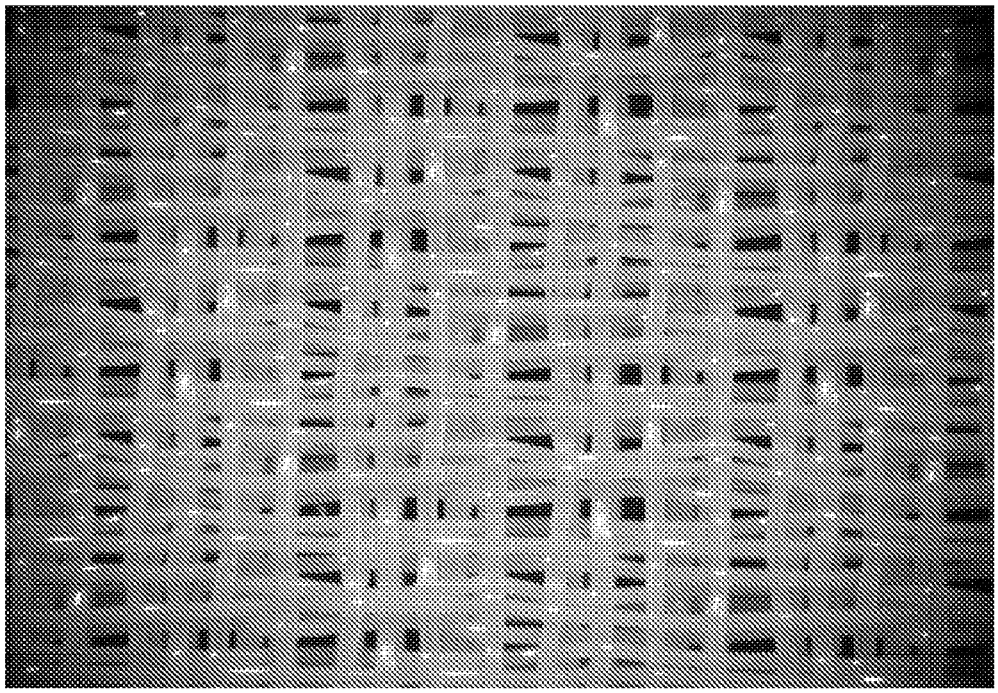
FIG. 110 shows a photograph of the upper surface or paper-facing surface of the forming fabric of FIG. 107.
Figure 111:
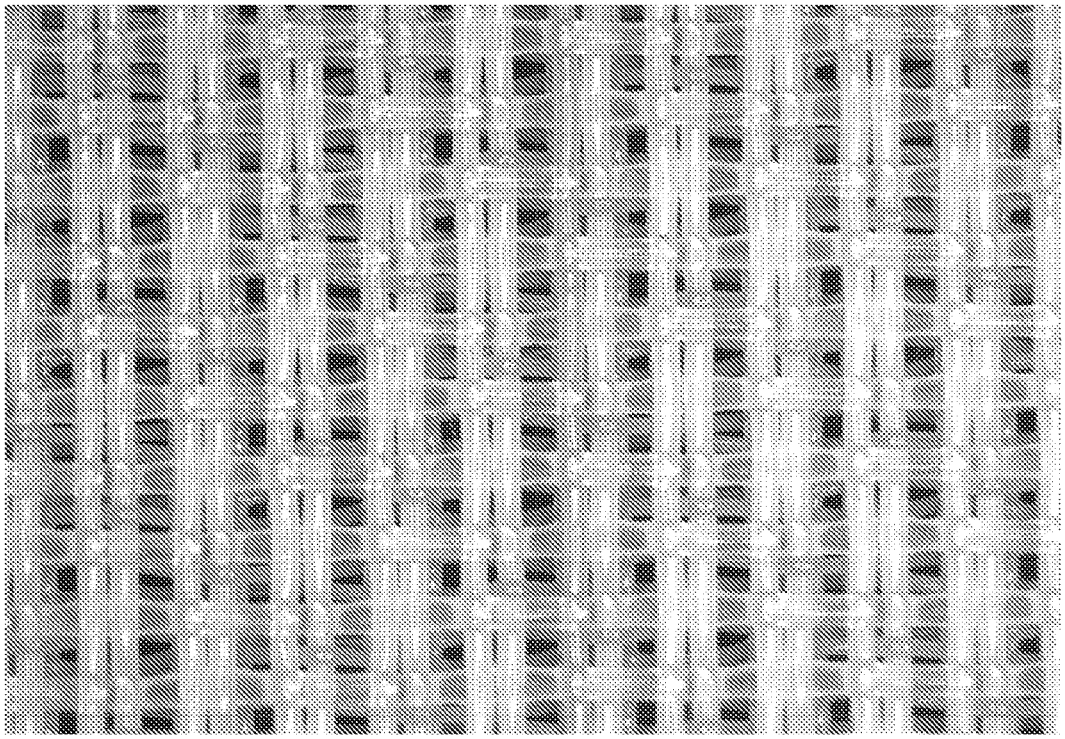
FIG. 111 shows a photograph of a bottom layer of the forming fabric of FIG. 107.
Figure 112:
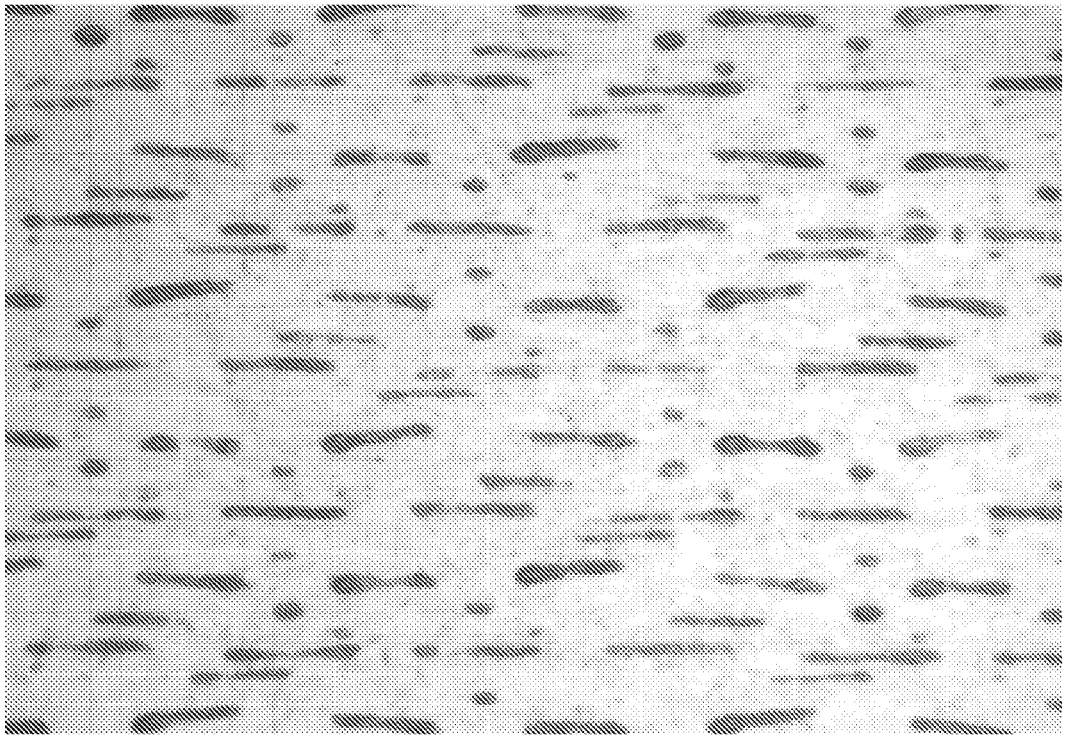
FIG. 112 shows a photograph of an impression of the upper surface of the forming fabric of FIG. 107.

Twenty second and twenty third non-limiting embodiments of the forming fabric of the present invention are illustrated in FIGS. 101-105 and 107-111, and impressions of the upper surfaces of the fabrics are illustrated in FIGS. 106 and 112. The fabrics are four over three butted-binder double fabrics. FIGS. 101 and 107 show repeating pattern areas of the fabrics that encompass twenty four warp yarns (yarns 1-24 extending vertically) and forty eight weft yarns (yarns 1-48 extending horizontally). FIGS. 102, 103, 108 and 109 depict the paths of weft yarns 1-24 as they weave with warp yarns 1-24. It should be noted that weft yarns 25-48 repeat the pattern of weft yarns 1-24. Like the DCB weft yarns of the previous embodiments of the forming fabric, the DCB weft yarns in each pair combine to match the weave pattern of the top weft yarns.

By way of non-limiting example, the twenty second embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the twenty second embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

By way of non-limiting example, the twenty third embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the twenty third embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 113:
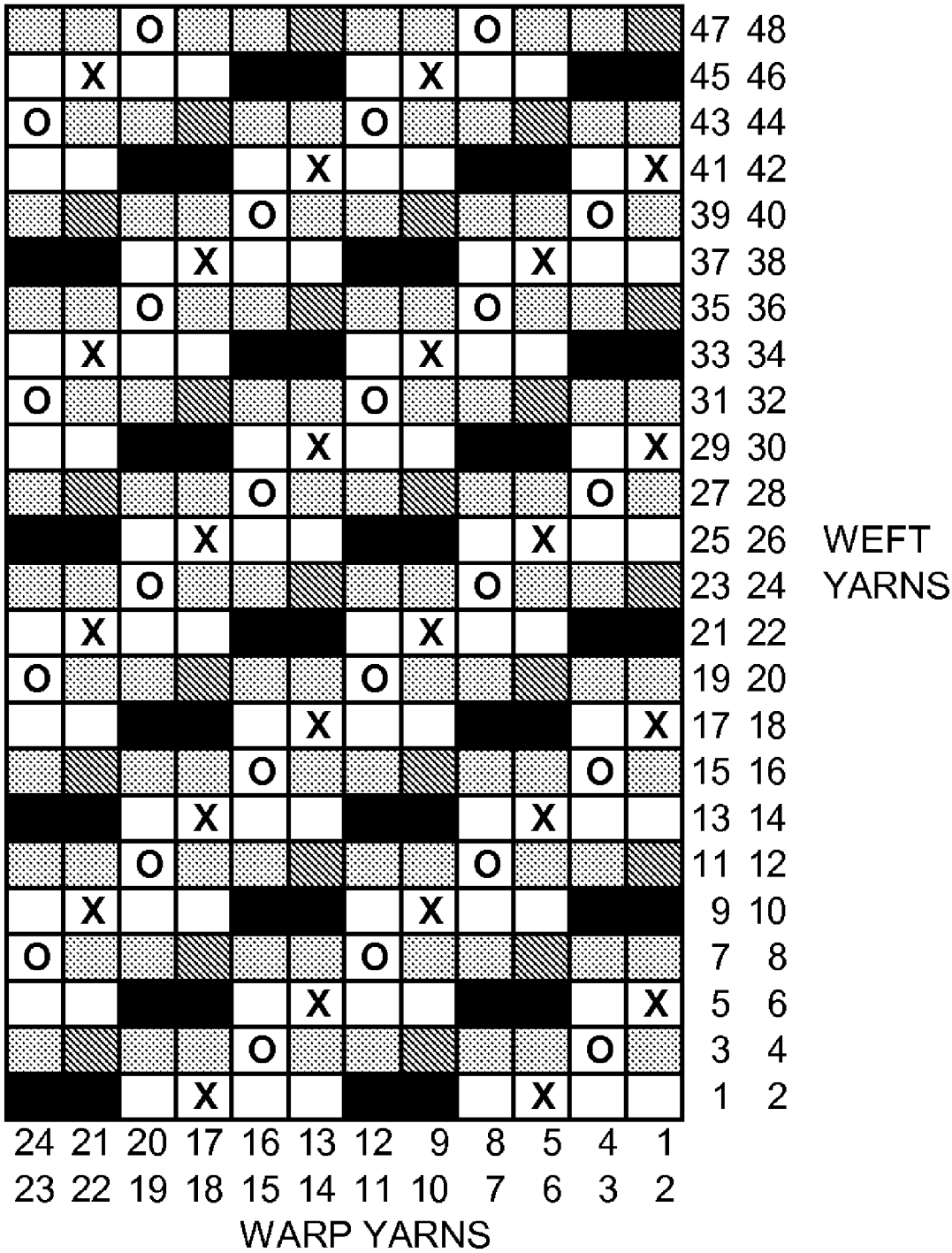
FIG. 113 shows a repeating pattern area of a thirty fifth embodiment of a forming fabric according to the invention.
Figure 114:
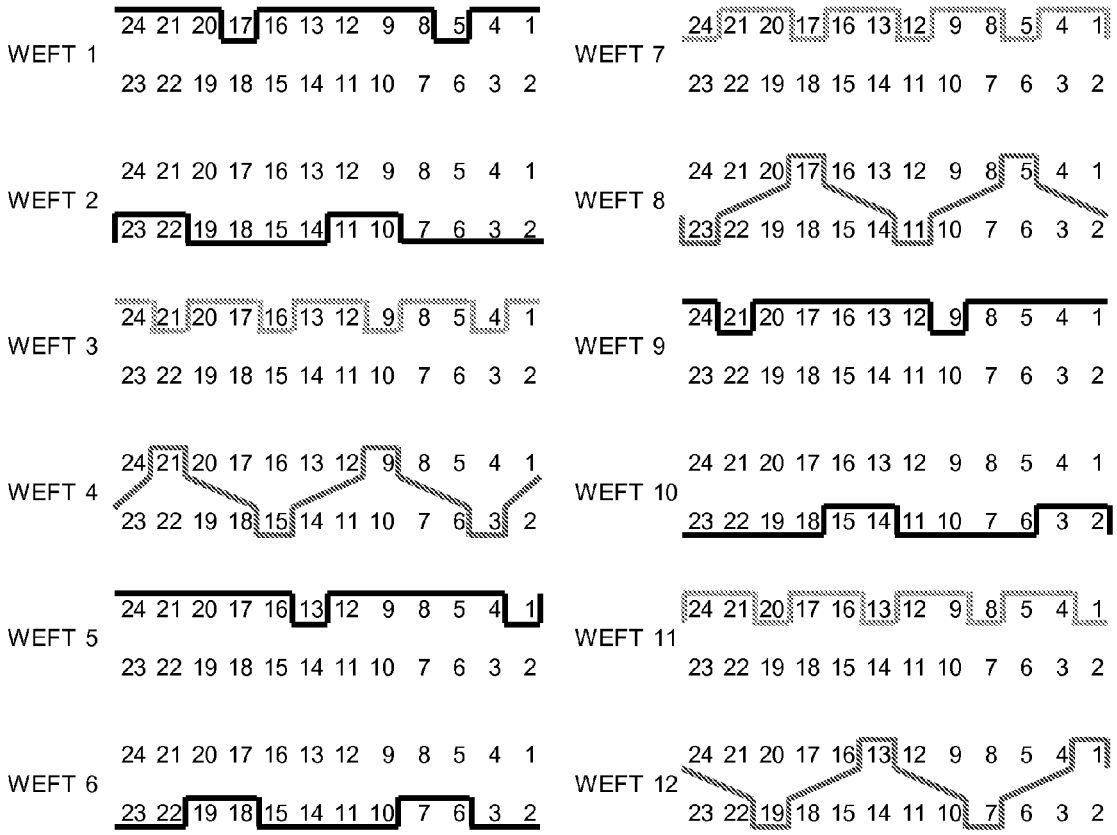
FIG. 114 shows a schematic representation of the weave pattern of individual weft yarns of FIG. 113 with the top and bottom warp yarns.
Figure 115:
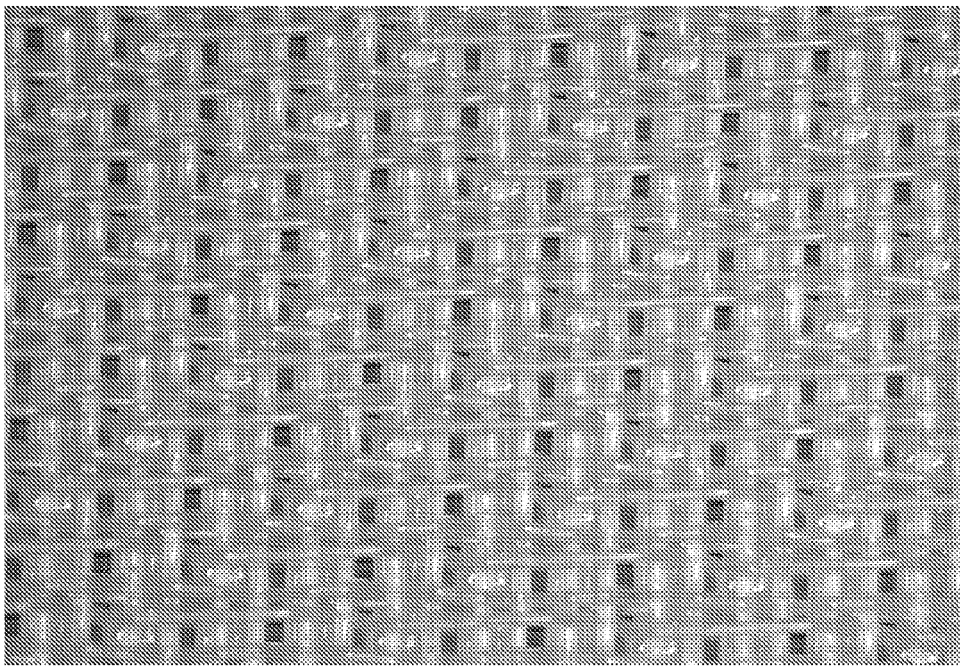
FIG. 115 shows a photograph of the upper surface or paper-facing surface of the forming fabric of FIG. 113.
Figure 116:
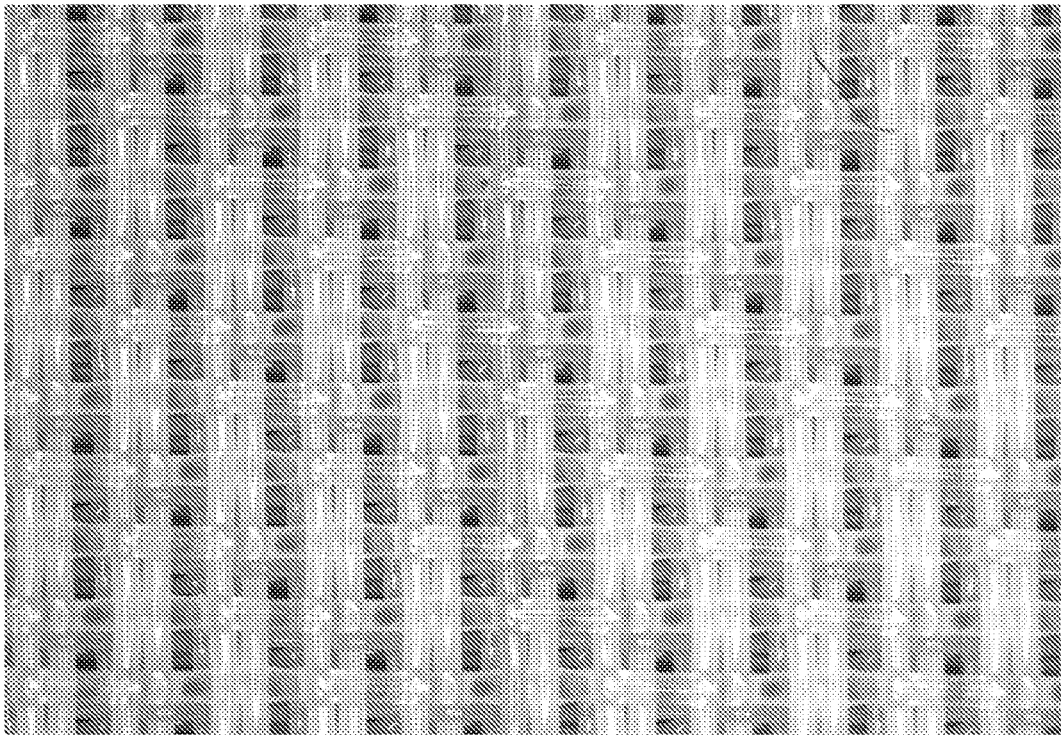
FIG. 116 shows a photograph of a bottom layer of the forming fabric of FIG. 113.
Figure 117:
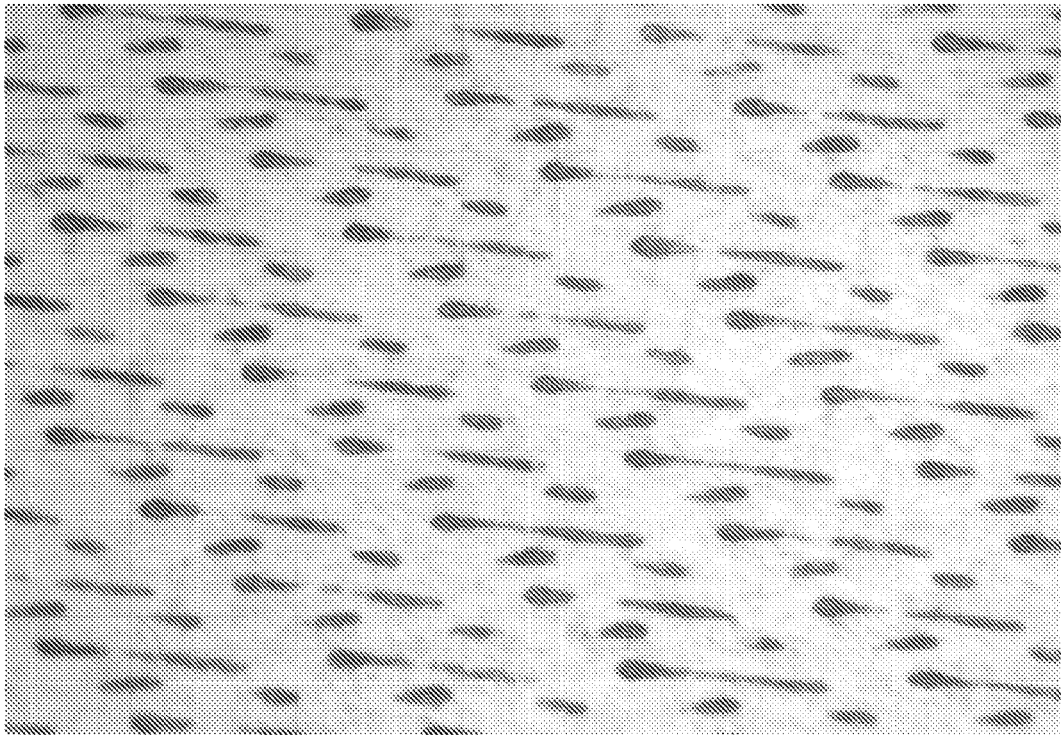

A twenty fourth embodiment of the forming fabric of the present invention is illustrated in FIGS. 113-116, and impressions of the upper surfaces of the fabrics are illustrated in FIG. 117. These fabrics are six over three butted-binder double fabrics. FIG. 113 shows a repeating pattern area of the fabric that encompasses twenty four warp yarns (yarns 1-24 extending vertically) and twenty four weft yarns (yarns 1-24 extending horizontally). Like the DCB weft yarns of the previous embodiments of the forming fabric, the DCB weft yarns in each pair combine to match the weave pattern of the top weft yarns.

By way of non-limiting example, the twenty fourth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the twenty fourth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Figure 118:
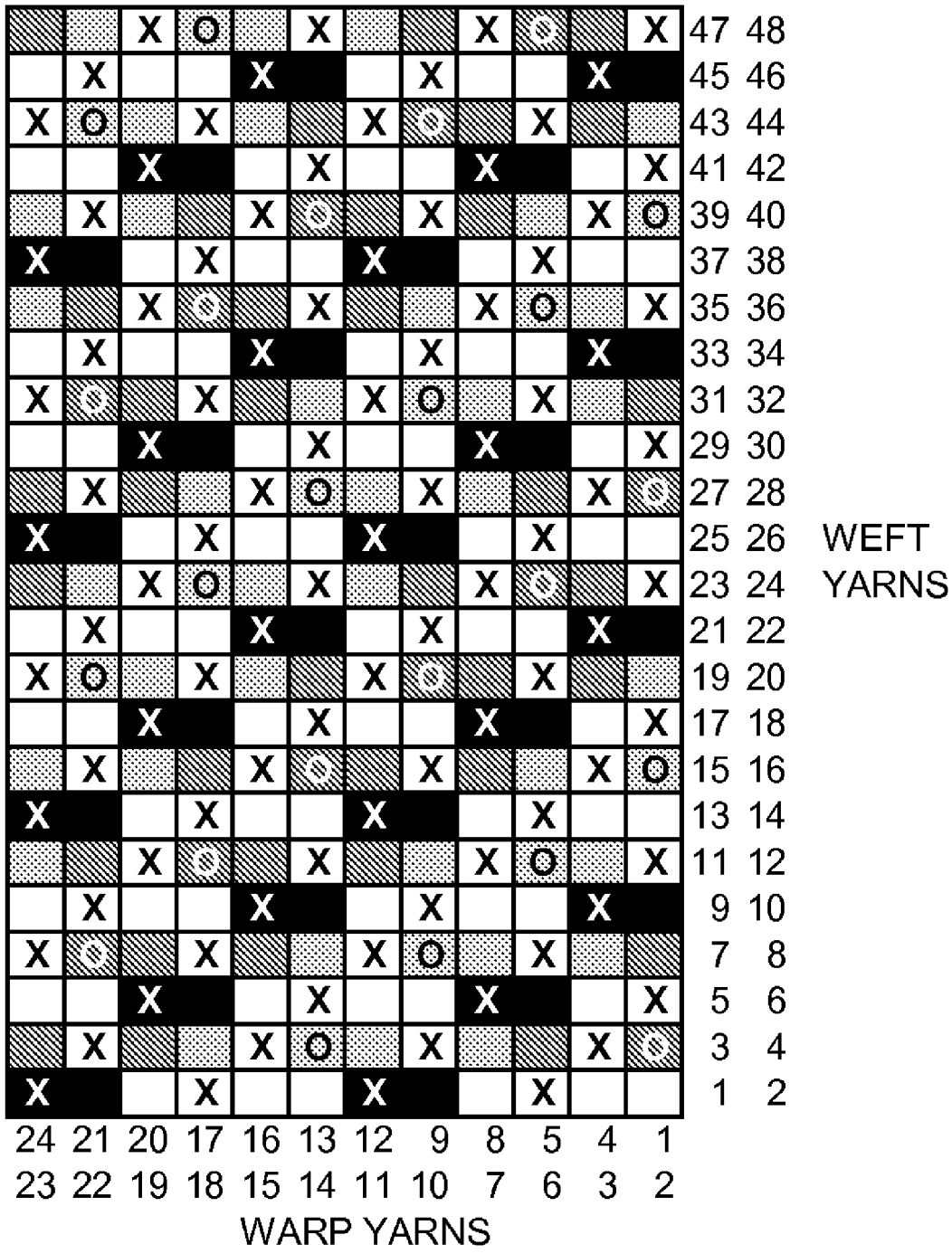
Figure 119:
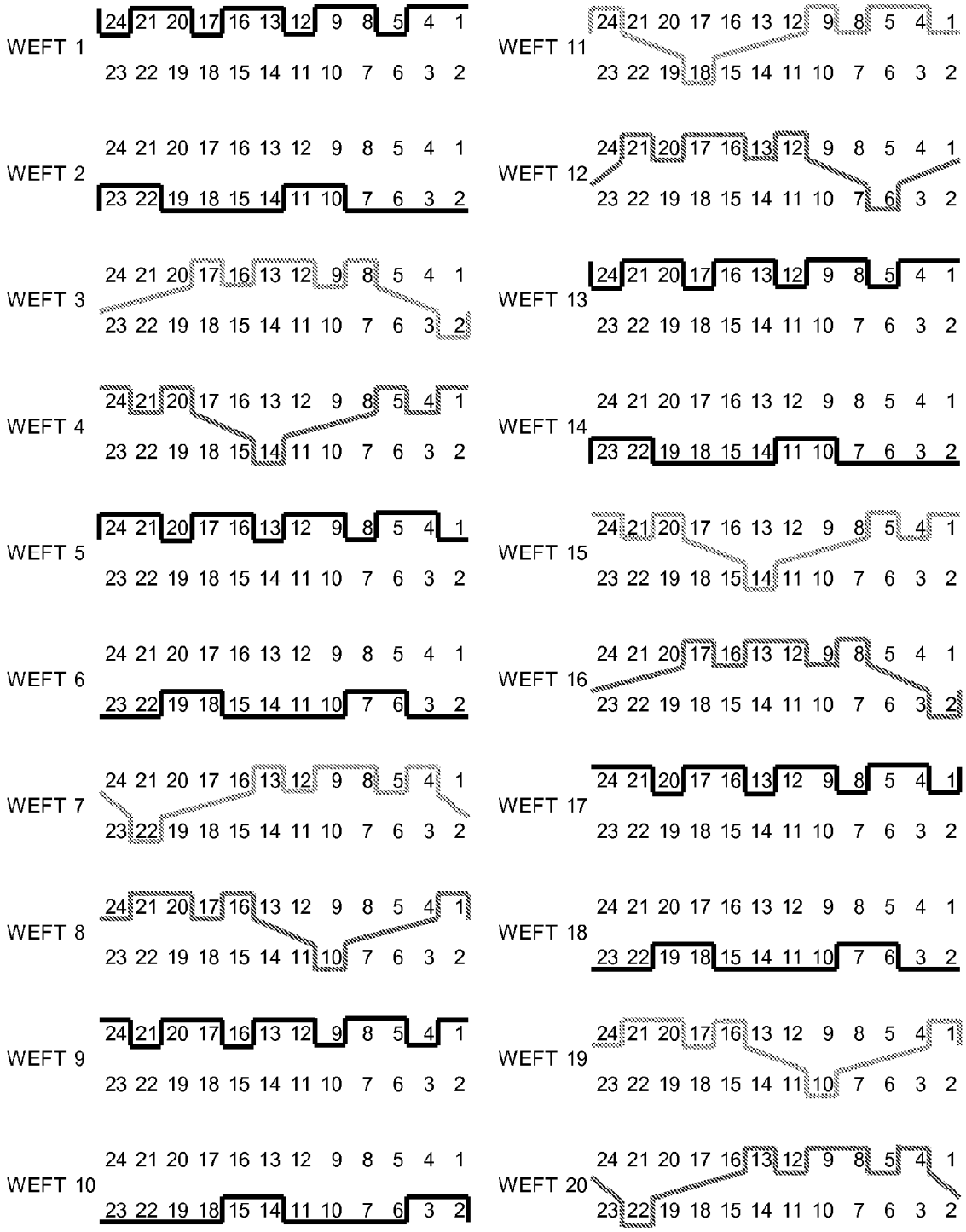
Figure 120:
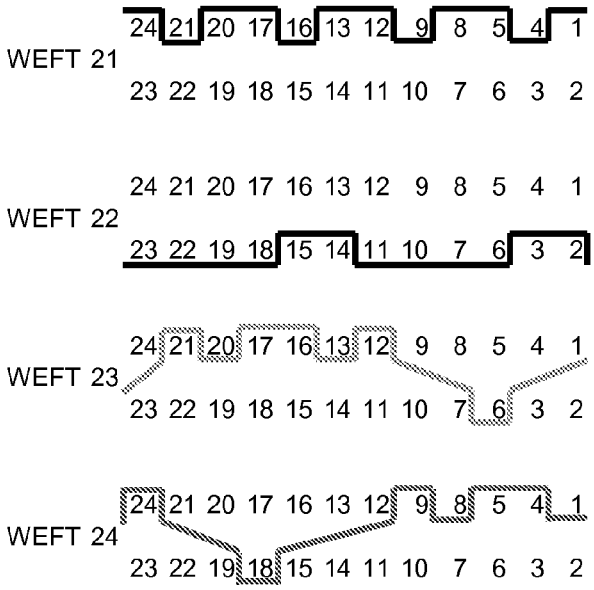
Figure 121:
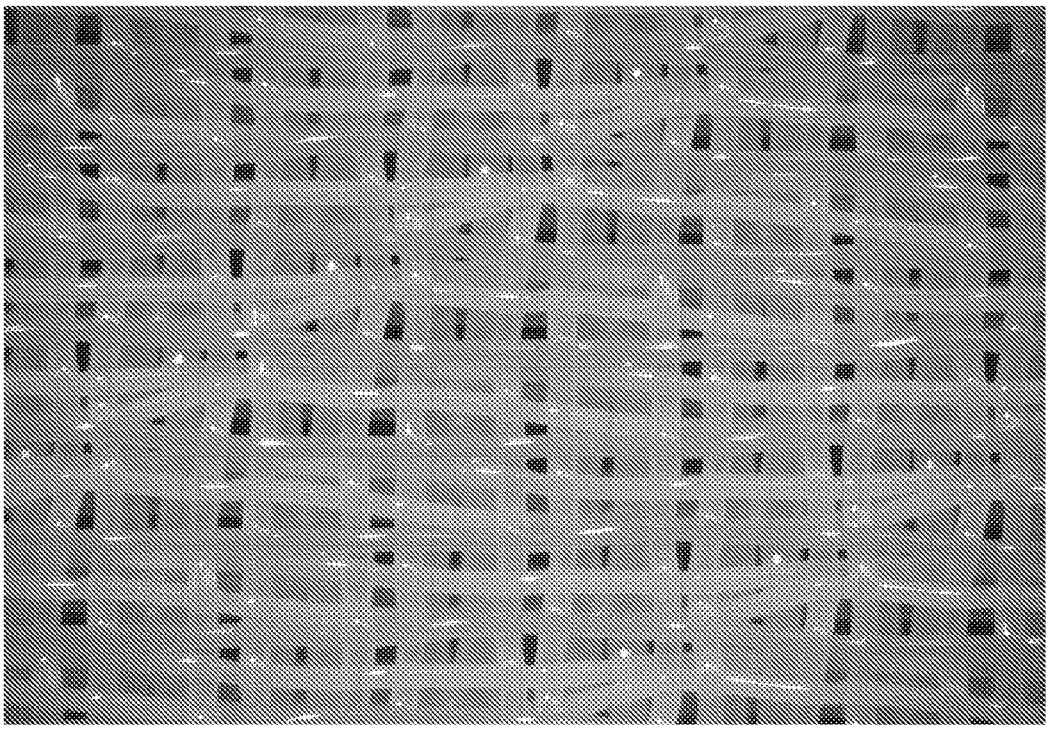
Figure 122:
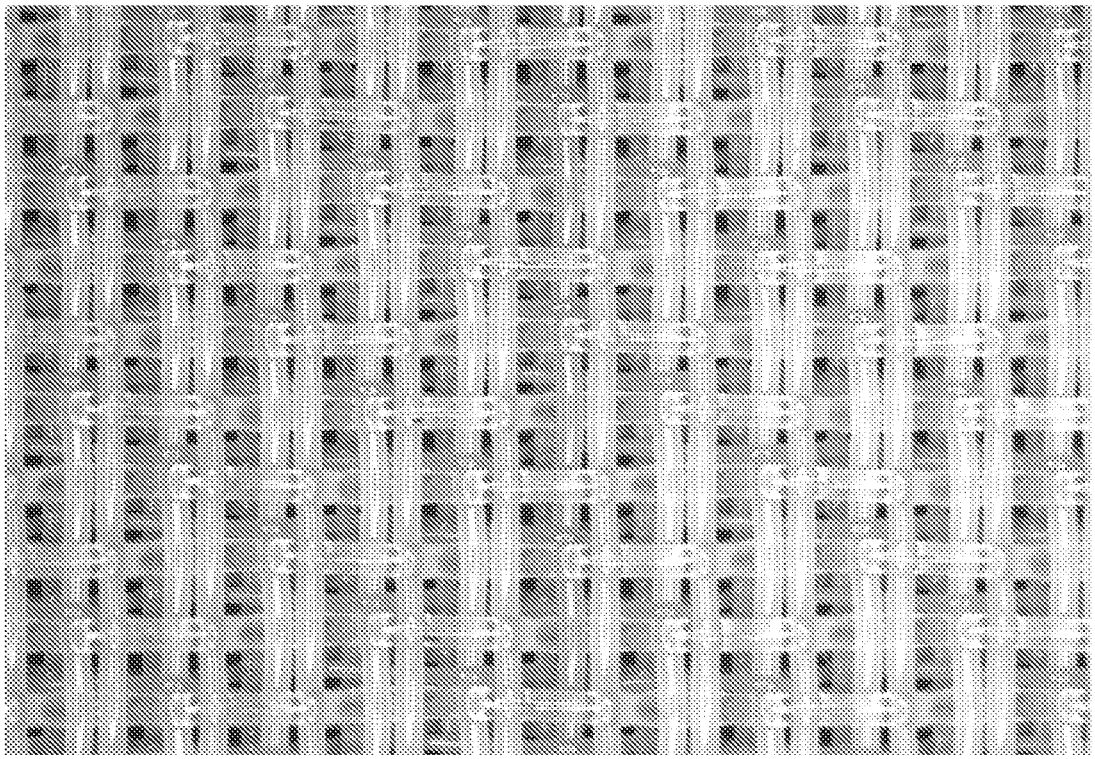
Figure 123:
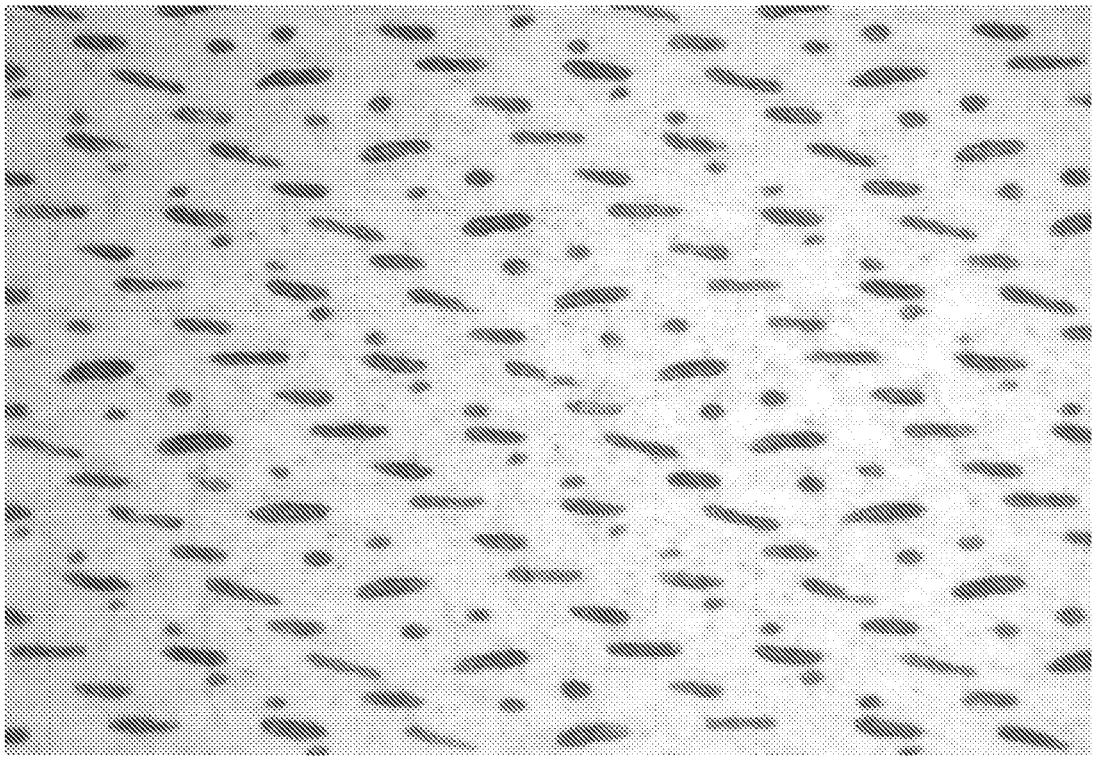

Twenty fifth and twenty sixth non-limiting embodiments of the forming fabric of the present invention are illustrated in FIGS. 118-122 and 124-128, and impressions of the upper surfaces of the fabrics are illustrated in FIGS. 123 and 129. These fabrics are three shed over three shed butted-binder fabrics. FIGS. 118 and 124 show repeating pattern areas of the fabrics that encompasses twenty four warp yarns (yarns 1-24 extending vertically) and forty eight weft yarns (yarns 1-48 extending horizontally). FIGS. 119, 120, 125 and 126 depict the paths of weft yarns 1-24 as they weave with warp yarns 1-24. It should be noted that weft yarns 25-48 repeat the same pattern as weft yarns 1-24. Like the DCB weft yarns of the previous embodiments of the forming fabric, the DCB weft yarns in each pair combine to match the weave pattern of the top weft yarns.

By way of non-limiting example, the twenty fifth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the twenty fifth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

By way of non-limiting example, the twenty sixth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the twenty sixth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Twenty seventh and twenty eighth non-limiting embodiments of the forming fabric of the present invention are illustrated in FIGS. 130-134 and 136-140, and impressions of the upper surfaces of the fabrics are illustrated in FIGS. 135 and 141. These fabrics are three shed over three shed twill butted-binder fabrics. FIGS. 130 and 136 show repeating pattern areas of the fabrics that encompasses twenty four warp yarns (yarns 1-24 extending vertically) and forty eight weft yarns (yarns 1-48 extending horizontally). FIGS. 131, 132, 137 and 138 depict the paths of weft yarns 1-24 as they weave with warp yarns 1-24. It should be noted that weft yarns 25-48 repeat the same pattern as weft yarns 1-24. Like the DCB weft yarns of the previous embodiments of the forming fabric, the DCB weft yarns in each pair combine to match the weave pattern of the top weft yarns.

By way of non-limiting example, the twenty seventh embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the twenty seventh embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

By way of non-limiting example, the twenty eighth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the twenty eighth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Twenty ninth and thirtieth non-limiting embodiments of the forming fabric of the present invention are illustrated in FIGS. 142-146 and 148-152, and impressions of the upper surfaces of the fabrics are illustrated in FIGS. 147 and 153. These fabrics are alternative three shed over three shed twill butted-binder fabrics. FIGS. 142 and 148 show repeating pattern areas of the fabrics that encompasses twenty four warp yarns (yarns 1-24 extending vertically) and forty eight weft yarns (yarns 1-48 extending horizontally). FIGS. 143, 144, 149 and 150 depict the paths of weft yarns 1-24 as they weave with warp yarns 1-24. It should be noted that weft yarns 25-48 repeat the same pattern as weft yarns 1-24. Like the DCB weft yarns of the previous embodiments of the forming fabric, the DCB weft yarns in each pair combine to match the weave pattern of the top weft yarns.

By way of non-limiting example, the twenty ninth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the twenty ninth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

By way of non-limiting example, the thirtieth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 dm. Regarding yarn dimensions, the thirtieth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Thirty first and thirty second non-limiting embodiments of the forming fabric of the present invention are illustrated in FIGS. 154-158 and 160-164, and impressions of the upper surfaces of the fabrics are illustrated in FIGS. 159 and 165. These fabrics are alternative three shed over three shed twill butted-binder double fabrics. FIGS. 154 and 160 show repeating pattern areas of the fabrics that encompasses twenty four warp yarns (yarns 1-24 extending vertically) and forty eight weft yarns (yarns 1-48 extending horizontally). FIGS. 155, 156, 161 and 162 depict the paths of weft yarns 1-24 as they weave with warp yarns 1-24. It should be noted that weft yarns 25-48 repeat the same pattern as weft yarns 1-24. Like the DCB weft yarns of the previous embodiments of the forming fabric, the DCB weft yarns in each pair combine to match the weave pattern of the top weft yarns.

By way of non-limiting example, the thirty first embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the thirty first embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

By way of non-limiting example, the thirty second embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the thirty second embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

A thirty third non-limiting embodiment of the forming fabric of the present invention is illustrated in FIG. 166. The fabric is a second alternative three shed over three shed twill butted-binder doube fabric. FIG. 166 shows a single repeating pattern area of the fabric that encompasses twenty four warp yarns (yarns 1-24 extending vertically in FIG. 166) and forty eight weft yarns (yarns 1-48 extending horizontally in FIG. 166). Like the DCB weft yarns of the previous embodiments of the forming fabric, the DCB weft yarns in each pair combine to match the weave pattern of the top weft yarns.

Thirty fourth and thirty fifth non-limiting embodiments of the forming fabric of the present invention are illustrated in FIGS. 167-171 and 173-177, and impressions of the upper surfaces of the fabrics are illustrated in FIGS. 172 and 178. These fabrics are three over three butted-binder double three-to-two weft ratio fabrics. FIGS. 167 and 173 show repeating pattern areas of the fabrics that encompasses twenty four warp yarns (yarns 1-24 extending vertically) and thirty six weft yarns (yarns 1-36 extending horizontally). FIGS. 168, 169, 174 and 175 depict the paths of weft yarns 1-36 as they weave with warp yarns 1-24. Like the DCB weft yarns of the previous embodiments of the forming fabric, the DCB weft yarns in each pair combine to match the weave pattern of the top weft yarns.

By way of non-limiting example, the thirty fourth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the thirty fourth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

By way of non-limiting example, the thirty fifth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the thirty fifth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

Thirty sixth and thirty seventh non-limiting embodiments of the forming fabric of the present invention are illustrated in FIGS. 179-183 and 185-189, and impressions of the upper surfaces of the fabrics are illustrated in FIGS. 184 and 190. These fabrics are three-to-one binder ratio butted-binder double fabrics. FIGS. 179 and 185 show repeating pattern areas of the fabrics that encompasses twenty four warp yarns (yarns 1-24 extending vertically) and forty two weft yarns (yarns 1-42 extending horizontally). FIGS. 180, 181, 186 and 187 depict the paths of weft yarns 1-42 as they weave with warp yarns 1-24. Like the DCB weft yarns of the previous embodiments of the forming fabric, the DCB weft yarns in each pair combine to match the weave pattern of the top weft yarns.

By way of non-limiting example, the thirty sixth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the thirty sixth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

By way of non-limiting example, the thirty seventh embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the thirty seventh embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

A thirty eighth non-limiting embodiment of the forming fabric of the present invention is illustrated in FIGS. 191-193. The fabric is a three-to-one binder ratio three shed over three shed twill butted-binder straight weave fabric. FIG. 191 shows a single repeating pattern area of the fabric that encompasses twenty four warp yarns (yarns 1-24 extending vertically in FIG. 191) and forty eight weft yarns (yarns 1-48 extending horizontally in FIG. 191). FIGS. 192 and 193 depict the paths of weft yarns 1-24 as they weave with warp yarns 1-24. It should be noted that weft yarns 25-48 repeat the same pattern as weft yarns 1-24. Like the DCB weft yarns of the previous embodiments of the forming fabric, the DCB weft yarns in each pair combine to match the weave pattern of the top weft yarns.

By way of non-limiting example, the thirty eighth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the thirty eighth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

A thirty ninth non-limiting embodiment of the forming fabric of the present invention is illustrated in FIGS. 194-196. FIG. 194 shows a repeating pattern area of the fabric that encompasses twenty four warp yarns (yarns 1-24 extending vertically) and forty eight weft yarns (yarns 1-48 extending horizontally). FIGS. 195 and 196 depict the paths of weft yarns 1-24 as they weave with warp yarns 1-24. It should be noted that weft yarns 25-48 repeat the pattern of weft yarns 1-24. Like the DCB weft yarns of the previous embodiments of the forming fabric, the DCB weft yarns in each pair combine to match the weave pattern of the top weft yarns.

By way of non-limiting example, the thirty ninth embodiment of the forming fabric can have a mesh (number of warp yarns per inch) of 160 and a count (number of weft yarns per inch) of 160. The fabric can have a caliper of about 0.030 inches. In addition, the fabric preferably has a permeability in the range of 500-600 cfm. Regarding yarn dimensions, the thirty ninth embodiment of the forming fabric typically has warp and weft yarn diameters between about 0.12 mm and 0.25 mm. The diameter of the warp yarns can be about 0.08-0.25 mm, is preferably about 0.10-0.20 mm, and is most preferably about 0.12-0.18 mm. The diameter of the weft yarns can be about 0.10-0.30 mm, is preferably about 0.10-0.25 mm, and is most preferably about 0.12-0.22 mm. Those of skill in the art will appreciate that yarns having diameters outside the above ranges may be used in certain applications.

In general, the warp and weft yarns of the above-described embodiments may be made from polyester or polyamide, for example.

In summary, the forming fabric has greater stability than previous forming fabrics due to increased interweaving of the warp and weft yarns. In addition, increased interweaving is also provided in conjunction with the DCB weft yarns weaving the same pattern as the top weft yarns, thereby providing long weft floats and a generally continuous paper-side surface on which a paper web may be formed. Further still, each DCB weft yarn passes over top warp yarns on either side of a top warp yarn it passes under, also thereby providing long weft floats and a generally continuous paper-side surface on which a paper web may be formed.

It is noted that the foregoing examples have been provided merely for the purpose of explanation and are in no way to be construed as limiting of the present invention. While the present invention has been described with reference to exemplary embodiments, it should be understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular arrangements, materials and embodiments, the invention is not intended to be limited to the particulars disclosed herein. Instead, the invention extends to all functionally equivalent structures, methods and uses, such as are within the scope of the appended claims.

I claim:

1. A forming fabric for a papermaking machine, comprising:

a machine-side layer including:

bottom warp yarns;

bottom weft yarns that weave with at least some of the bottom warp yarns;

a paper-side layer including:

top warp yarns;

top weft yarns that weave with at least some of the top warp yarns to create a weave pattern in a repeating pattern area, and at least one of the top weft yarns including at least one paper-side float in the repeating pattern area that passes over a number of consecutive top warp yarns;

a set of dual combination binder weft yarns disposed adjacent to a top weft yarn and at least one dual combination binder weft yarn of the set weaving with some of the bottom warp yarns and some of the top warp yarns to create a repeat of the dual combination binder weft yarns, each dual combination binder weft yarn of the set including at least one segment in the repeating pattern area that passes over at least one top warp yarn, the at least one segment disposed adjacent to a segment of another dual combination binder weft yarn of the set, the at least one segment and the adjacent segment combining to form a long weft float that passes over the number of consecutive top warp yarns passed over by the at least one paper-side float to match the weave pattern of the top weft yarns, the long weft float formed by the at least one segment and the adjacent segment of the set of dual combination binder weft yarns occurring at least once in each repeat of the dual combination binder weft yarns.

2. A forming fabric as claimed in claim 1, wherein each dual combination binder weft yarn in the set passes over top warp yarns on either side of a top warp yarn it passes under.

3. A forming fabric as claimed in claim 1, wherein each dual combination binder weft yarn of the set weaves with some of the bottom warp yarns and some of the top warp yarns.

4. A forming fabric as claimed in claim 1, wherein the set of dual combination binder weft yarns is disposed between adjacent top weft yarns.

5. A forming fabric as claimed in claim 1, wherein the dual combination binder weft yarns in the set combine to form at least two long weft floats in the repeat of the dual combination binder weft yarns.

6. A forming fabric as claimed in claim 5, wherein similar features of the dual combination binder weft yarns in the set are offset by five top warp yarns.

7. A forming fabric as claimed in claim 1, wherein each dual combination binder weft yarn passes over a total of four top warp yarns within a pattern area.

8. A forming fabric as claimed in claim 1, wherein each of the long weft float and the paper-side float pass over four consecutive top warp yarns.

9. A forming fabric as claimed in claim 1, wherein the floats are arranged in a series that extends diagonally relative to directions of the top warp yarns and the top weft yarns.

10. A forming fabric as claimed in claim 1, wherein each top weft yarn passes over more top warp yarns than a number of top warp yarns that each top weft yarn passes under.

11. A forming fabric as claimed in claim 1, wherein each dual combination binder weft yarn of the set includes at least a second segment within a repeating pattern area, and the second segment passes over at least one top warp yarn.

12. A forming fabric as claimed in claim 11, where the second segment passes over a different number of top warp yarns than the least one segment.

13. A forming fabric for a papermaking machine, comprising:

a machine-side layer including:

bottom warp yarns;

bottom weft yarns that weave with at least some of the bottom warp yarns;

a paper-side layer including:

top warp yarns;

top weft yarns that weave with at least some of the top warp yarns;

sets of dual combination binder weft yarns, each set disposed adjacent to a top weft yarn;

wherein the top warp yarns, the top weft yarns and dual combination binder weft yarns form a weave pattern in a repeating pattern area, each of the top weft yarns weaving with the top warp yarns in an identical pattern in the repeating pattern area and each of the top weft yarns including at least one paper-side float in the repeating pattern area that passes over a number of consecutive top warp yarns, each dual combination binder weft yarn of the sets weaving with the top warp yarns and the bottom warp yarns in an identical pattern in the repeating pattern area and each dual combination binder weft yarn of the sets including at least one segment in the repeating pattern area that passes over at least one top warp yarn, the at least one segment disposed adjacent to a segment of another dual combination binder weft yarn, the at least one segment and the adjacent segment of each set of dual combination binder weft yarns combining to form a long weft float that passes over the number of consecutive top warp yarns passed over by the paper-side floats of the top weft yarns to match the weave pattern of the top weft yarns, the long weft float formed by the at least one segment and the adjacent segment of the set of dual combination binder weft yarns occurring at least once in each repeat of the dual combination binder weft yarns.

14. A forming fabric as claimed in claim 13, wherein each dual combination binder weft yarn in each set passes over top warp yarns on either side of a top warp yarn it passes under.

15. A forming fabric as claimed in claim 13, wherein each dual combination binder weft yarn of each set includes at least a second segment within the repeating pattern area, and the second segment passes over at least one top warp yarn.

16. A forming fabric as claimed in claim 15, wherein the second segment passes over a different number of top warp yarns than the least one segment.

17. A forming fabric as claimed in claim 13, wherein the dual combination binder weft yarns in each set combine to form at least two long weft floats in the repeat of the dual combination binder weft yarns.

18. A forming fabric as claimed in claim 13, wherein each set of dual combination binder weft yarns is disposed between adjacent top weft yarns.

19. A forming fabric as claimed in claim 13, wherein each top weft yarn passes over more top warps yarn than a number of top warps yarns that each top weft yarn passes under.

20. A forming fabric as claimed in claim 13, wherein each of the long weft floats and the paper-side floats pass over four consecutive top warp yarns.

* * * * *

UNITED STATES PATENT AND TRADEMARK OFFICE

CERTIFICATE OF CORRECTION

PATENT NO. : 7,717,141 B1
APPLICATION NO. : 12/367309
DATED : May 18, 2010
INVENTOR(S) : Scott D. Quigley It is certified that error appears in the above-identified patent and that said Letters Patent is hereby corrected as shown below:

Col. 12

Line 16, "well yarn" should be -- weft yarn --
Line 21, "well yarn" should be -- weft yarn --
Line 22, "well yarn" should be -- weft yarn --
Line 31, "well yarn" should be -- weft yarn --
Line 32, "well yarn" should be -- weft yarn --
Line 37, "well yarn" should be -- weft yarn --
Line 44, "well yarn" should be -- weft yarn --
Line 47, "well yarn" should be -- weft yarn --
Line 50, "well yarn" should be -- weft yarn --
Line 51, "well yarn" should be -- weft yarn --

Col. 24

Line 4, "500-600 dm" should be -- 500-600 cfm --

Signed and Sealed this

Twenty-ninth Day of June, 2010

David J. Kappos

David J. Kappos
*Director of the United States Patent and Trademark Office*